US008082995B2

(12) United States Patent
Symington et al.

(10) Patent No.: US 8,082,995 B2
(45) Date of Patent: Dec. 27, 2011

(54) OPTIMIZATION OF UNTREATED OIL SHALE GEOMETRY TO CONTROL SUBSIDENCE

(75) Inventors: William A Symington, Houston, TX (US); Robert D Kaminsky, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 12/271,521

(22) Filed: Nov. 14, 2008

(65) Prior Publication Data

US 2009/0145598 A1 Jun. 11, 2009

Related U.S. Application Data

(60) Provisional application No. 61/007,044, filed on Dec. 10, 2007.

(51) Int. Cl.
*E21B 36/00* (2006.01)

(52) U.S. Cl. ..... 166/302; 166/250.01

(58) Field of Classification Search ..... None
See application file for complete search history.

(56) References Cited

U.S. PATENT DOCUMENTS

| | | | | |
|---|---|---|---|---|
| 363,419 | A | 5/1887 | Poetsch | |
| 895,612 | A | 8/1908 | Baker | |
| 1,342,780 | A | 6/1920 | Vedder | |
| 1,422,204 | A | 7/1922 | Hoover et al. | |
| 1,666,488 | A | 4/1928 | Crawshaw | |
| 1,701,884 | A | 2/1929 | Hogle | |
| 1,872,906 | A | 8/1932 | Doherty | |
| 2,033,560 | A | 3/1936 | Wells | 166/1 |
| 2,033,561 | A | 3/1936 | Wells | 166/21 |
| 2,534,737 | A | 12/1950 | Rose | |
| 2,584,605 | A | 2/1952 | Merriam et al. | |
| 2,634,961 | A | 4/1953 | Ljungstrom | 262/3 |
| 2,732,195 | A | 1/1956 | Ljungstrom | 262/3 |
| 2,777,679 | A | 1/1957 | Ljungstrom | 262/3 |
| 2,780,450 | A | 2/1957 | Ljungstrom | 262/3 |

(Continued)

FOREIGN PATENT DOCUMENTS

| | | |
|---|---|---|
| CA | 994694 | 8/1976 |

(Continued)

OTHER PUBLICATIONS

Allred, (1964) "Some Characteristic Properties of Colorado Oil Shale Which May Influence In Situ Processing," *Quarterly Colo. School of Mines, 1st Symposium Oil Shale*, v.59. No. 3, pp. 47-75.

(Continued)

*Primary Examiner* — Angela M DiTrani

(57) ABSTRACT

A method for developing hydrocarbons from a subsurface formation. The subsurface formation may include oil shale. The method may include conductively heating portions of an organic-rich rock formation located in a development area, thereby pyrolyzing at least a portion of formation hydrocarbons located in a heated zone in the organic-rich rock formation into hydrocarbon fluids. The heat may be generated from one or more wellbores completed within the formation, such as by means of a resistive heating element. At least one unheated zone is preserved within the organic-rich rock formation. This leaves a portion of the development area substantially unpyrolyzed. The at least one unheated zone is sized or configured in order to substantially optimize that portion of the development area in which the organic-rich rock is pyrolyzed while controlling subsidence above the organic-rich rock formation.

35 Claims, 42 Drawing Sheets

U.S. PATENT DOCUMENTS

| | | | | |
|---|---|---|---|---|
| 2,795,279 | A | 6/1957 | Sarapuu | |
| 2,812,160 | A | 11/1957 | West et al. | 255/1.4 |
| 2,813,583 | A | 11/1957 | Marx et al. | |
| 2,847,071 | A | 8/1958 | De Priester | 166/39 |
| 2,887,160 | A | 5/1959 | De Priester et al. | 166/59 |
| 2,895,555 | A | 7/1959 | De Priester | 166/59 |
| 2,923,535 | A | 2/1960 | Ljungstrom | 262/3 |
| 2,944,803 | A | 7/1960 | Hanson | 262/3 |
| 2,952,450 | A | 9/1960 | Purre | 262/3 |
| 2,974,937 | A | 3/1961 | Kiel | |
| 3,004,601 | A | 10/1961 | Bodine | 166/39 |
| 3,013,609 | A | 12/1961 | Brink | 166/39 |
| 3,095,031 | A | 6/1963 | Eurenius et al. | 158/99 |
| 3,106,244 | A | 10/1963 | Parker | |
| 3,109,482 | A | 11/1963 | O'Brien | 158/115 |
| 3,127,936 | A | 4/1964 | Eurenius | 166/39 |
| 3,137,347 | A | 6/1964 | Parker | 166/39 |
| 3,149,672 | A | 9/1964 | Orkiszewski et al. | 166/39 |
| 3,170,815 | A | 2/1965 | White | |
| 3,180,411 | A | 4/1965 | Parker | 166/11 |
| 3,183,675 | A | 5/1965 | Schroeder | 61/36 |
| 3,183,971 | A | 5/1965 | McEver et al. | |
| 3,194,315 | A | 7/1965 | Rogers | 166/57 |
| 3,205,942 | A | 9/1965 | Sandberg | |
| 3,225,829 | A | 12/1965 | Chown et al. | 166/59 |
| 3,228,869 | A | 1/1966 | Irish | |
| 3,241,611 | A | 3/1966 | Dougan | 166/7 |
| 3,241,615 | A | 3/1966 | Brandt et al. | 166/59 |
| 3,254,721 | A | 6/1966 | Smith et al. | 166/59 |
| 3,256,935 | A | 6/1966 | Nabor et al. | 166/9 |
| 3,263,211 | A | 7/1966 | Heidman | |
| 3,267,680 | A | 8/1966 | Schlumberger | 61/36 |
| 3,271,962 | A | 9/1966 | Dahms et al. | 61/36 |
| 3,284,281 | A | 11/1966 | Thomas | 166/2 |
| 3,285,335 | A | 11/1966 | Reistle, Jr. | |
| 3,288,648 | A | 11/1966 | Jones | |
| 3,294,167 | A | 12/1966 | Vogel | 166/11 |
| 3,295,328 | A | 1/1967 | Bishop | 61/0.5 |
| 3,323,840 | A | 6/1967 | Mason et al. | |
| 3,358,756 | A | 12/1967 | Vogel | |
| 3,372,550 | A | 3/1968 | Schroeder | 61/36 |
| 3,376,403 | A | 4/1968 | Mircea | 219/10.49 |
| 3,382,922 | A | 5/1968 | Needham | |
| 3,400,762 | A | 9/1968 | Peacock et al. | 166/11 |
| 3,436,919 | A | 4/1969 | Shock et al. | 61/0.5 |
| 3,439,744 | A | 4/1969 | Bradley | |
| 3,468,376 | A | 9/1969 | Slusser et al. | 166/272 |
| 3,500,913 | A | 3/1970 | Nordgren et al. | 166/259 |
| 3,501,201 | A | 3/1970 | Closmann et al. | 299/4 |
| 3,502,372 | A | 3/1970 | Prats | |
| 3,513,914 | A | 5/1970 | Vogel | 166/271 |
| 3,515,213 | A | 6/1970 | Prats | |
| 3,516,495 | A | 6/1970 | Patton | |
| 3,521,709 | A | 7/1970 | Needham | |
| 3,528,252 | A | 9/1970 | Gail | 61/36 |
| 3,528,501 | A | 9/1970 | Parker | |
| 3,547,193 | A | 12/1970 | Gill | |
| 3,559,737 | A | 2/1971 | Ralstin et al. | 166/281 |
| 3,572,838 | A | 3/1971 | Templeton | |
| 3,599,714 | A | 8/1971 | Messman | 166/258 |
| 3,602,310 | A | 8/1971 | Halbert | 166/303 |
| 3,613,785 | A | 10/1971 | Closmann et al. | 166/271 |
| 3,620,300 | A | 11/1971 | Crowson | 166/248 |
| 3,642,066 | A | 2/1972 | Gill | 166/248 |
| 3,661,423 | A | 5/1972 | Garret | |
| 3,692,111 | A | 9/1972 | Breithaupt et al. | 166/252 |
| 3,695,354 | A | 10/1972 | Dilgren et al. | |
| 3,700,280 | A | 10/1972 | Papadopoulos et al. | |
| 3,724,225 | A | 4/1973 | Mancini et al. | |
| 3,729,965 | A | 5/1973 | Gartner | 70/395 |
| 3,730,270 | A | 5/1973 | Allred | |
| 3,739,851 | A | 6/1973 | Beard | |
| 3,741,306 | A | 6/1973 | Papadopoulos | 166/252 |
| 3,759,328 | A | 9/1973 | Ueber et al. | |
| 3,759,329 | A | 9/1973 | Ross | 166/308.1 |
| 3,759,574 | A | 9/1973 | Beard | |
| 3,779,601 | A | 12/1973 | Beard | |
| 3,880,238 | A | 4/1975 | Tham et al. | |
| 3,882,937 | A | 5/1975 | Robinson | 166/267 |
| 3,882,941 | A | 5/1975 | Pelofsky | |
| 3,888,307 | A | 6/1975 | Closmann | |
| 3,924,680 | A | 12/1975 | Terry | |
| 3,943,722 | A | 3/1976 | Ross | 61/36 |
| 3,950,029 | A | 4/1976 | Timmins | 299/2 |
| 3,958,636 | A | 5/1976 | Perkins | |
| 3,967,853 | A | 7/1976 | Closmann et al. | |
| 3,978,920 | A | 9/1976 | Badyopadhyay | 166/258 |
| 3,999,607 | A | 12/1976 | Pennington et al. | |
| 4,003,432 | A | 1/1977 | Paull et al. | 166/271 |
| 4,005,750 | A | 2/1977 | Shuck | 166/308 |
| 4,007,786 | A | 2/1977 | Schlinger | |
| 4,008,762 | A | 2/1977 | Fisher et al. | |
| 4,008,769 | A | 2/1977 | Chang | |
| 4,014,575 | A | 3/1977 | French et al. | |
| 4,030,549 | A | 6/1977 | Bouck | 166/280 |
| 4,037,655 | A | 7/1977 | Carpenter | |
| 4,043,393 | A | 8/1977 | Fisher et al. | |
| 4,047,760 | A | 9/1977 | Ridley | |
| 4,057,510 | A | 11/1977 | Crouch et al. | |
| 4,065,183 | A | 12/1977 | Hill et al. | |
| 4,067,390 | A | 1/1978 | Camacho et al. | 166/302 |
| 4,069,868 | A | 1/1978 | Terry | |
| 4,071,278 | A | 1/1978 | Carpenter et al. | 299/5 |
| 4,093,025 | A | 6/1978 | Terry | |
| 4,096,034 | A | 6/1978 | Anthony | |
| 4,125,159 | A | 11/1978 | Vann | 166/285 |
| 4,140,180 | A | 2/1979 | Bridges et al. | 166/248 |
| 4,149,595 | A | 4/1979 | Cha | |
| 4,160,479 | A | 7/1979 | Richardson et al. | |
| 4,163,475 | A | 8/1979 | Cha et al. | |
| 4,167,291 | A | 9/1979 | Ridley | |
| 4,169,506 | A | 10/1979 | Berry | |
| 4,185,693 | A | 1/1980 | Crumb et al. | |
| 4,186,801 | A | 2/1980 | Madgavkar et al. | |
| 4,202,168 | A | 5/1980 | Acheson et al. | |
| 4,239,283 | A | 12/1980 | Ridley | 299/2 |
| 4,246,966 | A | 1/1981 | Stoddard et al. | |
| 4,250,230 | A | 2/1981 | Terry | |
| 4,265,310 | A | 5/1981 | Britton et al. | 166/259 |
| 4,271,905 | A | 6/1981 | Redford et al. | |
| 4,272,127 | A | 6/1981 | Hutchins | 299/2 |
| 4,285,401 | A | 8/1981 | Erickson | |
| 4,318,723 | A | 3/1982 | Holmes et al. | |
| 4,319,635 | A | 3/1982 | Jones | 166/263 |
| 4,320,801 | A | 3/1982 | Rowland et al. | 166/248 |
| 4,324,291 | A | 4/1982 | Wong et al. | |
| 4,340,934 | A | 7/1982 | Segesman | |
| 4,344,485 | A | 8/1982 | Butler | |
| 4,358,222 | A | 11/1982 | Landau | 405/130 |
| 4,362,213 | A | 12/1982 | Tabor | |
| 4,368,921 | A | 1/1983 | Hutchins | 299/2 |
| 4,369,842 | A | 1/1983 | Cha | |
| 4,372,615 | A | 2/1983 | Ricketts | 299/2 |
| 4,375,302 | A | 3/1983 | Kalmar | |
| 4,384,614 | A | 5/1983 | Justheim | |
| 4,397,502 | A | 8/1983 | Hines | 299/2 |
| 4,401,162 | A | 8/1983 | Osborne | 166/248 |
| 4,412,585 | A | 11/1983 | Bouck | 166/248 |
| 4,417,449 | A | 11/1983 | Hegarty et al. | |
| 4,473,114 | A | 9/1984 | Bell et al. | |
| 4,474,238 | A | 10/1984 | Gentry et al. | 166/268 |
| 4,483,398 | A | 11/1984 | Peters et al. | |
| 4,485,869 | A | 12/1984 | Sresty et al. | 166/248 |
| 4,487,257 | A | 12/1984 | Dauphine | 166/60 |
| 4,487,260 | A | 12/1984 | Pittman et al. | 166/259 |
| 4,511,382 | A | 4/1985 | Valencia et al. | |
| 4,533,372 | A | 8/1985 | Valencia et al. | |
| 4,537,067 | A | 8/1985 | Sharp et al. | |
| 4,545,435 | A | 10/1985 | Bridges et al. | |
| 4,546,829 | A | 10/1985 | Martin et al. | |
| 4,550,779 | A | 11/1985 | Zakiewicz | 166/248 |
| 4,567,945 | A | 2/1986 | Segalman | 166/248 |
| 4,589,491 | A | 5/1986 | Perkins | 166/302 |
| 4,589,973 | A | 5/1986 | Minden | |
| 4,602,144 | A | 7/1986 | Vogel | |
| 4,607,488 | A | 8/1986 | Karinthi et al. | 62/45 |
| 4,626,665 | A | 12/1986 | Fort | 219/534 |

4,633,948 A 1/1987 Closmann
4,634,315 A 1/1987 Owen et al. ..... 405/217
4,637,464 A 1/1987 Forgac et al.
4,640,352 A 2/1987 Vanmeurs et al. ..... 166/245
4,671,863 A 6/1987 Tejeda
4,694,907 A 9/1987 Stahl et al. ..... 166/303
4,704,514 A 11/1987 Van Egmond et al. ..... 219/278
4,705,108 A 11/1987 Little et al. ..... 166/248
4,706,751 A 11/1987 Gondouin
4,730,671 A 3/1988 Perkins
4,737,267 A 4/1988 Pao et al.
4,747,642 A 5/1988 Gash et al. ..... 299/11
4,754,808 A 7/1988 Harmon et al. ..... 166/254
4,776,638 A 10/1988 Hahn
4,779,680 A 10/1988 Sydansk
4,815,790 A 3/1989 Rosar et al.
4,817,711 A 4/1989 Jeambey
4,828,031 A 5/1989 Davis
4,860,544 A 8/1989 Krieg et al. ..... 62/45
4,886,118 A 12/1989 Van Meurs et al. ..... 166/245
4,923,493 A 5/1990 Valencia et al.
4,926,941 A 5/1990 Glandt et al. ..... 166/248
4,928,765 A 5/1990 Nielson
4,929,341 A 5/1990 Thirumalachar et al.
4,974,425 A 12/1990 Krieg et al. ..... 62/45.1
5,016,709 A 5/1991 Combe et al. ..... 166/245
5,036,918 A 8/1991 Jennings et al.
5,050,386 A 9/1991 Krieg et al. ..... 62/45.1
5,055,030 A 10/1991 Schirmer
5,055,180 A 10/1991 Klaila
5,082,055 A 1/1992 Hemsath
5,085,276 A 2/1992 Rivas et al.
5,117,908 A 6/1992 Hofmann
5,120,338 A 6/1992 Potts, Jr. et al.
5,217,076 A 6/1993 Masek
5,236,039 A 8/1993 Edelstein et al.
5,255,742 A 10/1993 Mikus ..... 166/303
5,275,063 A 1/1994 Steiger et al.
5,297,626 A 3/1994 Vinegar et al. ..... 166/271
5,305,829 A 4/1994 Kumar ..... 166/245
5,372,708 A 12/1994 Gewertz
5,377,756 A 1/1995 Northrop et al.
5,392,854 A 2/1995 Vinegar et al. ..... 166/271
5,411,089 A 5/1995 Vinegar et al. ..... 166/272
5,416,257 A 5/1995 Peters ..... 588/1
5,620,049 A 4/1997 Gipson et al. ..... 166/248
5,621,844 A 4/1997 Bridges
5,661,977 A 9/1997 Shnell
5,730,550 A 3/1998 Andersland et al. ..... 405/128
5,838,634 A 11/1998 Jones et al.
5,844,799 A 12/1998 Joseph et al.
5,868,202 A 2/1999 Hsu
5,899,269 A 5/1999 Wellington et al. ..... 166/58
5,905,657 A 5/1999 Celniker
5,907,662 A 5/1999 Buettner
5,956,971 A 9/1999 Cole et al.
6,015,015 A 1/2000 Luft et al.
6,016,867 A 1/2000 Gregoli et al.
6,023,554 A 2/2000 Vinegar et al. ..... 392/301
6,055,803 A 5/2000 Mastronarde et al.
6,056,057 A 5/2000 Vinegar et al.
6,079,499 A 6/2000 Mikus et al.
6,148,911 A 11/2000 Gipson et al. ..... 166/248
6,158,517 A 12/2000 Hsu
6,246,963 B1 6/2001 Cross et al.
6,247,358 B1 6/2001 dos Santos
6,328,104 B1 12/2001 Graue
6,434,436 B1 8/2002 Tubel et al.
6,480,790 B1 11/2002 Calvert et al.
6,540,018 B1 4/2003 Vinegar et al.
6,581,684 B2 6/2003 Wellington et al. ..... 166/245
6,585,046 B2 7/2003 Neuroth et al.
6,589,303 B1 7/2003 Lokhandwala et al.
6,591,906 B2 7/2003 Wellington et al.
6,607,036 B2 8/2003 Ranson et al. ..... 166/302
6,609,761 B1 8/2003 Ramey et al.
6,668,922 B2 12/2003 Ziauddin et al.
6,684,644 B2 2/2004 Mittricker et al. ..... 60/772
6,684,948 B1 2/2004 Savage
6,708,758 B2 3/2004 de Rouffignac et al. ..... 166/245
6,709,573 B2 3/2004 Smith
6,712,136 B2 3/2004 de Rouffignac et al. ..... 166/245
6,715,546 B2 4/2004 Vinegar et al.
6,722,429 B2 4/2004 de Rouffignac et al. ..... 166/245
6,742,588 B2 6/2004 Wellington et al. ..... 166/245
6,745,831 B2 6/2004 De Roufignac et al.
6,745,832 B2 6/2004 Wellington et al. ..... 166/245
6,752,210 B2 6/2004 de Rouffignac et al.
6,754,588 B2 6/2004 Cross et al.
6,764,108 B2 7/2004 Ernst et al.
6,782,947 B2 8/2004 de Rouffignac et al. ..... 166/245
6,796,139 B2 9/2004 Briley et al. ..... 62/260
6,820,689 B2 11/2004 Sarada
6,832,485 B2 12/2004 Sugarmen et al.
6,854,929 B2 2/2005 Vinegar et al. ..... 405/129.65
6,858,049 B2 2/2005 Mittricker ..... 48/127.7
6,877,555 B2 4/2005 Karanikas et al.
6,880,633 B2 4/2005 Wellington et al. ..... 166/245
6,887,369 B2 5/2005 Moulton et al. ..... 208/107
6,896,053 B2 5/2005 Berchenko et al. ..... 166/245
6,896,707 B2 5/2005 O'Rear et al.
6,913,078 B2 7/2005 Shahin et al. ..... 166/245
6,918,444 B2 7/2005 Passey et al. ..... 166/258
6,923,155 B2 8/2005 Vinegar et al.
6,923,258 B2 8/2005 Wellington et al. ..... 166/245
6,932,155 B2 8/2005 Vinegar et al. ..... 166/245
6,948,562 B2 9/2005 Wellington et al. ..... 166/272.1
6,951,247 B2 10/2005 De Rouffignac et al.
6,953,087 B2 10/2005 de Rouffignac et al. ..... 166/245
6,964,300 B2 11/2005 Vinegar et al. ..... 166/245
6,969,123 B2 11/2005 Vinegar et al. ..... 299/3
6,988,549 B1 1/2006 Babcock
6,994,160 B2 2/2006 Wellington et al.
6,997,518 B2 2/2006 Vinegar et al.
7,001,519 B2 2/2006 Linden et al.
7,004,247 B2 2/2006 Cole et al.
7,004,251 B2 2/2006 Ward et al.
7,011,154 B2 3/2006 Maher et al. ..... 166/245
7,032,660 B2 4/2006 Vinegar et al. ..... 166/245
7,036,583 B2 5/2006 de Rouffignac et al. ..... 166/245
7,048,051 B2 5/2006 McQueen
7,051,807 B2 5/2006 Vinegar et al.
7,055,600 B2 6/2006 Messier et al.
7,063,145 B2 6/2006 Veenstra et al.
7,066,254 B2 6/2006 Vinegar et al. ..... 166/245
7,073,578 B2 7/2006 Vinegar et al. ..... 166/245
7,077,198 B2 7/2006 Vinegar et al. ..... 166/245
7,077,199 B2 7/2006 Vinegar et al. ..... 166/250.1
7,093,655 B2 8/2006 Atkinson ..... 166/266
7,096,942 B1 8/2006 de Rouffignac et al. ..... 166/245
7,096,953 B2 8/2006 de Rouffignac et al. ..... 166/302
7,100,994 B2 9/2006 Vinegar et al.
7,104,319 B2 9/2006 Vinegar et al. ..... 166/245
7,121,342 B2 10/2006 Vinegar et al. ..... 166/302
7,124,029 B2 10/2006 Jammes et al.
7,165,615 B2 1/2007 Vinegar et al.
7,181,380 B2 2/2007 Dusterhoft et al.
7,198,107 B2 4/2007 Maguire
7,219,734 B2 5/2007 Bai et al.
7,225,866 B2 6/2007 Berchenko et al. ..... 166/245
7,243,618 B2 7/2007 Gurevich
7,322,415 B2 1/2008 de St. Remey
7,331,385 B2 2/2008 Symington et al. ..... 166/248
7,353,872 B2 4/2008 Sandberg
7,357,180 B2 4/2008 Vinegar et al. ..... 166/254.1
7,441,603 B2 10/2008 Kaminsky et al. ..... 166/308.1
7,461,691 B2 12/2008 Vinegar et al.
7,484,561 B2 2/2009 Bridges
7,516,785 B2 4/2009 Kaminsky ..... 166/245
7,516,786 B2 4/2009 Dallas et al.
7,516,787 B2 4/2009 Kaminsky ..... 166/250.1
7,546,873 B2 6/2009 Kim et al.
7,549,470 B2 6/2009 Vinegar et al.
7,556,095 B2 7/2009 Vinegar
7,617,869 B2 11/2009 Carney
7,631,691 B2 12/2009 Symington et al.
7,644,993 B2 1/2010 Kaminsky et al.
7,647,971 B2 1/2010 Kaminsky

| | | | | |
|---|---|---|---|---|
| 7,647,972 | B2 | 1/2010 | Kaminsky | |
| 7,654,320 | B2 | 2/2010 | Payton | |
| 7,669,657 | B2 | 3/2010 | Symington et al. | |
| 7,743,826 | B2 | 6/2010 | Harris et al. | |
| 7,798,221 | B2 | 9/2010 | Vinegar et al. | |
| 7,857,056 | B2 | 12/2010 | Kaminsky et al. | |
| 7,860,377 | B2 | 12/2010 | Vinegar et al. | |
| 7,905,288 | B2 | 3/2011 | Kinkead | |
| 2001/0049342 | A1 | 12/2001 | Passey et al. | |
| 2002/0013687 | A1 | 1/2002 | Ortoleva | |
| 2002/0023751 | A1 | 2/2002 | Neuroth et al. | |
| 2002/0029882 | A1 | 3/2002 | Rouffignac et al. | |
| 2002/0049360 | A1 | 4/2002 | Wellington et al. | |
| 2002/0077515 | A1 | 6/2002 | Wellington et al. | |
| 2002/0099504 | A1 | 7/2002 | Cross et al. | |
| 2003/0080604 | A1 | 5/2003 | Vinegar et al. | |
| 2003/0085570 | A1 | 5/2003 | Ernst et al. | |
| 2003/0111223 | A1 | 6/2003 | Rouffignac et al. | |
| 2003/0131994 | A1 | 7/2003 | Vinegar et al. | |
| 2003/0131995 | A1 | 7/2003 | de Rouffignac et al. | |
| 2003/0178195 | A1 | 9/2003 | Agee et al. | |
| 2003/0183390 | A1 | 10/2003 | Veenstra et al. | |
| 2003/0192691 | A1 | 10/2003 | Vinegar et al. | |
| 2003/0196788 | A1 | 10/2003 | Vinegar et al. | |
| 2003/0196789 | A1 | 10/2003 | Wellington | |
| 2003/0209348 | A1* | 11/2003 | Ward et al. | 166/256 |
| 2003/0213594 | A1 | 11/2003 | Wellington et al. | |
| 2004/0020642 | A1 | 2/2004 | Vinegar et al. | |
| 2004/0140095 | A1 | 7/2004 | Vinegar et al. | |
| 2004/0198611 | A1 | 10/2004 | Atkinson | |
| 2004/0211557 | A1 | 10/2004 | Cole et al. | |
| 2005/0051327 | A1 | 3/2005 | Vinegar et al. | |
| 2005/0252656 | A1 | 11/2005 | Maguire | |
| 2005/0252832 | A1 | 11/2005 | Doyle et al. | |
| 2005/0252833 | A1 | 11/2005 | Doyle et al. | |
| 2005/0269077 | A1 | 12/2005 | Sandberg | 166/249 |
| 2005/0269088 | A1 | 12/2005 | Vinegar et al. | |
| 2006/0021752 | A1 | 2/2006 | de St. Remey | |
| 2006/0100837 | A1 | 5/2006 | Symington et al. | |
| 2006/0213657 | A1 | 9/2006 | Berchenko et al. | |
| 2007/0000662 | A1 | 1/2007 | Symington et al. | |
| 2007/0023186 | A1 | 2/2007 | Kaminsky et al. | |
| 2007/0045265 | A1 | 3/2007 | McKinzie, II | 219/207 |
| 2007/0045267 | A1 | 3/2007 | Vinegar et al. | |
| 2007/0084418 | A1 | 4/2007 | Gurevich | |
| 2007/0095537 | A1 | 5/2007 | Vinegar | |
| 2007/0102359 | A1 | 5/2007 | Lombardi et al. | |
| 2007/0131415 | A1 | 6/2007 | Vinegar et al. | |
| 2007/0144732 | A1 | 6/2007 | Kim et al. | 166/245 |
| 2007/0209799 | A1 | 9/2007 | Vinegar et al. | 166/302 |
| 2007/0246994 | A1 | 10/2007 | Symington et al. | 299/3 |
| 2008/0087420 | A1 | 4/2008 | Symington et al. | 166/245 |
| 2008/0087421 | A1 | 4/2008 | Kaminsky | 166/245 |
| 2008/0087426 | A1 | 4/2008 | Kaminsky | 166/271 |
| 2008/0087427 | A1 | 4/2008 | Symington et al. | 166/272.1 |
| 2008/0087428 | A1 | 4/2008 | Symington et al. | 166/272.2 |
| 2008/0173443 | A1 | 7/2008 | Symington et al. | 166/248 |
| 2008/0185145 | A1 | 8/2008 | Carney et al. | |
| 2008/0207970 | A1 | 8/2008 | Meurer et al. | 484/24 |
| 2008/0230219 | A1 | 9/2008 | Kaminsky | 166/248 |
| 2008/0271885 | A1 | 11/2008 | Kaminsky | 166/245 |
| 2008/0283241 | A1 | 11/2008 | Kaminsky et al. | 166/245 |
| 2008/0289819 | A1 | 11/2008 | Kaminsky et al. | 166/256 |
| 2008/0290719 | A1 | 11/2008 | Symington et al. | 299/3 |
| 2009/0038795 | A1 | 2/2009 | Kaminsky et al. | |
| 2009/0050319 | A1 | 2/2009 | Kaminsky et al. | 166/257 |
| 2009/0101346 | A1 | 4/2009 | Vinegar et al. | |
| 2009/0101348 | A1 | 4/2009 | Kaminsky | |
| 2009/0107679 | A1 | 4/2009 | Kaminsky | |
| 2009/0133935 | A1 | 5/2009 | Kinkead | |
| 2009/0145598 | A1 | 6/2009 | Symington et al. | |
| 2010/0078169 | A1 | 4/2010 | Symington et al. | |
| 2010/0089575 | A1 | 4/2010 | Kaminsky et al. | |
| 2010/0089585 | A1 | 4/2010 | Kaminsky | |
| 2010/0095742 | A1 | 4/2010 | Kaminsky et al. | |
| 2010/0319909 | A1 | 12/2010 | Symington et al. | |

FOREIGN PATENT DOCUMENTS

| | | | |
|---|---|---|---|
| CA | 1288043 | 8/1991 | 166/38 |
| CA | 2560223 | 3/2007 | |
| EP | 0387846 | 9/1990 | |
| FR | EP 0866212 | 9/1998 | |
| GB | 855408 | 11/1960 | |
| GB | 1454324 | 11/1976 | |
| GB | 1463444 | 2/1977 | |
| GB | 1 478 880 | 7/1977 | |
| GB | 1501310 | 2/1978 | |
| GB | 1559948 | 1/1980 | |
| GB | 1595082 | 8/1981 | |
| WO | WO 82/01408 | 4/1982 | |
| WO | WO 90/06480 | 6/1990 | |
| WO | WO 99/67504 | 12/1999 | |
| WO | WO 01/78914 | 10/2001 | |
| WO | WO 01/81505 | 11/2001 | |
| WO | WO 2005/010320 | 2/2005 | |
| WO | WO 2005/045192 | 5/2005 | |
| WO | WO 2006/115943 | 11/2006 | |
| WO | WO 2007/033371 | 3/2007 | |
| WO | WO 2007/050445 | 5/2007 | |
| WO | WO 2007/050479 | 5/2007 | |
| WO | WO 2010/047859 | 4/2010 | |

OTHER PUBLICATIONS

Baugman, G. L. (1978) *Synthetic Fuels Data Handbook*, Second Edition, Cameron Engineers Inc.

Berry, K. L., et al. (1982) "Modified in situ retorting results of two field retorts", Gary, J. H., ed., 15th Oil Shale Symp., CCM, pp. 385-396.

Boyer, H. E. et al. (1985) "Chapter 16: Heat-Resistant Materials," *Metals Handbook*, American Society for Metals, 16 pages.

Brandt, H. et al. (1965) "Stimulating Heavy Oil Reservoirs With Downhole Air-Gas Burners," *World Oil*, (Sep. 1965), pp. 91-95.

Bridges, J. E., et al. (1983) "The IITRI in situ fuel recovery process", *J. Microwave Power*, v. 18, pp. 3-14.

Burnham, A. K. et al. (1983) "High-Pressure Pyrolysis of Green River Oil Shale" in Geochemistry and Chemistry of Oil Shales: ACS Symposium Series.

Burwell, E. L. et al. (1970) "Shale Oil Recovery by In-Situ Retorting—A Pilot Study" Journal of Petroleum Engr., Dec. 1970, pp. 1520-1524.

Chute, F. S., and Vermeulen, F. E., (1988) "Present and potential applications of electromagnetic heating in the in situ recovery of oil", AOSTRA J. Res., v. 4, pp. 19-33.

Chute, F. S. and Vermeulen, F.E., (1989) "Electrical heating of reservoirs", Hepler, L., and Hsi, C., eds., AOSTRA Technical Handbook on Oil Sands, Bitumens, and Heavy Oils, Chapt. 13, pp. 339-376.

Cook, G. L. et al. (1968) "The Composition of Green River Shale Oils" United Nations Symposium of the Development and Utilization of Oil Shale Resources, 23 pgs.

Covell, J. R., et al. (1984) "Indirect in situ retorting of oil shale using the TREE process", Gary, J. H., ed., 17th Oil Shale Symposium Proceedings, Colorado School of Mines, pp. 46-58, c.

Cummins, J. J. et al. (1972) "Thermal Degradation of Green River Kerogen at 150 to 350C: Rate of Product Formation, Report of Investigation 7620," *US Bureau of Mines*, 1972.

DePriester, C. et al. (1963) "Well Stimulation by Downhole Gas-Air Burner," *Jrnl. Petro. Tech.*, (Dec. 1963), pp. 1297-1302.

Dougan, P. M. et al. (1981) "BX In Situ Oil Shale Project," *Colorado School of Mines; Fourteenth Oil Shale Symposium Proceedings*, 1981, pp. 118-127.

Dougan, P. M. (1979) "The BX In Situ Oil Shale Project," *Chem. Engr. Progress*, pp. 81-84.

Duncan, D. C., (1967) "Geologic Setting of Oil Shale Deposits and World Prospects," *in Proceedings of the Seventh World Petroleum Congress*, v.3, Elsevier Publishing, pp. 659-667.

Fisher, S. T. (1980) "A Comparison of Eleven Processes for Production of Energy from the Solid Fossil Fuels of North America," *SPE 9098*, pp. 1-27.

Hill, G.R. et al. (1967) "The Characteristics of a Low Temperature In Situ Shale Oil," *4th Symposium on Oil Shale, Quarterly of the Colorado School of Mines*, v.62(3), pp. 641-656.

Humphrey, J. P. (1978) "Energy from in situ processing of Antrim oil shale", *DOE Report FE-2346-29*.
Ingram, L. L. et al. (1983) "Comparative Study of Oil Shales and Shale Oils from the Mahogany Zone, Green River Formation (USA) and Kerosene Creek Seam, Rundle Formation (Australia)," *Chemical Geology*, 38, pp. 185-212.
Jacobs, H. R. (1983) "Analysis of the Effectiveness of Steam Retorting of Oil Shale", *AIChE Symposium Series—Heat Transfer*—Seattle 1983 pp. 373-382.
Johnson, D. J. (1966) "Decomposition Studies of Oil Shale," University of Utah, May 1966.
Katz, D.L. et al. (1978) "*Predicting Phase Behavior of Condensate/Crude-Oil Systems Using Methane Interaction Coefficients, J. Petroleum Technology*", pp. 1649-1655.
Tisot, P. R. et al. (1970) "Structural Response of Rich Green River Oil Shales to Heat and Stress and Its Relationship to Induced Permeability," *Journal of Chemical Engineering Data*, v. 15(3), pp. 425-434.
Tisot, P. R. et al. (1971) "Structural Deformation of Green River Oil Shale as It Relates to In Situ Retorting," *US Bureau of Mines Report of Investigations* 7576, 1971.
Tisot, P. R. (1975) "Structural Response of Propped Fractures in Green River Oil Shale as It Relates to Underground Retorting," *US Bureau of Mines Report of Investigations 8021*.
Tissot, B. P., and Welte, D. H. (1984) *Petroleum Formation and Occurrence*, New York, Springer-Verlag, p. 160-174, 175-198 and 254-266.
Tissot, B. P., and Welte, D. H. (1984) *Petroleum Formation and Occurrence*, New York, Springer-Verlag, p. 267-289 and 470-492.
Tyner, C. E. et al. (1982) "Sandia/Geokinetics Retort 23: a horizontal in situ retorting experiment", Gary, J. H., ed., *15th Oil Shale Symp.*, CSM, p. 370-384.
Yen, T. F. et al. (1976) *Oil Shale*, Amsterdam, Elsevier, p. 216-267.
Oil & Gas Journal, 1998, "Aussie oil shale project moves to Stage 2", Oct. 26, p. 42.
International Search Report for PCT/US07/21669, Apr. 29, 2008.
International Search Report for PCT/US08/083815, Mar. 20, 2009.
International Search Report for PCT/US04/11508, Jan. 5, 2005.
International Search Report for PCT/US08/88045, Feb. 12, 2009.
US Pat No. 7,516,787—Office Action mailed Apr. 3, 2008.
US Pat No. 7,516,785—Office Action mailed Apr. 2, 2008.
US Pat No. 7,331,385—Office Action mailed Jul. 12, 2007.
U.S. Appl. No. 11/973,750 Office Action mailed Dec. 4, 2008.
EP Search Report dated Feb. 16, 2007 (RS 114807, Corresponding to U.S. Appl. No. 11/973,753).
EP Search Report dated Mar. 12, 2009 (EP 08 00 3956,—Corresponding to U.S. Appl. No. 12/271,521).
EP Search Report dated Dec. 29, 2003 (RS 110243, Corresponding to US Pat 7,331,385).
Lekas, M. A. et al. (1991) "Initial evaluation of fracturing oil shale with propellants for in situ retorting—Phase 2", *DOE Report DOE/MC/11076-3064*.
Mut, Stephen (2005) "The Potential of Oil Shale," *Shell Oil Presentation at National Academies, Trends in Oil Supply Demand*, in Washington, Dc, Oct. 20-21, 2005, 11 pages.
Needham, et al (1976) "Oil Yield and Quality from Simulated In-Situ Retorting of Green River Oil Shale", Society of Petroleum Engineers of American Institute of Mining, Metallurgical and Petroleum Engineers, Inc. SPE 6069.
Prats, M. et al. (1975) "The Thermal Conductivity and Diffusivity of Green River Oil Shales", *Journal of Petroleum Technology*, pp. 97-106, Jan. 1975.
Rajeshwar, K. et al. (1979) "Review: Thermophysical Properties of Oil Shales", *Journal of Materials Science*, v.14, pp. 2025-2052.
Riva, D. et al. (1998) "Suncor down under: the Stuart Oil Shale Project", Annual Meeting of the *Canadian Inst. of Mining, Metallurgy, and Petroleum*, Montreal, May 3-7.
Rupprecht, R. (1979) "Application of the Ground-Freezing Method to Penetrate a Sequence of Water-Bearing and Dry Formations—Three Construction Cases," *Engineering Geology*, 13, pp. 541-546.
Salamonsson, G. (1951) "The Ljungstrom In Situ Method for Shale-Oil Recovery," *2nd Oil Shale and Cannel Coal Conference*, 2, Glasgow, Scotland, Inst. of Petrol., London, pp. 260-280.
Sandberg, C. R. et al. (1962) "In-Situ Recovery of Oil from Oil Shale—A Review and Summary of Field and Laboratory Studies," RR62.039FR, Nov. 1962.
Sierra, R. et al. (2001) "Promising Progress in Field Application of Reservoir Electrical Heating Methods," SPE 69709, SPE Int'l Thermal Operations and Heavy Oil Symposium, Venezuela, Mar. 2001, 17 pages.
Siskin, M. et al. (1995) "Detailed Structural Characterization of the Organic Material in Rundel Ramsay Crossing and Green River Oil Shales," *Kluwer Academic Publishers*, pp. 143-158.
Smith, F. M. (1966) "A Down-hole Burner—Versatile Tool for Well Heating," *25th Tech. Conf on Petroleum Production*, Pennsylvania State Univ., pp. 275-285.
Sresty, G. C.; et al. (1982) "Kinetics of Low-Temperature Pyrolysis of Oil Shale by the IITRI RF Process," *Colorado School of Mines; Fifteenth Oil Shale Symposium Proceedings*, Aug. 1982, pp. 411-423.
Stevens, A. L., and Zahradnik, R. L. (1983) "Results from the simultaneous processing of modified in situ retorts 7& 8", Gary, J. H., ed., *16th Oil Shale Symp.*, CSM, p. 267-280.
Stoss, K. et al. (1979) "Uses and Limitations of Ground Freezing With Liquid Nitrogen," *Engineering Geology*, 13, pp. 485-494.
Thomas, G. W. (1964) "A Simplified Model of Conduction Heating in Systems of Limited Permeability," *Soc.Pet. Engineering Journal*, Dec. 1964, pp. 335-344.
Thomas, G. W. (1966) "Some Effects of Overburden Pressure on Oil Shale During Underground Retorting," *Society of Petroleum Engineers Journal*, pp. 1-8, Mar. 1966.
Tihen, S. S. et al. (1967) "Thermal Conductivity and Thermal Diffusivity of Green River Oil Shale," *Thermal Conductivity: Proceedings of the Seventh Conference* (Nov. 13-16, 1967), *NBS Special Publication* 302, pp. 529-535, 1968.
Ali, A.H.A, et al, (2003) "Watching Rocks Change-Mechanical Earth Modeling", *Oilfield Review,* pp. 22-39.
Asquith, G., et al., (2004) *Basic Well Log Analysis,* Second Ed., Chapter 1, pp. 1-20.
Ball, J.S., et al. (1949) "Composition of Colorado Shale-Oil Naphtha", *Industrial and Engineering Chemistry,* vol. 41, No. 3 pp. 581-587.
Barnes, A. L. et al. (1968) "Quarterly of the Colorado School of Mines" *Fifth Symposium on Oil Shale,* v. 63(4), Oct. 1968, pp. 827-852.
Bastow, T.P., (1998) Sedimentary Processes Involving Aromatic Hydrocarbons. Thesis (PhD in Applied Chemistry) Curtin University of Technology (Australia), Dec., p. 102.
Blanton, T. L. et al, (1999) "Stress Magnitudes from Logs: Effects of Tectonic Strains and Temperature", *SPE Reservoir Eval. & Eng.* 2, vol. 1, Feb., pp. 62-68.
Brandt, H. et al. (1965) "Stimulating Heavy Oil Reservoirs With Downhole Air-Gas Burners," *World Oil,* (Sep. 1965), pp. 91-95.
Charlier, R. et al, (2002) "Numerical Simulation of the Coupled Behavior of Faults During the Depletion of a High-Pressure/High-Temperature Reservoir", *Society of Petroleum Engineers,* SPE 78199, pp. 1-12.
Cipolla, C.L., et al. (1994), "Practical Application of in-situ Stress Profiles", *Society of Petroleum Engineers,* SPE 28607, pp. 487-499.
Day, R. L., (1998) "Solution Mining of Colorado Nahcolite, Wyoming State Geological Survey Public Information Circular 40," *Proceedings of the First International Soda Ash Conference,* V.11 (Rock Springs, Wyoming, Jun. 10-12) pp. 121-130.
Domine, F. et al. (2002) "Up to What Temperature is Petroleum Stable? New Insights from a 5200 Free Radical Reactions Model", *Organic Chemistry,* 33, pp. 1487-1499.
Dunks, G. et al. (1983) "Electrochemical Studies of Molten Sodium Carbonate," *Inorg. Chem.,* 22, pp. 2168-2177.
Dusseault, M.B. (1998) "Casing Shear: Causes, Cases, Cures", Society of Petroleum Engineers, SPE 48,864 pp. 337-349.
Dyni, J. R., (1974) "Stratigraphy and Nahcolite Resources of the Saline Facies of the Green River Formation in Northwest Colorado," in D.K. Murray (ed.), *Guidebook to the Energy Resources of the Piceance Creek Basin Colorado, Rocky Mountain Association of Geologists,* Guidebook, pp. 111-122.

Fainberg, V. et al. (1998) "Integrated Oil Shale Processing Into Energy and Chemicals Using Combined-Cycle Technology," *Energy Sources,* v.20.6, Abstract, 1 page.
Farouq Ali, S. M., (1994), "Redeeming features of in situ combustion", DOE/NIPER *Symposium on In Situ Combustion Practices-Past, Present, and Future Application,* Tulsa, OK, Apr. 21-22, No. ISC 1, pp. 3-8.
Fox, J. P, (1980) "Water-related Impacts of In-Situ Oil Shale Processing," *California Univ., Berkeley, Lawrence Berkeley Lab,* Chapters 6-7.
Fredrich, J. T. et al, (1996) "Three-Dimensional Geomechanical Simulation of Reservoir Compaction and Implications for Well Failures in the Belridge Diatomite", *Society of Petroleum Engineers* SPE 36698, pp. 195-210.
Fredrich, J. T. et al, (2000) "Geomechanical Modeling of Reservoir Compaction, Surface Subsidence, and Casing Damage at the Belridge Diatomite Field", *SPE Reservoir Eval. & Eng.3,* vol. 4, Aug., pp. 348-359.
Fredrich, J. T. et al, (2003) "Stress Perturbations Adjacent to Salt Bodies in the Deepwater Gulf of Mexico", *Society of Petroleum Engineers* SPE 84554, pp. 1-14.
Frederiksen, S. et al, (2000) "A Numerical Dynamic Model for the Norwegian-Danish Basin", *Tectonophysics,* 343, 2001, pp. 165-183.
Freund, H. et al., (1989) "Low-Temperature Pyrolysis of Green River Kerogen", *The American Association of Petroleum Geologists Bulletin,* v. 73, No. 8 (Aug.) pp. 1011-1017.
Gatens III, J. M. et al, (1990) "In-Situ Stress Tests and Acoustic Logs Determine Mechanical Properties and Stress Profiles in the Devonian Shales", *SPE Formation Evaluation* SPE 18523, pp. 248-254.
Garthoffner, E. H., (1998), "Combustion front and burned zone growth in successful California ISC projects", SPE 46244, pp. 1-11.
Greaves, M., et al. (1994) "In situ combustion (ISC) processes: 3D studies of vertical and horizontal wells", *Europe Comm. Heavy Oil Technology in a Wider Europe Symposium,* Berlin, Jun. 7-8, p. 89-112.
Hansen, K. S. et al, (1989) "Earth Stress Measurements in the South Belridge Oil Field, Kern County, California", *SPE Formation Evaluation,* Dec. pp. 541-549.
Hansen, K. S. et al, (1993) "Finite-Element Modeling of Depletion-Induced Reservoir Compaction and Surface Subsidence in the South Beiridge Oil Field, California", SPE 26074, pp. 437-452.
Hansen, K. S. et al, (1995) "Modeling of Reservoir Compaction and Surface Subsidence at South Belridge", *SPE Production & Facilities,* Aug. pp. 134-143.
Hardy, M. et al. (2003) "Solution Mining of Nahcolite at the American Soda Project, Piceance Creek, Colorado," *SME Annual Mtg.,* Feb. 24-26, Cincinnati, Ohio, Preprint 03-105.
Hardy, M., et al. (2003) "Solution Mining of Nahcolite at American Soda's Yankee Gulch Project," Mining Engineering, Oct. 2003, pp. 23-31.
Henderson, W, et al. (1968) "Thermal Alteration as a Contributory Process to the Genesis Of Petroleum", *Nature* vol. 219, pp. 1012-1016.
Hilbert, L. B. et al, (1999) "Field-Scale and Wellbore Modeling of Compaction-Induced Casing Failures", *SPE Drill. & Completion,* 14(2), Jun. pp. 92-101.
Hill, G. R. et al. (1967) "Direct Production of a Low Pour Point High Gravity Shale Oil", *I&EC Product Research and Development,* 6(1), Mar. pp. 52-59.
Holditch, S. A., (1989) "Pretreatment Formation Evaluation", *Recent Advances in Hydraulic Fracturing,* SPE Monograph vol. 12, Chapter 2 (Henry L. Doherty Series), pp. 39-56.
Holmes, A. S. et al. (1982) "Process Improves Acid Gas Separation," *Hydrocarbon Processing,* pp. 131-136.
Holmes, A. S. et al. (1983) "Pilot Tests Prove Out Cryogenic Acid-Gas/Hydrocarbon Separation Processes," *Oil & Gas Journal,* pp. 85-91.
Ireson, A. T. (1990) "Review of the Soluble Salt Process for In-Situ Recovery of Hydrocarbons from Oil Shale with Emphasis on Leaching and Possible Beneficiation," 23rd *Colorado School of Mines Oil Shale Symposium* (Golden, Colorado), 152-161.
Kenter, C. J. et al, (2004) "Geomechanics and 4D: Evaluation of Reservoir Characteristics from Timeshifts in the Overburden", Gulf Rocks 2004, 6th *North America Rock Mechanics Symposium* (*NARMS*): *Rock Mechanics Across Borders and Disciplines,* Houston, Texas, Jun. 5-9, ARMA/NARMS 04-627.
Kuo, M. C. T. et al (1979) "Inorganics leaching of spent shale from modified in situ processing," J. H. Gary (ed.) *Twelfth Oil Shale Symposium Proceedings,* Colorado School of Mines, Golden CO., Apr. 18-20, pp. 81-93.
Laughrey, C. D. et al. (2003) "Some Applications of Isotope Geochemistry for Determining Sources of Stray Carbon Dioxide Gas," *Environmental Geosciences,* 10(3), pp. 107-122.
Le Pourhiet, L. et al, (2003) "Initial Crustal Thickness Geometry Controls on the Extension in a Back Arc Domain: Case of the Gulf of Corinth", *Tectonics,* vol. 22, No. 4, pp. 6-1-6-14.
Lundquist, L. (1951) "Refining of Swedish Shale Oil", *Oil Shale Cannel Coal Conference,* vol./Issue: 2, pp. 621-627.
Marotta, A. M. et al, (2003) "Numerical Models of Tectonic Deformation at the Baltica-Avalonia Transition Zone During the Paleocene Phase of Inversion", *Tectonophysics,* 373, pp. 25-37.
Miknis, F.P, et al (1985) "Isothermal Decomposition of Colorado Oil Shale", DOE/FE/60177-2288 (DE87009043) May 1985.
Mohammed, Y.A., et al (2001) "A Mathematical Algorithm for Modeling Geomechanical Rock Properties of the Khuff and PreKhuff Reservoirs in Ghawar Field", *Society of Petroleum Engineers* SPE 68194, pp. 1-8.
Molenaar, M. M. et al, (2004) "Applying Geo-Mechanics and 4D: '4D In-Situ Stress' as a Complementary Tool for Optimizing Field Management", *Gulf Rocks 2004, 6th North America Rock Mechanics Symposium* (*NARMS*): *Rock Mechanics Across Borders and Disciplines,* Houston, Texas, Jun. 5-9, ARMA/NARMS 04-639, pp. 1-7.
Moschovidis, Z. (1989) "Interwell Communication by Concurrent Fracturing—a New Stimulation Technique", *Joum. Of Canadian Petro. Tech.* 28(5), pp. 42-48.
Motzfeldt, K. (1954) "The Thermal Decomposition of Sodium Carbonate by the Effusion Method," *Jml. Phys. Chem.,* v. Lix, pp. 139-147.
Newkirk, A. E. et al. (1958) "Drying and Decomposition of Sodium Carbonate," *Anal. Chem.,* 30(5), pp. 982-984.
Nielsen, K. R., (1995) "Colorado Nahcolite: A Low Cost Source of Sodium Chemicals," 7th *Annual Canadian Conference on Markets for Industrial Minerals,* (Vancouver, Canada, Oct. 17-18) pp. 1-9.
Nottenburg, R.N. et al. (1979) "Temperature and stress dependence of electrical and mechanical properties of Green River oil shale," *Fuel,* 58, pp. 144-148.
Nowacki, P. (ed.), (1981) *Oil Shale Technical Handbook,* Noyes Data Corp.
Pattillo, P. D. et al, (1998) "Reservoir Compaction and Seafloor Subsidence at Valhall", SPE 47274, 1998, pp. 377-386.
Pattillo, P. D. et al, (2002) "Analysis of Horizontal Casing Integrity in the Valhall Field", SPE 78204, pp. 1-10.
Persoff, P. et al. (1979) "Control strategies for abandoned in situ oil shale retorts," J. H. Gary (ed.), $12_{th}$ *Oil Shale Symposium Proceedings,* Colorado School of Mines, Golden, CO., Apr. 18-20, pp. 72-80.
Peters, G., (1990) "The Beneficiation of Oil Shale by the Solution Mining of Nahcolite," 23rd *Colorado School of Mines Oil Shale Symposium* (Golden, CO) pp. 142-151.
Plischke, B., (1994) "Finite Element Analysis of Compaction and Subsidence—Experience Gained from Several Chalk Fields", *Society of Petroleum Engineers,* SPE 28129, 1994, pp. 795-802.
Prats, M., et al. (1977) "Soluble-Salt Processes for In-Situ Recovery of Hydrocarbons from Oil Shale," *Journal of Petrol. Technol.,* pp. 1078-1088.
Ramey, M. et al. (2004) "The History and Performance of Vertical Well Solution Mining of Nahcolite ($NaHCO_3$) in the Piceance Basin, Northwestern, Colorado, USA," *Solution Mining Research Institute: Fall* 2004 *Technical Meeting* (Berlin, Germany).
Ruzicka, D.J. et al. (1987) "Modified Method Measures Bromine Number of Heavy Fuel Oils", *Oil & Gas Journal,* 85(31), Aug. 3, pp. 48-50.
Sahu, D. et al. (1988) "Effect of Benzene and Thiophene on Rate of Coke Formation During Naphtha Pyrolysis", *Canadian Joum. Of Chem. Eng.,* 66, Oct. pp. 808-816.
Smart, K. J. et al, (2004) "Integrated Structural Analysis and Geomechanical Modeling: an Aid to Reservoir Exploration and Development", *Gulf Rocks 2004, 6th North America Rock Mechanics Symposium* (*NARMS*): *Rock Mechanics Across Borders and Disciplines,* Houston, Texas, Jun. 5-9, ARMA/NARMS 04-470.
Symington, W.A., et al (2006) ExxonMobil's electrofrac process for in situ oil shale conversion 26th Oil Shale Symposium, Colorado School of Mines.
Syunyaev, Z.I. et al. (1965) "Change in the Resistivity of Petroleum Coke on Calcination," Chemistry and Technology of Fuels and Oils, 1(4), pp. 292-295.
Templeton, C. C. (1978) "Pressure-Temperature Relationship for Decomposition of Sodium Bicarbonate from 200 to 600° F," *J. of Chem. And Eng. Data,* 23(1), pp. 7-8.
Thomas, A. M. (1963) "Thermal Decomposition of Sodium Carbonate Solutions," *J. of Chem. And Eng. Data,* 8(1), pp. 51-54.
Turta, A., (1994), "In situ combustion—from pilot to commercial application", DOE/NIPER *Symposium on In Situ Combustion Practices-Past, Present, and Future Application,* Tulsa, OK, Apr. 21-22, No. ISC 3, pp. 15-39.
Tzanco, E. T., et al. (1990), "Laboratory Combustion Behavior of Countess B Light Oil", *Petroleum Soc. Of CIM and SPE,* Calgary, Jun. 10-13, No. CIM/SPE 90-63, p. 63.1-63.16.
Veatch, Jr. R.W. and Martinez, S.J., et al. (1990) "Hydraulic Fracturing: Reprint Series No. 28", *Soc. Of Petroleum Engineers* SPE 14085, Part I, Overview.
Warpinski, N. R., (1989) "Elastic and Viscoelastic Calculations of Stresses in Sedimentary Basins", *SPE Formation Evaluation,* vol. 4, pp. 522-530.
Yoon, E. et al. (1996) "High-Temperature Stabilizers for Jet Fuels and Similar Hydrocarbon Mixtures. 1. Comparative Studies of Hydrogen Donors", *Energy & Fuels,* 10, pp. 806-811.
"Encyclopedia of Chemical Technology" (4th ed.), *Alkali and Chlorine Products,* pp. 1025-1039 (1998).
EP Search Report dated Mar. 17, 2004 (RS 110686, Corresponding to U.S. Patent 7,441,603).
EP Search Report, Supplementary dated Apr. 10, 2007 (EP 04 77 9878 Corresponding to U.S. Patent 7,441,603).
EP Search Report dated Apr. 29, 2005 (RS 112183, Corresponding to U.S. Appl. No. 11/250,804, Published as US 2006/0100837 on May 11, 2008).
EP Search Report dated Jun. 2, 2006 (RS113865, corresponding to U.S. Appl. No. 11/726,651).
EP Search Report dated Feb. 16, 2007 (RS 114808, Corresponding to U.S. Appl. No. 11/973,746, Published as US 2008/0087420 on May 17, 2008).
EP Search Report dated Feb. 16, 2007 (RS 114804, Corresponding to U.S. Appl. No. 11/973,750, Published as US 2008/0087427 on Apr. 17, 2008).
EP Search Report dated Mar. 21, 2007 (RS 114890, Corresponding to U.S. Patent 7,516,787).
EP Search Report dated Nov. 13, 2007 (RS 115479, Corresponding to U.S. Appl. No. 12/148414).
EP Search Report dated Aug. 29, 2007 (No. RS115553, Corresponding to U.S. Appl. No. 12/148,388).
EP Search Report dated Jul. 4, 2007 ( RS 115341 Corresponding to U.S. Appl. No. 12/074,899).
EP Search Report dated Jul. 5, 2007 (RS 115432 Corresponding to U.S. Appl. No. 12/075,087).
EP Search Report dated Aug. 29, 2007 (RS 1155554, Corresponding to U.S. Appl. No. 12/154,238).
EP Search Report dated Aug. 28, 2007 (RS 1155555, Corresponding to U.S. Appl. No. 12/154,256).
International Search Report for PCT/US01/09247 Jun. 20, 2001.
International Search Report for PCT/US04/24947 Mar. 10, 2005.
International Search Report for PCT/US07/07133, Jan. 4, 2008.
International Search Report for PCT/US07/21673 Jun. 24, 2008.
International Search Report for PCT/US07/21668 Apr. 29, 2008.
International Search Report for PCT/US07/21666 Apr. 4, 2008.
International Search Report for PCT/US07/21660 Apr. 4, 2008.
International Search Report for PCT/US07/021968, May 14, 2008.
International Search Report for PCT/US07/021968, May 21, 2008.
International Search Report for PCT/US08/005008, Aug. 29, 2008.
International Search Report for PCT/US08/05056, Aug. 25, 2008.
International Search Report for PCT/US/08/003069, Jun. 25, 2008.
International Search Report for PCT/US08/003043, Jul. 2, 2008.
International Search Report for PCT/US08/006462 Sep. 22, 2008.
International Search Report for PCT/US08/006463 Aug. 22, 2008.
International Search Report for PCT/US07/21645 Apr. 21, 2008.
International Search Report for PCT/US09/037419 Jul. 7, 2009.
International Search Report for PCT/US09/055403, Oct. 22, 2009.
International Search Report for PCT/US10/20342 Feb. 26, 2010.
International Search Report for PCT/US10/031910 Aug. 3, 2010.
International Search Report for PCT/US10/057204 Jan. 27, 2011.
U.S. Appl. No. 12/630,636 Office Action mailed Oct. 27, 2010.
U.S. Appl. No. 11/250,804 Office Action mailed Oct. 16, 2008.
U.S. Appl. No. 11/250,804 Office Action mailed Jun. 11, 2009.
U.S. Appl. No. 11/973,746 Office Action mailed Jun. 25, 2009.
U.S. Appl. No. 11/973,746 Office Action mailed Nov. 8, 2010.
U.S. Appl. No. 11/973,750 Office Action mailed Jul. 22, 2009.
U.S. Appl. No. 12/638,630 Office Action mailed Mar. 16, 2011.
U.S. Appl. No. 12/712,904 Office Action mailed Nov. 10, 2010.
U.S. Appl. No. 12/148,414 Office Action mailed May 19, 2010.
U.S. Appl. No. 12/148,414 Office Action mailed Oct. 22, 2010.
U.S. Appl. No. 12/148,388 Office Action mailed Jun. 10, 2010.
U.S. Appl. No. 12/148,388 Office Action mailed Nov. 19, 2010.
U.S. Appl. No. 12/074,899 Office Action mailed Dec. 16, 2009.
U.S. Appl. No. 12/074,899 Office Action mailed Jul. 26, 2010.
U.S. Appl. No. 12/074,899 Office Action mailed Jan. 4, 2011.
U.S. Appl. No. 12/075,087 Office Action mailed Dec. 12, 2010.
U.S. Appl. No. 12/075,087 Office Action mailed Mar. 7, 2011.
U.S. Appl. No. 12/271,521 Office Action mailed Nov. 2, 2010.
U.S. Appl. No. 11/973,898 Office Action mailed May 6, 2010.
U.S. Appl. No. 11/973,898 Office Action mailed Dec. 20, 2010.
U.S. Appl. No. 12/405,901 Office Action mailed Feb. 14, 2011.
U.S. Appl. No. 12/154,238 Office Action mailed Apr. 22, 2011.
U.S. Appl. No. 12/154,256 Office Action mailed May 9, 2011.
U.S. Appl. No. 12/148,414 Office Action mailed May 17, 2011.
U.S. Appl. No. 12/443,680 Office Action mailed Jun. 23, 2011.
U.S. Pat No. 6,918,444—Office Action mailed Sep. 16, 2004.
U.S. Pat No. 7,631,691—Office Action mailed Mar. 18, 2009.
U.S. Pat No. 7,441,603—Office Action mailed Feb. 25, 2008.
U.S. Pat No. 7,857,056—Office Action mailed Mar. 19, 2010.
U.S. Pat No. 7,647,972—Office Action mailed May 19, 2009.
U.S. Pat No. 7,647,971—Office Action mailed May 21, 2009.
U.S. Pat No. 7,669,657—Office Action mailed Jun. 26, 2008.
U.S. Pat No. 7,669,657—Office Action mailed Dec. 15, 2008.
U.S. Pat No. 7,669,657—Office Action mailed Sep. 15, 2009.
U.S. Pat No. 7,644,993—Office Acton mailed Jun. 24, 2009.

* cited by examiner

OPTIMIZATION OF UNTREATED OIL SHALE GEOMETRY TO CONTROL SUBSIDENCE

STATEMENT OF RELATED APPLICATIONS

This application claims the benefit of U.S. Provisional Patent Application 61/007,044 filed Dec. 10, 2007 entitled OPTIMIZATION OF UNTREATED OIL SHALE GEOMETRY TO CONTROL SUBSIDENCE. This application is also related to copending (i) U.S. patent application Ser. No. 11/973,750, filed on Oct. 10, 2007, entitled COMBINED DEVELOPMENT OF OIL SHALE BY IN SITU HEATING WITH A DEEPER HYDROCARBON RESOURCE, which claims the benefit of U.S. Provisional Application No. 60/851,542, which was filed on Oct. 13, 2006 and (ii) International Patent Publication WO 2009/076006 titled OPTIMIZATION OF UNTREATED OIL SHALE GEOMETRY TO CONTROL SUBSIDENCE, filed Nov. 17, 2008 which also claims the benefit of U.S. Provisional Patent Application 61/007,044.

BACKGROUND OF THE INVENTION

1. Field of the Invention

The present invention relates to the field of hydrocarbon recovery from subsurface formations. More specifically, the present invention relates to the in situ recovery of hydrocarbon fluids from organic-rich rock formations including, for example, oil shale formations, coal formations and tar sands formations. The present invention also relates to methods for maximizing the recovery of shale oil while controlling surface subsidence during a production operation.

2. Discussion of Technology

Certain geological formations are known to contain an organic matter known as "kerogen." Kerogen is a solid, carbonaceous material. When kerogen is imbedded in rock formations, the mixture is referred to as oil shale. This is true whether or not the mineral is, in fact, technically shale, that is, a rock formed from compacted clay.

Kerogen is subject to decomposing upon exposure to heat over a period of time. Upon heating, kerogen molecularly decomposes to produce oil, gas, and carbonaceous coke. Small amounts of water may also be generated. The oil, gas and water fluids are mobile within the rock matrix, while the carbonaceous coke remains essentially immobile.

Oil shale formations are found in various areas worldwide, including the United States. Such formations are notably found in Wyoming, Colorado, and Utah. Oil shale formations tend to reside at relatively shallow depths and are often characterized by limited permeability. Some consider oil shale formations to be hydrocarbon deposits which have not yet experienced the years of heat and pressure thought to be required to create conventional oil and gas reserves.

The decomposition rate of kerogen to produce mobile hydrocarbons is temperature dependent. Temperatures generally in excess of 270° C. (518° F.) over the course of many months may be required for substantial conversion. At higher temperatures substantial conversion may occur within shorter times. When kerogen is heated for an adequate time period, chemical reactions break the larger molecules forming the solid kerogen into smaller molecules of oil and gas. The thermal conversion process is referred to as pyrolysis or retorting.

Attempts have been made for many years to extract oil from oil shale formations. Near-surface oil shales have been mined and retorted at the surface for over a century. In 1862, James Young began processing Scottish oil shales. The industry lasted for about 100 years. Commercial oil shale retorting through surface mining has been conducted in other countries as well. Such countries include Australia, Brazil, China, Estonia, France, Russia, South Africa, Spain, Jordan and Sweden. However, the practice has been mostly discontinued in recent years because it proved to be uneconomical or because of environmental constraints on spent shale disposal. (See T. F. Yen, and G. V. Chilingarian, "Oil Shale," Amsterdam, Elsevier, p. 292.) Further, surface retorting requires mining of the oil shale, which limits that particular application to very shallow formations.

In the United States, the existence of oil shale deposits in northwestern Colorado has been known since the early 1900's. While research projects have been conducted in this area from time to time, no serious commercial development has been undertaken. Most research on oil shale production was been carried out in the latter half of the 1900's. The majority of this research was on shale oil geology, geochemistry, and retorting in surface facilities.

In 1947, U.S. Pat. No. 2,732,195 issued to Ljungstrom. That patent, entitled "Method of Treating Oil Shale and Recovery of Oil and Other Mineral Products Therefrom," proposed the application of heat at high temperatures to the oil shale formation in situ to distill and produce hydrocarbons. The '195 Ljungstrom patent is incorporated herein by reference.

Ljungstrom coined the phrase "heat supply channels" to describe bore holes drilled into the formation. The bore holes received an electrical heat conductor which transferred heat to the surrounding oil shale. Thus, the heat supply channels served as heat injection wells. The electrical heating elements in the heat injection wells were placed within sand or cement or other heat-conductive material to permit the heat injection well to transmit heat into the surrounding oil shale while preventing the inflow of fluid. According to Ljungstrom, the "aggregate" was heated to between 500° and 1,000° C. in some applications.

Along with the heat injection wells, fluid producing wells were completed in near proximity to the heat injection wells. As kerogen was pyrolyzed upon heat conduction into the aggregate or rock matrix, the resulting oil and gas would be recovered through the adjacent production wells.

Ljungstrom applied his approach of thermal conduction from heated wellbores through the Swedish Shale Oil Company. A full scale plant was developed that operated from 1944 into the 1950's. (See G. Salamonsson, "The Ljungstrom In Situ Method for Shale-Oil Recovery," $2^{nd}$ Oil Shale and Cannel Coal Conference, v. 2, Glasgow, Scotland, Institute of Petroleum, London, p. 260-280 (1951).)

Additional in situ methods have been proposed. These methods generally involve the injection of heat and/or solvent into a subsurface oil shale. Heat may be in the form of heated methane (see U.S. Pat. No. 3,241,611 to J. L. Dougan), flue gas, or superheated steam (see U.S. Pat. No. 3,400,762 to D. W. Peacock). Heat may also be in the form of electric resistive heating, dielectric heating, radio frequency (RF) heating (U.S. Pat. No. 4,140,180, assigned to the ITT Research Institute in Chicago, Ill.) or oxidant injection to support in situ combustion. In some instances, artificial permeability has been created in the matrix to aid the movement of pyrolyzed fluids. Permeability generation methods include mining, rubblization, hydraulic fracturing (see U.S. Pat. No. 3,468,376 to M. L. Slusser and U.S. Pat. No. 3,513,914 to J. V. Vogel), explosive fracturing (see U.S. Pat. No. 1,422,204 to W. W.

Hoover, et al.), heat fracturing (see U.S. Pat. No. 3,284,281 to R. W. Thomas), and steam fracturing (see U.S. Pat. No. 2,952,450 to H. Purre).

It has been disclosed to run alternating current or radio frequency electrical energy between stacked conductive fractures or electrodes in the same well in order to heat a subterranean formation. See U.S. Pat. No. 3,149,672 titled "Method and Apparatus for Electrical Heating of Oil-Bearing Formations;" U.S. Pat. No. 3,620,300 titled "Method and Apparatus for Electrically Heating a Subsurface Formation;" U.S. Pat. No. 4,401,162 titled "In Situ Oil Shale Process;" and U.S. Pat. No. 4,705,108 titled "Method for In Situ Heating of Hydrocarbonaceous Formations." U.S. Pat. No. 3,642,066 titled "Electrical Method and Apparatus for the Recovery of Oil," provides a description of resistive heating within a subterranean formation by running alternating current between different wells. Others have described methods to create an effective electrode in a wellbore. See U.S. Pat. No. 4,567,945 titled "Electrode Well Method and Apparatus;" and U.S. Pat. No. 5,620,049 titled "Method for Increasing the Production of Petroleum From a Subterranean Formation Penetrated by a Wellbore." U.S. Pat. No. 3,137,347 titled "In Situ Electrolinking of Oil Shale," describes a method by which electric current is flowed through a fracture connecting two wells to get electric flow started in the bulk of the surrounding formation. Heating of the formation occurs primarily due to the bulk electrical resistance of the formation. F. S. Chute and F. E. Vermeulen, Present and Potential Applications of Electromagnetic Heating in the In Situ Recovery of Oil, AOSTRA J. Res., v. 4, p. 19-33 (1988) describes a heavy-oil pilot test where "electric preheat" was used to flow electric current between two wells to lower viscosity and create communication channels between wells for follow-up with a steam flood.

In 1989, U.S. Pat. No. 4,886,118 issued to Shell Oil Company, the entire disclosure of which is incorporated herein by reference. That patent, entitled "Conductively Heating a Subterranean Oil Shale to Create Permeability and Subsequently Produce Oil," declared that "[c]ontrary to the implications of . . . prior teachings and beliefs . . . the presently described conductive heating process is economically feasible for use even in a substantially impermeable subterranean oil shale." (col. 6, ln. 50-54). Despite this declaration, it is noted that few, if any, commercial in situ shale oil operations have occurred other than Ljungstrom's application. The '118 patent proposed controlling the rate of heat conduction within the rock surrounding each heat injection well to provide a uniform heat front.

Additional history behind oil shale retorting and shale oil recovery can be found in co-owned U.S. Pat. No. 7,331,385 entitled "Methods of Treating a Subterranean Formation to Convert Organic Matter into Producible Hydrocarbons." The Background and technical disclosure of this patent is incorporated herein by reference.

In connection with the production of hydrocarbons from a rock matrix, particularly those of shallow depth, a concern may exist with respect to earth subsidence. This is particularly true in connection with the in situ heating of organic-rich rock where a portion of the matrix itself is thermally converted and removed. Initially, the formation may contain formation hydrocarbons in solid form, such as, for example, kerogen. The formation may also initially contain water-soluble minerals. Initially, the formation may also be substantially impermeable to fluid flow.

The in situ heating of the matrix pyrolyzes at least a portion of the formation hydrocarbons to create hydrocarbon fluids. In this respect, the in situ heating and production of oil and gas from oil shale converts a volumetrically significant portion of the heated oil shale to hydrocarbon fluids. The volumetric portion, e.g., final porosity of heated oil shale, may be as much as 15 to 35 percent, and more likely between 20 to 30 percent.

The pyrolyzation process creates voids and permeability within a matured (pyrolyzed) organic-rich rock zone in the organic-rich rock formation. Pyrolyzation also creates thermally-induced fractures with the organic-rich rock formation. The combination of pyrolyzation and increased permeability permits hydrocarbon fluids to be produced from the formation. At the same time, the loss of supporting matrix material also creates the potential for surface subsidence.

A need exists for improved processes for the production of shale oil. In addition, a need exists for improved methods for anticipating and controlling subsidence during a shale oil production operation. Still further, a need exists for methods that optimize the amount of rock that is treated so as to maximize the hydrocarbons recovered from an organic-rich rock formation.

SUMMARY

One or more of the methods described herein have various benefits in improving the recovery of shale oil. In various embodiments, such benefits may include increased production of hydrocarbon fluids from an organic-rich rock formation, and controlling subsidence from a production operation.

A method for developing hydrocarbons from a subsurface formation in a development area is provided. The formation contains organic-rich rock. In one aspect, the organic-rich rock formation is comprised of solid hydrocarbons. Preferably, the solid hydrocarbons include kerogen.

In one embodiment, the method includes heating portions of the organic-rich rock formation through primarily conductive heat generation, e.g., some convective heating may take place, but the primary heat transfer mechanism is conductive heating, e.g., with a non-oxidative heat generation process. The heating pyrolyzes at least a portion of formation hydrocarbons located in a heated zone in the organic rich rock into hydrocarbon fluids. The method also includes preserving at least one unheated zone within the organic-rich rock formation that is not intentionally heated. In this way, at least one zone is left within the formation that is substantially unpyrolyzed. In connection with the method, the at least one unheated zone is sized in order to substantially optimize the heated zone. In this way the likelihood of subsidence above the subsurface formation is controlled.

The method is not limited to the manner in which heating of the formation hydrocarbons is carried out so long as the heating is primarily conductive. The primarily conductive heat generation may include non-oxidative heating, which means, for purposes of this application, that the organic-rich rock formation is not artificially exposed to oxygen. For example, non-oxidative heat generation may comprise radiative heating by using an electrically resistive heating element in one or more heater wells, or by using one or more downhole combustion burners within piping of one or more heater wells. Alternatively, non-oxidative heat generation comprises heat generated (1) by passing an electrical current through an electrically resistive granular material residing within fractures in the organic-rich rock formation, or (2) by flowing a heated fluid through parallel propped vertical fractures within the organic-rich rock formation. These latter techniques are taught in U.S. Pat. No. 7,331,385 entitled "Methods of Treating a Subterranean Formation to Convert Organic Matter into Producible Hydrocarbons," and in patent publication U.S. Pat. No. 7,441,603 entitled "Hydrocarbon Recovery from Impermeable Oil Shales." The Background and technical disclosures of these two patent publications are incorporated herein by reference.

Preferably, the step of controlling subsidence above the organic-rich rock formation comprises not exceeding a maximum subsidence criterion. The term "maximum subsidence criterion" means that one or more criteria are applied for quantifying or controlling subsidence. In one aspect, the maximum subsidence criterion is a measure of the difference in surface elevation before and after heating the formation. For example, the difference in elevation may be less than or about one foot. In another aspect, the maximum subsidence criterion is an absence of faulting above or adjacent the subsurface formation. For example, the absence of faulting may be an absence of faulting between the organic-rich rock formation and a ground water formation there above.

The size of an unheated region will vary depending upon the nature of the organic-rich rock formation under development. In one aspect, the at least one unheated zone represents no more than 50 percent of the development area. Alternatively, the at least one unheated zone represents no more than 25 percent of the development area. More preferably, the at least one unheated zone represents no more than 10 percent of the development area.

The method for developing hydrocarbons from a subsurface formation may also include the step of selecting a geometry for the at least one unheated zone within the development area. In one aspect, the at least one unheated zone defines an area that is at least 5 percent greater than an area considered to be a subsidence failure point for the selected geometry. In another aspect, the at least one unheated zone defines an area that is at least 10 percent greater than an area considered to be a subsidence failure point for the selected geometry. The failure point may be a projected incidence of surface subsidence of less than about one foot or, for example, greater than one foot and up to three feet. In one aspect, the failure point is a difference in elevation of a selected portion of the development area before and after heating that is not significant as viewed by an owner or manager of the surface rights.

Various specific configurations for the at least one unheated zone may be employed. In one aspect, a single large area that is essentially a four-sided polygon is left unheated. In another aspect, two or more smaller squares, rectangles, hexagons or rhomboids are left unheated, creating pillars. In yet another aspect, a plurality of star-shaped areas is preserved from substantial pyrolysis.

In one embodiment, the method further comprises drilling at least one cooling well through each of at least two unheated zones, and injecting a cooling fluid into each cooling well in order to inhibit pyrolysis within the at least two unheated zones. Each cooling well may comprise, for example, a downhole piping assembly for circulating a cooling fluid. The cooling fluid may be an unheated fluid, or a fluid that has been chilled at the earth's surface.

A method for developing hydrocarbons from a subsurface formation containing organic-rich rock while controlling subsidence in a development area is also provided. In one aspect, the method comprises providing a finite element computer model of a subsurface zone within the organic-rich rock formation; providing for the computer model a designated heated area, and an unheated area located in the subsurface zone adjacent to the designated heated area, thereby providing a selected size ratio of the unheated area to the heated area within the subsurface zone; assigning geomechanical properties for the heated area and the unheated area; determining whether a subsidence failure point has been reached in rock above or adjacent the heated area at a first fluid pressure within the heated area; determining whether a subsidence failure point has been reached in rock above or adjacent the designated heated area at a second lower fluid pressure within the designated heated area at the selected size ratio, thus simulating a reduction of fluid pressure within the subsurface zone; and heating the subsurface formation in the designated heated area at approximately the selected size ratio, thereby pyrolyzing at least a portion of formation hydrocarbons found in the organic rich rock into hydrocarbon fluids.

Preferably, the organic-rich rock formation is comprised of oil shale. The geomechanical properties may include the Poisson ratio, the modulus of elasticity, shear modulus, Lame' constant, $V_p/V_s$, or combinations thereof. The geomechanical properties may further, or in addition, include a Mohr-Coulomb failure criterion.

In one aspect, the step (e) of determining whether a subsidence failure point has been reached in the rock above or adjacent the designated heated area comprises determining whether a principal stress in the rock above or adjacent the designated heated area becomes tensile. Alternatively, the step (e) of determining whether a subsidence failure point has been reached in the rock above or adjacent the designated heated area comprises determining whether a shear stress in the rock above or adjacent the designated heated area exceeds the Mohr-Coulomb failure criterion.

The method may further include the steps of increasing the size of the selected size ratio by increasing the size of the designated heated area relative to the unheated area, thereby providing a new selected size ratio; repeating steps (c) through (e) at the new selected size ratio; and using the finite element computer model, confirming that the subsidence failure point has not been reached in the rock above or adjacent the designated heated area at the new selected size ratio.

If the subsidence failure point has not been reached, then the method may further comprise heating the subsurface formation in the designated heated area at approximately the new selected size ratio.

A method for developing hydrocarbons from an organic-rich rock formation in a development area while controlling a subsidence area is also provided. In one aspect, the method comprises assigning an area of the subsurface formation to be heated, thereby providing a heated area; assigning an area of the subsurface formation to be left unheated, thereby providing an unheated area; providing an initial value for a geomechanical property of the heated area, the geomechanical property representing a softened condition of the subsurface formation in the heated area; assigning sequentially lower pore pressure values to the heated area; evaluating at least one of (1) the displacement of rock above the heated area, and (2) the maximum principal stress in the unheated area adjacent the heated area at the initial value for the geomechanical property at each of the sequentially lower pore pressure values, in order to predict a likelihood of subsidence within the heated area; and heating that area of the subsurface formation in the heated area, thereby causing organic-rich rock therein to become pyrolyzed.

Preferably, the subsurface formation is an oil shale formation. In one aspect, the method further comprises providing a second value of the geomechanical property in order to simulate a further softening of the organic-rich rock relative to the initial value of the geomechanical property; and evaluating at least one of (1) the displacement of rock above the heated area, and (2) the maximum principal stress in the unheated area adjacent the heated area, at the second value for the geomechanical property in order to predict a likelihood of subsidence within the heated area.

In another aspect, the method may further include in response to step (g), if minimal likelihood of subsidence above the heated area is predicted, increasing a size of the heated area relative to a size of the unheated area; and repeating steps (c) through (g) at the increased size.

In yet another aspect, the unheated area defines a first configuration, and the method further comprises in response to step (g), if minimal likelihood of subsidence above the heated area is predicted, changing the configuration of the subsurface formation to be left unheated to a second configuration; and repeating steps (c) through (g) at the changed configuration.

In yet another aspect, the area of the subsurface formation to be left unheated defines a first configuration, and the method further comprises in response to step (g), if minimal likelihood of subsidence above the heated area is predicted, increasing a size of the heated area relative to a size of the unheated area using a second configuration for the unheated area; and repeating steps (c) through (g) at the second larger configuration.

A method of minimizing unpyrolyzed oil shale in a subsurface formation is also provided herein. In one embodiment, the method comprises providing a finite element model computer program; designating for the program a first volume of the subsurface formation as being treated; designating for the program a second volume of rock above and adjacent to the first volume as being untreated; initializing the second volume in a geomechanical stress state; assigning a Young's modulus to the rock in the second volume; assigning a Young's modulus to the first volume that is lower than the Young's modulus assigned to the second volume; assigning a pore pressure within the first volume; incrementally reducing the pore pressure to simulate pyrolysis of formation hydrocarbons in and the removal of fluids from the first volume; and evaluating at least one of (1) the displacement of rock above the first volume, and (2) the maximum principal stress in the second volume, in order to predict a likelihood of subsidence.

In this method, the pore pressure may be reduced to a value that approximates hydrostatic pressure. This reduction is preferably an incremental step reduction, meaning that the pressure reductions are of essentially equal value.

A method for developing hydrocarbons from an oil shale formation is also provided herein. In one aspect, the method includes mechanically characterizing geological forces acting upon the oil shale formation; mechanically characterizing the oil shale formation after at least partial pyrolysis of the oil shale formation; selecting a first prototype pillar geometry; selecting a dimension for the first prototype pillar geometry representing a first selected percentage area of the oil shale formation; running a subsidence model for the first prototype pillar geometry at the first selected percentage area; and evaluating whether failure of the oil shale formation may occur at the selected first prototype pillar geometry and the first selected percentage area.

In one aspect the method further includes the steps of: selecting a new dimension for the first prototype pillar geometry representing a second selected percentage area of the oil shale formation; running a subsidence model for the first prototype pillar geometry at the second selected percentage area; and evaluating whether failure of the oil shale formation may occur at the selected first prototype pillar geometry and the second selected percentage area.

In one aspect the method further includes the steps of selecting a second prototype pillar geometry; selecting a dimension for the second prototype pillar geometry representing the first selected percentage area of the oil shale formation; running a subsidence model for the second prototype pillar geometry at the first selected percentage area; and evaluating whether failure of the oil shale formation may occur at the selected second prototype pillar geometry and the first selected percentage area.

In one embodiment, evaluating whether failure of the oil shale formation may occur at the selected first prototype pillar geometry and the first selected percentage area comprises determining whether rock adjacent to the oil shale formation goes into a state of tension. Alternatively, evaluating whether failure of the oil shale formation may occur at the selected first prototype pillar geometry and the first selected percentage area comprises determining whether significant displacement of rock in the overburden occurs.

Also offered herein is a method of minimizing environmental impact in a hydrocarbon development area. In one aspect, the method includes reviewing the topography of the hydrocarbon development area, and determining portions of the topography that are amenable to subsidence without significant environmental impact. The method then further includes conductively heating the oil shale formation below those portions of the topography that are amenable to subsidence without significant environmental impact in order to pyrolyze oil shale and produce hydrocarbons.

In one embodiment, the method further includes determining a portion of the topography that is more environmentally sensitive to subsidence than the portions of the topography that are amenable to subsidence without significant environmental impact, and inhibiting the heating of a portion of the oil shale formation below that portion of the topography that is more environmentally sensitive, thereby forming a pillar. The step of inhibiting the heating may comprise drilling at least one cooling well through the oil shale formation below the portion of the topography that is more environmentally sensitive to subsidence, and then injecting a cooling fluid into the cooling well in order to inhibit pyrolysis within the portion of the oil shale formation below that portion of the topography that is more environmentally sensitive to subsidence. Inhibiting the subsidence may, alternatively or in addition, comprise not affirmatively heating that portion of the topography that is more environmentally sensitive to subsidence to an extent that measurable pyrolysis takes place.

Finally, a method for importing hydrocarbons is offered herein. In one embodiment, the method includes locating a subsurface formation outside of the territorial boundaries of a first country, the subsurface formation containing organic rich rock. The method also includes arranging to have hydrocarbon fluids loaded into a marine vessel, and then arranging to have the marine vessel transport the hydrocarbon fluids to a terminal within the territorial boundaries of a second country such as the United States of America. In this method, the hydrocarbon fluids have been produced as a result of conductively heating the subsurface formation across a development area, thereby pyrolyzing at least a portion of formation hydrocarbons in the organic rich rock into the hydrocarbon fluids.

In this method of importing, heating the subsurface formation has been conducted in a deliberate manner to control subsidence by preserving at least one zone within the formation that is not significantly heated, thereby leaving formation hydrocarbons in the organic rich rock in the at least one unheated zone substantially unpyrolyzed, with the at least one unheated zone being located within the development area. Preferably, the organic-rich rock formation is comprised of oil shale.

BRIEF DESCRIPTION OF THE DRAWINGS

So that the present inventions can be better understood, certain drawings, charts, graphs and flow charts are appended hereto. It is to be noted, however, that the drawings illustrate only selected embodiments of the inventions and are therefore not to be considered limiting of scope, for the inventions may admit to other equally effective embodiments and applications.

FIGS. 13A and 13B present in flow chart form an implementation of the model geometry of FIG. 12A.

In FIG. 14A, the pore pressure in the subsurface treated volume is assumed to be 1,858 psi.

In FIG. 14B, the pore pressure in the treated volume is assumed to be 1,458 psi. Thus, the pore pressure in the treated volume has been incrementally decreased by 400 psi to determine how stresses in the rocks surrounding the treated volume are modified.

FIG. 14C represents a third pressure increment. Fluid pressure in the treated volume is further reduced to 1,058 psi. This represents another 400 psi incremental drop.

In FIG. 14D, the pore pressure in the treated volume is further reduced by 400 psi to 658 psi. Thus, the pore pressure in the treated volume has been decreased to a level that is just above hydrostatic pressure. This represents a logical end point for the computer simulation.

In FIG. 15A, the pore pressure in the subsurface treated volume is assumed to be 1,858 psi.

In FIG. 15B, the pore pressure in the treated volume is reduced to 1,458 psi. Thus, the pore pressure in the treated volume has been incrementally decreased by 400 psi to determine the amount of displacement that will occur in the rocks surrounding the treated volume.

In FIG. 15C, the pore pressure in the treated volume is further reduced to 1,058 psi.

In FIG. 15D, the pore pressure in the treated volume is further reduced to 658 psi. Thus, the pore pressure in the treated volume has been decreased to a level that is just above hydrostatic pressure. Again, this represents a logical end point for the computer simulation.

FIG. 17 presents in flow chart form another implementation of the model of FIG. 12A.

DETAILED DESCRIPTION OF CERTAIN EMBODIMENTS

Figure 1:
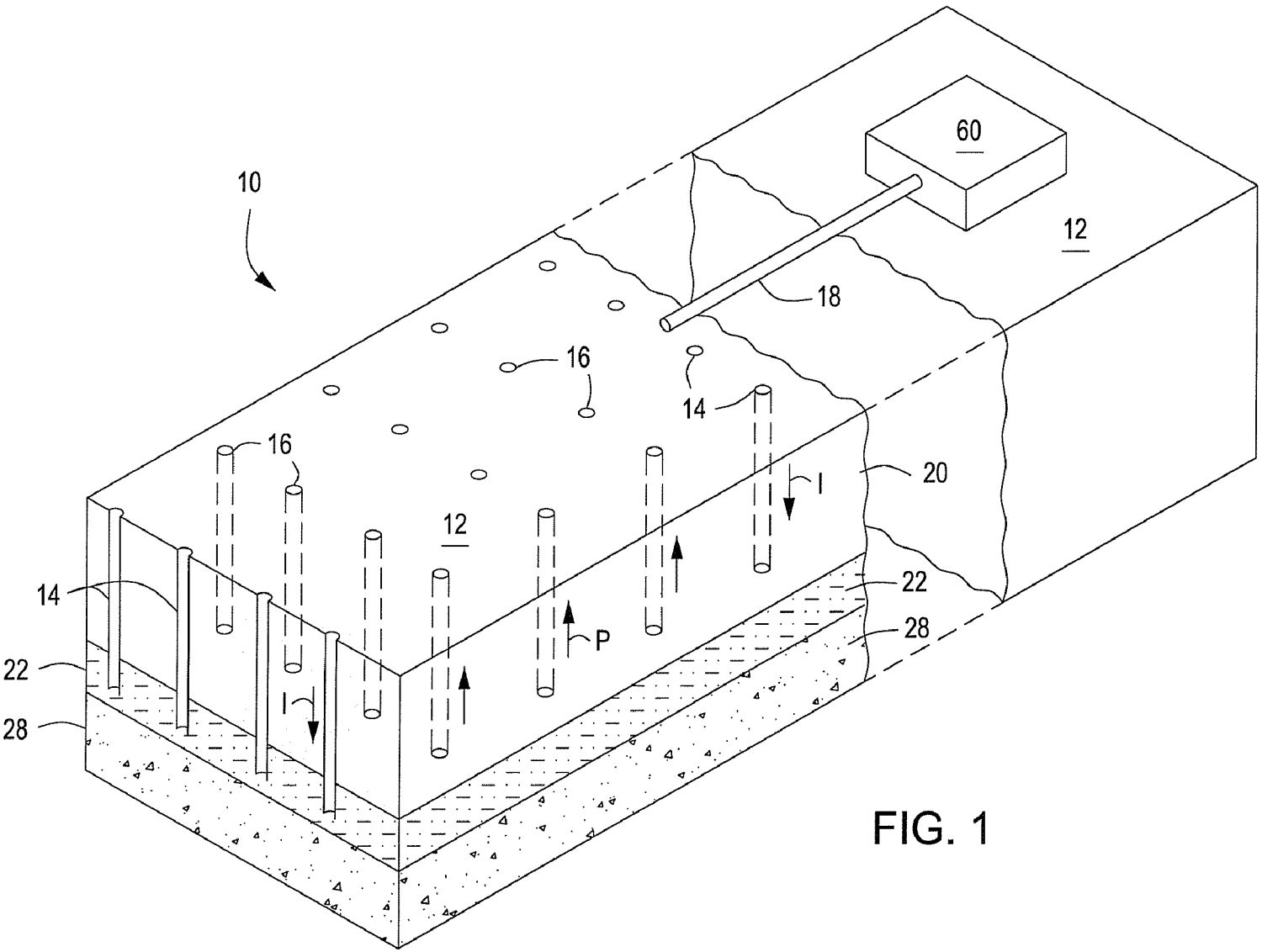
FIG. 1 is a cross-sectional isometric view of an illustrative hydrocarbon development area. The development area includes an organic-rich rock matrix that defines a subsurface formation.

As used herein, the term "hydrocarbon(s)" refers to organic material with molecular structures containing carbon bonded to hydrogen. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, pyrolyzed shale oil, synthesis gas, a pyrolysis product of coal, carbon dioxide, hydrogen sulfide and water (including steam). Produced fluids may include both hydrocarbon fluids and non-hydrocarbon fluids.

As used herein, the term "condensable hydrocarbons" means those hydrocarbons that condense at approximately 25° C. and one atmosphere absolute pressure. Condensable hydrocarbons may include a mixture of hydrocarbons having carbon numbers greater than 4.

As used herein, the term "non-condensable hydrocarbons" means those hydrocarbons that do not condense at approximately 25° C. and one atmosphere absolute pressure. Non-condensable hydrocarbons may include hydrocarbons having carbon numbers less than 5.

As used herein, the term "heavy hydrocarbons" refers to hydrocarbon fluids that are highly viscous at ambient conditions (15° C. and 1 atm pressure). Heavy hydrocarbons may include highly viscous hydrocarbon fluids such as heavy oil, tar, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20 degrees. Heavy oil, for example, generally has an API gravity of about 10-20 degrees, whereas tar generally has an API gravity below about 10 degrees. The viscosity of heavy hydrocarbons is generally greater than about 100 centipoise at 15° C.

As used herein, the term "solid hydrocarbons" refers to any hydrocarbon material that is found naturally in substantially solid form at formation conditions. Non-limiting examples include kerogen, coal, shungites, asphaltites, and natural mineral waxes.

As used herein, the term "formation hydrocarbons" refers to both heavy hydrocarbons and solid hydrocarbons that are contained in an organic-rich rock formation. Formation hydrocarbons may be, but are not limited to, kerogen, oil shale, coal, bitumen, tar, natural mineral waxes, and asphaltites.

As used herein, the term "tar" refers to a viscous hydrocarbon that generally has a viscosity greater than about 10,000 centipoise at 15° C. The specific gravity of tar generally is greater than 1.000. Tar may have an API gravity less than 10 degrees. "Tar sands" refers to a formation that has tar in it.

As used herein, the term "kerogen" refers to a solid, insoluble hydrocarbon that principally contains carbon, hydrogen, nitrogen, oxygen, and sulfur. Oil shale contains kerogen.

As used herein, the term "bitumen" refers to a non-crystalline solid or viscous hydrocarbon material that is substantially soluble in carbon disulfide.

As used herein, the term "oil" refers to a hydrocarbon fluid containing a mixture of condensable hydrocarbons.

As used herein, the term "subsurface" refers to geologic strata occurring below the earth's surface.

As used herein, the term "hydrocarbon-rich formation" refers to any formation that contains more than trace amounts of hydrocarbons. For example, a hydrocarbon-rich formation may include portions that contain hydrocarbons at a level of greater than 5 percent by volume. The hydrocarbons located in a hydrocarbon-rich formation may include, for example, oil, natural gas, heavy hydrocarbons, and solid hydrocarbons.

As used herein, the term "organic-rich rock" refers to any rock matrix holding solid hydrocarbons and/or heavy hydrocarbons. Rock matrices may include, but are not limited to, sedimentary rocks, shales, siltstones, sands, silicilytes, carbonates, and diatomites. Organic-rich rock may contain kerogen.

As used herein, the term "formation" refers to any definable subsurface region. The formation may contain one or more hydrocarbon-containing layers, one or more non-hydrocarbon containing layers, an overburden, and/or an underburden of any geologic formation.

An "overburden" and/or an "underburden" is geological material above or below the formation of interest. An overburden or underburden may include one or more different types of substantially impermeable materials. For example, overburden and/or underburden may include rock, shale, mudstone, or wet/tight carbonate (i.e., an impermeable carbonate without hydrocarbons). An overburden and/or an underburden may include a hydrocarbon-containing layer that is relatively impermeable. In some cases, the overburden and/or underburden may be permeable.

As used herein, the term "organic-rich rock formation" refers to any formation containing organic-rich rock. Organic-rich rock formations include, for example, oil shale formations, coal formations, and tar sands formations.

As used herein, the term "pyrolysis" refers to the breaking of chemical bonds through the application of heat. For example, pyrolysis may include transforming a compound into one or more other substances by heat alone or by heat in combination with an oxidant. Pyrolysis may include modifying the nature of the compound by addition of hydrogen atoms which may be obtained from molecular hydrogen, water, carbon dioxide, or carbon monoxide. Heat may be transferred to a section of the formation to cause pyrolysis.

As used herein, the term "water-soluble minerals" refers to minerals that are soluble in water. Water-soluble minerals include, for example, nahcolite (sodium bicarbonate), soda ash (sodium carbonate), dawsonite ($NaAl(CO_3)(OH)_2$), or combinations thereof. Substantial solubility may require heated water and/or a non-neutral pH solution.

As used herein, the term "formation water-soluble minerals" refers to water-soluble minerals that are found naturally in a formation.

As used herein, the term "migratory contaminant species" refers to species that are both soluble or moveable in water or an aqueous fluid, and are considered to be potentially harmful or of concern to human health or the environment. Migratory contaminant species may include inorganic and organic contaminants. Organic contaminants may include saturated hydrocarbons, aromatic hydrocarbons, and oxygenated hydrocarbons. Inorganic contaminants may include metal contaminants, and ionic contaminants of various types that may significantly alter pH or the formation fluid chemistry. Aromatic hydrocarbons may include, for example, benzene, toluene, xylene, ethylbenzene, and tri-methylbenzene, and various types of polyaromatic hydrocarbons such as anthracenes, naphthalenes, chrysenes and pyrenes. Oxygenated hydrocarbons may include, for example, alcohols, ketones, phenols, and organic acids such as carboxylic acid. Metal contaminants may include, for example, arsenic, boron, chromium, cobalt, molybdenum, mercury, selenium, lead, vanadium, nickel or zinc. Ionic contaminants include, for example, sulfides, sulfates, chlorides, fluorides, ammonia, nitrates, calcium, iron, magnesium, potassium, lithium, boron, and strontium.

As used herein, the term "cracking" refers to a process involving decomposition and molecular recombination of organic compounds to produce a greater number of molecules than were initially present. In cracking, a series of reactions take place accompanied by a transfer of hydrogen atoms between molecules. For example, naphtha may undergo a thermal cracking reaction to form ethene and $H_2$ among other molecules.

As used herein, the term "subsidence" refers to a downward movement of an earth surface relative to an initial elevation of the surface.

As used herein, the term "thickness" of a layer refers to the distance between the upper and lower boundaries of a cross section of a layer, wherein the distance is measured normal to the average tilt of the cross section.

As used herein, the term "thermal fracture" refers to fractures created in a formation caused directly or indirectly by expansion or contraction of a portion of the formation and/or fluids within the formation, which in turn is caused by increasing/decreasing the temperature of the formation and/or fluids within the formation, and/or by increasing/decreasing a pressure of fluids within the formation due to heating. Thermal fractures may propagate into or form in neighboring regions significantly cooler than the heated zone.

As used herein, the term "hydraulic fracture" refers to a fracture at least partially propagated into a formation, wherein the fracture is created through injection of pressurized fluids into the formation. While the term "hydraulic fracture" is used, the inventions herein are not limited to use in hydraulic fractures. The invention is suitable for use in any fracture created in any manner considered to be suitable by one skilled in the art. The fracture may be artificially held open by injection of a proppant material. Hydraulic fractures may be substantially horizontal in orientation, substantially vertical in orientation, or oriented along any other plane.

As used herein, the term "wellbore" refers to a hole in the subsurface made by drilling or insertion of a conduit into the subsurface. A wellbore may have a substantially circular cross section, or other cross-sectional shapes (e.g., circles, ovals, squares, rectangles, triangles, slits, or other regular or irregular shapes). As used herein, the term "well", when referring to an opening in the formation, may be used interchangeably with the term "wellbore."

As used herein, the term "unheated" means that a rock formation has not been heated or otherwise energized to such an extent as would cause significant pyrolysis of formation hydrocarbons located in an organic-rich formation.

Reciprocally, the term "heated" means a rock formation that has been heated or otherwise energized to such an extent as would cause measurable pyrolysis of formation hydrocarbons located in an organic-rich formation.

As used herein, the term "maximum subsidence criterion" means one or more criteria for quantifying and controlling subsidence.

Conductive heating means that a primary heat transfer mechanism is conductive heat transfer, e.g., some convective heating may still take place. Alternatively, or in addition to, conductive heating may also include non-oxidative heating. Non-oxidative heating for the purposes of this application means that a formation combustion process is not used for pyrolyzing an organic-rich rock formation. In this respect, the organic-rich rock formation is not artificially exposed to oxygen.

DESCRIPTION OF SPECIFIC EMBODIMENTS

The inventions are described herein in connection with certain specific embodiments. However, to the extent that the following detailed description is specific to a particular embodiment or a particular use, such is intended to be illustrative only and is not to be construed as limiting the scope of the inventions.

As discussed herein, some embodiments of the inventions include or have application related to an in situ method of recovering natural resources. The natural resources may be recovered from a formation containing organic-rich rock, including, for example, an oil shale formation. The organic-rich rock may include formation hydrocarbons, including, for example, kerogen, coal, and heavy hydrocarbons. In some embodiments of the inventions the natural resources may include hydrocarbon fluids, including, for example, products of the pyrolysis of formation hydrocarbons such as shale oil. In some embodiments of the inventions the natural resources may also include water-soluble minerals, including, for example, nahcolite (sodium bicarbonate, or $2NaHCO_3$), soda ash (sodium carbonate, or $Na_2CO_3$), and dawsonite ($NaAl(CO_3)(OH)_2$).

FIG. 1 presents a perspective view of an illustrative oil shale development area 10. A surface 12 of the development area 10 is indicated. Below the surface 12 are various subsurface strata 20. The strata 20 include, for example, an organic-rich rock formation 22 and a non-organic-rich formation 28 there below. The illustrative organic-rich rock formation 22 contains formation hydrocarbons (such as, for example, kerogen) and possibly valuable water-soluble minerals (such as, for example, nahcolite).

It is understood that the representative formation 22 may be any organic-rich rock formation, including a rock matrix containing coal or tar sands, for example. In addition, the rock matrix making up the formation 22 may be permeable, semi-permeable or essentially non-permeable. The present inventions are particularly advantageous in oil shale development areas initially having very limited or effectively no fluid permeability.

In order to access formation 22 and recover natural resources therefrom, a plurality of wellbores is formed. First, certain wellbores 14 are shown along a periphery of the development area 12. These wellbores 14 are designed originally to serve as heater wells. The heater wells provide heat to pyrolyze hydrocarbon solids in the organic-rich rock formation 22. In some embodiments, a well spacing of 15 to 25 feet is provided for the heater wells 14. Subsequent to the pyrolysis process, the peripheral wellbores 14 may be converted to water injection wells. Selected injection wells 14 are denoted with a downward arrow "I."

The illustrative wellbores 14 are presented in so-called "line drive" arrangements. However, as discussed more fully in connection with FIG. 4, various other arrangements may be provided. The inventions disclosed herein are not limited to the arrangement of or method of selection for heater wells or water injection wells.

Additional wellbores 16 are shown at 14 internal to the development area 10. These represent production wells. The representative wellbores 16 for the production wells are essentially vertical in orientation relative to the surface 12. However, it is understood that some or all of the wellbores 16 for the production wells could deviate into an obtuse or even horizontal orientation. Selected production wells 16 are denoted with an upward arrow "P."

In the arrangement of FIG. 1, each of the wellbores 14, 16 is completed in the oil shale formation 22. The completions may be either open or cased hole. The well completions for the production well wellbores 16 may also include propped or unpropped hydraulic fractures emanating therefrom. Subsequent to production, some of these internal wellbores 16 may be converted to water production wells.

In the view of FIG. 1, only eight wellbores 14 are shown for the injection wells and only eight wellbores 16 are shown for the production wells. However, it is understood that in an oil shale development project, numerous additional wellbores 14, 16 will be drilled. The wellbores 16 for the production wells may be located in relatively close proximity, being from 10 feet to up to 300 feet in separation. Alternatively, the wellbores may be spaced from 30 to 200 feet or 50 to 100 feet.

Typically, the wellbores are also completed at shallow depths, ranging from 200 to 5,000 feet at true vertical depth. Alternatively, the wellbores may be completed at depths from 1,000 to 4,000 feet, or 1,500 to 3,500 feet. In some embodiments, the oil shale formation targeted for in situ retorting is at a depth greater than 200 feet below the surface. In alternative embodiments, the oil shale formation targeted for in situ retorting is at a depth greater than 500, 1,000, or 1,500 feet below the surface. In alternative embodiments, the oil shale formation targeted for in situ retorting is at a depth between 200 and 5,000 feet, alternatively between 1,000 and 4,000 ft, 1,200 and 3,700 feet, or 1,500 and 3,500 feet below the surface.

As noted, the wellbores 14, 16 will be selected for certain initial functions before being converted to water injection wells and oil production wells and/or water-soluble mineral solution production wells. In one aspect, the wellbores 14, 16 are dimensioned to serve two, three, or four different purposes in designated sequences. Suitable tools and equipment may be sequentially run into and removed from the wellbores 14, 16 to serve the various purposes.

A production fluids processing facility 60 is also shown schematically in FIG. 1. The processing facility 60 is equipped to receive fluids produced from the organic-rich rock formation 22 through one or more pipelines or flow lines 18. The fluid processing facility 60 may include equipment suitable for receiving and separating oil, gas, and water produced from a heated formation. The fluids processing facility 60 may further include equipment for separating out dissolved water-soluble minerals and/or migratory contaminant species, including, for example, dissolved organic contaminants, metal contaminants, or ionic contaminants in the produced water recovered from the organic-rich rock formation 22. If the pyrolysis is performed in the absence of oxygen or air, the contaminant species may include aromatic hydrocarbons. These may include benzene, toluene, xylene, ethylbenzene and tri-methylbenzene. The contaminants may also include polyaromatic hydrocarbons such as anthracene, naphthalene, chrysene and pyrene. Metal contaminants may include species containing arsenic, boron, chromium, mercury, selenium, lead, vanadium, nickel, cobalt, molybdenum, or zinc. Ionic contaminant species may include, for example, sulfates, chlorides, fluorides, lithium, potassium, aluminum, ammonia, and nitrates. Other species such as sulfates, ammonia, aluminum, potassium, magnesium, chlorides, flourides and phenols may also exist. If oxygen or air is employed, contaminant species may also include ketones, alcohols, and cyanides. Further, the specific migratory contaminant species present may include any subset or combination of the above-described species.

Figure 2A:
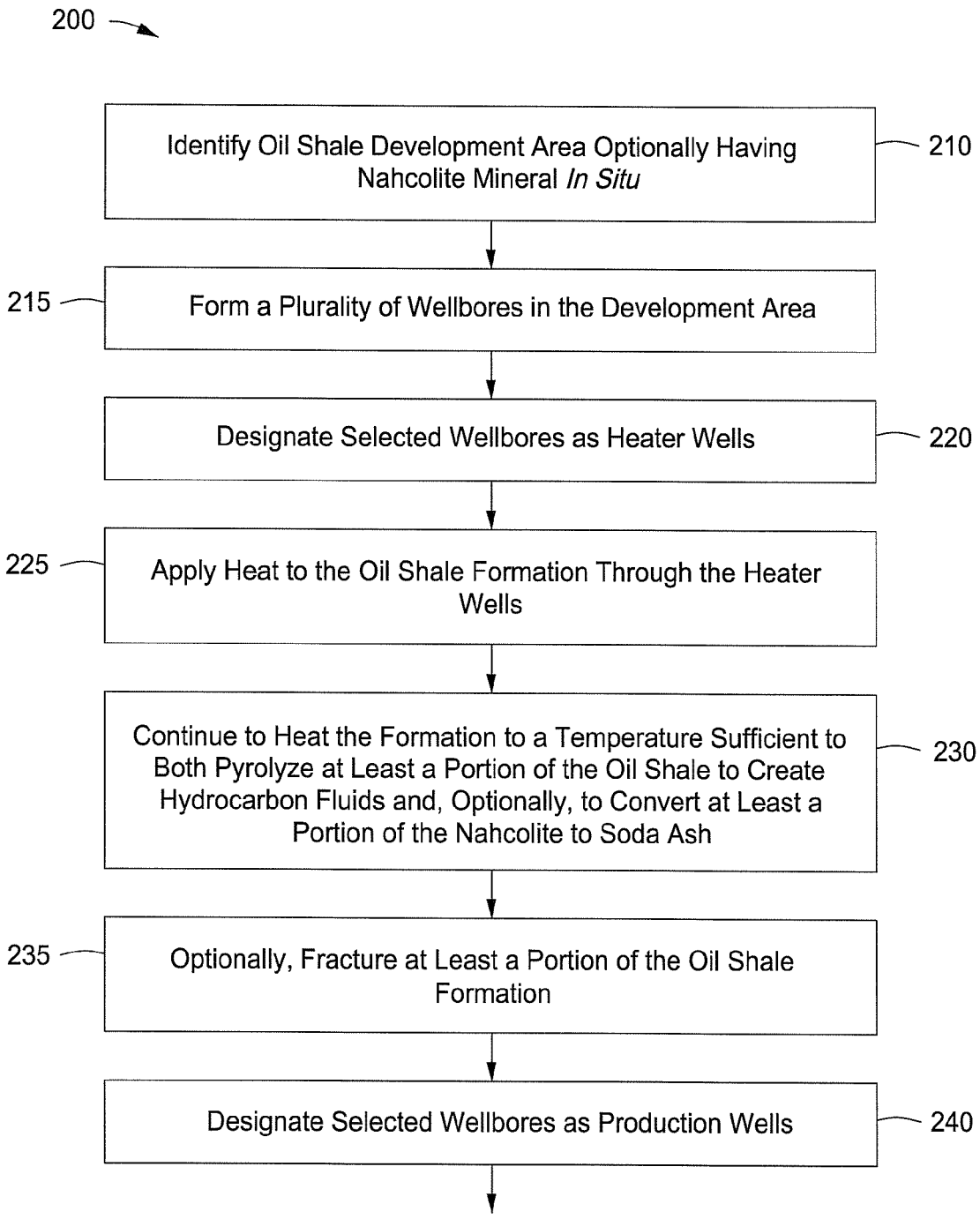
FIGS. 2A-2B present a unified flow chart demonstrating a general method of in situ thermal recovery of oil and gas from an organic-rich rock formation, in one embodiment.
Figure 2B:
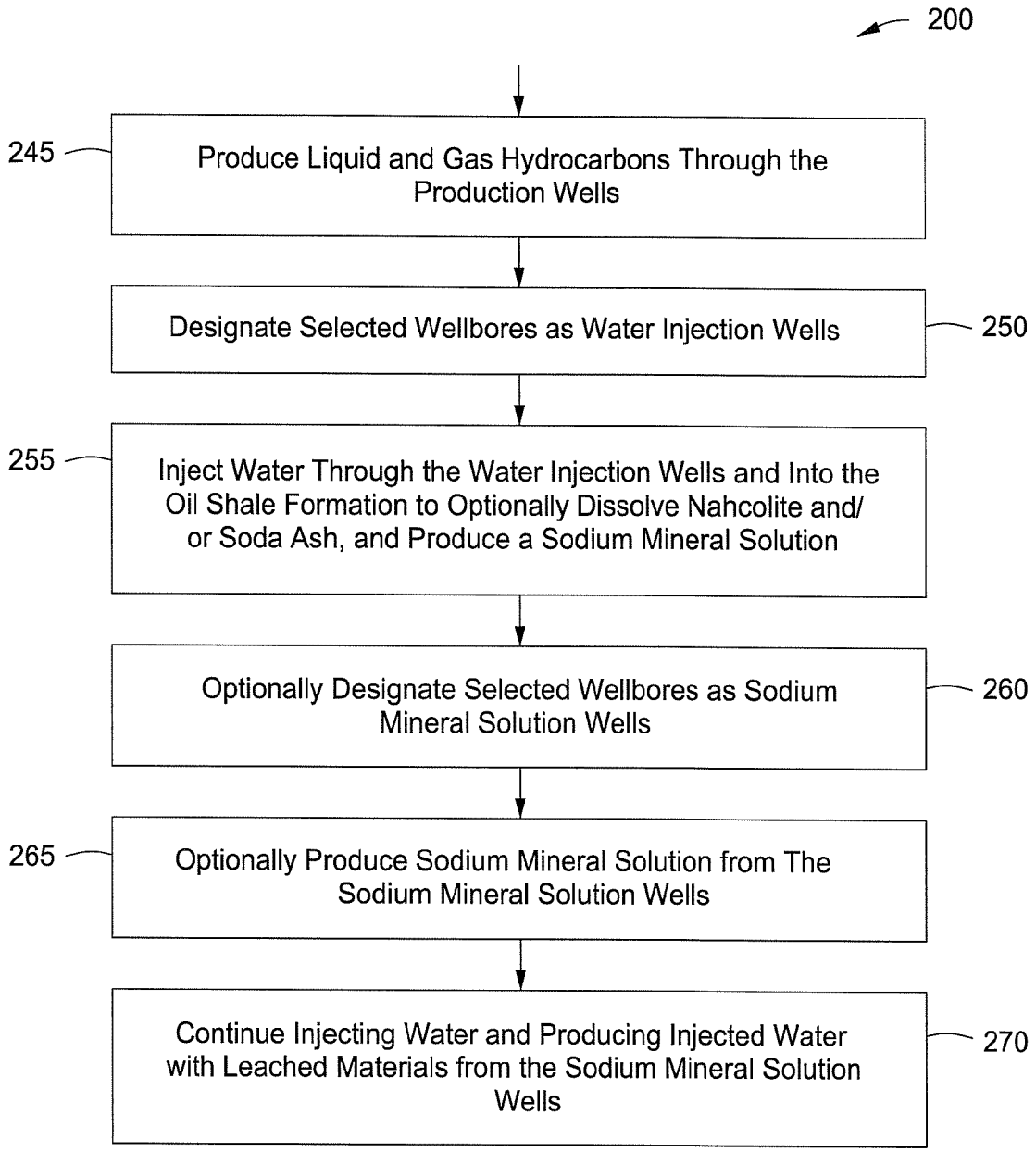

In order to recover oil, gas, and sodium (or other water-soluble minerals), a series of steps may be undertaken. FIG. 2 presents a flow chart demonstrating a method 200 of in situ thermal recovery of oil and gas from an organic-rich rock formation, in one embodiment. It is understood that the order of some of the steps from FIG. 2 may be changed, and that the sequence of steps is merely for illustration.

First, an oil shale development area 12 is identified. This step is shown in Box 210. The oil shale development area includes an oil shale (or other organic-rich rock) formation 22. Optionally, the oil shale formation 22 contains nahcolite or other sodium minerals.

The targeted development area 12 within the oil shale formation 22 may be identified by measuring or modeling the depth, thickness and organic richness of the oil shale as well as evaluating the position of the formation 22 relative to other rock types, structural features (e.g. faults, anticlines or synclines), or hydrogeological units (i.e. aquifers). This is accomplished by creating and interpreting maps and/or models of depth, thickness, organic richness and other data from available tests and sources. This may involve performing geological surface surveys, studying outcrops, performing seismic surveys, and/or drilling boreholes to obtain core samples from subsurface rock.

In some fields, formation hydrocarbons, such as oil shale, may exist in more than one subsurface formation. In some instances, the organic-rich rock formations may be separated by rock layers that are hydrocarbon-free or that otherwise have little or no commercial value. Therefore, it may be desirable for the operator of a field under hydrocarbon development to undertake an analysis as to which of the subsurface, organic-rich rock formations to target or in which order they should be developed.

The organic-rich rock formation may be selected for development based on various factors. One such factor is the thickness of the hydrocarbon-containing layer within the formation. Greater pay zone thickness may indicate a greater potential volumetric production of hydrocarbon fluids. Each of the hydrocarbon-containing layers may have a thickness that varies depending on, for example, conditions under which the formation hydrocarbon-containing layer was formed. Therefore, an organic-rich rock formation 22 will typically be selected for treatment if that formation includes at least one formation hydrocarbon-containing layer having a thickness sufficient for economical production of produced hydrocarbon fluids.

An organic-rich rock formation 22 may also be chosen if the thickness of several layers that are closely spaced together is sufficient for economical production of produced fluids. For example, an in situ conversion process for formation hydrocarbons may include selecting and treating a layer within an organic-rich rock formation having a thickness of greater than about 5 meters, 10 meters, 50 meters, or even 100 meters. In this manner, heat losses (as a fraction of total injected heat) to layers formed above and below an organic-rich rock formation may be less than such heat losses from a thin layer of formation hydrocarbons. A process as described herein, however, may also include selecting and treating layers that may include layers substantially free of formation hydrocarbons or thin layers of formation hydrocarbons.

The richness of one or more organic-rich rock formations may also be considered. For an oil shale formation, richness is generally a function of the kerogen content. The kerogen content of an oil shale formation may be ascertained from outcrop or core samples using a variety of data. Such data may include organic carbon content, hydrogen index, and modified Fischer assay analyses. The Fischer Assay is a standard method which involves heating a sample of a formation hydrocarbon containing layer to approximately 500° C. in one hour, collecting fluids produced from the heated sample, and quantifying the amount of fluids produced.

Richness may depend on many factors including the conditions under which the formation hydrocarbon-containing layer was formed, an amount of formation hydrocarbons in the layer, and/or a composition of formation hydrocarbons in the layer. A thin and rich formation hydrocarbon layer may be able to produce significantly more valuable hydrocarbons than a much thicker, less rich formation hydrocarbon layer. Of course, producing hydrocarbons from a formation that is both thick and rich is desirable.

Subsurface formation permeability may also be assessed via rock samples, outcrops, or studies of ground water flow. Furthermore the connectivity of the development area to ground water sources may be assessed. Thus, an organic-rich rock formation may be chosen for development based on the permeability or porosity of the formation matrix even if the thickness of the formation is relatively thin. Reciprocally, an organic-rich rock formation may be rejected if there appears to be vertical continuity with groundwater.

Other factors known to petroleum engineers may be taken into consideration when selecting a formation for development. Such factors include depth of the perceived pay zone, continuity of thickness, and other factors. For instance, the assessed fluid production content within a formation will also effect eventual volumetric production.

Next, a plurality of wellbores 14, 16 is formed across the targeted development area 10. This step is shown schematically in Box 215. For purposes of the wellbore formation step of Box 215, only a portion of the wellbores need be completed initially. For instance, at the beginning of the project, heat injection wells are needed, while a majority of the hydrocarbon production wells are not yet needed. Production wells may be brought in once conversion begins, such as after 4 to 12 months of heating.

The purpose for heating the organic-rich rock formation is to pyrolyze at least a portion of the solid formation hydrocarbons to create hydrocarbon fluids. The solid formation hydrocarbons may be pyrolyzed in situ by raising the organic-rich rock formation, (or heated zones within the formation), to a pyrolyzation temperature. In certain embodiments, the temperature of the formation may be slowly raised through the pyrolysis temperature range. For example, an in situ conversion process may include heating at least a portion of the organic-rich rock formation to raise the average temperature of the zone above about 27° C. at a rate less than a selected amount (e.g., about 10° C., 5° C.; 3° C., 1° C., 0.5° C., or 0.1° C.) per day. In a further embodiment, the portion may be heated such that an average temperature of the selected zone may be less than about 375° C. or, in some embodiments, less than about 40° C.

The formation may be heated such that a temperature within the formation reaches (at least) an initial pyrolyzation temperature, that is, a temperature at the lower end of the temperature range where pyrolyzation begins to occur. The pyrolysis temperature range may vary depending on the types of formation hydrocarbons within the formation, the heating methodology, and the distribution of heating sources. For example, a pyrolysis temperature range may include temperatures between about 270° C. and about 900° C. Alternatively, the bulk of the target zone of the formation may be heated to between 300° to 600° C. In an alternative embodiment, a pyrolysis temperature range may include temperatures between about 270° C. to about 500° C.

It is understood that petroleum engineers will develop a strategy for the best depth and arrangement for the wellbores 14, 16, depending upon anticipated reservoir characteristics, economic constraints, and work scheduling constraints. In addition, engineering staff will determine what wellbores 14 or 16 shall be used for initial formation 22 heating. This selection step is represented by Box 220.

Concerning heat injection wells, there are various methods for applying heat to the organic-rich rock formation 22. The methods disclosed herein are not limited to the heating technique employed so long as heating within the formation is non-oxidative. The heating step is represented generally by Box 225.

The organic-rich rock formation 22 is heated to a temperature sufficient to pyrolyze at least a portion of the oil shale in order to convert the kerogen to hydrocarbon fluids. The conversion step is represented in FIG. 2 by Box 230. The resulting liquids and hydrocarbon gases may be refined into products which resemble common commercial petroleum products. Such liquid products include transportation fuels such as diesel, jet fuel, and naphtha. Generated gases include light alkanes, light alkenes, $H_2$, $CO_2$, CO, and $NH_3$.

Preferably, for in situ processes the heating and conversion processes of Boxes 225 and 230, occur over a lengthy period of time. In one aspect, the heating period is from three months to four or more years. Alternatively, the formation may be heated for one to fifteen years, alternatively, 3 to 10 years, 1.5 to 7 years, or 2 to 5 years. Also as an optional part of Box 230, the formation 22 may be heated to a temperature sufficient to convert at least a portion of nahcolite, if present, to soda ash. In this respect, heat applied to mature the oil shale and recover oil and gas will also convert nahcolite to sodium carbonate (soda ash), a related sodium mineral. The process of converting nahcolite (sodium bicarbonate) to soda ash (sodium carbonate) is described herein.

Some production procedures include in situ heating of an organic-rich rock formation that contains both formation hydrocarbons and formation water-soluble minerals prior to substantial removal of the formation water-soluble minerals from the organic-rich rock formation. In some embodiments of the invention there is no need to partially, substantially or completely remove the water-soluble minerals prior to in situ heating.

Conversion of oil shale into hydrocarbon fluids may increase permeability in rocks in the formation 22 that were originally substantially impermeable. For example, permeability may increase due to formation of thermal fractures within a heated portion caused by application of heat. As the temperature of the heated portion increases, water may be removed due to vaporization. The vaporized water may escape and/or be removed from the formation. In addition, permeability of the heated portion may also increase as a result of production of hydrocarbon fluids from pyrolysis of at least some of the formation hydrocarbons within the heated portion on a macroscopic scale.

In one embodiment, the organic-rich rock formation has an initial total permeability less than 1 millidarcy, alternatively less than 0.1 or 0.01 millidarcies, before heating the organic-rich rock formation. Permeability of a selected zone within the heated portion of the organic-rich rock formation 22 may rapidly increase while the selected zone is heated by conduction. For example, pyrolyzing at least a portion of organic-rich rock formation may increase permeability within a selected zone of the portion to about 1 millidarcy, alternatively, greater than about 10 millidarcies, 50 millidarcies, 100 millidarcies, 1 Darcy, 10 Darcies, 20 Darcies, or 50 Darcies. Therefore, a permeability of a selected zone of the portion may increase by a factor of more than about 10, 100, 1,000, 10,000, or 100,000.

In connection with the heating step 225, the organic-rich rock formation 22 may optionally be fractured to aid heat transfer or later hydrocarbon fluid production. The optional fracturing step is shown in Box 235. Fracturing may be accomplished by creating thermal fractures within the formation through the application of heat. Thermal fracturing can occur both in the immediate region undergoing heating, and in cooler neighboring regions. The thermal fracturing in the neighboring regions is due to propagation of fractures and tension stresses developed due to the expansion in the hotter zones. Thus, by both heating the organic-rich rock and transforming the kerogen to oil and gas, the permeability is increased not only from fluid formation and vaporization, but also via thermal fracture formation. The increased permeability aids fluid flow within the formation and production of the hydrocarbon fluids generated from the kerogen.

Alternatively, a process known as hydraulic fracturing may be used. Hydraulic fracturing is a process known in the art of oil and gas recovery where an injection fluid is pressurized within the wellbore above the fracture pressure of the formation, thus developing fracture planes within the formation to relieve the pressure generated within the wellbore. Hydraulic fractures may be used to create additional permeability in portions of the formation 22 and/or be used to provide a planar source for heating.

Patent publication U.S. Pat. No. 7,331,385 entitled "Methods of Treating a Subterranean Formation to Convert Organic Matter into Producible Hydrocarbons" describes one use of hydraulic fracturing, and is incorporated herein by reference in its entirety. This patent publication teaches the use of electrically conductive fractures to heat oil shale. A heating element is constructed by forming wellbores and then hydraulically fracturing the oil shale formation around the wellbores. The fractures are filled with an electrically conductive material which forms the heating element. Calcined petroleum coke is an exemplary suitable conductant material. Preferably, the fractures are created in a vertical orientation extending from horizontal wellbores. Electricity may be conducted through the conductive fractures from the heel to the toe of each well. The electrical circuit may be completed by an additional horizontal well that intersects one or more of the vertical fractures near the toe to supply the opposite electrical polarity. The U.S. Pat. No. 7,331,385 process creates an "in situ toaster" that artificially matures oil shale through the application of electric heat. Thermal conduction heats the oil shale to conversion temperatures in excess of 300° C., causing artificial maturation.

Patent publication U.S. Pat. No. 7,441,603 teaches an alternative heating means that employs the circulation of a heated fluid within an oil shale formation. In the process of U.S. Pat. No. 7,441,603, supercritical heated naphtha may be circulated through fractures in the formation. This means that the oil shale is heated by circulating a dense, hot hydrocarbon vapor through sets of closely-spaced hydraulic fractures. In one aspect, the fractures are horizontally formed and conventionally propped. Fracture temperatures of 320°-400° C. are maintained for up to five to ten years. Vaporized naphtha may be the preferred heating medium due to its high volumetric heat capacity, ready availability and relatively low degradation rate at the heating temperature. In the U.S. Pat. No. 7,441,603 process, as the kerogen matures, fluid pressure will drive the generated oil to the heated fractures, where it will be produced with the cycling hydrocarbon vapor.

As part of the hydrocarbon fluid production process 200, certain wellbores 16 may be designated as oil and gas production wells. This step is depicted by Box 240. Oil and gas production might not be initiated until it is determined that the kerogen has been sufficiently retorted to allow a steady flow of oil and gas from the formation 22. In some instances, dedicated production wells are not drilled until after heat injection wells 14 (Box 230) have been in operation for a period of several weeks or months. Thus, Box 240 may include the formation of additional wellbores 16 for production. In other instances, selected heater wells are converted to production wells.

After certain wellbores 16 have been designated as oil and gas production wells, oil and/or gas is produced from the wellbores 16. The oil and/or gas production process is shown at Box 245. At this stage (Box 245), any water-soluble minerals, such as nahcolite and converted soda ash likely remain substantially trapped in the organic-rich rock formation 22 as finely disseminated crystals or nodules within the oil shale beds, and are not produced. However, some nahcolite and/or soda ash may be dissolved in the water created during heat conversion (Box 235) within the formation. Thus, production fluids may contain not only hydrocarbon fluids, but also aqueous fluid containing water-soluble minerals. In such a case, the production fluids may be separated into a hydrocarbon stream and an aqueous stream at a production fluids processing facility 60. Thereafter, the water-soluble minerals and any migratory contaminant species may be recovered from the aqueous stream as discussed more fully below.

Box 250 presents an optional next step in the oil and gas recovery method 100. Here, certain wellbores 14 are designated as water or aqueous fluid injection wells. This is preferably done after the production wells have ceased operation.

The aqueous fluids used for the injection wells are solutions of water with other species. The water may constitute "brine," and may include dissolved inorganic salts of chloride, sulfates and carbonates of Group I and II elements of The Periodic Table of Elements. Organic salts can also be present in the aqueous fluid. The water may alternatively be fresh water containing other species. The other species may be present to alter the pH. Alternatively, the other species may reflect the availability of brackish water not saturated in the species wished to be leached from the subsurface. Preferably, wellbores 14 used for the water injection wells are selected from some or all of the wellbores initially used for heat injection or for oil and/or gas production. However, the scope of the step of Box 250 may include the drilling of yet additional wellbores 14 for use as dedicated water injection wells.

It is noted that in the arrangement of FIG. 1, the wellbores 14 for the water injection wells are completed along a periphery of the development area 10. This serves to create a boundary of high pressure. However, as discussed above other arrangements for water injection wells may be employed.

Next, water or an aqueous fluid is injected through the water injection wells and into the oil shale formation 22. This step is shown at Box 255. The water may be in the form of steam or pressurized hot water. Alternatively the injected water may be cool and becomes heated as it contacts the previously heated formation. The injection process may further induce fracturing. This process may create fingered caverns and brecciated zones in the nahcolite-bearing intervals some distance, for example up to 200 feet out, from the water injection wellbores 14. In one aspect, a gas cap, such as nitrogen, may be maintained at the top of each "cavern" to prevent vertical growth.

Along with the designation of certain wellbores 14 as water injection wells, the design engineers may also designate certain wellbores 16 as water production wells. This step is shown in Box 260. These wells may be the same as wells used to previously produce hydrocarbons. The water production wells may be used to produce an aqueous solution of dissolved water-soluble minerals. For example, the solution may be one primarily of dissolved soda ash. This step is shown in Box 265. Alternatively, single wellbores may be used to both inject water and then later to recover a sodium mineral solution. Thus, Box 265 includes the option of using the same wellbores 14 for both water injection and water or aqueous solution production (Box 265).

The use of wellbores for more than one purpose helps to lower project costs and/or decrease the time required to perform certain tasks. For example, one or more of the production wells may also be used as injection wells for later injecting water into the organic-rich rock formation. Alternatively, one or more of the production wells may also be used as water production wells for later circulating an aqueous solution through the organic-rich rock formation in order to leach out migratory contaminant species.

In other aspects, production wells (and in some circumstances heater wells) may initially be used as dewatering wells (e.g., before heating is begun and/or when heating is initially started). In addition, in some circumstances dewatering wells can later be used as production wells (and in some circumstances heater wells). As such, the dewatering wells may be placed and/or designed so that such wells can be later used as production wells and/or heater wells. The heater wells may be placed and/or designed so that such wells can be later used as production wells and/or dewatering wells. The production wells may be placed and/or designed so that such wells can be later used as dewatering wells and/or heater wells. Similarly, injection wells may be wells that initially were used for other purposes (e.g., heating, production, dewatering, monitoring, etc.), and injection wells may later be used for other purposes. Similarly, monitoring wells may be wells that initially were used for other purposes (e.g., heating, production, dewatering, injection, etc.). Finally, monitoring wells may later be used for other purposes such as water production.

Removal of water-soluble minerals may represent the degree of removal of a water-soluble mineral that occurs from any commercial solution mining operation as known in the art. Substantial removal of a water-soluble mineral may be approximated as removal of greater than 5 weight percent of the total amount of a particular water-soluble mineral present in the zone targeted for hydrocarbon fluid production in the organic-rich rock formation. In alternative embodiments, in situ heating of the organic-rich rock formation to pyrolyze formation hydrocarbons may be commenced prior to removal of greater than 3 weight percent, alternatively 7 weight percent, 10 weight percent or 13 weight percent of the formation water-soluble minerals from the organic-rich rock formation.

The water-soluble minerals may include sodium. The water-soluble minerals may also include nahcolite (sodium bicarbonate), soda ash (sodium carbonate), dawsonite ($NaAl(CO_3)(OH)_2$), or combinations thereof. The surface processing may further include converting the soda ash back to sodium bicarbonate (nahcolite) in the surface facility by reaction with $CO_2$.

The step of producing a sodium mineral solution (Box 265) may include processing an aqueous solution containing water-soluble minerals in a surface facility to remove a portion of the water-soluble minerals therein. The processing step may include removing the water-soluble minerals by precipitation caused by altering the temperature of the aqueous solution.

The impact of heating oil shale to produce oil and gas prior to producing nahcolite is to convert the nahcolite to a more recoverable form (soda ash), and provide permeability facilitating its subsequent recovery. Water-soluble mineral recovery may take place as soon as the retorted oil is produced, or it may be left for a period of years for later recovery. If desired, the soda ash can be readily converted back to nahcolite on the surface. The ease with which this conversion can be accomplished makes the two minerals effectively interchangeable.

During the pyrolysis process, migration of hydrocarbon fluids and migratory contaminant species may be contained by creating a peripheral area in which the temperature of the formation is maintained below a pyrolysis temperature. Preferably, temperature of the formation is maintained below the freezing temperature of in situ water. The use of subsurface freezing to stabilize poorly consolidated soils or to provide a barrier to fluid flow is known in the art. Shell Exploration and Production Company has discussed the use of freeze walls for oil shale production in several patents, including U.S. Pat. No.

6,880,633 and U.S. Pat. No. 7,032,660. Shell's '660 patent uses subsurface freezing to protect against groundwater flow and groundwater contamination during in situ shale oil production. Additional patents that disclose the use of so-called freeze walls are U.S. Pat. No. 3,528,252, U.S. Pat. No. 3,943,722, U.S. Pat. No. 3,729,965, U.S. Pat. No. 4,358,222, and U.S. Pat. No. 4,607,488.

Freeze walls may be formed by circulating refrigerant through peripheral wells to substantially reduce the temperature of the rock formation 22. This, in turn, prevents the pyrolyzation of kerogen present at the periphery of the field and the outward migration of oil and gas. Freeze walls will also cause native water in the formation along the periphery to freeze. This serves to prevent the migration of pyrolyzed fluids into ground water outside of the field.

Once production of hydrocarbons begins, control of the migration of hydrocarbons and migratory contaminant species can also be obtained via selective placement of injection 16 and production wells 14 such that fluid flow out of the heated zone is minimized. Typically, this involves placing injection wells at the periphery of the heated zone so as to cause pressure gradients which prevent flow inside the heated zone from leaving the zone. The injection wells may inject water, steam, $CO_2$, heated methane, or other fluids to drive cracked kerogen fluids inwardly towards production wells.

After partial or complete removal of the water-soluble minerals, the aqueous solution may be reinjected into a subsurface formation where it may be sequestered. The subsurface formation may be the same as or different from the original organic-rich rock formation.

Figure 3:
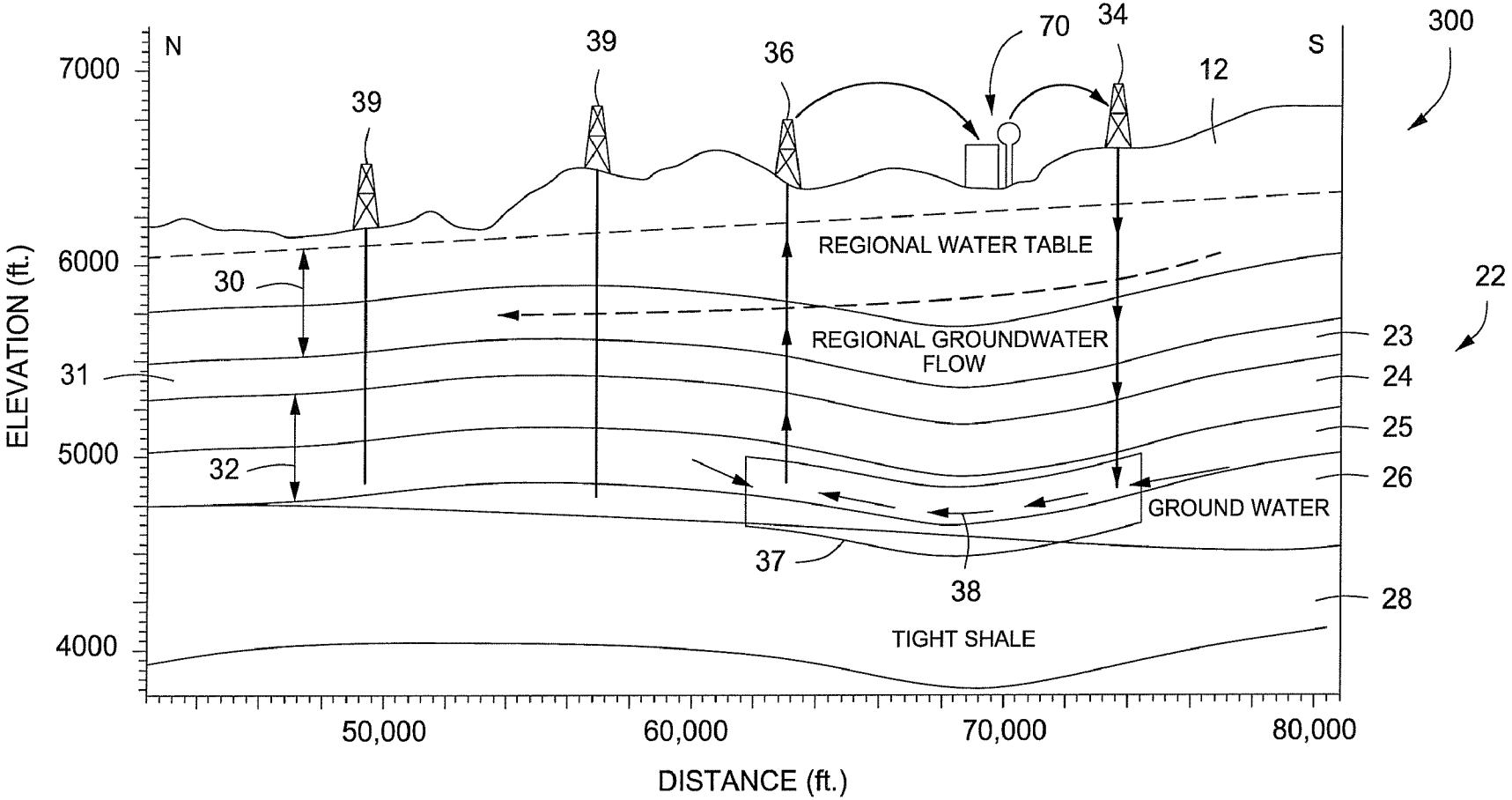
FIG. 3 is cross-sectional side view of an illustrative oil shale formation that is within or connected to groundwater aquifers, and a formation leaching operation.

The circulation of water through a shale oil formation is shown in one embodiment in FIG. 3. FIG. 3 presents a field 300 under hydrocarbon development. FIG. 3 is a cross-sectional view of an illustrative oil shale formation 22 within the field 300. The formation 22 is within or connected to ground water aquifers and a formation leaching operation. Four separate oil shale formation zones 23, 24, 25, and 26 are depicted within the oil shale formation. The water aquifers are below the ground surface 12, and are categorized as an upper aquifer 30 and a lower aquifer 32. Intermediate the upper 30 and lower 32 aquifers is an aquitard 31. It can be seen that certain zones of the formation 22 are both aquifers or aquitards and oil shale zones. A pair of wells 34, 36 is shown traversing vertically downward through the aquifers 30, 32. One of the wells is serving as a water injection well 34, while another is serving as a water production well 36. In this way, water is circulated 38 through at least the lower aquifer 32.

FIG. 3 shows diagrammatically water circulating 38 through an oil shale volume 37 that was heated, that resides within or is connected to the lower aquifer 32, and from which hydrocarbon fluids were previously recovered. Introduction of water via the water injection well 34 forces water into the previously heated oil shale 37. Water-soluble minerals and migratory contaminants species are then swept to the water production well 36. The water may then be processed in a water treatment facility (not shown) wherein the water-soluble minerals (e.g. nahcolite or soda ash) and the migratory contaminants may be substantially removed from the water stream. The migratory contaminant species may be removed through use of, for example, an adsorbent material, reverse osmosis, chemical oxidation, bio-oxidation, and/or ion exchange. Examples of these processes are individually known in the art. Exemplary adsorbent materials may include activated carbon, clay, or fuller's earth.

In one aspect, an operator may calculate a pore volume of the oil shale formation after hydrocarbon production is completed. The operator will then circulate an amount of water equal to one pore volume for the primary purpose of producing the aqueous solution of dissolved soda ash and other water-soluble sodium minerals. The operator may then circulate an amount of water equal to two, three, four or even five additional pore volumes for the purpose of leaching out any remaining water-soluble minerals and other non-aqueous species, including, for example, remaining hydrocarbons and migratory contaminant species. The produced water is carried through the water treatment facility. The step of injecting water and then producing the injected water with leached minerals is demonstrated in Box 270.

Water is reinjected into the oil shale volume 37 until levels of migratory contaminant species are at environmentally acceptable levels within the previously heated oil shale zone 37. This may require one cycle, two cycles, five cycles or more cycles of formation leaching, where a single cycle indicates injection and production of approximately one pore volume of water.

The injected water may be treated to increase the solubility of the migratory contaminant species and/or the water-soluble minerals. The adjustment may include the addition of an acid or base to adjust the pH of the solution. The resulting aqueous solution may then be produced from the organic-rich rock formation to the surface for processing.

The circulation of water through the oil shale volume 37 is preferably completed after a substantial portion of the hydrocarbon fluids have been produced from the matured organic-rich rock. In some embodiments, the circulation step (Box 170) may be delayed after the hydrocarbon fluid production step (Box 225, 230). The circulation, or "leaching," may be delayed to allow heat generated from the heating step to migrate deeper into surrounding unmatured organic-rich rock zones to convert nahcolite within the surrounding unmatured organic-rich rock zones to soda ash. Alternatively, the leaching may be delayed to allow heat generated from the heating step to generate permeability within the surrounding unmatured organic-rich rock zones. Further, the leaching may be delayed based on current and/or forecast market prices of sodium bicarbonate, soda ash.

It is understood that there may be numerous water injection 34 and water production 36 wells in an actual oil shale development 10. Moreover, the system may include one or more monitoring wells 39 disposed at selected points in the field. The monitoring wells 39 can be utilized during the oil shale heating phase, the shale oil production phase, the leaching phase, or during any combination of these phases to monitor for migratory contaminant species and/or water-soluble minerals. Further, the monitoring wells 39 may be configured with one or more devices that measure a temperature, a pressure, and/or a property of a fluid in the wellbore. In some instances, a production well may also serve as a monitoring well, or otherwise be instrumented.

As noted above, several different types of wells may be used in the development of an organic-rich rock formation, including, for example, an oil shale field. For example, the heating of the organic-rich rock formation may be accomplished through the use of heater wells. The heater wells may include, for example, electrical resistance heating elements. An early patent disclosing the use of electrical resistance heaters to produce oil shale in situ is U.S. Pat. No. 1,666,488. The '488 patent issued to Crawshaw in 1928. Since 1928, various designs for downhole electrical heaters have been proposed. Illustrative designs are presented in U.S. Pat. No. 1,701,884, U.S. Pat. No. 3,376,403, U.S. Pat. No. 4,626,665, U.S. Pat. No. 4,704,514, and U.S. Pat. No. 6,023,554).

In one aspect, an electrically resistive heater may be formed by providing electrically resistive piping or materials within multiple wellbores. A conductive granular material is then placed between two or three adjacent wellbores, and a current is passed between the wellbores. Passing current through the wellbores causes resistive heat to be generated primarily from elongated conduits or resistive granular material within the wellbores. In another aspect, the resistive heat is generated primarily from electrically conductive material injected into the formation between the adjacent wellbores. An electrical current is passed through the conductive material between the two wellbores so that electrical energy is converted to thermal energy. In either instance, thermal energy is transported to the formation by thermal conduction to heat the organic-rich rocks.

The use of electrical resistors in which an electrical current is passed through a resistive material which dissipates the electrical energy as heat is distinguished from dielectric heating in which a high-frequency oscillating electric current induces electrical currents in nearby materials and causes them to heat.

Co-owned U.S. Pat. Pub. 2010-0101793 is also instructive. That application was filed on Aug. 28, 2009 and is entitled "Electrically Conductive Methods for Heating a Subsurface Formation to Convert Organic Matter into Hydrocarbon Fluids." The application teaches the use of two or more materials placed within an organic-rich rock formation and having varying properties of electrical resistance. An electrical current is passed through the materials in the formation to generate resistive heat. The materials placed in situ provide for resistive heat without creating hot spots near the wellbores. This patent application is incorporated herein by reference in its entirety.

It is desirable to arrange the heater wells and production wells for an oil shale field in a pre-planned pattern. For instance, heater wells may be arranged in a variety of patterns including, but not limited to triangles, squares, hexagons, and other polygons. The pattern may include a regular polygon to promote uniform heating through at least the portion of the formation in which the heater wells are placed. The pattern may also be a line drive pattern. A line drive pattern generally includes a first linear array of heater wells, a second linear array of heater wells, and a production well or a linear array of production wells between the first and second linear array of heater wells.

The arrays of heater wells may be disposed such that a distance between each heater well is less than about 70 feet (21 meters). A portion of the formation may be heated with heater wells disposed substantially parallel to a boundary of the hydrocarbon formation. In alternative embodiments, the array of heater wells may be disposed such that a distance between each heater well may be less than about 100 feet, or 50 feet, or 30 feet. Regardless of the arrangement of or distance between the heater wells, in certain embodiments, a ratio of heater wells to production wells disposed within a organic-rich rock formation may be greater than about 5, 8, 10, 20, or more.

Interspersed among the heater wells are typically one or more production wells. The injection wells may likewise be disposed within a repetitive pattern of units, which may be similar to or different from that used for the heater wells. In one embodiment, individual production wells are surrounded by at most one layer of heater wells. This may include arrangements such as 5-spot, 7-spot, or 9-spot arrays, with alternating rows of production and heater wells. In another embodiment, two layers of heater wells may surround a production well, but with the heater wells staggered so that a clear pathway exists for the majority of flow away from the further heater wells. Flow and reservoir simulations may be employed to assess the pathways and temperature history of hydrocarbon fluids generated in situ as they migrate from their points of origin to production wells.

Figure 4:
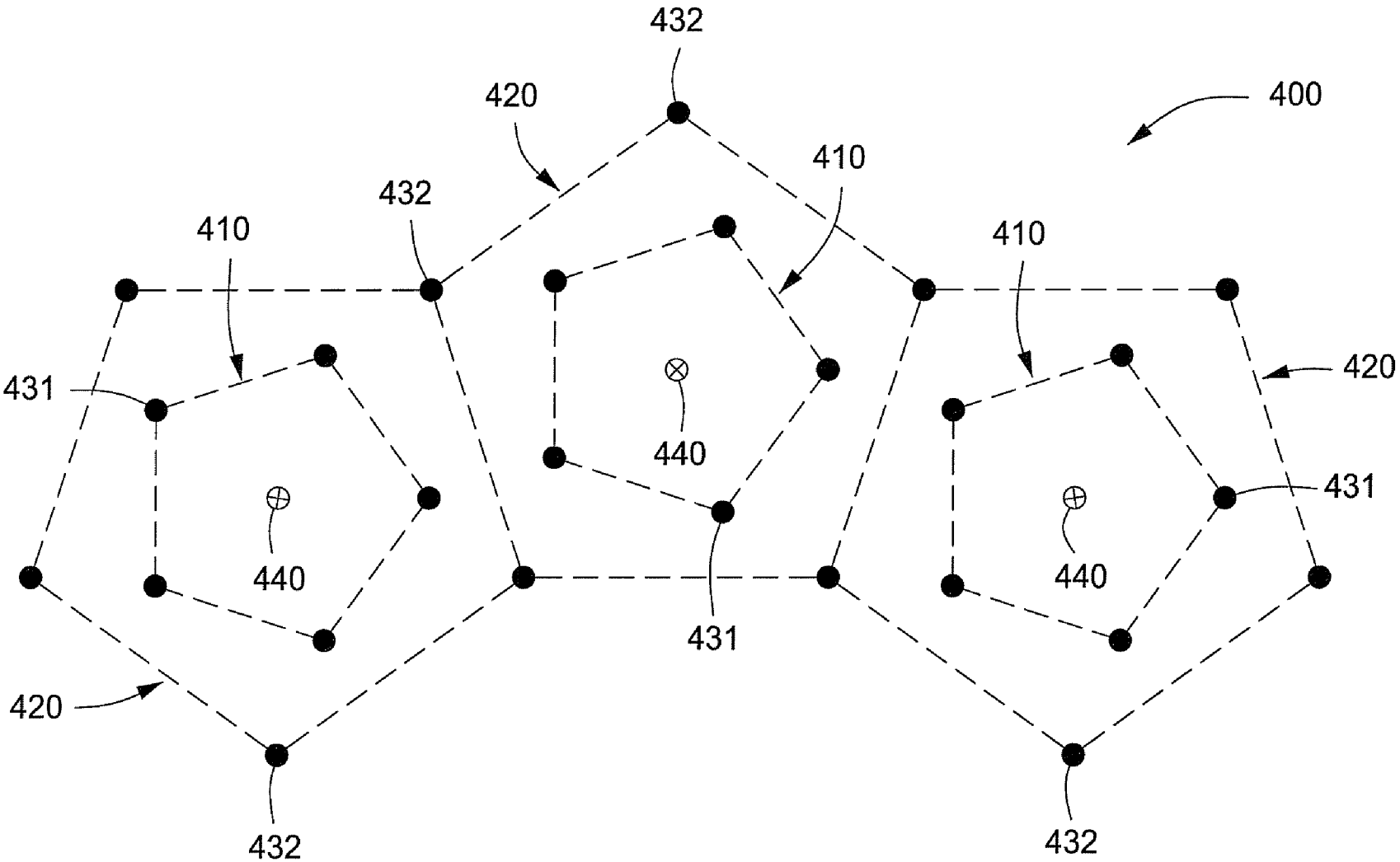
FIG. 4 provides a plan view of an illustrative heater well pattern. Two layers of heater wells are shown surrounding respective production wells.

FIG. 4 provides a plan view of an illustrative heater well arrangement using more than one layer of heater wells. The heater well arrangement is used in connection with the production of hydrocarbons from a shale oil development area 400. In FIG. 4, the heater well arrangement employs a first layer of heater wells 410, surrounded by a second layer of heater wells 420. The heater wells in the first layer 410 are referenced at 431, while the heater wells in the second layer 420 are referenced at 432.

A production well 440 is shown central to the well layers 410 and 420. It is noted that the heater wells 432 in the second layer 420 of wells are offset from the heater wells 431 in the first layer 410 of wells, relative to the production well 440. The purpose is to provide a flowpath for converted hydrocarbons that minimizes travel near a heater well in the first layer 410 of heater wells. This, in turn, minimizes secondary cracking of hydrocarbons converted from kerogen as hydrocarbons flow from the second layer of wells 420 to the production wells 440. The heater wells 431, 432 in the two layers 410, 420 further may be arranged such that the majority of hydrocarbons generated by heat from each heater well 432 in the second layer 420 are able to migrate to the production well 440 without passing through a zone of substantially increasing formation temperature.

In the illustrative arrangement of FIG. 4, the first layer 410 and the second layer 420 each defines a 5-spot pattern. However, it is understood that other patterns may be employed, such as 3-spot or 6-spot patterns. In any instance, a plurality of heater wells 431 comprising a first layer of heater wells 410 is placed around a production well 440, with a second plurality of heater wells 432 comprising a second layer of heater wells 420 placed around the first layer 410.

In some instances, it may be desirable to use well patterns that are elongated in a particular direction, particularly in the direction of most efficient thermal conductivity. Heat convection may be affected by various factors such as bedding planes and stresses within the formation. For instance, heat convection may be more efficient in the direction perpendicular to the least horizontal principal stress on the formation. In some instanced, heat convection may be more efficient in the direction parallel to the least horizontal principal stress. Elongation may be practiced in, for example, line drive patterns or spot patterns.

In connection with the development of an oil shale field, it may be desirable that the progression of heat through the subsurface in accordance with steps 225 and 230 be uniform. However, for various reasons the heating and maturation of formation hydrocarbons in a subsurface formation may not proceed uniformly despite a regular arrangement of heater and production wells. Heterogeneities in the oil shale properties and formation structure may cause certain local areas to be more or less productive. Moreover, formation fracturing which occurs due to the heating and maturation of the oil shale can lead to an uneven distribution of preferred pathways and, thus, increase flow to certain production wells and reduce flow to others. Uneven fluid maturation may be an undesirable condition since certain subsurface regions may receive more heat energy than necessary where other regions receive less than desired. This, in turn, leads to the uneven flow and recovery of production fluids. Produced oil quality, overall production rate, and/or ultimate recoveries may be reduced.

To detect uneven flow conditions, production and heater wells may be instrumented with sensors. Sensors may include equipment to measure temperature, pressure, flow rates, and/or compositional information. Data from these sensors can be processed via simple rules or input to detailed simulations to reach decisions on how to adjust heater and production wells to improve subsurface performance. Production well performance may be adjusted by controlling backpressure or throttling on the well. Heater well performance may also be adjusted by controlling energy input. Sensor readings may also sometimes imply mechanical problems with a well or downhole equipment which requires repair, replacement, or abandonment.

In one embodiment, flow rate, compositional, temperature and/or pressure data are utilized from two or more wells as inputs to a computer algorithm to control heating rate and/or production rates. Unmeasured conditions at or in the neighborhood of the well are then estimated and used to control the well. For example, in situ fracturing behavior and kerogen maturation are estimated based on thermal, flow, and compositional data from a set of wells. In another example, well integrity is evaluated based on pressure data, well temperature data, and estimated in situ stresses. In a related embodiment the number of sensors is reduced by equipping only a subset of the wells with instruments, and using the results to interpolate, calculate, or estimate conditions at uninstrumented wells. Certain wells may have only a limited set of sensors (e.g., wellhead temperature and pressure only) where others have a much larger set of sensors (e.g., wellhead temperature and pressure, bottomhole temperature and pressure, production composition, flow rate, electrical signature, casing strain, etc.).

As noted above, there are various methods for applying heat to an organic-rich rock formation. For example, one method may include electrical resistance heaters disposed in a wellbore or outside of a wellbore. One such method involves the use of electrical resistive heating elements in a cased or uncased wellbore. Electrical resistance heating involves directly passing electricity through a conductive material such that resistive losses cause it to heat the conductive material. Other heating methods include the use of downhole combustors, in situ combustion, radio-frequency (RF) electrical energy, or microwave energy. Still others include injecting a hot fluid into the oil shale formation to directly heat it. The hot fluid may or may not be circulated.

In certain embodiments of the methods of the present invention, downhole burners may be used to heat a targeted oil shale zone. Downhole burners of various design have been discussed in the patent literature for use in oil shale and other largely solid hydrocarbon deposits. Examples include U.S. Pat. No. 2,887,160; U.S. Pat. No. 2,847,071; U.S. Pat. No. 2,895,555; U.S. Pat. No. 3,109,482; U.S. Pat. No. 3,225,829; U.S. Pat. No. 3,241,615; U.S. Pat. No. 3,254,721; U.S. Pat. No. 3,127,936; U.S. Pat. No. 3,095,031; U.S. Pat. No. 5,255,742; and U.S. Pat. No. 5,899,269. Downhole burners operate through the transport of a combustible fuel (typically natural gas) and an oxidizer (typically air) to a subsurface position in a wellbore. The fuel and oxidizer react downhole to generate heat. The combustion gases are removed (typically by transport to the surface, but possibly via injection into the formation). Oftentimes, downhole burners utilize pipe-in-pipe arrangements to transport fuel and oxidizer downhole, and then to remove the flue gas back up to the surface. Some downhole burners generate a flame, while others may not.

The use of downhole burners is an alternative to another form of downhole heat generation called steam generation. In downhole steam generation, a combustor in the well is used to boil water placed in the wellbore for injection into the formation. Applications of the downhole heat technology have been described in F. M. Smith, "A Down-Hole Burner—Versatile Tool for Well Heating," 25$^{th}$ Technical Conference on Petroleum Production, Pennsylvania State University, pp 275-285 (Oct. 19-21, 1966); H. Brandt, W. G. Poynter, and J. D. Hummell, "Stimulating Heavy Oil Reservoirs with Downhole Air-Gas Burners," World Oil, pp. 91-95 (September 1965); and C. I. DePriester and A. J. Pantaleo, "Well Stimulation by Downhole Gas-Air Burner," Journal of Petroleum Technology, pp. 1297-1302 (December 1963).

Downhole burners have advantages over electrical heating methods due to the reduced infrastructure cost. In this respect, there is no need for an expensive electrical power plant and distribution system. Moreover, there is increased thermal efficiency because the energy losses inherently experienced during electrical power generation are avoided.

Few applications of downhole burners exist due to various design issues. Downhole burner design issues include temperature control and metallurgy limitations. In this respect, the flame temperature can overheat the tubular and burner hardware and cause them to fail via melting, thermal stresses, severe loss of tensile strength, or creep. Certain stainless steels, typically with high chromium content, can tolerate temperatures up to ~700° C. for extended periods. (See for example H. E. Boyer and T. L. Gall (eds.), *Metals Handbook*, "Chapter 16: Heat-Resistant Materials", American Society for Metals, (1985.) The existence of flames can cause hot spots within the burner and in the formation surrounding the burner. This is due to radiant heat transfer from the luminous portion of the flame. However, a typical gas flame can produce temperatures up to about 1,650° C. Materials of construction for the burners must be sufficient to withstand the temperatures of these hot spots. The heaters are therefore more expensive than a comparable heater without flames.

For downhole burner applications, heat transfer can occur in one of several ways. These include conduction, convection, and radiative methods. Radiative heat transfer can be particularly strong for an open flame. Additionally, the flue gases can be corrosive due to the $CO_2$ and water content. Use of refractory metals or ceramics can help solve these problems, but typically at a higher cost. Ceramic materials with acceptable strength at temperatures in excess of 900° C. are generally high alumina content ceramics. Other ceramics that may be useful include chrome oxide, zirconia oxide, and magnesium oxide based ceramics.

Heat transfer in a pipe-in-pipe arrangement for a downhole burner can also lead to difficulties. The down going fuel and air will heat exchange with the up going hot flue gases. In a well there is minimal room for a high degree of insulation and hence significant heat transfer is typically expected. This cross heat exchange can lead to higher flame temperatures as the fuel and air become preheated. Additionally, the cross heat exchange can limit the transport of heat downstream of the burner since the hot flue gases may rapidly lose heat energy to the rising cooler flue gases.

Improved downhole burners are offered in co-owned U.S. Pat. Pub. 2008-0283241. That application was filed on Apr. 18, 2008, and is entitled "Downhole Burner Wells for In Situ Conversion of Organic-Rich Formations." The teachings pertaining to improved downhole burner wells are incorporated herein by reference.

In the production of oil and gas resources, it may be desirable to use the produced hydrocarbons as a source of power for ongoing operations. This may be applied to the development of oil and gas resources from oil shale. In this respect, when electrically resistive heaters are used in connection with in situ shale oil recovery, large amounts of power are required.

Electrical power may be obtained from turbines that turn generators. It may be economically advantageous to power the gas turbines by utilizing produced gas from the field. However, such produced gas must be carefully controlled so not to damage the turbine, cause the turbine to misfire, or generate excessive pollutants (e.g., $NO_x$).

One source of problems for gas turbines is the presence of contaminants within the fuel. Contaminants include solids, water, heavy components present as liquids, and hydrogen sulfide. Additionally, the combustion behavior of the fuel is important. Combustion parameters to consider include heating value, specific gravity, adiabatic flame temperature, flammability limits, autoignition temperature, autoignition delay time, and flame velocity. Wobbe Index (WI) is often used as a key measure of fuel quality. WI is equal to the ratio of the lower heating value to the square root of the gas specific gravity. Control of the fuel's Wobbe Index to a target value and range of, for example, ±10% or ±20% can allow simplified turbine design and increased optimization of performance. For example, copending U.S. Patent Pub. No. 2008-0290719 (A Process for Producing Hydrocarbon Fluids Combining In Situ Heating, A Power Plant and A Gas Plant, filed on May 21, 2008) and U.S. Patent Pub. No. 2008-0289819 (Utilization of Low BTU Gas Generated During In Situ Heating of Organic Rich Rock, filed on May 21, 2008) describe exemplary methods incorporating control of fuel quality, including Wobbe Index, the entirety of each of which are hereby incorporated by reference.

Fuel quality control may be useful for shale oil developments where the produced gas composition may change over the life of the field and where the gas typically has significant amounts of $CO_2$, CO, and $H_2$ in addition to light hydrocarbons. Commercial scale oil shale retorting is expected to produce a gas composition that changes with time.

Methods for obtaining a substantially constant gas composition are disclosed in co-owned U.S. Pat. Pub. No. 2009-0308608, That application was filed on Mar. 17, 2009, and is entitled "Field Management for Substantially Constant Composition Gas Generation." The teachings pertaining to incrementally producing wells and sections of a development area in order to maintain a substantially constant gas composition are incorporated herein by reference.

Inert gases in the turbine fuel can increase power generation by increasing mass flow while maintaining a flame temperature in a desirable range. Moreover inert gases can lower flame temperature and thus reduce $NO_x$ pollutant generation. Gas generated from oil shale maturation may have significant $CO_2$ content. Therefore, in certain embodiments of the production processes, the $CO_2$ content of the fuel gas is adjusted via separation or addition in the surface facilities to optimize turbine performance.

Achieving a certain hydrogen content for low-BTU fuels may also be desirable to achieve appropriate burn properties. In certain embodiments of the processes herein, the $H_2$ content of the fuel gas is adjusted via separation or addition in the surface facilities to optimize turbine performance. Adjustment of $H_2$ content in non-shale oil surface facilities utilizing low BTU fuels has been discussed in the patent literature (e.g., U.S. Pat. No. 6,684,644 and U.S. Pat. No. 6,858,049, the entire disclosures of which are hereby incorporated by reference).

As noted, the process of heating formation hydrocarbons within an organic-rich rock formation, for example, by pyrolysis, may generate fluids. The heat-generated fluids may include water which is vaporized within the formation. In addition, the action of heating kerogen produces pyrolysis fluids which tend to expand upon heating. The produced pyrolysis fluids may include not only water, but also, for example, hydrocarbons, oxides of carbon, ammonia, molecular nitrogen, and molecular hydrogen. Therefore, as temperatures within a heated portion of the formation increase, a pressure within the heated portion may also increase as a result of increased fluid generation, molecular expansion, and vaporization of water. Thus, some corollary exists between subsurface pressure in an oil shale formation and the fluid pressure generated during pyrolysis. This, in turn, indicates that formation pressure may be monitored to detect the progress of a kerogen conversion process.

The pressure within a heated portion of an organic-rich rock formation depends on other reservoir characteristics. These may include, for example, formation depth, distance from a heater well, a richness of the formation hydrocarbons within the organic-rich rock formation, the degree of heating, and/or a distance from a producer well.

It may be desirable for the developer of an oil shale field to monitor formation pressure during development. Pressure within a formation may be determined at a number of different locations. Such locations may include, but may not be limited to, at a wellhead and at varying depths within a wellbore. In some embodiments, pressure may be measured at a producer well. In an alternate embodiment, pressure may be measured at a heater well. In still another embodiment, pressure may be measured downhole of a dedicated monitoring well.

The process of heating an organic-rich rock formation to a pyrolysis temperature range will not only increase formation pressure, but will also increase formation permeability. The pyrolysis temperature range should be reached before substantial permeability has been generated within the organic-rich rock formation. An initial lack of permeability may prevent the transport of generated fluids from a pyrolysis zone within the formation. In this manner, as heat is initially transferred from a heater well to an organic-rich rock formation, a fluid pressure within the organic-rich rock formation may increase proximate to that heater well. Such an increase in fluid pressure may be caused by, for example, the generation of fluids during pyrolysis of at least some formation hydrocarbons in the formation.

Alternatively, pressure generated by expansion of pyrolysis fluids or other fluids generated in the formation may be allowed to increase. This assumes that an open path to a production well or other pressure sink does not yet exist in the formation. In one aspect, a fluid pressure may be allowed to increase to or above a lithostatic stress. In this instance, fractures in the hydrocarbon containing formation may form when the fluid pressure equals or exceeds the lithostatic stress. For example, fractures may form from a heater well to a production well. The generation of fractures within the heated portion may reduce pressure within the portion due to the production of produced fluids through a production well.

Once pyrolysis has begun within an organic-rich rock formation, fluid pressure may vary depending upon various factors. These include, for example, thermal expansion of hydrocarbons, generation of pyrolysis fluids, rate of conversion, and withdrawal of generated fluids from the formation. For example, as fluids are generated within the formation, fluid pressure within the pores may increase. Removal of generated fluids from the formation should then decrease the fluid pressure within the near wellbore region of the formation.

In certain embodiments, a mass of at least a portion of an organic-rich rock formation may be reduced due, for example, to pyrolysis of formation hydrocarbons and the production of hydrocarbon fluids from the formation. As such, the permeability and porosity of at least a portion of the formation may increase. Any in situ method that effectively produces oil and gas from oil shale will create permeability in what was originally a very low permeability rock. The extent to which this will occur is illustrated by the large amount of expansion that must be accommodated if fluids generated from kerogen are unable to flow. The concept is illustrated in FIG. 5.

Figure 5:
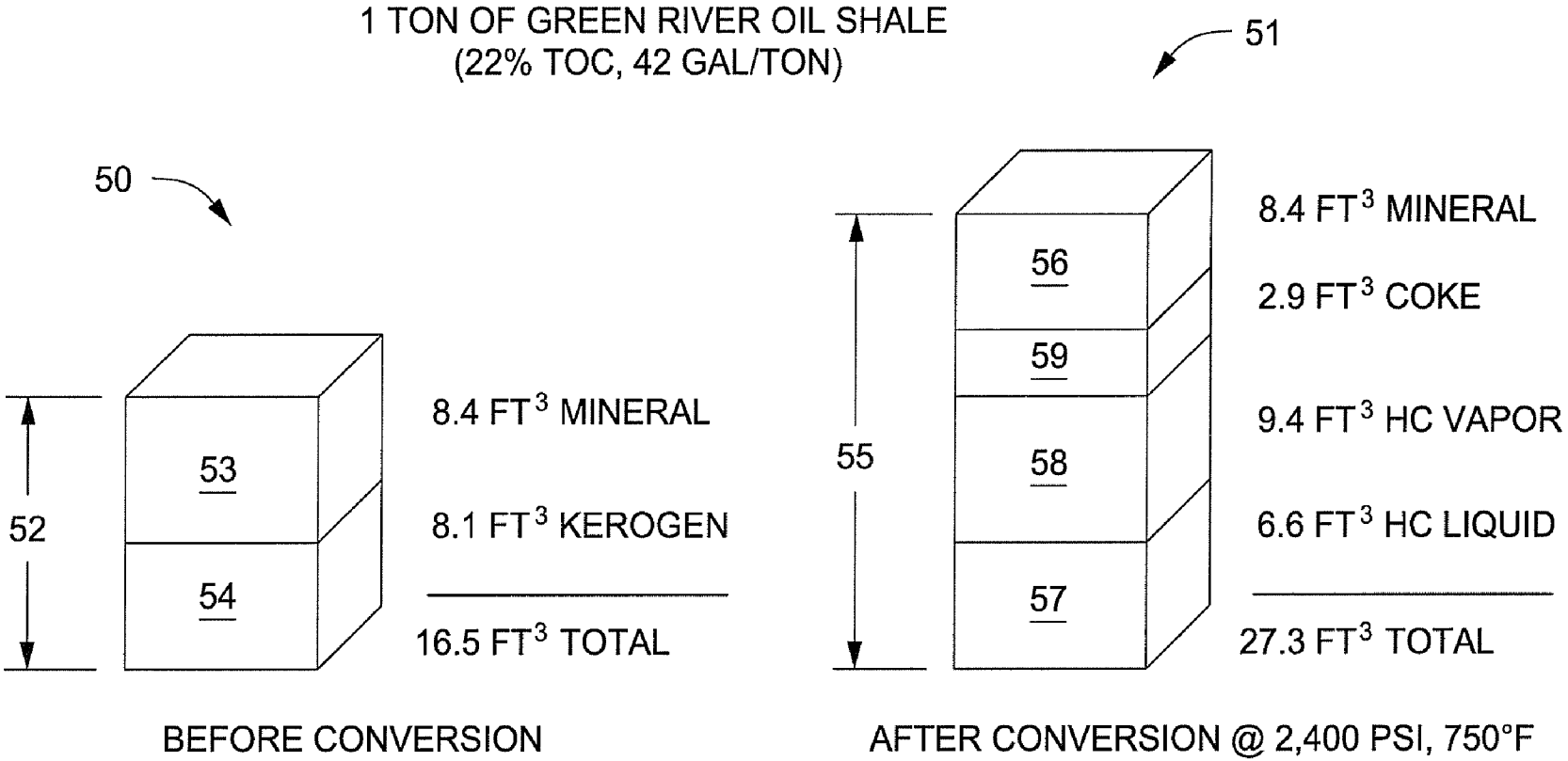
FIG. 5 is a bar chart comparing one ton of Green River oil shale before and after a simulated in situ, retorting process.

FIG. 5 provides a bar chart comparing one ton of Green River oil shale before 50 and after 51 a simulated in situ, retorting process. The simulated process was carried out at 2,400 psi and 750° F. on oil shale having a total organic carbon content of 22 wt. % and a Fisher assay of 42 gallons/ton. Before the conversion, a total of 15.3 $ft^3$ of rock matrix 52 existed. This matrix comprised 7.2 $ft^3$ of mineral 53, i.e., dolomite, limestone, etc., and 8.1 $ft^3$ of kerogen 54 imbedded within the shale. As a result of the conversion the material expanded to 26.1 $ft^3$ 55. This represented 7.2 $ft^3$ of mineral 56 (the same number as before the conversion), 6.6 $ft^3$ of hydrocarbon liquid 57, 9.4 $ft^3$ of hydrocarbon vapor 58, and 2.9 $ft^3$ of coke 59. It can be seen that substantial volume expansion occurred during the conversion process. This, in turn, increases permeability of the rock structure.

Certain systems and methods described herein may be used to treat formation hydrocarbons in at least a portion of a relatively low permeability formation (e.g., in "tight" formations that contain formation hydrocarbons). Such formation hydrocarbons may be heated to pyrolyze at least some of the formation hydrocarbons in a selected zone of the formation. Heating may also increase the permeability of at least a portion of the selected zone. Hydrocarbon fluids generated from pyrolysis may be produced from the formation, thereby further increasing the formation permeability.

Figure 6:
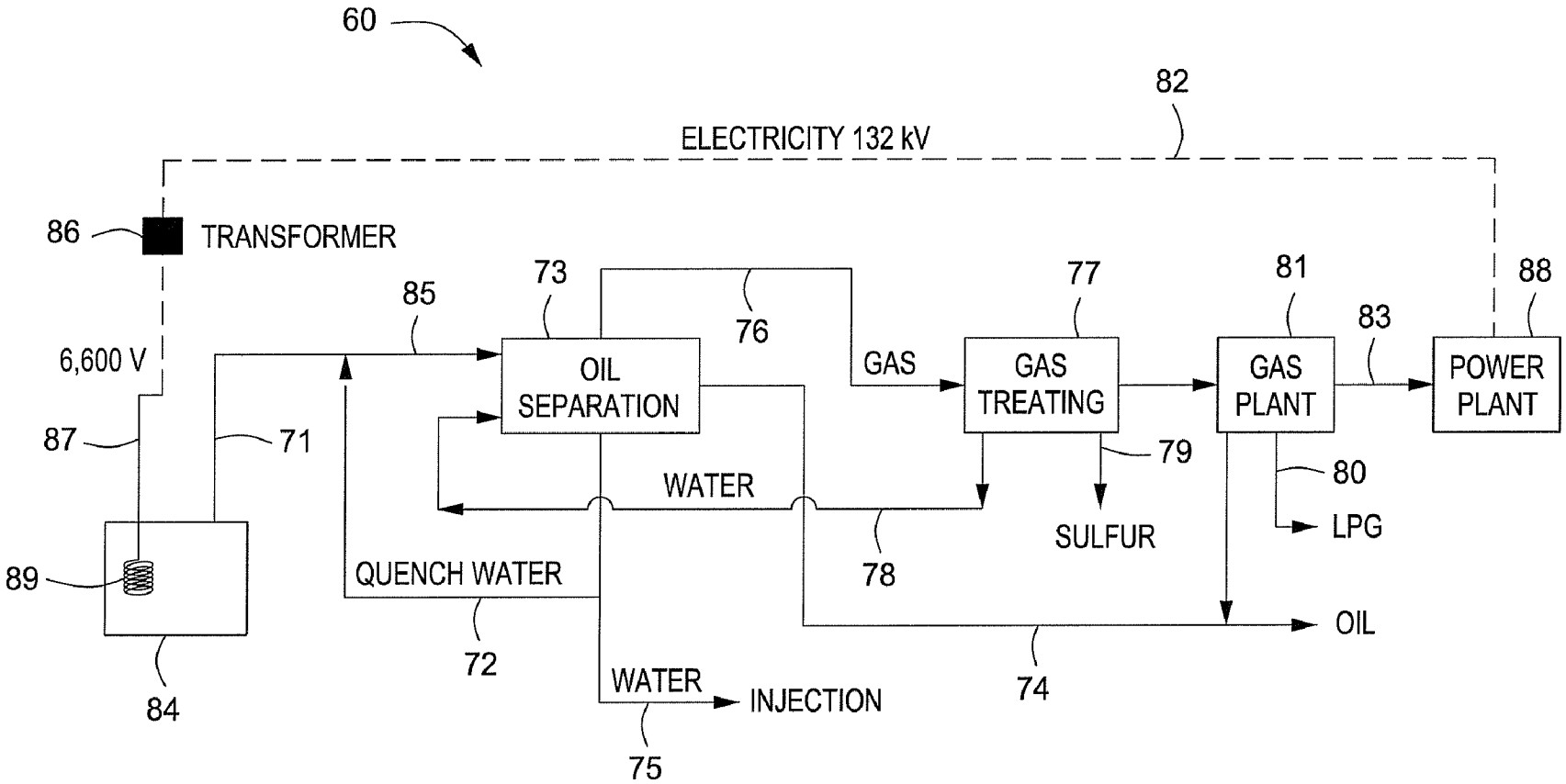
FIG. 6 is a process flow diagram of an exemplary production fluids processing facility for a subsurface formation development.

FIG. 6 illustrates a schematic diagram of an embodiment of a production fluids processing facility 60 that may be configured to treat produced fluids. The fluids 85 are produced from the subsurface formation, shown schematically at 84, though a production well 71.

The subsurface formation 84 may be any subsurface formation having organic-rich rock formation. The organic-rich rock formation may be, for example, a heavy hydrocarbon formation or a solid hydrocarbon formation. Particular examples of such formations may include an oil shale formation, a tar sands formation or a coal formation. Particular formation hydrocarbons present in such formations may include oil shale, kerogen, coal, and/or bitumen.

In the illustrative processing facility 60, the produced fluids are quenched 72 to a temperature below 300° F., 200° F., or even 100° F. This serves to separate out condensable components (i.e., oil 74 and water 75). The produced fluids may include any of the produced fluids produced by any of the methods as described herein. In the case of in situ oil shale production, produced fluids contain a number of components which may be separated in the fluids processing facility 60. The produced fluids 85 typically contain water 78, noncondensable hydrocarbon alkane species (e.g., methane, ethane, propane, n-butane, isobutane), noncondensable hydrocarbon alkene species (e.g., ethene, propene), condensable hydrocarbon species composed of (alkanes, olefins, aromatics, and polyaromatics among others), $CO_2$, CO, $H_2$, $H_2S$, and $NH_3$. In a surface facility such as production fluids processing facility 60, condensable components 74 may be separated from non-condensable components 76 by reducing temperature and/or increasing pressure. Temperature reduction may be accomplished using heat exchangers cooled by ambient air or available water 72. Alternatively, the hot produced fluids may be cooled via heat exchange with produced hydrocarbon fluids previously cooled. The pressure may be increased via centrifugal or reciprocating compressors. Alternatively, or in conjunction, a diffuser-expander apparatus may be used to condense out liquids from gaseous flows. Separations may involve several stages of cooling and/or pressure changes.

In a surface facility, condensable components may be separated from non-condensable components by reducing temperature and/or increasing pressure. Temperature reduction may be accomplished using heat exchangers cooled by ambient air or available water. Alternatively, the hot produced fluids may be cooled via heat exchange with produced hydrocarbon fluids previously cooled. The pressure may be increased via centrifugal or reciprocating compressors. Alternatively, or in conjunction, a diffuser-expander apparatus may be used to condense out liquids from gaseous flows. Separations may involve several stages of cooling and/or pressure changes.

In the arrangement of FIG. 6, the production fluids processing facility 60 includes an oil separator 73 for separating liquids, or oil 74, from hydrocarbon vapors, or gas 76. The noncondensable vapor components 76 are treated in a gas treating unit 77 to remove water 78 and sulfur species 79. Heavier components are removed from the gas (e.g., propane and butanes) in a gas plant 81 to form liquid petroleum gas (LPG) 80. The LPG 80 may be further chilled and placed into a truck or line for sale.

Water 78 in addition to condensable hydrocarbons may be dropped out of the gas 76 when reducing temperature or increasing pressure. Liquid water may be separated from condensable hydrocarbons after gas treating 77 via gravity settling vessels or centrifugal separators. In the arrangement of FIG. 6, condensable fluids 78 are routed back to the oil separator 73.

At the oil separator 73, water 75 is separated from oil 74. Preferably, the oil separation 73 process includes the use of demulsifiers to aid in water separation. The water 78 may be directed to a separate water treatment facility for treatment and, optionally, storage for later re-injection.

The fluids processing facility 60 also operates to generate electrical power 82 in a power plant 88. To this end, the remaining gas 83 is used to generate electrical power 82. The electrical power 82 may be used as an energy source for heating the subsurface formation 84 through any of the methods described herein. For example, the electrical power 82 may be fed at a high voltage, for example 132,000 V, to a transformer 86 and let down to a lower voltage, for example 6,600 V, before being fed to an electrical resistance heater element 89 located in a heater well 87 in the subsurface formation 84. In this way all or a portion of the power required to heat the subsurface formation 84 may be generated from the non-condensable portion 76 of the produced fluids 85. Excess gas, if available, may be exported for sale.

Methods to remove $CO_2$, as well as other so-called acid gases (such as $H_2S$), from produced hydrocarbon gas include the use of chemical reaction processes and of physical solvent processes. Chemical reaction processes typically involve contacting the gas stream with an aqueous amine solution at high pressure and/or low temperature. This causes the acid gas species to chemically react with the amines and go into solution. By raising the temperature and/or lowering the pressure, the chemical reaction can be reversed and a concentrated stream of acid gases can be recovered.

Acid gas removal may also be effectuated through the use of distillation towers. Such towers may include an intermediate freezing section wherein frozen $CO_2$ and $H_2S$ particles are allowed to form. A mixture of frozen particles and liquids fall downward into a stripping section, where the lighter hydrocarbon gasses break out and rise within the tower. A rectification section may be provided at an upper end of the tower to further facilitate the cleaning of the overhead gas stream.

As noted, the produced fluids 85 are a result of formation heating and a pyrolysis of organic-rich rock. During heating, the temperature (and average temperatures) within a heated organic-rich rock formation may vary, depending on, for example, proximity to a heater well, thermal conductivity and thermal diffusivity of the formation, type of reaction occurring, type of formation hydrocarbon, and the presence of water within the organic-rich rock formation. At points in the field where monitoring wells are established, temperature measurements may be taken directly in the wellbore. Further, at heater wells the temperature of the immediately surrounding formation is fairly well understood. However, it may be desirable to interpolate temperatures to points in the formation intermediate temperature sensors and heater wells.

In some embodiments, a heater well may be turned down and/or off after an average temperature in a formation may have reached a selected temperature. Turning down and/or off the heater well may reduce input energy costs, substantially inhibit overheating of the formation, and allow heat to substantially transfer into colder regions of the formation.

In accordance with one aspect of the production processes of the present inventions, a temperature distribution within the organic-rich rock formation may be computed using a numerical simulation model. The numerical simulation model may calculate a subsurface temperature distribution through interpolation of known data points and assumptions of formation conductivity. In addition, the numerical simulation model may be used to determine other properties of the formation under the assessed temperature distribution. For example, the various properties of the formation may include, but are not limited to, permeability of the formation.

The numerical simulation model may also include assessing various properties of a fluid formed within an organic-rich rock formation under the assessed temperature distribution. For example, the various properties of a formed fluid may include, but are not limited to, a cumulative volume of a fluid formed in the formation, fluid viscosity, fluid density, and a composition of the fluid formed in the formation. Such a simulation may be used to assess the performance of a commercial-scale operation or small-scale field experiment. For example, a performance of a commercial-scale development may be assessed based on, but not limited to, a total volume of product that may be produced from a research-scale operation.

In some embodiments, compositions and properties of the hydrocarbon fluids produced by an in situ conversion process may vary depending on, for example, conditions within an organic-rich rock formation. Controlling heat and/or heating rates of a selected section in an organic-rich rock formation may increase or decrease production of selected produced fluids.

In one embodiment, operating conditions may be determined by measuring at least one property of the organic-rich rock formation. The measured properties may be input into a computer executable program. At least one property of the produced fluids selected to be produced from the formation may also be input into the computer executable program. The program may be operable to determine a set of operating conditions from at least the one or more measured properties. The program may also be configured to determine the set of operating conditions from at least one property of the selected produced fluids. In this manner, the determined set of operating conditions may be configured to increase production of selected produced fluids from the formation.

The produced hydrocarbon fluids may include a pyrolysis oil component (or condensable component) and a pyrolysis gas component (or non-condensable component). Condensable hydrocarbons produced from the formation will typically include paraffins, cycloalkanes, mono-aromatics, and di-aromatics as components. Such condensable hydrocarbons may also include other components such as tri-aromatics and other hydrocarbon species. The hydrocarbon fluid may additionally be produced together with non-hydrocarbon fluids. Exemplary non-hydrocarbon fluids include, for example, water, carbon dioxide, hydrogen sulfide, hydrogen, ammonia, and/or carbon monoxide.

In certain embodiments, a majority of the hydrocarbons in the produced fluid may have a carbon number of less than approximately 25. Alternatively, less than about 15 weight % of the hydrocarbons in the fluid may have a carbon number greater than approximately 25. The non-condensable hydrocarbons may include, but are not limited to, hydrocarbons having carbon numbers less than 5.

In certain embodiments, the API gravity of the condensable hydrocarbons in the produced fluid may be approximately 20 or above (e.g., 25, 30, 40, 50, etc.). In some embodiments the condensable hydrocarbon portion of the hydrocarbon fluid has an API gravity greater than 30. Alternatively, the condensable hydrocarbon portion may have an API gravity greater than 30, 32, 34, 36, 40, 42 or 44. As used herein and in the claims, API gravity may be determined by any generally accepted method for determining API gravity. In certain embodiments, the hydrogen to carbon atomic ratio in produced fluid may be at least approximately 1.7 (e.g., 1.8, 1.9, etc.).

In some embodiments the condensable hydrocarbon portion of the hydrocarbon fluid has a basic nitrogen to total nitrogen ratio between 0.1 and 0.50. Alternatively, the condensable hydrocarbon portion may have a basic nitrogen to total nitrogen ratio between 0.15 and 0.40. As used herein and in the claims, basic nitrogen and total nitrogen may be determined by any generally accepted method for determining basic nitrogen and total nitrogen.

Certain heater well embodiments may include an operating system that is coupled to any of the heater wells such as by insulated conductors or other types of wiring. The operating system may be configured to interface with the heater well. The operating system may receive a signal (e.g., an electromagnetic signal) from a heater that is representative of a temperature distribution of the heater well. Additionally, the operating system may be further configured to control the heater well, either locally or remotely. For example, the operating system may alter a temperature of the heater well by altering a parameter of equipment coupled to the heater well. Therefore, the operating system may monitor, alter, and/or control the heating of at least a portion of the formation.

One embodiment of the invention includes an in situ method of producing hydrocarbon fluids with improved properties from an organic-rich rock formation. Applicants have surprisingly discovered that the quality of the hydrocarbon fluids produced from in situ heating and pyrolysis of an organic-rich rock formation may be improved by selecting sections of the organic-rich rock formation with higher lithostatic stress for in situ heating and pyrolysis.

Thus, a method is offered herein for in situ heating of a section of an organic-rich rock formation that has a high lithostatic stress to form hydrocarbon fluids having improved properties. The method may include creating the hydrocarbon fluid by pyrolysis of a solid hydrocarbon and/or a heavy hydrocarbon present in the organic-rich rock formation. Embodiments may include the hydrocarbon fluid being partially, predominantly or substantially completely created by pyrolysis of the solid hydrocarbon and/or heavy hydrocarbon present in the organic-rich rock formation. The method may include heating the section of the organic-rich rock formation by any method, including any of the methods described herein. The method may include heating the section of the organic-rich rock formation to above 270° C. For example, the method may include heating the section of the organic-rich rock formation between 270° C. and 500° C.

The method may include heating in situ a section of the organic-rich rock formation having a lithostatic stress greater than 200 psi and producing a hydrocarbon fluid from the heated section of the organic-rich rock formation. In alternative embodiments, the heated section of the organic-rich rock formation may have a lithostatic stress greater than 400 psi. In alternative embodiments, the heated section of the organic-rich rock formation may have a lithostatic stress greater than 800 psi, greater than 1,000 psi, greater than 1,200 psi, greater than 1,500 psi or greater than 2,000 psi. Applicants have found that in situ heating and pyrolysis of organic-rich rock formations with increasing amounts of stress lead to the production of hydrocarbon fluids with improved properties.

The lithostatic stress of a section of an organic-rich formation can normally be estimated by recognizing that it will generally be equal to the weight of the rocks overlying the formation. The density of the overlying rocks can be expressed in units of psi/ft. Generally, this value will fall between 0.8 and 1.1 psi/ft and can often be approximated as 0.9 psi/ft. As a result the lithostatic stress of a section of an organic-rich formation can be estimated by multiplying the depth of the organic-rich rock formation interval by 0.9 psi/ft. Thus the lithostatic stress of a section of an organic-rich formation occurring at about 1,000 feet can be estimated to be about (0.9 psi/ft) multiplied by (1,000 feet) or about 900 psi. If a more precise estimate of lithostatic stress is desired the density of overlying rocks can be measured using wireline logging techniques or by making laboratory measurements on samples recovered from coreholes. The method may include heating a section of the organic-rich rock formation that is located at a depth greater than 200 feet below the earth's surface. Alternatively, the method may include heating a section of the organic-rich rock formation that is located at a depth greater than 500 feet below the earth's surface, greater than 1,000 feet below the earth's surface, greater than 1,200 feet below the earth's surface, greater than 1,500 feet below the earth's surface, or greater than 2,000 feet below the earth's surface.

Typically in its natural state, the weight of a formation's overburden is fairly uniformly distributed over the formation. In this state, the lithostatic stress existing at particular points within a formation is largely controlled by the thickness and density of the overburden. A desired lithostatic stress may be selected by analyzing overburden geology and choosing a position with an appropriate depth and position.

Although lithostatic stresses are commonly assumed to be set by nature and not changeable short of removing all or part of the overburden, lithostatic stress at a specific location within a formation can be adjusted by redistributing the overburden weight so it is not uniformly supported by the formation. For example, this redistribution of overburden weight may be accomplished by two exemplary methods. One or both of these methods may be used within a single formation. In certain cases, one method may be primarily used earlier in time whereas the other may be primarily used at a later time. Favorably altering the lithostatic stress experienced by a formation region may be performed prior to instigating significant pyrolysis within the formation region and also before generating significant hydrocarbon fluids. Alternately, favorably altering the lithostatic stress may be performed simultaneously with the pyrolysis.

A first method of altering lithostatic stress involves making a region of a subsurface formation less stiff than its neighboring regions. Neighboring regions thus increasingly act as pillars supporting the overburden as a particular region becomes less stiff. Pillars are regions within the organic-rich rock formation left unpyrolyzed at a given time to lessen or mitigate surface subsidence. Pillars may be regions within a formation surrounded by pyrolysis regions within the same formation. Alternatively, pillars may be part of or connected to the unheated regions outside the general development area. Certain regions that act as pillars early in the life of a producing field may be converted to producing regions later in the life of the field.

The pillar regions experience increased lithostatic stress whereas the less stiff regions experience reduced lithostatic stress. The amount of change in lithostatic stress depends upon a number of factors including, for example, the change in stiffness of the treated region, the size of the treated region, the pillar size, the pillar spacing, the rock compressibility, and the rock strength. In an organic-rich rock formation, a region within a formation may be made to experience mechanical weakening by pyrolyzing the region and creating void space within the region by removing produced fluids. In this way a region within a formation may be made less stiff than neighboring regions that have not experienced pyrolysis or have experienced a lesser degree of pyrolysis or production.

A second method of altering lithostatic stress involves causing a region of a subsurface formation to expand and push against the overburden with greater force than neighboring regions. This expansion may remove a portion of the overburden weight from the neighboring regions thus increasing the lithostatic stress experienced by the heated region and reducing the lithostatic stress experienced by neighboring regions. If the expansion is sufficient, horizontal fractures will form in the neighboring regions and the contribution of these regions to supporting the overburden will decrease.

The amount of change in lithostatic stress depends upon a number of factors including, for example, the amount of expansion in the treated region, the size of the treated region, the pillar size, the pillar spacing, the rock compressibility, and the rock strength. A region within a formation may be made to expand by heating it so as to cause thermal expansion of the rock. Fluid expansion or fluid generation can also contribute to expansion if the fluids are largely trapped within the region. The total expansion amount may be proportional to the thickness of the heated region. It is noted that if pyrolysis occurs in the heated region and sufficient fluids are removed, the heated region may be mechanically weakened and, thus, may alter the lithostatic stresses experienced by the neighboring regions as described in the first exemplary method.

The in situ heating of an organic-rich rock matrix pyrolyzes at least a portion of the formation hydrocarbons to create hydrocarbon fluids. In this respect, the in situ heating and production of oil and gas from oil shale converts a volumetrically significant portion of the heated oil shale to hydrocarbon fluids. This, in turn, creates permeability within a matured (pyrolyzed) organic-rich rock zone in the organic-rich rock formation. The combination of pyrolyzation and increased permeability permits hydrocarbon fluids to be produced from the formation. At the same time, the loss of supporting matrix material also creates the potential for subsidence.

It is desirable to control subsidence in order to avoid environmental or hydrogeological impact. In this respect, changing the contour and relief of the earth surface may change runoff patterns, affect vegetation patterns, and impact watersheds. In addition, subsidence in the form of compression stratigraphic layers in the overburden has the potential of damaging heater wells, monitoring wells, injection wells, and production wells completed in a production area. Such subsidence can create damaging hoop and compressional stresses on wellbore casings, cement jobs, and downhole equipment.

In order to evaluate the potential for subsidence, certain principles of geomechanics may first be considered. Application of geomechanical principles allows the stress response of rocks within and around a treated volume to be estimated.

Prior to heating, stresses will exist in the rocks within and around the treated volume. When the treated volume is heated, kerogen will be converted to hydrocarbon fluids. This will cause the rock in the treated volume to soften, or become less stiff. This softening in response to conversion can be mathematically described as a decrease in elastic modulus. When this happens, the rock will be less able to support the weight of its overburden.

For some time during and after heating, the overburden weight will be supported in the formation 22 by fluid pressure of the hydrocarbon fluids generated from kerogen conversion. However, this pore pressure will decrease as production takes place. As production from the formation 22 occurs and the supporting pressure in the rock declines, the softened rock in the treated volume will then be called upon to provide support for its overburden. This, in turn, creates a potential for subsidence.

As support for the overburden is transferred from the fluid pressure to the softened rock, stresses in the surrounding rock will be altered. Initially, the stress response of the surrounding rocks will be elastic and the principles of geomechanics permit the stress response to be estimated. Generally, if the stress response of the rocks around the treated interval remains elastic, the degree of subsidence will be minor. If, however, the stresses in rocks around the treated interval reach a failure condition, subsidence is likely to be more severe. A failure condition is a stress state that cannot be supported by the rock and which results in rock breakage.

One way to evaluate the potential for subsidence above a treated volume is to first estimate the stress response of the rocks within and around the treated volume assuming elastic behavior. The estimated stresses may then be used to determine if a designated failure criterion has been exceeded. Those of ordinary skill in the art understand that various criteria exist for the evaluation of rock failure. In the present methods, the empirical failure criteria are preferably evaluated in terms of "principal stresses". These are normal stresses referenced to a coordinate system in which all the shear stresses are equal to zero.

In connection with an evaluation of geomechanical stresses and failure criteria, it is generally recognized that rocks are strong in compression but weak in tension. This is particularly true for rocks with natural fractures. For these rocks, compressive stresses will tend to leave fractures closed, but tensile stresses will open the fractures and encourage fracture growth. By this criterion, any portion of a rock subjected to a tensile stress will fail.

Figure 7:
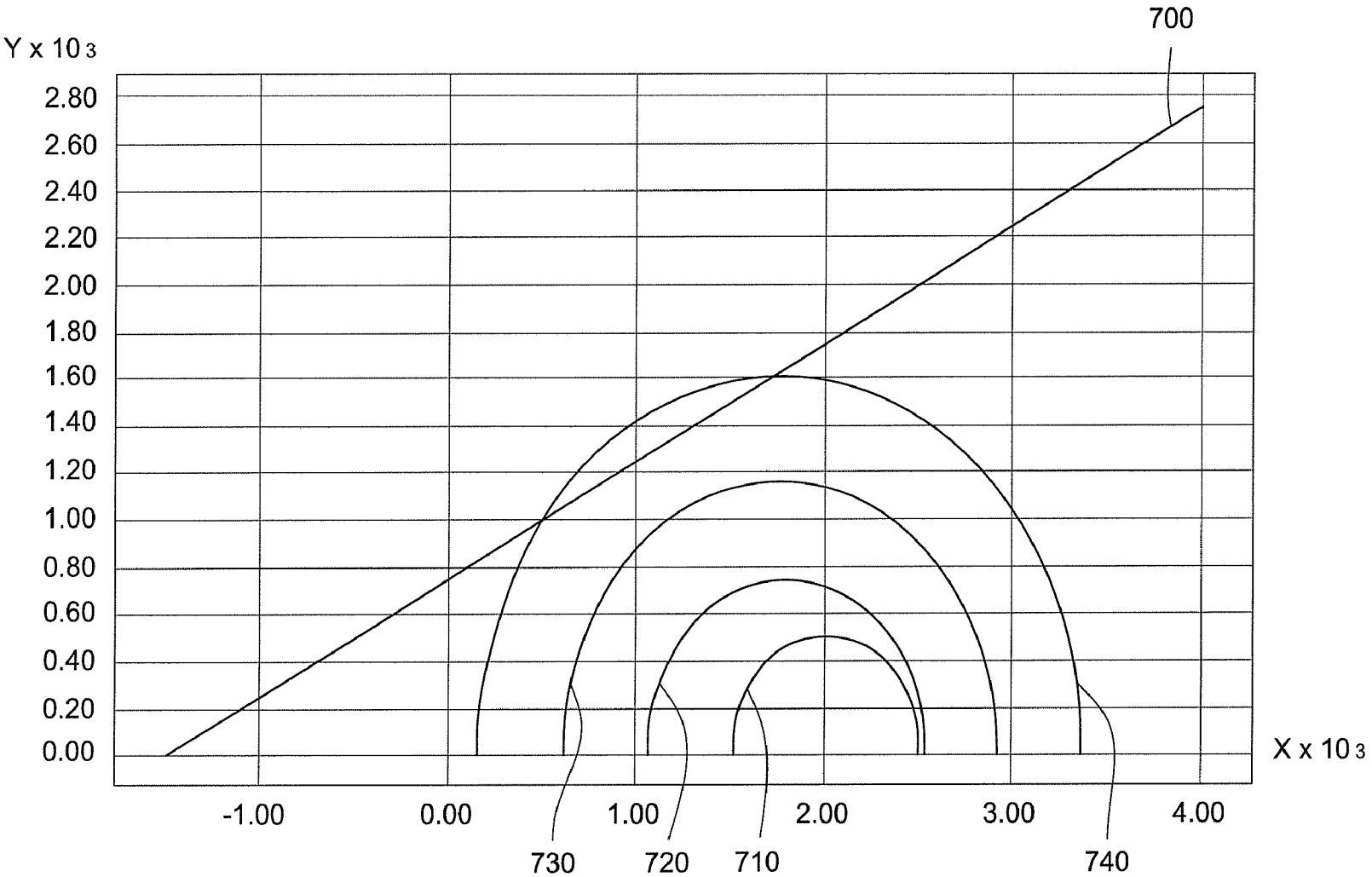
FIG. 7 is a graph illustrating the Mohr-Coulomb principle of geomechanical stress.

Other failure criteria recognize that in addition to being weak in tension, rocks also have limited frictional strength. The Mohr-Coulomb failure criterion is an example. FIG. 7 presents a graph depicting a Mohr Coulomb failure line 700. In FIG. 7, the horizontal or x-axis represents the effective normal stress in the rock with compression being considered positive. The vertical or y-axis represents the shear stress in the rock. The normal stress increases with compression in the positive "x" direction, and decreases with tension in the negative "x" direction.

The Mohr Coulomb failure line 700 defines rock stress states at failure. To evaluate the failure criterion for a given stress state, the maximum and minimum principal stresses are plotted along the x-axis. A semi-circle is constructed whose center is along the x-axis at a value corresponding to the mean of the maximum and minimum principal stresses. If the semi-circle crosses the failure line, the stress state corresponds to a state at which rock failure will occur.

In practice, failure points may be determined by breaking core samples in compression under different confining pressures. The tri-axial compression laboratory test procedures and calculations to define the failure line 700 are known to those skilled in the art. When considering porous rocks with an internal pore fluid under pressure, the stresses correspond to "effective stresses." The "effective stress" on a porous rock is the normal total stress minus the pore fluid pressure. The measurement of "effective stress" and its use in mechanics is known to those skilled in the art.

The graph shown in FIG. 7 includes a failure line 700 and four Mohr Coulomb semicircles 710, 720, 730 and 740. Semicircles 710, 720, 730 and 740 represent successive stress states in time. Curve 710 represents an initial pore pressure of 1,858 psi. Subsequent curves 720, 730 and 740 represent pore pressures in a treated oil shale volume that have been reduced by production. Curve 720 represents a pore pressure of 1,458 psi; curve 730 represents a pore pressure of 1,058 psi; and curve 740 represents a pore pressure of only 658 psi.

As shown by curve 740, the semi-circle enlarges outwardly as pore pressure within the treated formation is reduced. This is a reflection of fluid production from within the formation. As the treated volume pore pressure is reduced, the stress state changes from a stable to an unstable state. It can be seen that curve 740 crosses over the failure line 700, thus indicating that an unstable state has been reached.

The assumption of zero rock tensile strength and the Mohr-Coulomb failure line 700 represent two empirical failure criteria. However, other failure criteria exist such as the Drucker-Prager failure criteria, the Cam-clay model, and various other "critical state" models.

As applied to a formation where solid hydrocarbons such as kerogen are being pyrolyzed, tensile failure within a formation may be caused by two factors: (1) the removal of material from the subsurface formation due to pyrolysis; and (2) a reduction in pore pressure within the subsurface formation due to the ongoing removal of pyrolyzed hydrocarbon fluids over time. The pyrolysis may be non-oxidative. In one aspect, pyrolyzing is a result of electrically resistive heating of the subsurface formation.

In order to avoid tensile failure within a formation and to control subsidence due to pyrolysis and production, it is proposed to leave selected portions of the formation hydrocarbons substantially unpyrolyzed. This serves to preserve one or more unmatured, organic-rich rock zones. In some embodiments, the unmatured organic-rich rock zones may be shaped as substantially vertical pillars extending through a substantial portion of the thickness of the organic-rich rock formation.

Figure 8:
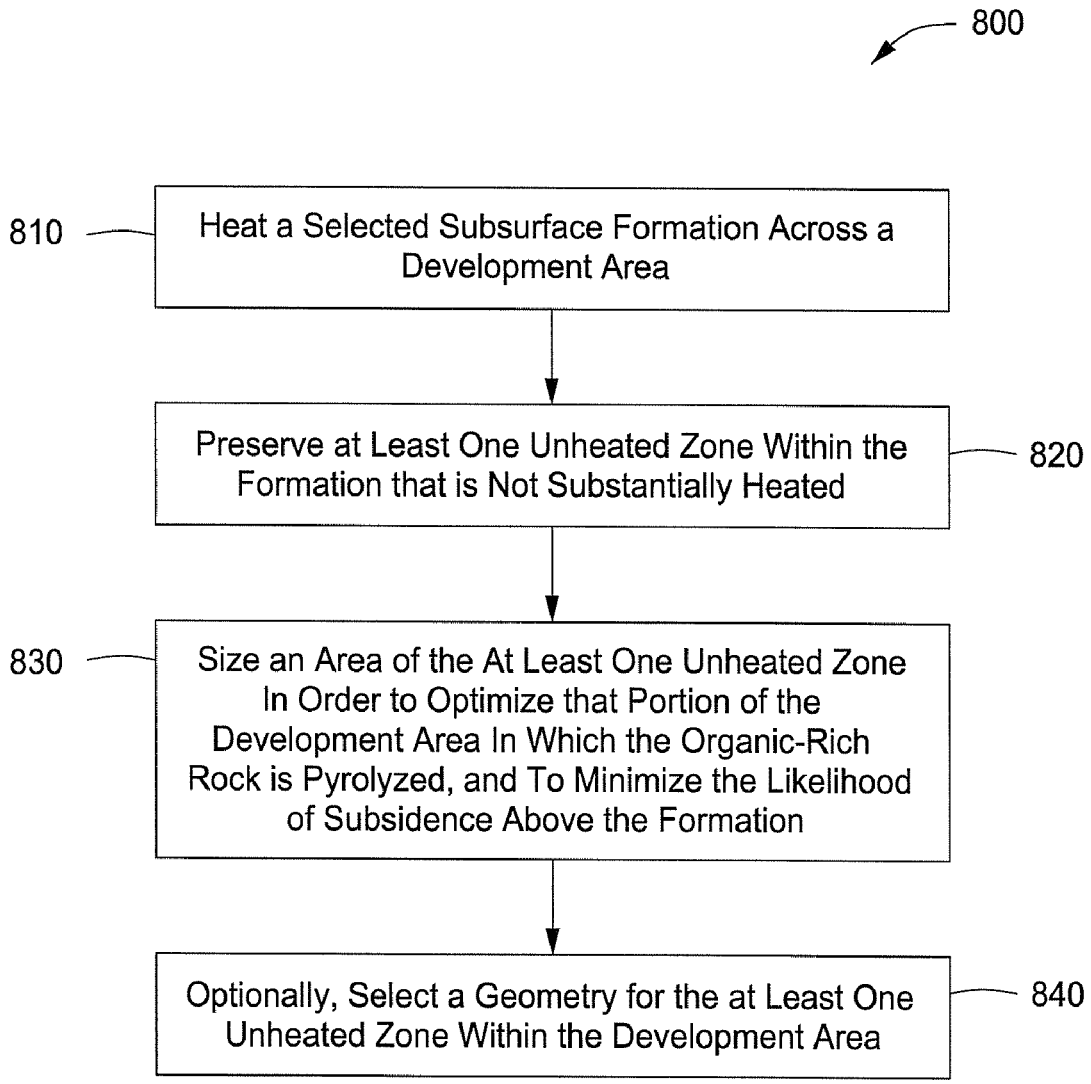
FIG. 8 is a flow chart showing steps that may be performed in connection with one embodiment of the methods disclosed herein.

FIG. 8 is a flow chart showing steps that may generally be performed in connection with one embodiment 800 of the methods disclosed herein. The steps represent one method for developing hydrocarbons from a subsurface formation containing organic-rich rock. As seen in FIG. 8, the method 800 includes the step of heating the formation across a development area. This step is represented by Box 810. The purpose for the heating step 810 is to pyrolyze at least a portion of the formation hydrocarbons in the organic rich rock into hydrocarbon fluids.

For purposes of the present disclosure, the development area represents the area that is subject to hydrocarbon development. The development area incorporates all of the projections of zones from the surface to the subsurface which are being heated or have been heated.

The method 800 of FIG. 8 also includes the step of preserving at least one unheated zone within the formation. This step is shown in Box 820. The at least one unheated zone is located within the development area. The purpose of the preservation step 820 is to preserve at least one zone within the formation that is not heated. In this way, the formation hydrocarbons in the at least one unheated zone are left substantially unpyrolyzed. The at least one zone that is preserved is not heated to a point of substantial pyrolysis, nor is it rubblized.

It is understood that there will be transition zones between heated and unheated zones. There will also be a complex temperature profile across a heated zone as the temperature varies between heater wells, producer wells, and unheated zones. Over time the temperature within a heated zone will even out but leave a transition zone of less heating. For purposes of this disclosure it is understood that the unheated zone is an area that is not heated or otherwise energized to such an extent as would cause substantial or significant pyrolysis of the organic-rich formation.

The method 800 also provides the step of sizing an area of the at least one unheated zone. This step is presented in Box 830. The purpose is to optimize that portion of the development area in which the formation hydrocarbons are pyrolyzed while controlling the likelihood of subsidence above the subsurface formation. Preferably, the at least one unheated zone represents no more than 50 percent of the development area. More preferably, the at least one unheated zone represents no more than 40 percent of the development area. More preferably still, the at least one unheated zone represents no more than 25, or even no more than 10 percent, of the development area.

It is preferred that the steps 810 through 830 be practiced in an organic-rich rock formation that is comprised of solid hydrocarbons. A particularly preferred example of solid hydrocarbons is kerogen.

One step for the method 800 is to select a geometry for the at least one unheated zone within the development area. This step is represented in Box 840 of FIG. 8. It is understood that "geometry" indicates a designated configuration or a selected location within the development area. For instance, the unheated zone may have a configuration that represents a single circle, a square, a rectangle or a star. Alternatively, the unheated zone may represent a plurality of circles or a plurality of squares, rectangles, hexagons, rhomboids or stars that serve as support pillars. These pillars may or may not be in contact with one another. In any event, the at least one unheated zone may define an area that is at least 5 percent greater than an area considered to be a subsidence failure point for the selected geometry. Alternatively, the at least one unheated zone defines an area that is at least 10 percent greater than an area considered to be a subsidence failure point for the selected size or area.

In one aspect, the at least one unheated zone defines a single, contiguous unheated zone within the development area. The contiguous unheated zone has pyrolyzed zones located therein. Alternatively, the at least one unheated zone defines at least two unheated zones. The at least two unheated zones may be non-contiguous.

Figure 9:
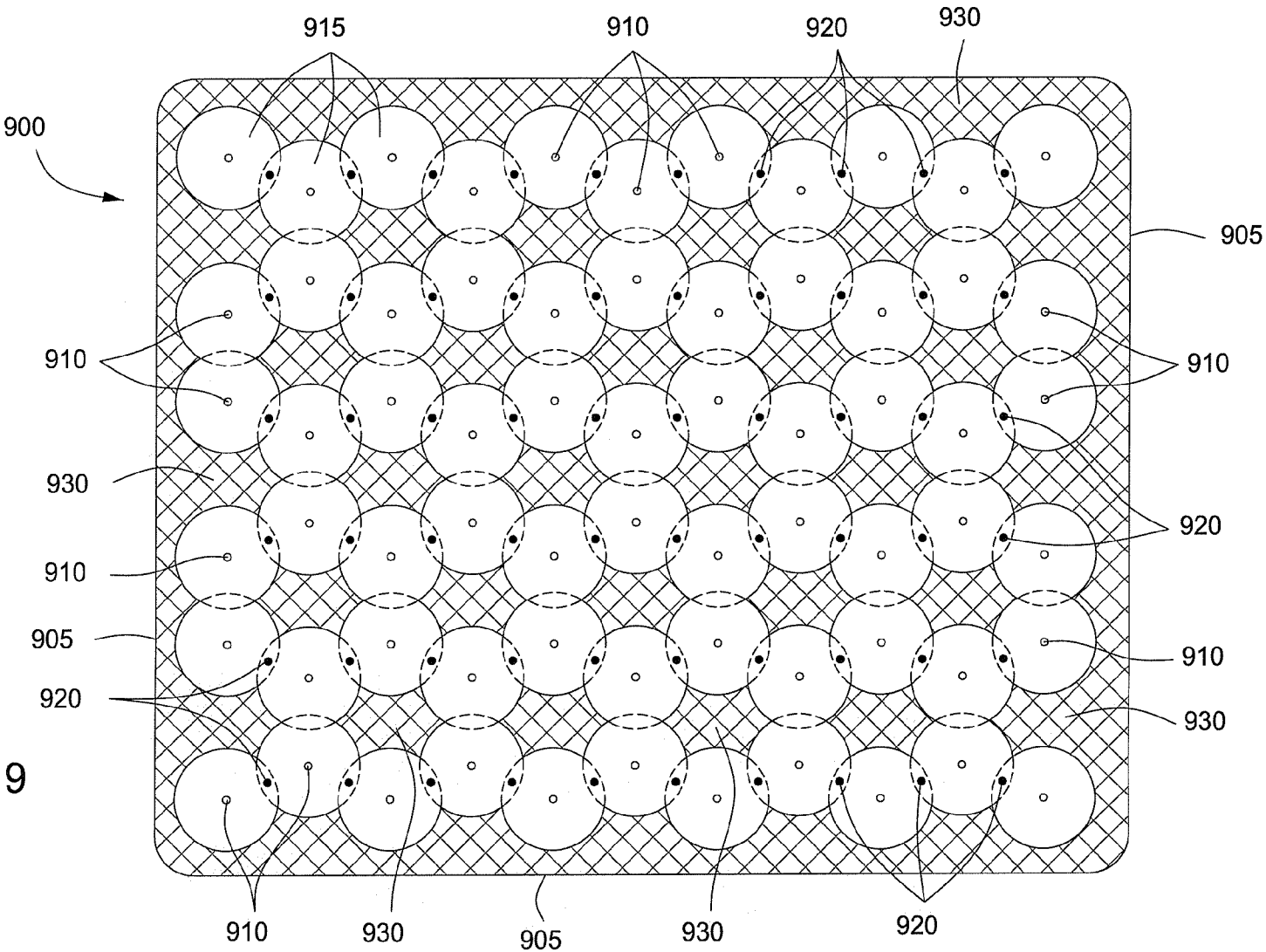
FIG. 9 presents a map view of a shale oil development area, in one embodiment. The development area includes both heater wells and producers.

FIG. 9 presents a map view of a shale oil development area 900, in one embodiment. The illustrative development area 900 is defined by a surface boundary or perimeter 905. Within the boundary 905, a plurality of heater wells 910 have been formed. The heater wells 910 may employ downhole combustion heaters. Alternatively, the heater wells 910 may have resistive heater elements. Alternatively still, the heater wells 910 may receive injections of heated fluids for circulation. In any instance, the heater wells 910 serve to heat a subsurface formation made up of solid hydrocarbons for the purpose of pyrolyzing oil shale or other solid hydrocarbons into hydrocarbon fluids.

Associated with each heater well 910 is a heating profile 915. The heating profiles 915 are in the form of circles, and indicate a scope of heating within the subsurface formation around the individual heater wells 910. More specifically, the profiles 915 show the extent of formation heating to a pyrolysis temperature. It is understood that heating a formation is a process that takes time. As heat is first applied downhole, the heating profiles will be small. As heat continues to be applied downhole, a heat front moves away from the respective heater wells 910. In the stage depicted in FIG. 9, a pyrolysis heat profile has emanated away from the respective heater wells 910, and the various heat profiles have begun to overlap. Continued formation heating will cause further overlapping of the heat profiles 915, producing more complete pyrolysis across a subsurface formation.

The development area 900 also includes a plurality of production wells or producers 920. The producers 920 serve to deliver pyrolyzed hydrocarbon fluids under pressure to the surface. In the arrangement of FIG. 9, the ratio between heater wells 910 and producers 920 is about 1:1. However, other heater well 910 and production well 920 arrangements may be used to generate different ratios.

In accordance with embodiments of the present methods, a portion of the formation is left unheated in order to preserve one or more unheated zones. Such unheated zones are indicated in FIG. 9 by crosshatching at 930. In the arrangement of FIG. 9, the unheated zones 930 comprise separate or non-contiguous stars or portions thereof. However, the unheated zones 930 may optionally be interconnected. The unheated zones 930 are preserved in a virgin state and are not substantially pyrolyzed, burned or rubblized.

The unheated zones 930 serve as pillars. In this respect, alteration of solid rock formations through the pyrolysis process creates a potential for subsidence at the surface. The unheated zones 930 preferably prevent significant surface subsidence by supporting the rock layers overlying the subsurface formation or formations that are undergoing pyrolysis.

Figure 10:
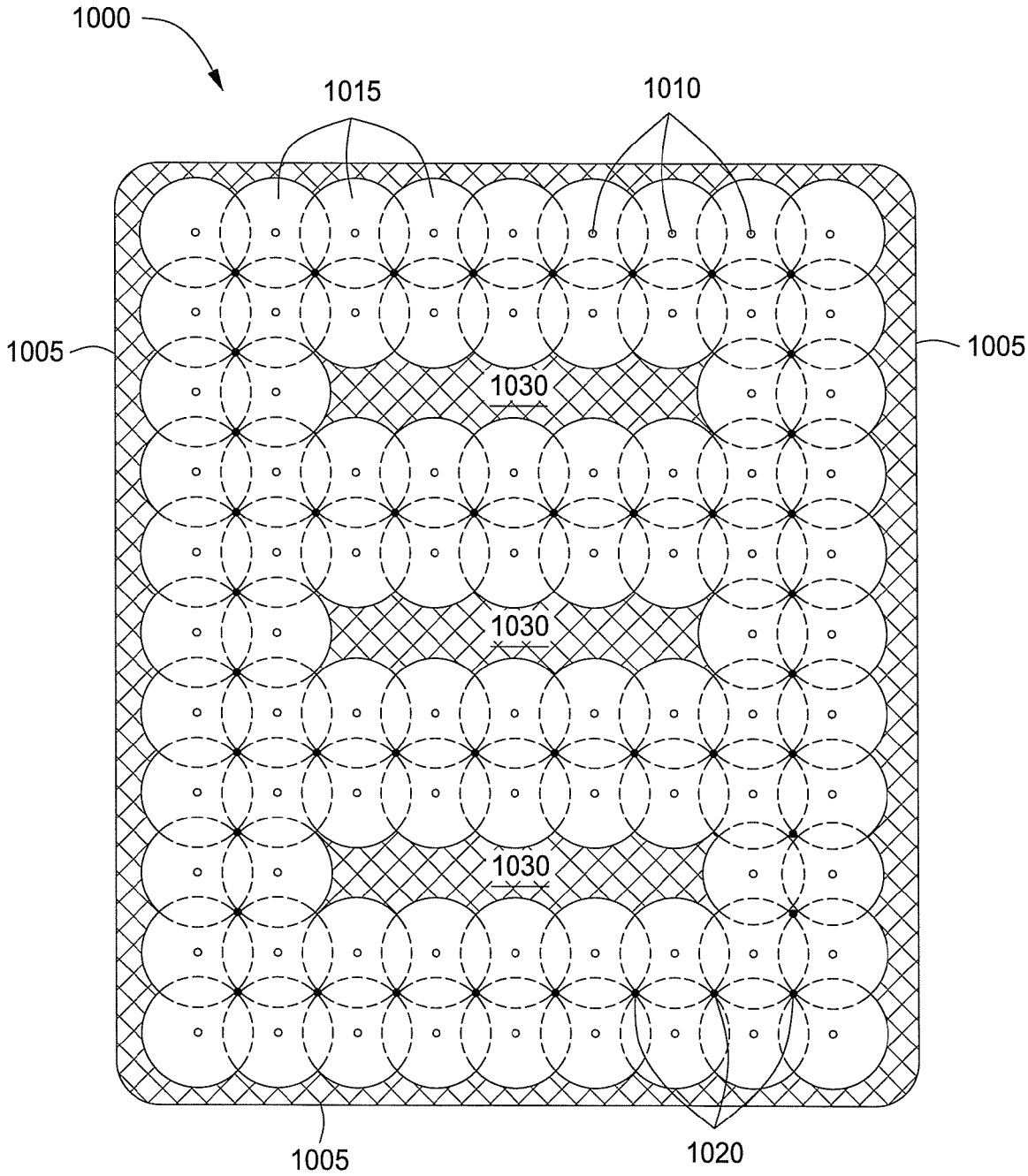
FIG. 10 is a map view of an alternate shale oil development area. The development area again includes both heater wells and producers.

FIG. 10 is an alternate view of a shale oil development area 1000. The development area 1000 is defined by a surface boundary or perimeter 1005. The perimeter 1005 may be of any configuration. In the illustrative view of FIG. 10, the perimeter 1005 is four-sided, forming a development area that is a rectangle.

Within the perimeter 1005, a plurality of heater wells 1010 have been formed. The heater wells 1010 are completed in a subsurface formation containing solid hydrocarbons. As with heater wells 910, heater wells 1010 serve to heat the subsurface formation for the purpose of pyrolyzing solid hydrocarbons into hydrocarbon fluids. Any method of heating may be used so long as it is non-oxidative within the formation.

Associated with each heater well 1010 is a heating profile 1015. Circles 1015 are provided around the heater wells 1010 indicating a scope of heating within the subsurface formation. More specifically, the circles 1015 show the extent of formation heating at a pyrolysis temperature. It is again understood that heating a formation is a process that takes time. As heat is first applied downhole, the heating profile is very small. As heat continues to be applied, a heat front moves away from the respective heater wells 1010. In the stage depicted in FIG. 10, a pyrolysis heat profile has emanated away from the respective heater wells 1010, and the various heat profiles have begun to overlap. Continued formation heating will cause further overlapping of the heat profiles 1015, producing more complete pyrolysis.

The development area 1000 also includes a plurality of production wells or producers 1020. The producers 1020 serve to deliver pyrolyzed hydrocarbon fluids under pressure to the surface. In the arrangement of FIG. 10, the heater wells 1010 and producers 1020 form a four-spot pattern. However, other heater well 1010 and production well 1020 arrangements may be used to generate different patterns or well ratios.

In accordance with certain embodiments of the present methods, a portion of the formation is left unheated. This serves to create or preserve at least one unheated zone. Such unheated zones are indicated in FIG. 10 by crosshatching at 1030. In the arrangement of FIG. 10, the unheated zones 1030 comprise separate or non-contiguous four-sided polygons. However, the unheated zones 1030 may optionally be interconnected. The unheated zones 1030 are preserved in a virgin state and are not substantially pyrolyzed, burned or rubblized.

As with unheated zones 930, the unheated zones 1030 serve as pillars. In this respect, alteration of solid rock formations through the pyrolysis process creates a potential for subsidence at the surface. The unheated zones 1030 preferably prevent or control significant surface subsidence by supporting the rock layers overlying the subsurface formation or formations that are undergoing pyrolysis.

It is also understood that in both development area 900 of FIG. 9 and development area 1000 of FIG. 10, a large number of heater wells and production wells may be employed. Thus, for example, the development areas 900 or 1000 may be indicative of small sections in a much larger development area.

The step 840 of selecting a geometry may optionally comprise the steps of drilling at least one cooling well through each of the one or more unheated zones 930 or 1030. A cooling fluid is then injected into each cooling well (not shown). The cooling fluid serves to inhibit pyrolysis within the unheated zones. It is preferred that the cooling fluid be a gas at ambient conditions.

In one embodiment, each cooling well comprises a downhole piping assembly for circulating unheated fluid. The unheated fluid may optionally be chilled at the earth surface. In one aspect, the unheated fluid is a cooling fluid that is chilled below ambient air temperature prior to injection into the downhole piping assembly. The cooling fluid is circulated through the tubular member, to the completion depth, and back up the wellbore through the annular region.

In one embodiment, each cooling well is completed at or below a depth of the subsurface formation, and comprises a wellbore, an elongated tubular member within the wellbore, and an expansion valve in fluid communication with the tubular member. The cooling fluid travels through the tubular member to inhibit heating within the subsurface formation. The expansion valve is preferably positioned in the tubular member at or above the depth of the kerogen.

In one embodiment, the cooling well further comprises an annular region formed between the elongated tubular member and a diameter of the wellbore. The cooling fluid is then circulated through the tubular member, to the completion depth (that is, to at least the subsurface formation), and back up the wellbore through the annular region.

In some instances, the subsurface formation comprises in situ water. It is then anticipated that the cooling fluid will cool the subsurface formation sufficient to freeze at least a portion of the in situ water.

It is believed that a plurality of smaller pillars (such as unheated zones 930) provide greater stability to the formation than one or two larger pillars. Therefore, as an alternative, the one or more unheated zones may define at least five non-contiguous, unheated zones that serve as pillars to minimize subsidence. Alternatively, if only a few unheated zones are used, then the unheated zones may be proportionally larger zones (such as unheated zones 1030). The heating rate and distribution of heat within the formation may be designed and implemented to leave sufficient unmatured pillars to prevent subsidence.

A number of methods are provided herein for the step 830 of sizing the cumulative area of the at least one unheated zone. Before discussing the various methods and the factors that are considered, it should be noted that the purpose for sizing the area of the unheated zone is to control subsidence while maximizing hydrocarbon production. Stated another way, it is desirable to optimize that portion of the hydrocarbon development area in which the organic rich rock is pyrolyzed while controlling subsidence above the subsurface formation.

The concept of "controlling" subsidence does not mean that subsidence is eliminated, but rather refers to the idea of anticipating when subsidence may occur under various geometries of unheated zones, and then attempting to maintain a degree of subsidence that is within an amount that can be tolerated. The amount of subsidence that can be tolerated in a development area will vary depending upon the location and environmental sensitivity of the area. For instance, the amount that can be tolerated may be determined by the owner or manager of the surface rights and the owner or operator of the underlying mineral rights in the development area.

Ideally, no subsidence would occur at all, meaning that the difference in elevation before and the after heating and production of hydrocarbons is imperceptible. However, in one aspect, the difference in elevation is less than three feet. More preferably, the difference in elevation is less than one foot or, even more preferably, less than six inches. What is considered to be a "significant" amount of subsidence is dependent on the needs and desires of the operator, the land owner, or any governmental entity or regulatory agency.

In the present disclosure, the concept of "substantially optimizing" a portion of a development area in which organic rich rock is pyrolyzed is offered. This concept does not necessarily mean that a heated area is maximized. In one aspect, "substantially optimizing" means that an area is within 5% of the maximum amount of area that can be heated while avoiding significant subsidence. In another aspect, "substantially optimizing" means that an area is within 10% of the maximum amount of area that can be heated while avoiding significant subsidence.

Various factors may be considered in connection with the step 830 of sizing the cumulative area of the at least one unheated zone. In one embodiment, the step of sizing the area of the at least one unheated zone comprises considering at least one of richness of the organic rich rock, the thickness of the subsurface formation, and the permeability of the subsurface formation. Alternatively, or in addition, the step of sizing the area of the at least one unheated zone includes considering geomechanical properties of the subsurface formation. Such geomechanical properties may include, for example, the Poisson ratio, the modulus of elasticity, shear modulus, a Lame' constant, or combinations thereof.

In one embodiment, the step of sizing the area of the at least one unheated zone is performed using a computer model. The computer model may be, for example, a finite element model. The finite element model assumes that during the heating process, oil and gas are generated in sufficient volumes to keep the average fluid pressure in the heated areas at or near lithostatic pressure. After heating is ended and generation begins to decline, the average fluid pressure will decrease with fluid production until an approximately hydrostatic condition is reached. It is during this pressure decline that subsidence is most likely to occur. In one aspect, the model tracks the stresses in rocks adjacent to the treated volume during this period.

The computer model generally considers the treated volume to be homogeneous, rather than attempting to describe the details of the pyrolysis process on the scale of individual heater wells and flow paths. In one aspect, the model assumes that artificial fractures were formed in the area under development as part of the formation heating process. It also assumes that the organic-rich rock acts as a linearly elastic, isotropic solid.

When using a computer model, the method 800 may include the step of assigning for the computer model an initial post-treatment modulus of elasticity for the area that has been pyrolyzed. In one aspect, the initial post-treatment modulus of elasticity is lower than a modulus of elasticity for the formation in an untreated state. The initial modulus of elasticity may be empirically determined through field tests conducted on untreated rock. Alternatively, the initial modulus of elasticity may be empirically determined through laboratory tests on one or more core samples. Alternatively still, the initial modulus of elasticity may be estimated from previous field tests. The simulated post-treatment modulus is a factor of, for example, 10, 20, 30, 50, 100, 200 and/or 300 times lower than the modulus of elasticity value for untreated rock.

When using a computer model, the method 800 may include the step of assigning for the computer model a first fluid pressure in the heated area. The method 800 then includes confirming that a subsidence failure point has not been reached at the first fluid pressure. A second lower fluid pressure may then be assigned in the heated area. The method 800 then further includes determining whether a subsidence failure point has been reached at the second lower fluid pressure. This progression may be repeated until the fluid pressure is reduced to a point that approximates hydrostatic pressure. This effectively simulates the reduction of fluid pressure within the formation towards a hydrostatic pressure level. At each progression, the model is reviewed to determine whether there is a likelihood of subsidence in the rock above the organic-rich rock.

When using a computer model, the method 800 may include the step of assigning for the computer model a second lower post-treatment modulus of elasticity for the heated area, and then assigning a new first fluid pressure in the heated area. In one aspect, the second post-treatment modulus of elasticity is at least 5 times lower than the pre-treatment modulus of elasticity. Alternatively, the second modulus of elasticity is at least 10, 20 or 30 times lower than the pre-treatment modulus of elasticity. In any event, the method 800 then includes confirming that a subsidence failure point has not been reached at the first fluid pressure.

If the subsidence failure point has not been reached at the first fluid pressure, then a new second lower fluid pressure may be assigned in the heated area. The method 800 then includes determining whether the subsidence failure point has been reached at the second lower fluid pressure for the second post-treatment modulus of elasticity. This progression of lower fluid pressures may again be repeated to simulate the reduction of fluid pressure within the formation towards a hydrostatic pressure level.

In the above methods, the step of confirming that a subsidence failure point has not been reached may comprise confirming that a maximum principal stress does not present a likelihood of faulting within the at least one unheated zone. Alternatively, or in addition, the step of confirming that a subsidence failure point has not been reached may comprise confirming that a Mohr-Coulomb criterion does not present a likelihood of faulting within the at least one unheated zone. Such Mohr-Coulomb criterion is where stresses exceed the Mohr-Coulomb failure line. Alternatively, or in addition, the step of confirming that a subsidence failure point has not been reached may comprise confirming that unacceptable vertical displacement is not taking place at the surface above the organic-rich rock formation. Alternatively, the step of confirming that a subsidence failure point has not been reached may comprise determining when a portion of the rock around a heated zone goes into tension.

The method 800 may also include the step of selecting a first size ratio between an at least one heated area and an at least one unheated area. In this instance, the method 800 may further comprise increasing the size of the selected size ratio by increasing the size of the first heated area relative to the second area to be left unheated. In this way, a second selected size ratio is provided.

It is noted that the first and second size ratios are preferably calculated by using the same configuration for the pyrolyzed area in both ratios. However, in connection with the step of selecting a second size ratio, a different configuration may be used. This, again, is indicated at Box 840 of FIG. 8. For instance, the configuration at the first size ratio may be a square, whereas the configuration at the second size ratio is a rectangle. In this instance, the second size ratio may in fact be substantially similar to the first size ratio when using the new configuration.

In one aspect, the configuration comprises a plurality of substantially circular heated areas, leaving a plurality of unheated zones there between. In another aspect, the configuration comprises a plurality of four-sided polygons that are unheated. In any instance, the above-described steps concerning assigning sequentially lower pore pressures, and then confirming that no subsidence failure condition has occurred may be repeated at a new selected size ratio or configuration.

Referring back to FIGS. 9 and 10, it is noted that a size ratio of the heated areas (represented by the heat fronts 915/1015) to the unheated areas (represented by unheated zones 930/1030) is implied. In FIG. 9, the cumulative area of the unheated areas 930 is about 50% of the overall development area 900. In FIG. 10, the cumulative area of the unheated areas 1030 is about 35% of the overall development area 1000. These percentages will decrease as additional heating takes place towards maturity. Therefore, the operator should be mindful of the optimum portion of the development area in which organic rich rock is pyrolyzed while still controlling subsidence above the subsurface formation.

In one aspect, substantially optimizing that portion of the development area in which the organic rich rock is pyrolyzed comprises identifying a maximum area of heating while still controlling subsidence above the subsurface formation, and then reducing the size of the area of heating by 1 to 10 percent of the maximum area of heating. In another aspect, substantially optimizing a portion of the development area in which the organic rich rock is pyrolyzed comprises identifying a maximum area of heating while still controlling subsidence above the subsurface formation, and then reducing the size of the area of heating by 1 to 5 percent of the maximum area of heating.

Figure 11A:
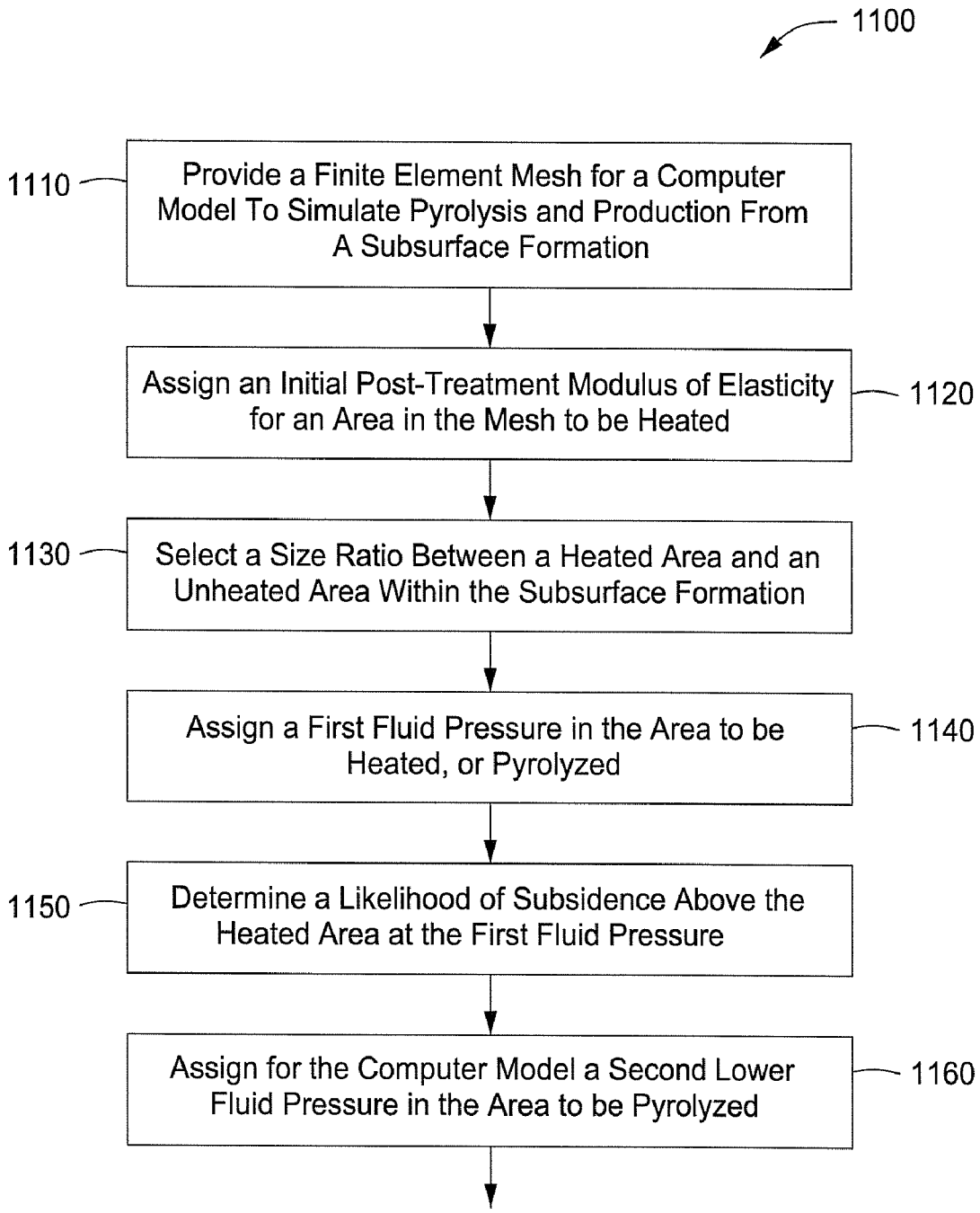
FIGS. 11A and 11B together provide a flow chart showing steps that may be performed in connection with an alternate embodiment of the methods disclosed herein.
Figure 11B:
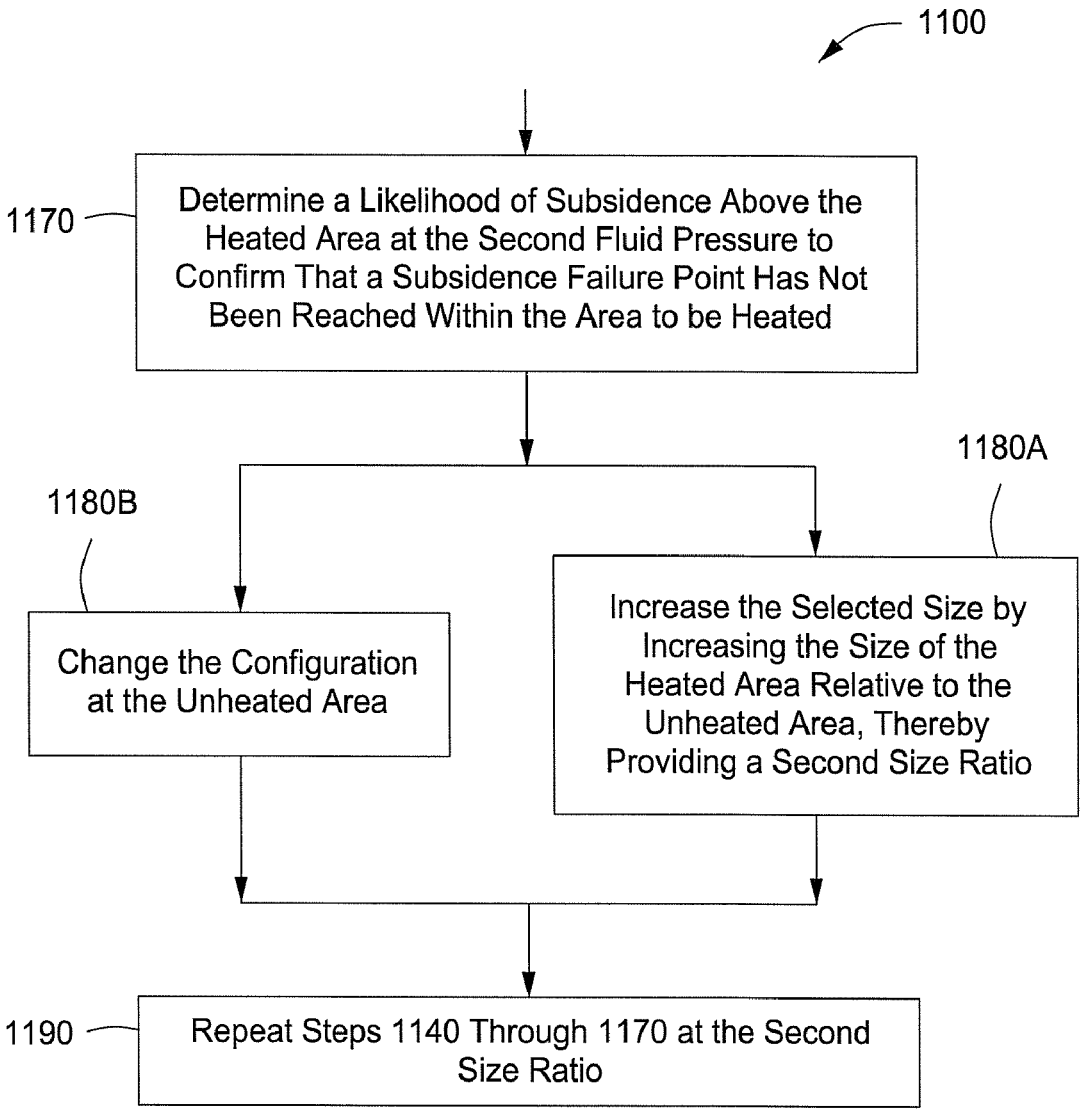

FIGS. 11A and 11B together present another flow chart showing steps that may be performed in connection with an alternate embodiment 1100 of the present inventions. The method 1100 employs a computer model such as a finite element computer model in order to analyze possible subsidence in a subsurface formation as a result of pyrolysis and production activities. Box 1110 shows the step of providing a finite element mesh for a computer model.

The method 1100 also includes the step of selecting an initial post-treatment modulus of elasticity. This is represented in FIG. 11A at Box 1120. The initial post-treatment modulus of elasticity is selected to represent a modulus of elasticity for the subsurface area being developed through pyrolysis and production. The simulated post-treatment modulus is a factor of, for example, 10, 20, 30, 50, 100, 200 and/or 300 times lower than the modulus of elasticity value for untreated rock.

The initial (untreated) modulus of elasticity may be empirically determined through field tests conducted on untreated rock. Alternatively, the initial modulus of elasticity may be empirically determined through laboratory tests on one or more core samples. Alternatively still, the initial modulus of elasticity may be estimated from previous field tests. In method 1100, the rock under investigation is initialized in a softened condition.

The method 1100 further includes the step of selecting a size ratio between a heated area and an unheated area within the subsurface formation. This is shown at Box 1130. It is noted that the heated area need not be one single or contiguous area, but may be a plurality of separate unheated zones that serve as pillars. The unheated area thus represents the cumulative area of the unheated zones.

As an option associated with selecting a size ratio, the operator may determine the shape or shapes of the unheated areas that provide optimum support for the overburden. Further, the operator may determine the location of the unheated areas within the development area for providing optimum support for the overburden.

The method 1100 also includes the step of assigning a first fluid pressure in the area that has been heated, or pyrolyzed. This is indicated at Box 1140. The fluid pressure simulates the degree of pore pressure within the area after treatment.

The method 1100 next includes determining a likelihood of subsidence above the heated area at the first fluid pressure. The purpose is to confirm that a subsidence failure point has not been reached at the first fluid pressure. This determination step is indicated at Box 1150. Various ways may be used to determine the likelihood of subsidence above the heated area. These include, for example, monitoring the displacement of rock above the heated area, or confirming that the maximum principal stress in the unheated area adjacent the heated area does not exceed a failure criterion. This is accomplished through the computer model.

As a next step, the method 1100 includes assigning for the computer model a second lower fluid pressure in the heated area. This step is shown at Box 1160. By stepping down the fluid pressure in the computer model, the production of hydrocarbon and other fluids in the subsurface formation is simulated. Stated another way, stepping the fluid pressure down serves to simulate the production of oil and gas after conversion of the formation hydrocarbons in the organic rich rock at the initial post-treatment modulus of elasticity for the selected size ratio.

A likelihood of subsidence above the heated area is next determined at the second lower fluid pressure. This is shown in FIG. 11B at Box 1170. The purpose of the determination step 1170 is to confirm that rock displacement or maximum principal stress or some other chosen criteria at the second lower fluid pressure does not present a likelihood of subsidence above the heated area at the selected size ratio (Box 1130).

After determining that subsidence is not likely from steps 1110 through 1170, the size ratio of the heated versus unheated areas may be adjusted. Box 1180A indicates the step of increasing the size of the selected size ratio. This is done by increasing the size of the heated area relative to the unheated area. Thus, a second size ratio is provided. From there, steps 1140 through 1170 may be repeated at the second size ratio. This is shown at Box 1190. From step 1190 it is determined whether subsidence above the heated area at the second size is likely.

The steps 1140 through 1180A may be repeated at third, fourth, or additional increased size ratios (Box 1190) until unacceptable rock displacement is anticipated. Preferably, these steps are performed by assuming a modulus of elasticity that is significantly softer than the rock in its untreated or unheated condition (Box 1120). In this way, the area of the treated interval is maximized while avoiding a likelihood of subsidence. The step of Boxes 1180A and 1190 (of selecting a new size ratio and re-running the computer model) may be performed manually by restarting the model or via an automated routine.

In an alternative embodiment, after determining that subsidence is not likely from steps 1120 through 1170, the configuration of the unheated areas may be adjusted. This is shown in FIG. 11B at Box 1180B. From there, steps 1140 through 1170 may be repeated for the new configuration. It is then determined whether subsidence above the heated area at the new configuration is likely. The size ratio may be adjusted at the new configuration in accordance with Box 1180A until unacceptable rock displacement is anticipated.

Figure 12B:
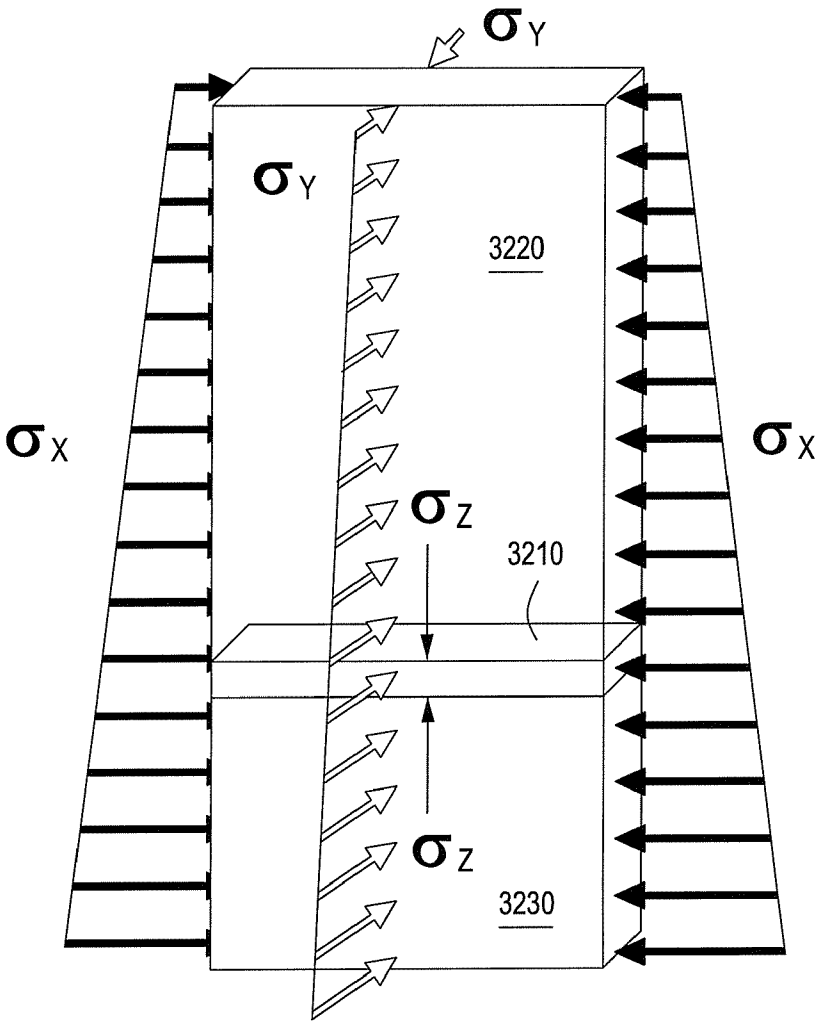
FIG. 12B is a diagram showing stresses acting on a rock system. The rock system includes a treated interval. Lateral stresses are indicated by arrows labeled "$\sigma_x$" and "$\sigma_y$." Vertical stresses due to the weight of the overburden are shown by arrows labeled "$\sigma_z$."
Figure 12A:
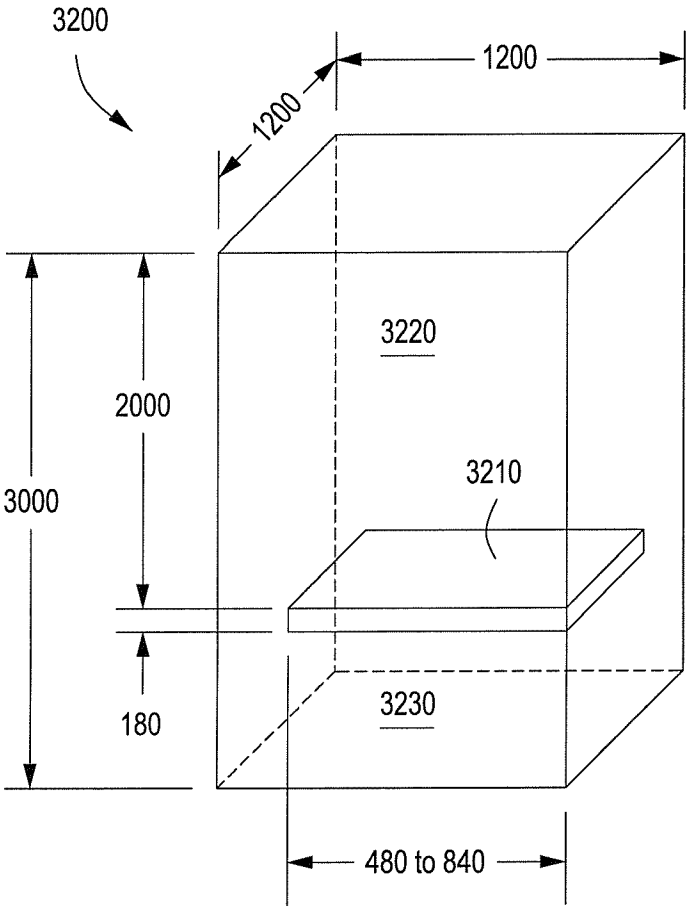
FIG. 12A is an example of a model geometry used for finite element modeling of formation stresses in a subsurface formation. The model represents one-quarter of a treated volume, plus an untreated area surrounding it.

FIG. 12A is an example of a model geometry 3200 used for finite element modeling of formation stresses. The model 3200 is designed to determine whether a pillar of untreated oil shale can adequately mitigate subsidence. The model 3200 represents one-quarter of a treated volume, plus an untreated area surrounding it. The lateral extent of the model 3200 is constant and measures 1,200 feet by 1,200 feet. The treated volume in the model 3200 is square. However, this is merely exemplary, and could represent a quarter of a circle or another shape.

The model 3200 has a treated interval 3210. The lateral dimensions of the treated interval 3210 are preferably varied in test runs to determine a minimum size that prevents subsidence. In one aspect, the size of the treated interval is varied from 840 feet down to 480 feet in width. The thickness of the treated interval 3210 may also be adjusted. In one model the thickness of the treated interval 3200 may be 180 feet.

The treated interval 3200 may also be placed at different depths, reflecting the depth of a targeted organic-rich rock in a development area. In the illustrative model of FIG. 12A, the treated interval 3210 is at a depth of 2,000 feet, meaning that an overburden 3220 of 2,000 feet is assumed. An underburden 3230 of 820 feet is also assumed in the model 3200.

FIG. 12B presents a diagram showing stresses acting on the treated interval 3210 of FIG. 12A. The initial loading of the finite element model 3200 is shown schematically. Lateral stresses are indicated by arrows labeled "$\sigma_x$" and "$\sigma_y$." Vertical stresses corresponding to the weight of overlying rocks are shown by arrows labeled "$\sigma_z$." It can be seen that lateral stresses "$\sigma_x$" and "$\sigma_y$" increase with depth. Together, the "$\sigma_x$", "$\sigma_y$", and "$\sigma_z$." stresses define the in situ stresses for rocks in the development area.

The "$\sigma_x$" and "$\sigma_y$" stresses vary linearly, and are not necessarily equal. For instance, it can be seen that lateral stress, "$\sigma_x$" increases with depth. The "$\sigma_z$" stress is predominantly a function of the weight of the overburden 3220. The "$\sigma_z$" stress will increase with depth throughout the section.

Referring generally to both FIGS. 12A and 12B, the model 3200 may be built using different elements. In the illustrative model 3200, the model is built using 20-noded brick elements. Laterally a 10 by 10 mesh may be used, making the elements 120 feet on a side. Elements in the treated interval 3210 may have various sizes. In the model 3200, the elements are 60 feet in thickness. This means that three elements are provided vertically for the treated zone 3210. Overburden 3220 and underburden 3230 elements are made to be 200 feet thick and 164 feet thick, respectively, though they may be any convenient thicknesses. Elements within the treated interval 3210 are designated as pore-pressure elements, while elements outside of the treated interval 3210 are designated as stress-only elements.

It is desirable to test the stresses acting above and below the treated interval 3210 by changing the size of the treated interval 3210. Therefore, as noted the size of the treated interval 3210 may be varied from run to run by changing the number of elements designated as pore-pressure elements or, alternatively, by varying the size of the elements.

According to the model 3200, pressure exists in the treated interval 3210. The pressure is in the form of fluid pressure, referred to as "pore pressure." In each run for the computer model 3200, and as demonstrated more fully below in connection with FIGS. 14A through 14D and 15A through 15D, the fluid pressure in the treated interval 3210 may be decreased in 50-psi increments.

To simulate the response of the treated interval 3200 after heating, the computer model may be assigned a geomechanical property. In one aspect, the geomechanical property is an initial post-treatment modulus of elasticity. A separate value is assigned to the rocks in the treated interval 3210 and to the untreated rocks in the surrounding formations. The untreated rocks are assigned properties similar to organic-rich rock comprised of unconverted oil shale. In connection with the model 3200, the Young's modulus may be 2.3e6 psi, and the Poisson ratio may be 0.2.

For the treated interval 3210, it is assumed that heating softens the oil shale. More specifically, heating causes pyrolysis in the oil shale which in turn creates formation fluids. The fluids are then removed as part of a production process. Preferably, laboratory tests are conducted to estimate the post-heating mechanical properties of oil shale in the treated interval 3210. This allows for the mechanical integrity of the treated interval 3210 to be pre-determined so that a more accurate model may be run. Computer runs may then be performed that assume a softened condition of the treated interval 3210. For example, an initial run may be made that assumes a Young's modulus that is 5 times, or alternatively, 10 times lower than the untreated value of 2.3e6 psi. The Poisson ratio of the treated interval 3210 may also be assumed as 0.2.

After assuming a reduced pressure state of the treated interval 3210, a computer run is made. During the run, the pressure within the treated interval 3210 is incrementally reduced. For example, an initial pore pressure of approximately 1,900 psi may be assumed. Then, the pressure is incrementally reduced to a value of approximately 600 psi, or another value that approximates hydrostatic pressure. During this run, if it is determined that the untreated rocks around or above the treated interval 3210 are able to withstand the removal of fluids from the treated interval 3210 at a given geometry, then a subsequent run may be made that assumes a still greater amount of production. In one aspect, a new Young's modulus is used that is 30 times lower than the untreated value of 2.3e6 psi. During this run, the pressure within the treated interval 3210 is again incrementally reduced. This sequence may be repeated at even lower elasticity values, such as a Young's modulus that is 100 times lower than the untreated value of 2.3e6 psi, or even 300 times lower than the untreated value of 2.3e6 psi. A modulus of elasticity range of 10 to 300 times lower than the untreated rock effectively spans the range from slight production (where the treated interval can support a portion of its overburden) to a state where the treated volume behaves almost as if it were excavated.

Figure 13A:
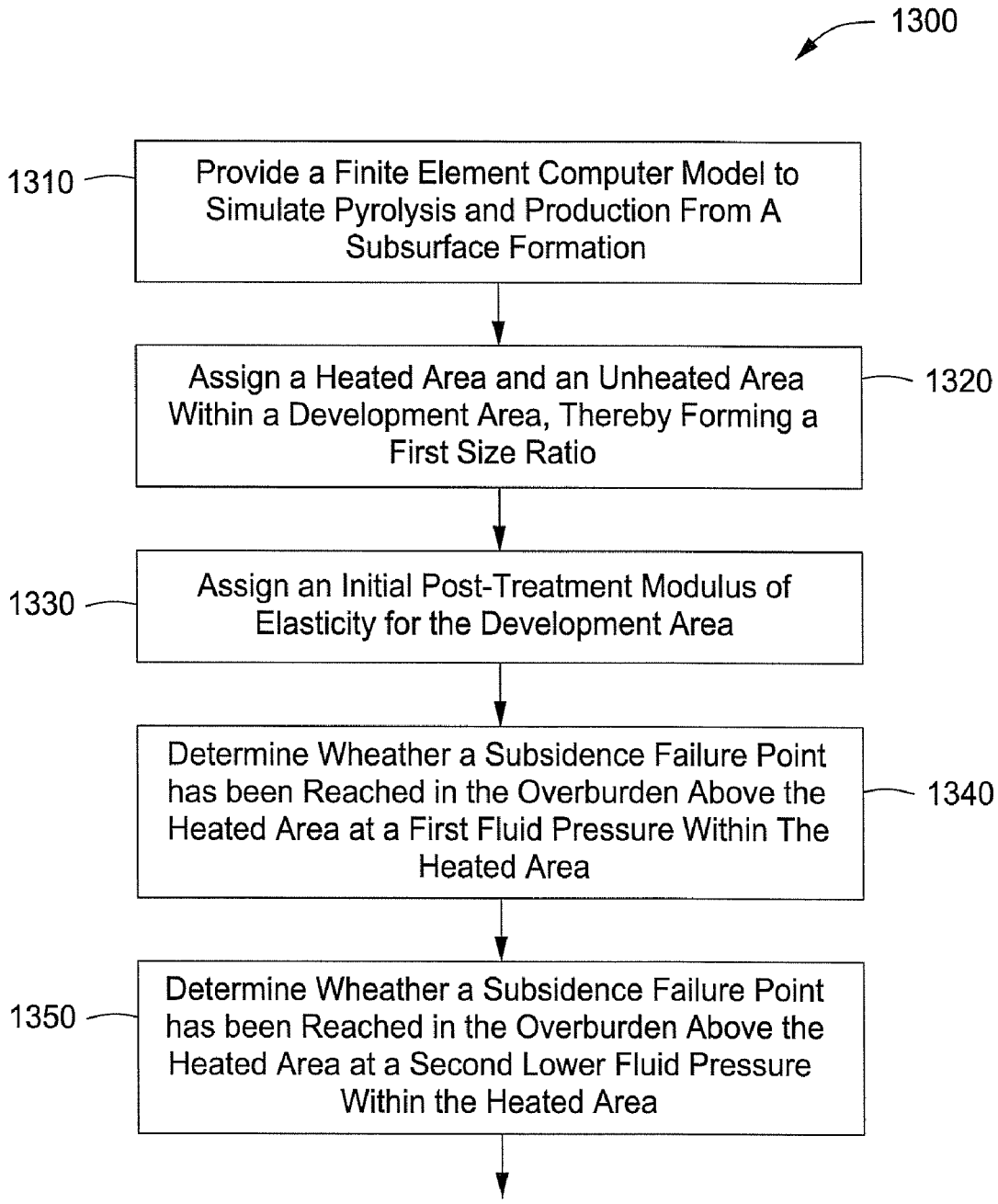
FIGS. 13A and 13B together demonstrate steps that may be performed in connection with an alternate embodiment of the methods for developing hydrocarbons from a subsurface formation disclosed herein.
Figure 13B:
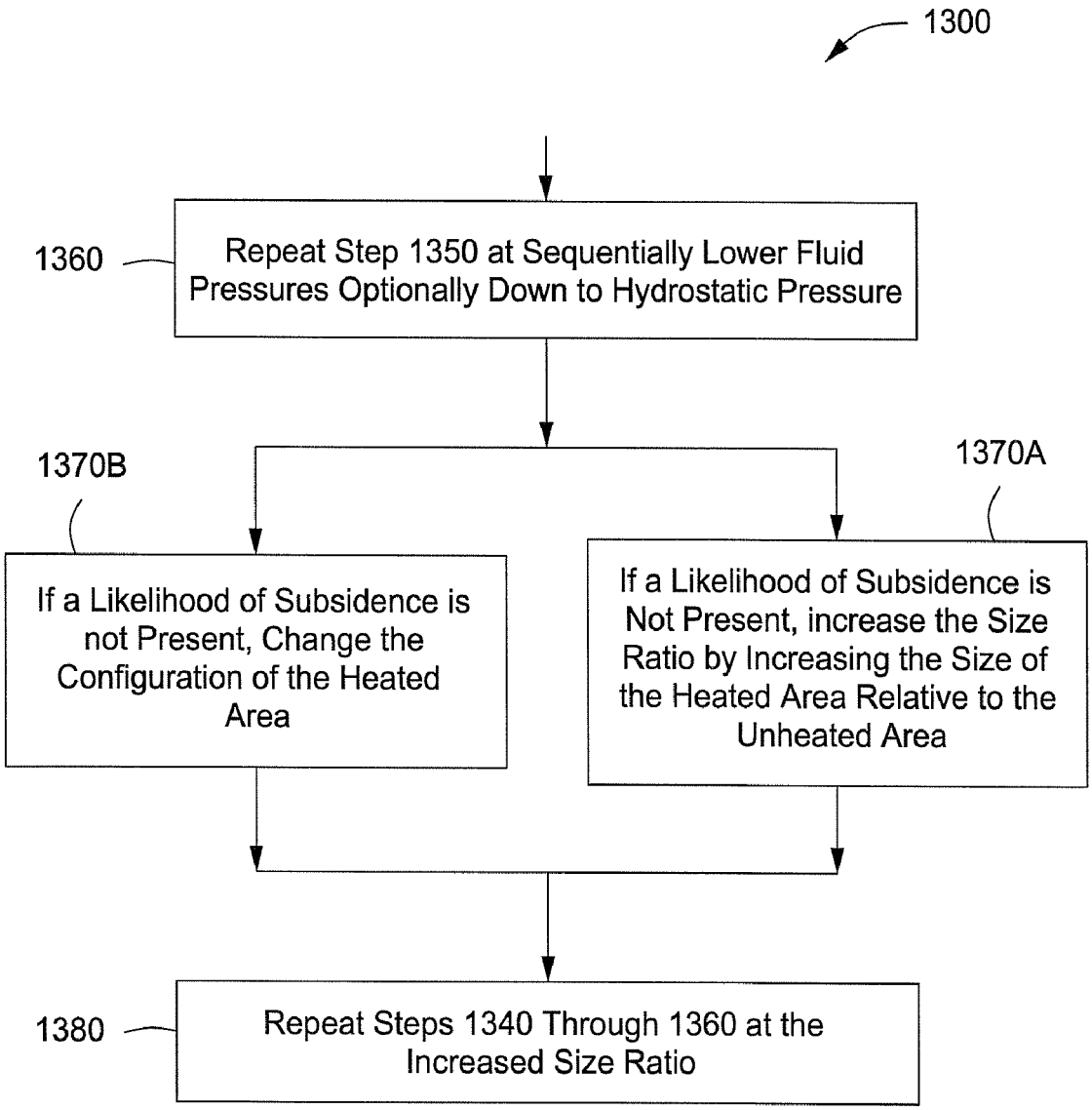

FIGS. 13A and 13B together present in flow chart form an implementation of the model 3200 of FIG. 12A as discussed above, using method 1300. The method 1300 demonstrates steps that may be performed in connection with an alternate embodiment of the methods disclosed herein. The method 1300 again relates to developing hydrocarbons from a subsurface formation containing organic-rich rock. Preferably, the organic-rich rock formation is comprised of solid hydrocarbons. Preferably, the solid hydrocarbons comprise kerogen.

The method 1300 employs the finite element computer model 3200 in order to analyze possible subsidence above the treated interval 3210 as a result of pyrolysis and production activities. Box 1310 shows the step of providing a finite element computer model. The purpose of the step 1310 is to simulate the production of hydrocarbon fluids from the subsurface formation at a given model geometry.

In connection with method 1300, areas are assigned to the computer model 3200. The areas represent a heated area and an unheated area within a development area. This step is shown in FIG. 13A at Box 1320. In the illustrative model 3200, the heated area represents one-quarter of a treated volume, and is represented by treated interval 3210. The unheated area is understood to be adjacent the treated interval 3210, but is not shown. Initially, the unheated area may represent approximately 50% of the development area. The heated area 3210 versus an adjacent unheated area defines a size ratio.

A geomechanical property is assigned for the heated area 3210. The geomechanical property may be, for example, an initial post-treatment modulus of elasticity. This step is represented by Box 1330. The initial post-treatment modulus of elasticity is selected to represent a modulus of elasticity for the subsurface area being developed through pyrolysis and production. The simulated post-treatment modulus is a factor of, for example, 10, 20, 30, 50, 100, 200 and/or 300 times lower than the modulus of elasticity value for untreated rock.

The initial (untreated) modulus of elasticity may be empirically determined through field tests conducted on untreated rock. Alternatively, the initial modulus of elasticity may be empirically determined through laboratory tests on one or more core samples. Alternatively still, the initial modulus of elasticity may be estimated from previous field tests. In the method 1300, the rock under investigation is initialized in a softened condition.

Next, it is determined whether a subsidence failure point has been reached in the overburden 3220 above the heated area 3210. This is indicated at Box 1340. In this instance, one determines whether the principal stress in the rock above the heated area 3210 becomes tensile. This represents a subsidence failure point. The subsidence failure point is determined at a first fluid pressure assigned within the heated area 3210.

If a subsidence failure point has not been reached at the first fluid pressure level, then the method 1300 also includes determining whether a subsidence failure point has been reached in the overburden 3220 above the heated area 3210 at a second fluid pressure assigned within the heated area 3210. This is indicated at Box 1350. This again may involve a determination as to whether the principal stress in the rock above the heated area 3210 goes into a state of tension.

It is preferred that the step 1350 be repeated at sequentially lower fluid pressures until a subsidence failure point is reached, or until the fluid pressure reaches a level that approximates hydrostatic pressure. This is shown at Box 1360. In one aspect, the fluid pressure is sequentially dropped in 50 psi increments to a hydrostatic pressure level. By stepping down or reducing the fluid pressure within the formation, one is able to simulate the production of fluids from the heated area 3210. This production is reflective of solid hydrocarbons having been pyrolyzed within the heated area 3210 and subsequently removed.

Other failure criteria besides the maximum principal stress being tensile may be analyzed in order to determine whether a subsidence failure point has been reached. For example, the step of determining whether a subsidence failure point has been reached in the rock above the heated area may comprise determining whether a shear stress in the rock above the heated area 3210 or, perhaps, adjacent the heated area, exceeds a Mohr-Coulomb failure criterion. Such criteria may also include the Drucker-Prager failure criteria, the Cam-clay model, or various other "critical state" models.

In one embodiment, the method 1300 further includes increasing the size of the selected size ratio by increasing the size of the heated area 3210 relative to the unheated area. In this way, a new size ratio is provided. This step is indicated in FIG. 13B at Box 1370A. Steps 1340 through 1360 may then be repeated at the new size ratio. This step is shown at Box 1380. The purpose is to determine whether (or to confirm that) a subsidence failure point has been reached in the rock above the heated area 3210 at the new selected size ratio. Where maximum principal stress is used as a geomechanical property, this may involve determining whether a likelihood of faulting exists within the unheated zone 3210. This, in turn, may involve considering whether the overburden 3220 rock has gone into a state of substantial tension.

In an alternative embodiment, after determining that subsidence is not likely from steps 1320 through 1370A, the configuration of the unheated area may be adjusted. This is shown at Box 1370B. From there, steps 1340 through 1360 may be repeated for the new configuration. It is then determined whether subsidence above the heated area at the new configuration is likely. The size ratio may optionally be adjusted at the new configuration in accordance with Box 1370A until unacceptable rock displacement is anticipated.

As discussed above, the pore pressure within the treated interval 3210 may be incrementally reduced to simulate the production of fluids from the organic-rich rock formation. Again, production is reflective of solid hydrocarbons having been pyrolyzed within the heated area 3210, and then removed. FIGS. 14A through 14D present calculated stresses for pressure increments 34A, 34B, 34C, 34D from a model run 3400 wherein pore pressure in a treated volume 3410 is incrementally decreased. The model 3400 shows a treated volume 3410 within a development area 3405. An overburden 3407 is provided over the treated volume 3410 extending to the surface, and an underburden 3409 below the treated volume 3410. In this model 3400, the treated volume 3410 is laterally 840 feet by 840 feet (1,680 feet×1,680 feet on a full pattern).

The model 3400 is tilted in each of FIGS. 14A to 14D to provide a better interior view for the treated volume 3410. In other words, FIGS. 14A, 14B, 14C and 14D provide isometric views of a formation model that is substantially vertical, but is shown leaning merely for illustrative purposes. In addition, the rock representing the treated volume 3410 is actually removed. This allows a better view of the stresses in an untreated portion 3420 below and around the treated volume 3410. However, this too is for illustrative purposes as it is understood that rock is present, particularly at the beginning 14A of the model run.

The model 3400 is initialized in a stress state reflecting the uplift and tectonics in the Piceance Basin. Different mechanical properties are used in the model 3400 for the treated volume 3410 and for the untreated portion 3420. The rock in the untreated portion 3420 is preferably assigned properties similar to unconverted oil shale. The Young's modulus may be, for example, 2.3e6 psi, and the Poisson ratio may be 0.2.

For the treated volume 3410, it is assumed that heating softens the oil shale. The model 3400 represents a single run with a post-heating or post-treatment modulus of elasticity for the treated volume 3410 that is softer than the modulus of elasticity for the untreated portion 3420 around the treated volume 3410, including the overburden 3407. In the illustrative model 3400, the modulus of elasticity was simulated to be 300 times softer than the modulus of elasticity for the untreated rock 3420. This corresponds to the treated volume 3410 behaving almost as if it were excavated. The treated volume 3410 was also assigned an initial porosity of 25%.

It is understood that other properties may be used in lieu of modulus of elasticity. These may include porosity, permeability, shear modulus, $V_p/V_s$ Poisson ratio, or a Lame' constant. Values for these properties may be assumed in the treated volume 3410.

In connection with the model run 3400, the fluid pressure in the treated volume 3410 was decreased in 50-psi increments. It is noted that pressure increments 34A, 34B, 34C, and 34D do not show each 50-psi increment, but only show incremental pressure reductions of 400-psi.

The model 3400 shows vertical stress profiles (measured in pounds per square foot) acting on the treated volume 3410. The model 3400 also shows horizontal stress profiles (measured in pounds per square foot) acting around the treated volume 3410. The stress profiles represent the maximum principal stress, which is the most tensional stress acting on the rock. Maximum principal stress is indicated by shades of gray, with greater compression levels (that is, more negative stress) being shown in darker shades. The maximum principal stress ranges from 0.0 lb/ft$^2$ to −4.0e5 lb/ft$^2$ (0 to −400,000 lb/ft$^2$).

In FIGS. 14A through 14D the maximum principal stresses developed in the rocks 3407 and 3420 surrounding the treated volume 3410 is monitored as the fluid pressure declines. In model 3400, portions of the rocks 3407 and 3420 surrounding the treated volume 3410 are monitored so as to detect whether tensional stresses develop. If tensional stresses arise that exceed the strength of the rocks 3407 and 3420, particularly in the overburden 3407, faulting is likely to occur, potentially causing subsidence. If faulting does not occur, the elastic response of the rocks 3407 and 3420 surrounding the treated volume 3410 will likely prevent noticeable subsidence from occurring.

Figure 14B:
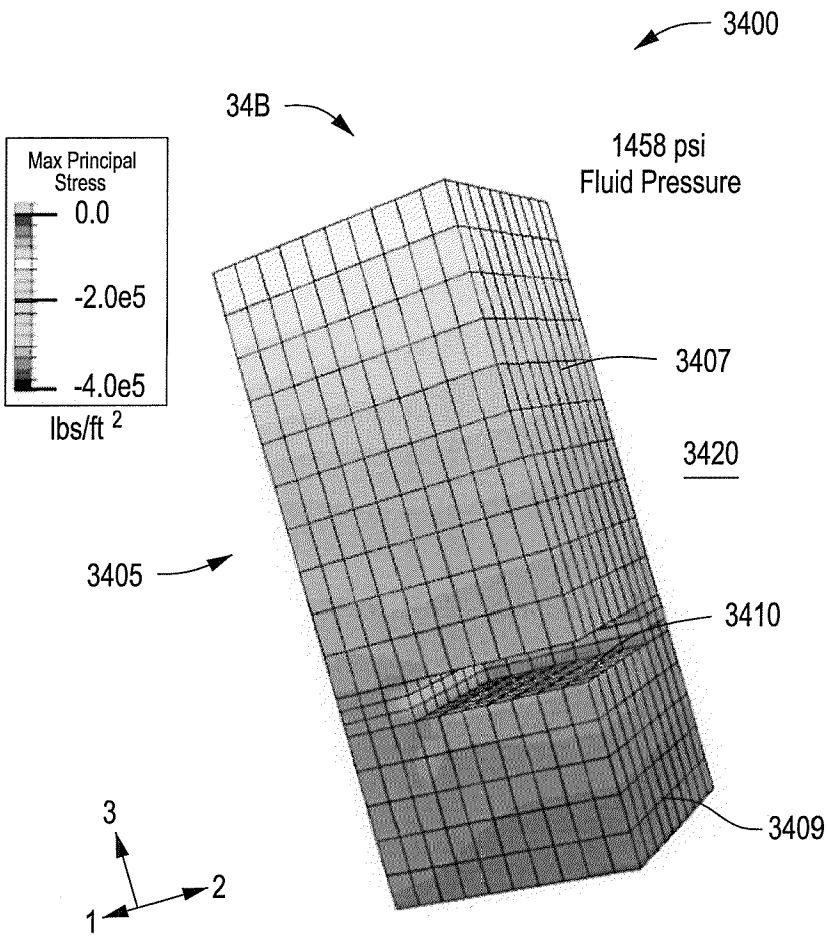
FIGS. 14A through 14D display the results of a computer model in terms of the maximum principal stress acting on rocks within an oil shale development area. In these results, the post-treatment elastic modulus of the treated oil shale is modeled to be 300 times lower than its pre-treatment value.
Figure 14A:
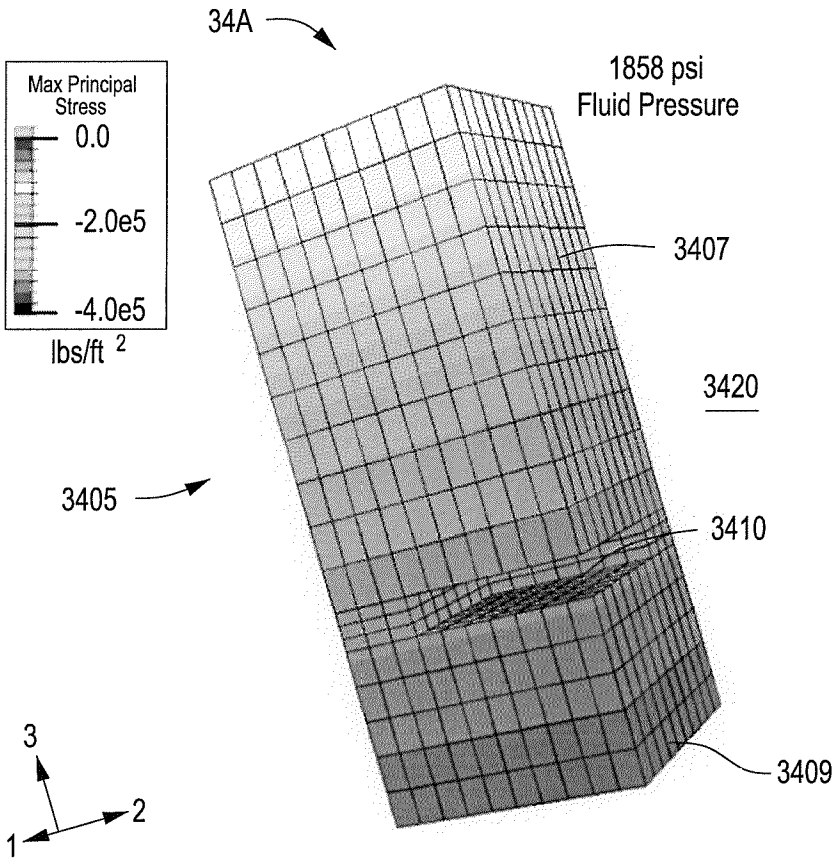

In the pressure increment 34A of FIG. 14A, it can be seen that the stress level is horizontally constant at the various depths. The rock in the overburden 3407 has not entered a state of tension, and there is minimal likelihood of faulting above the treated interval 3410. It should be noted that this does not mean that subsidence in the overburden 3405 cannot occur. However, it does mean that there will not be catastrophic subsidence as a result of faulting.

FIG. 14B represents a second pressure increment 34B. In FIG. 14B, fluid pressure in the treated volume 3410 is reduced to 1,458 psi. This is a 400 psi drop. In the pressure increment 34B, it can be seen that the stresses are less compressive below (or more tensile) the surface, but no tensile stress conditions are observed. Thus, there is little or no likelihood of faulting above the treated interval 3410.

Figure 14D:
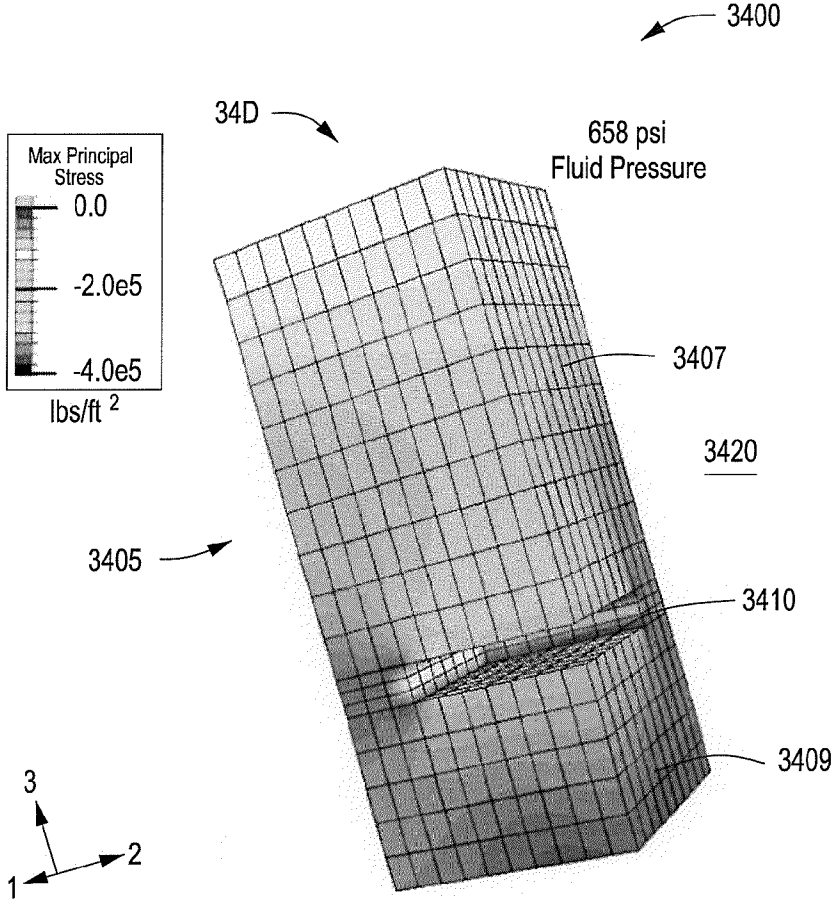
Figure 14C:
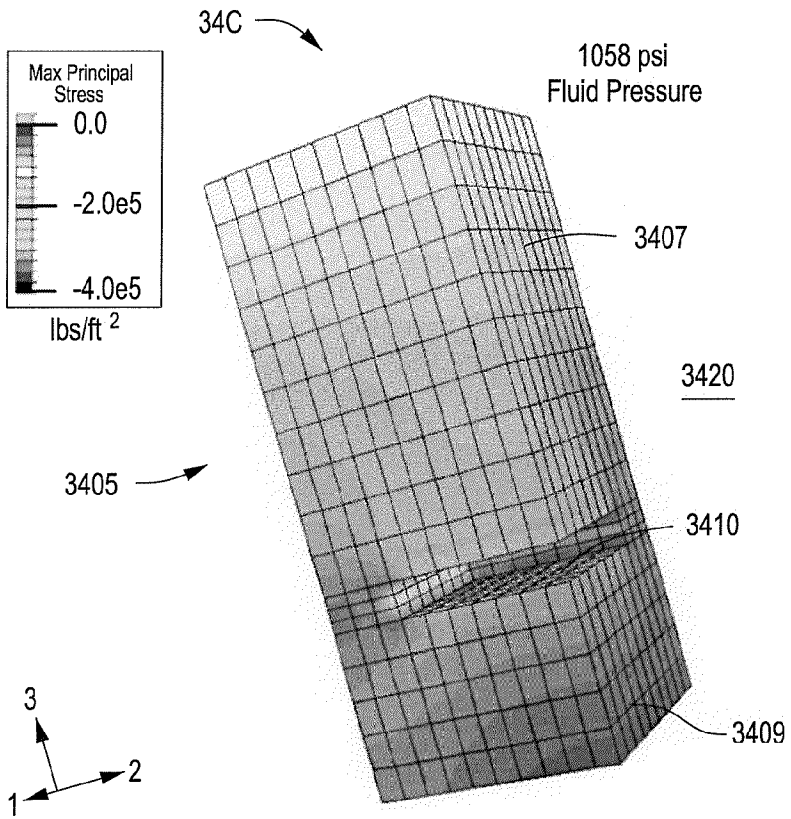

FIG. 14C represents a third pressure increment 34C. In FIG. 14C, fluid pressure in the treated volume 3410 is further reduced to 1,058 psi. This represents another 400 psi incremental pressure drop. In the pressure increment 34C, it can be seen that the stresses are again less compressive (or more tensile), but again no tensile stress conditions are observed. Particularly, the maximum principal stress values above and adjacent the treated interval 3410 remain moderate. Thus, there is again little to no likelihood of faulting or, inferentially, subsidence above the treated interval 3410.

FIG. 14D represents a fourth pressure increment 34D. In FIG. 14D, fluid pressure in the treated volume 3410 is further reduced to 658 psi. This represents still another 400 psi reduction. This amount is very close to hydrostatic pressure.

In the pressure increment 14D of FIG. 14D, it can be seen that the stresses are again less compressive. Close examination indicates that several very small areas directly adjacent to the treated interval are experiencing tensile stresses. However, even in this increment there actually are no tensile stresses calculated at element integration points. It is understood that the interpolation of stresses to model nodes for presentation creates artifacts that may result in small areas which appear to be in tension adjacent to the treated volume. However, these artifacts are of no consequence.

The pressure increments 34A, 34B, 34C, 34D indicate that only at the lowest fluid pressure (658 psi) are there any tensile stresses in the model 3400. However, even at the lowest increment 34D there is little likelihood of subsidence, and certainly no suggestion of wholesale faulting. Therefore, a subsidence failure point at this modulus of elasticity parameter and this particular geometry is not detected.

FIGS. 15A through 15D represent the same computer model as used to generate pressure increments 34A through 34D. However, FIGS. 15A through 15D present calculated displacements instead of stresses 3500 to detect subsidence in an oil shale development area 3505. More specifically, model 3500 determines rock displacement above a treated volume 3510. The model 3500 shows displacement of rock, measured in feet. The range of displacement is from +1.0 foot to −1.0 foot. Displacement is indicated by shades of gray, with negative displacement being shown in darker shades. These displacements are calculated based on an assumption of elastic behavior of the rocks. As expected, elastic behavior (no failure) leads to only small displacements and subsidence.

As with FIGS. 14A through 14D, FIGS. 15A through 15D present pressure increments 35A, 35B, 35C, and 35D wherein pore pressure in the treated volume 3510 is incrementally decreased to determine the effect on rock displacement above the treated volume 3510. The model 3500 shows the treated volume 3510 within the development area 3505. An overburden 3507 is provided over the treated volume 3510 extending to the surface, and an underburden 3509 below the treated volume 3510. In this model 3500, the treated volume 3510 is again laterally 840 feet by 840 feet (1,680 feet by 1,680 feet on a full pattern).

As with model 3400, the model 3500 is tilted in each of FIGS. 15A to 15D to provide a better interior view for the treated volume 3510. In other words, FIGS. 15A, 15B, 15C and 15D provide isometric views of a formation model that is substantially vertical, but is shown leaning merely for illustrative purposes. In addition, the rock representing the treated volume 3510 is again removed to allow for a better view of the stresses in an untreated portion 3520 around the treated volume 3510. This too is for illustrative purposes.

As discussed above, each pressure increment 35A, 35B, 35C, 35D assumes an untreated portion 3520 adjacent the treated volume 3510. Different mechanical properties were used in the model 3500 for the treated volume 3510 and for the untreated portion 3520. As noted, for the treated volume 3510, it was assumed that heating would soften the oil shale. In this respect, the Young's modulus was increased to a factor that is 300 times above the value assigned to the untreated rock 3520. Of course, other Young's modulus values may be employed as demonstrated below in connection with FIG. 16.

In the model runs, the fluid pressure in the treated volume 3510 was decreased in 50-psi increments. It is noted that pressure increments 35A, 35B, 35C, and 35D do not show each 50-psi increment, but only show increments of 400-psi pressure reductions. In FIGS. 15A through 15D, displacement appearing in the overburden 3507 above the treated volume 3510 is monitored as the fluid pressure declines.

Figure 15B:
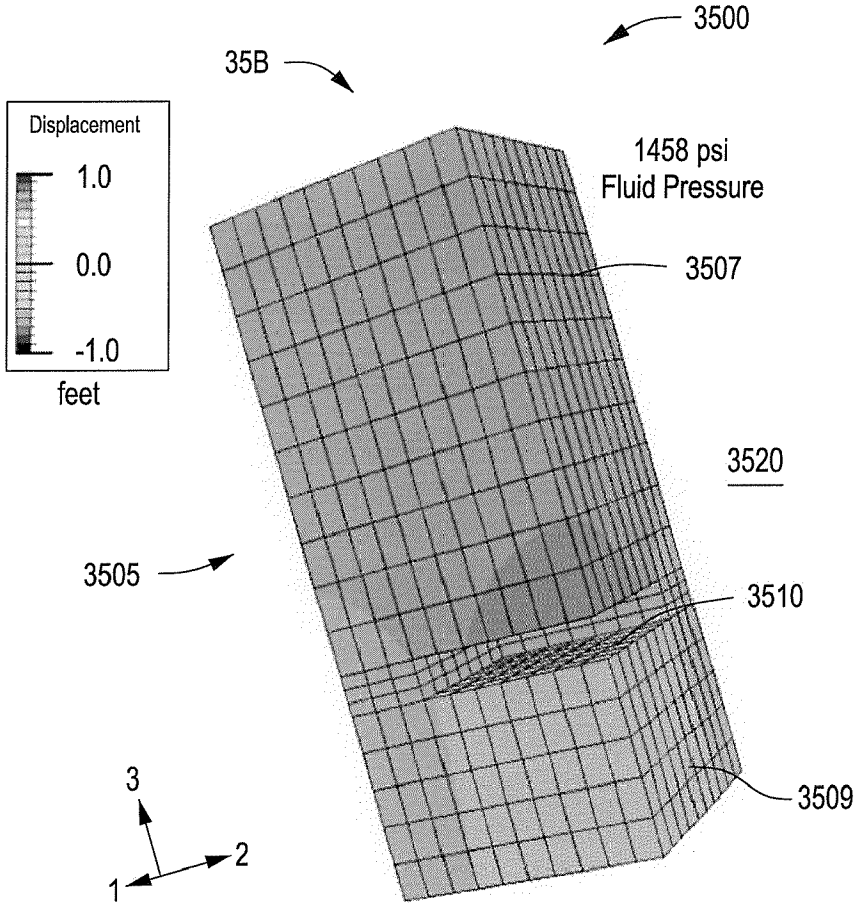
FIGS. 15A through 15D display displacements calculated by the same computer model that was used to generate the stresses displayed in FIGS. 14A through 14D.
Figure 15A:
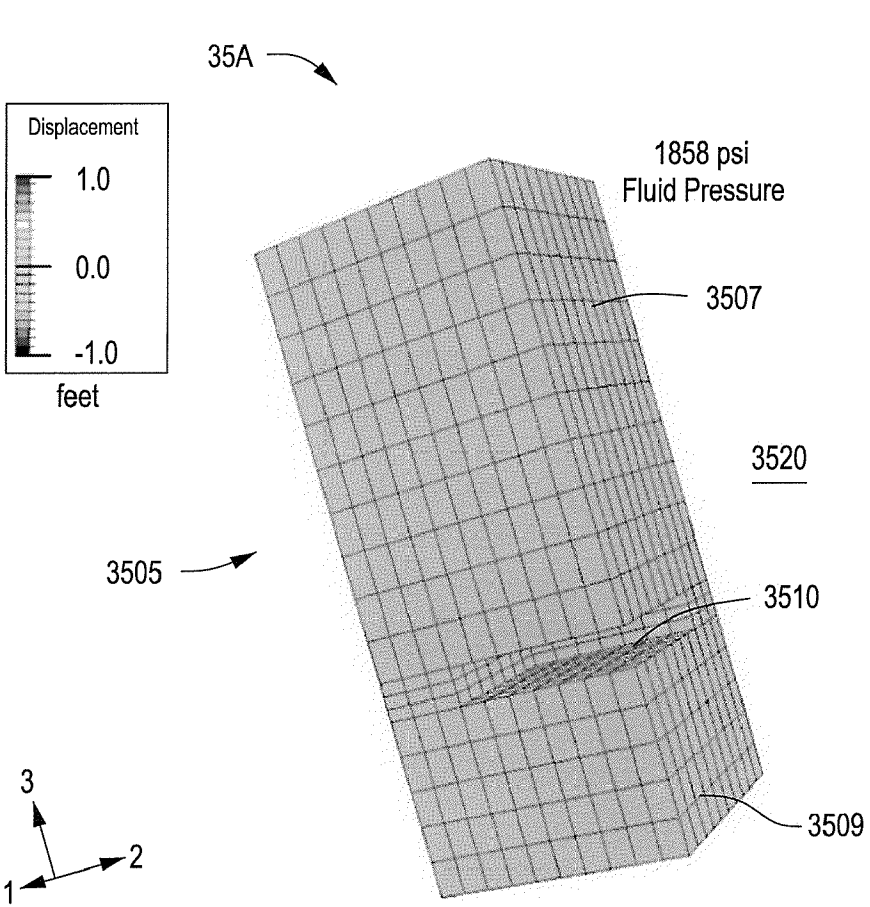

FIG. 15A represents the pressure increment 35A at an initial state. In accordance with the model, fluid pressure in the treated volume 3510 was initialized at 1,858 psi. In the pressure increment 13A, it can be seen that no displacement has taken place at any level within the overburden 3407. The shading in the overburden 3507 is monochromatic. Thus, there is no subsidence anticipated at the initial state.

FIG. 15B represents the second pressure increment 35B. In FIG. 35B, fluid pressure in the treated volume 3510 is reduced to 1,458 psi. It can be seen that some slight negative displacement is beginning to take place below the surface and immediately above the treated volume 3510. However, the overburden 3507 remains stable and no catastrophic subsidence above the treated volume 3510 is anticipated.

Figure 15D:
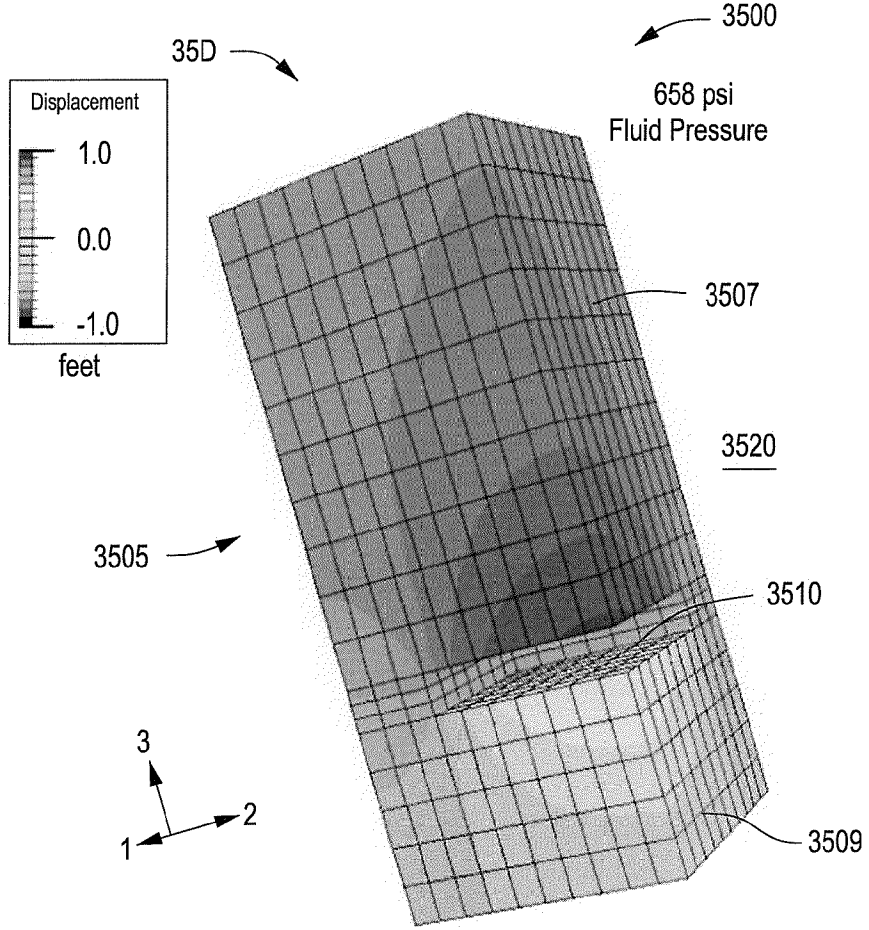
Figure 15C:
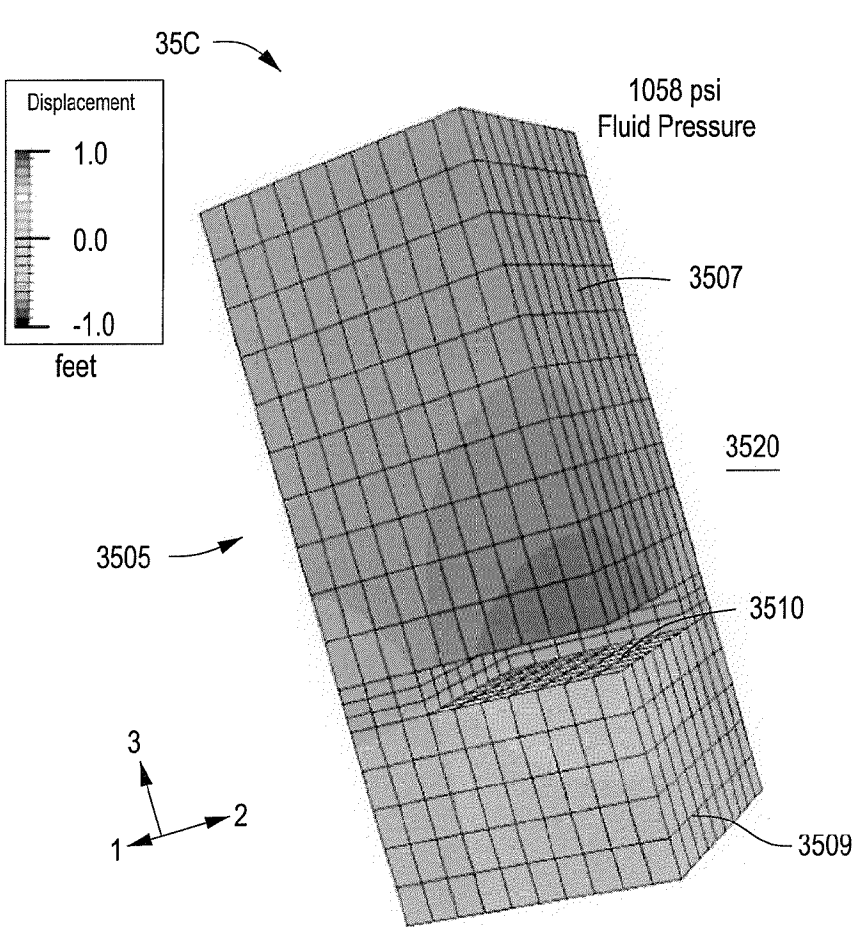

FIG. 15C represents the third pressure increment 35C. In FIG. 35C, fluid pressure in the treated volume 3510 is further reduced to 1,058 psi. In the pressure increment 13C, it can be seen that negative displacement of less than one-half of one foot just above the treated volume 3510 is taking place. Displacement at the surface may be occurring, but only in terms of a few inches.

Finally, FIG. 15D represents the pressure increment 35D at a fourth state. In FIG. 15D, fluid pressure in the treated volume 3510 is further reduced to 658 psi. This amount is very close to hydrostatic pressure.

In the pressure increment 35D, it can be seen that negative displacement of just under one foot is taking place immediately above the treated volume 3510. Displacement at the surface is also occurring, but only in terms of about six inches. The displacement in FIG. 15D indicates that in the absence of any faulting, the level of subsidence should be relatively minor. The largest vertical displacement in the pressure increment 15D is directly over the treated volume 3510. At the surface there is potentially about one-half of one foot of movement.

The stress simulation of FIGS. 14A through 14D did not project any subsidence at the assumed initial post-treatment modulus of elasticity of 300 times lower than initial state.

However, the subsidence simulation of FIGS. 15A through 15D did project a possibility of a small amount of subsidence. Thus, the value of running two different simulations is demonstrated. It will now be up to the analyst to decide whether a subsidence value of up to six inches is within an established failure criterion, or whether it exceeds an established failure criterion. It is anticipated that in a typical production operation, a six inch subsidence experience would be well within a range of tolerance for the land owner or the production operator. However, to further control subsidence, an operator could choose to reduce the area of the treated interval to provide further support. Other options would include changing the configuration to increase the number of pillars without reducing the overall size of the unheated area.

It is demonstrated from FIGS. 14A-14D and 15A-15D that "pillars" of untreated oil shale would control subsidence. Based on the confirmatory results of the modeling, a method for developing hydrocarbons from a subsurface formation is substantiated. Each unheated zone (or pillar) may be circular, may be a four-sided polygon, may be star-shaped, or may have another shape. The optimum size of the area of the subsurface formation to be heated is preferably at least as large as a size of the area to be left unheated. More preferably, the optimum size of the area to be heated is a size that is at least 20 percent greater than the size of the area to be left unheated. More preferably still, the optimum size of the area to be heated is a size that is at least 40 percent greater than the size of the area to be left unheated. Alternatively, the optimum size of the area to be heated defines a percentage of about 60 percent to 90 percent of the development area. Moreover, the optimum size of a single contiguous unheated area may be less than 25 percent of the development area or even less than 10 percent of the development area.

Figure 16:
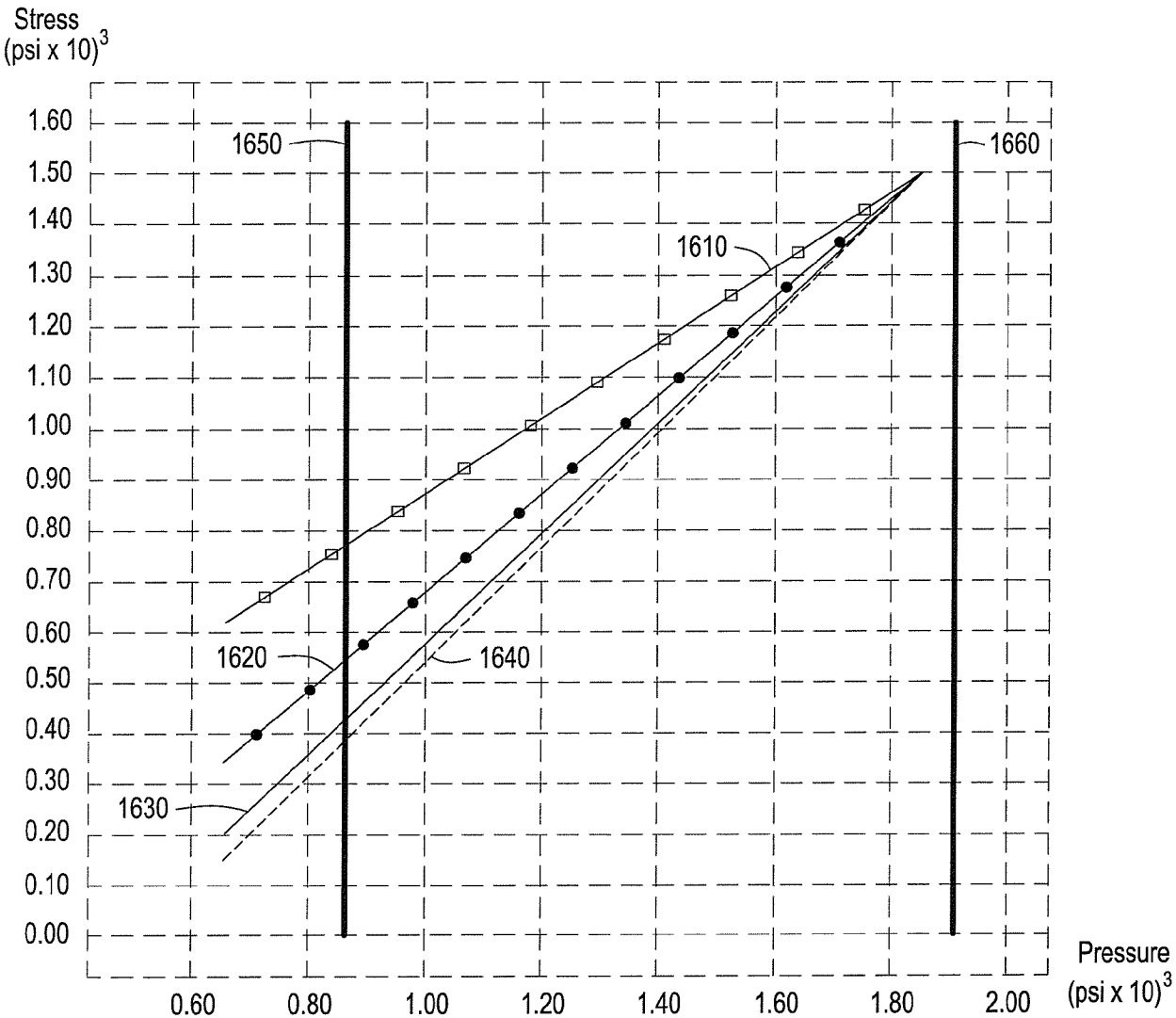
FIG. 16 is a graph wherein different plots are made of the fluid pressure in a treated volume (shown on the horizontal, or "x" axis) against the maximum principal stress in a model formation (shown on the vertical, or "y" axis). Four different runs representing different post-treatment elastic moduli for a treated volume are demonstrated.

It is desirable to compare the results of a number of model pressure increments at different levels of softening, or conversion, within an oil shale formation. FIG. 16 provides a graph wherein different plots are made of the fluid pressure in a treated volume (shown on the horizontal or "x" axis) against the maximum principal stress in a model formation (shown on the vertical or "y" axis).

FIG. 16 shows four model runs made within the 840-foot by 840-foot section defining the treated volume 3410 or 3510. Each run is represented by a line, indicated at 1610, 1620, 1630 and 1640, respectively. Each run 1610, 1620, 1630, 1640 reflects a change or variation in the amount of softening of the rock in the treated volume. In the model runs 1610, 1620, 1630, 1640, softening represents the change in elastic modulus.

In the four runs, the Young's modulus for the treated interval in an unheated state was increased by various factors, as follows:

- line 1610 represents a run at a modulus of elasticity of 10 times less than the untreated estimate;
- line 1620 represents a run at a modulus of elasticity of 30 times less than the untreated state;
- line 1630 represents a run at a modulus of elasticity of 100 times less than the untreated state; and
- line 1640 represents a run at a modulus of elasticity of 300 times less than the untreated state.

Thus, each line represents a progressively softer condition for the treated interval.

For each run 1610, 1620, 1630, 1640 the maximum stress at element integration points was extracted and plotted. It can be seen from FIG. 16 that the stresses move toward becoming tensile as fluid pressure decreases. However, the stresses do not go below 150 psi of compression in any of the runs 1610, 1620, 1630, 1640. Since the stress never becomes tensile, the likelihood of faulting and excessive subsidence is minimized.

It is also interesting to note that results of decreasing the elastic modulus by factors of 100 and 300 (represented by lines 1630 and 1640, respectively) are quite similar. This indicates that the amount of softening at a modulus of elasticity of 100 times lower than an unheated state (represented by line 1630) is actually the point where the treated volume provides no effective support for its overburden.

FIG. 16 also shows two vertical lines. Hydrostatic pressure in the model formation is shown by vertical line 1650, while lithostatic pressure in the model formation is shown by vertical line 1660. The lithostatic pressure represents the likely starting point where the overburden load begins to be supported by the rock rather than the fluid pressure in the treated volume. The hydrostatic pressure represents the likely end point, at which fluid pressure will fall no further. It is observed that as the modulus of elasticity is lowered (such as in run 1640 where the modulus of elasticity of the treated volume is simulated to be 300 times less than in its untreated state), the formation becomes tensile at a lower stress value.

Figure 17:
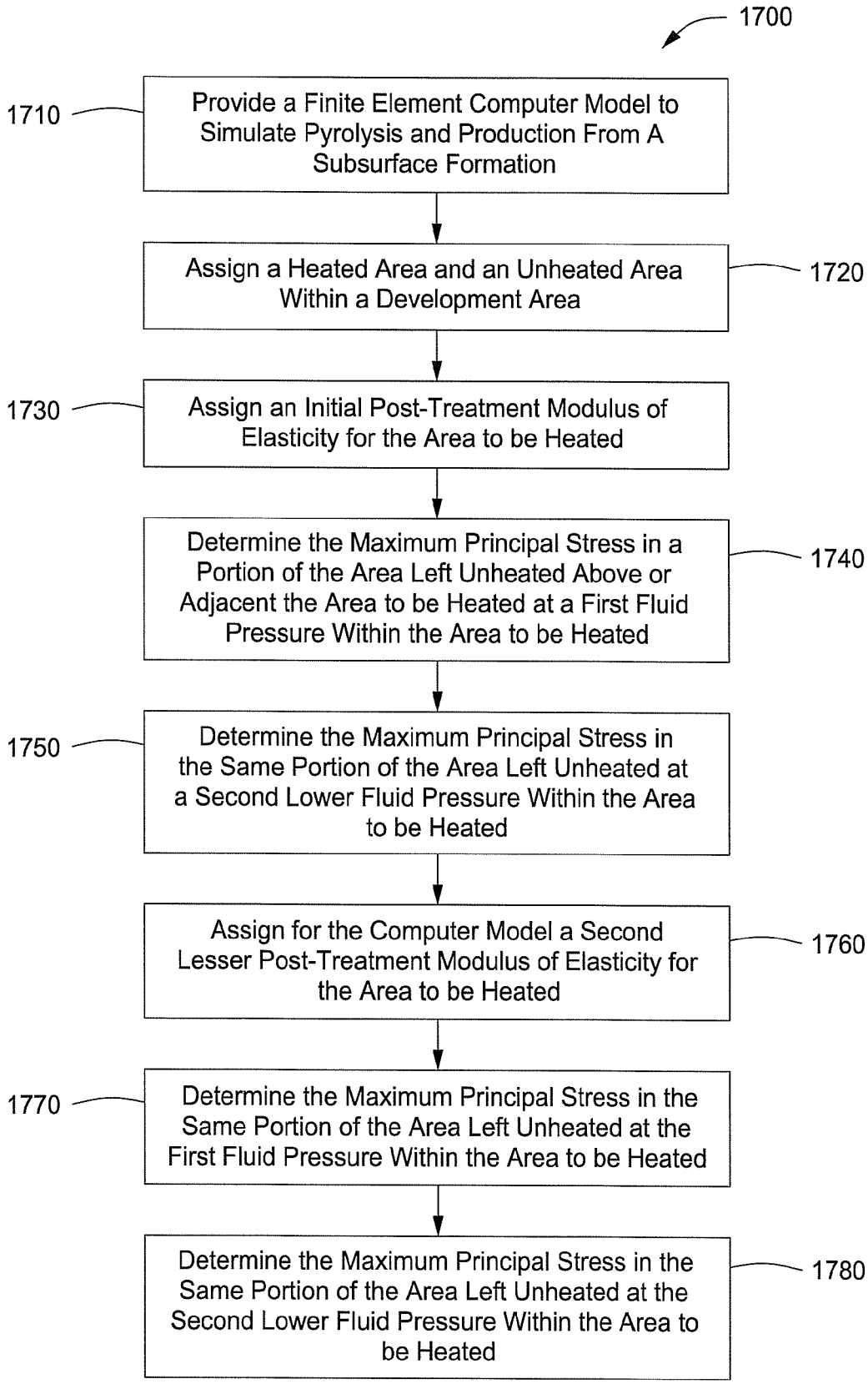
FIG. 17 demonstrates steps that may be performed in connection with an alternate embodiment of the methods for developing hydrocarbons from a subsurface formation disclosed herein.

FIG. 17 presents another flow chart showing steps that may be performed in connection with an alternate embodiment 1700 of the present inventions. In this method 1700, the modulus of elasticity of a treated interval is sequentially lowered in accordance with the graph of FIG. 16. The method 1700 again relates to developing hydrocarbons from a subsurface formation containing organic-rich rock. Preferably, the organic-rich rock formation is comprised of solid or heavy hydrocarbons. Preferably, the solid hydrocarbons comprise kerogen.

The method 1700 employs the finite element computer model 3200 in order to analyze possible subsidence in the treated interval 3210 as a result of pyrolysis and production activities. Box 1710 shows the step of providing a finite element computer model. The purpose of the step 1710 is to simulate the production of hydrocarbon fluids from the subsurface formation.

In connection with method 1700, areas are assigned to the computer model 3200. The areas represent a heated area and an unheated area within a development area. This step is shown at Box 1720. The heated and unheated areas are adjacent to one another. In the illustrative model 3200, the heated area represents one-quarter of a treated volume, and is represented by treated interval 3210. The unheated area is understood to be adjacent the treated interval 3210, but is not shown. In one aspect, the initial unheated area represents approximately 50% of the development area. The heated area 3210 versus an adjacent unheated area defines a size ratio.

A geomechanical property is assigned for the heated area 3210. The geomechanical property is an initial post-treatment modulus of elasticity. This step is represented by Box 1730. The initial post-treatment modulus of elasticity may be a modulus that is, for example, 10 times the modulus of elasticity for the rock volume in its untreated state.

Next, it is determined whether a subsidence failure point has been reached in the overburden 3220 above the heated area 3210. This is indicated at Box 1740. In one aspect, the subsidence failure point is determined by analyzing the maximum principal stress in the overburden. In this instance, one determines whether the principal stress in the rock above the heated area 3210 becomes tensile. Alternatively, the subsidence failure point is determined by analyzing the maximum principal stress in a portion of the area left unheated adjacent the heated area 3210. In any event, the subsidence failure point is determined at a first fluid pressure assigned within the heated area 3210. The fluid pressure is representative of an early pore pressure.

The method 1700 also includes determining whether a subsidence failure point has been reached in the overburden 3220 above the heated area 3210 at a second fluid pressure. This is indicated at Box 1750. The second fluid pressure represents a pore pressure that is lower than the first fluid pressure assigned within the heated area 3210. The subsidence failure point is preferably determined by analyzing the maximum principal stress in the overburden. This again would involve a determination as to whether the principal stress in the rock above the heated area 3210 goes into a state of tension. In addition, changes in stress in the rock immediately adjacent to the heated area 3210 may be considered.

It is preferred that the step 1750 be repeated at sequentially lower fluid pressures until a subsidence failure point is reached or until the pore pressure approximates hydrostatic pressure. In one aspect, the fluid pressure is sequentially dropped in 50 psi increments to a hydrostatic pressure level. By stepping down or reducing the fluid pressure within the formation, one is able to simulate the production of fluid hydrocarbons from the heated area 3210 after pyrolysis, or treatment.

In accordance with FIG. 16 wherein runs were made at multiple moduli of elasticity, a second post-treatment modulus of elasticity is selected for the heated area 3210. This step is shown in Box 1760. The second post-treatment modulus of elasticity is lower than the first post-treatment modulus of elasticity. This means that the rock in the heated area 3210 is assigned a softer value. In one instance, the second lesser post-treatment modulus of elasticity is 30 times lower than the modulus of elasticity of untreated rock.

Next, it is determined whether a subsidence failure point has been reached in the overburden 3220 above the heated area 3210 at the second lesser modulus of elasticity. This is indicated at Box 1770. In this instance, one determines whether the principal stress in the rock above the heated area 3210 becomes tensile. In any event, the subsidence failure point is determined at a first fluid pressure assigned within the heated area 3210. The fluid pressure is again representative of an early pore pressure.

The method 1700 also includes determining whether a subsidence failure point has been reached in the overburden 3220 above the heated area 3210 at a second fluid pressure. This is indicated at Box 1780. The second fluid pressure represents a pore pressure that is lower than the first fluid pressure assigned within the heated area 3210. This again would involve a determination as to whether the principal stress in the rock above the heated area 3210 goes into a state of tension. In addition, changes in stress in the rock immediately adjacent to the heated area may be considered.

It is preferred that the step 1780 be repeated at sequentially lower fluid pressures until a subsidence failure point is reached or until the pore pressure approximates hydrostatic pressure. In one aspect, the fluid pressure is sequentially dropped in 50 psi increments to a hydrostatic pressure level. By stepping down or reducing the fluid pressure within the formation, one is again able to simulate the production of fluid hydrocarbons from the heated area 3210, but at a second lesser modulus of elasticity.

It is noted that the flow charts in FIGS. 8, 9, 13 and 17 are merely illustrative. Other embodiments of the methods are within the scope of the claims, below. In one aspect, the method includes the steps of assigning an area of the subsurface formation to be heated, and also assigning an area of the subsurface formation to be left unheated. An initial value for a geomechanical property of the heated area is assigned. The geomechanical property represents a softened condition of the heated area. An assigned pore pressure in the heated area is incrementally decreased. From there, at least one of (1) the displacement of rock above the heated area, or (2) the maximum principal stress in the unheated area adjacent to the heated area at the second value for the geomechanical property, is evaluated. In this way, a likelihood of subsidence within the heated area may be considered.

Various geomechanical properties or criteria may be used. For example, the geomechanical property may be Young's modulus, shear modulus, $V_p/V_s$, Poisson ratio, or a Lame' constant.

In one aspect, the method further includes providing a second value of the geomechanical property in order to simulate a further softening of the organic rich rock relative to the initial value of the geomechanical property. From there, at least one of (1) the displacement of rock above the heated area, or (2) the maximum principal stress in the unheated area adjacent the first heated area at the initial value for the geomechanical property, may again be evaluated. In this way, a likelihood of subsidence within the heated area may be considered.

As part of the method, the step of increasing a size of the area of the subsurface formation to be heated relative to a size of the area to be left unheated may be performed. As part of the method, the shape or configuration of the area to be left unheated may be simultaneously or independently varied. The above steps may then be repeated at the new size ratio. Ideally, subsequent size ratios are provided and the steps repeated again so that an optimum size of the area of the subsurface formation to be heated relative to a size of the area to be left unheated may be determined.

In one aspect, the area of the subsurface formation to be left unheated defines a first configuration. After determining that subsidence above the heated area is predicted, the configuration of the subsurface formation to be left unheated may be changed to a second configuration. The above steps may then be repeated at the new configuration or the new size ratio.

It is preferred that the geomechanical property is the post-treatment modulus of elasticity. In one aspect, the initial value for the post-treatment modulus of elasticity is at least 5 times lower than the modulus of elasticity for the untreated area. Alternatively, the initial value for the post-treatment modulus of elasticity is at least 10 times lower than the modulus of elasticity for the untreated area. Subsequent values for the post-treatment modulus of elasticity may be 30 times lower than the modulus of elasticity for the untreated area, or even 300 times lower than the modulus of elasticity for the untreated area. A value of 100 to 300 times lower than the virgin modulus of elasticity is very likely to simulate a formation having virtually no independent ability to support an overburden.

The optimum size of the area of the subsurface formation to be left unheated relative to the overall size of the development area will vary depending on the rock properties in the subsurface formation. Other factors such as depth of the subsurface formation may also affect the optimum size. In one aspect, the optimum size defines a percentage of about 40 percent to 90 percent of the overall development area. Alternatively, the optimum size defines a percentage of about 60 percent to 90 percent. Alternatively still, the optimum size defines a percentage of about 65 percent to 80 percent.

In addition to the above methods, a method of minimizing environmental impact in a hydrocarbon development area is also provided. The hydrocarbon development area includes a subsurface oil shale formation. The method includes reviewing the topography of the hydrocarbon development area, and determining portions of the topography that are amenable to subsidence without significant environmental impact. For example, topological areas that are substantially flat or that have only modest profile changes may tolerate subsidence more than topological areas that have greater surface relief. Alternatively, areas with little vegetation may suffer less environmental impact due to changes in runoff than areas with much vegetation. Alternatively still, areas that have no buildings are preferred for subsidence pyrolysis over areas that have permanent surface structures. The method also comprises heating the oil shale formation primarily below those portions of the topography that are amenable to subsidence without significant environmental impact in order to pyrolyze the oil shale and produce hydrocarbons.

In one aspect, the method further includes determining a portion of the topography that is more environmentally sensitive to subsidence than the portions of the topography that are amenable to subsidence without significant environmental impact. From there, the method includes inhibiting the heating of a portion of the oil shale formation below that portion of the topography that is more environmentally sensitive, thereby forming a pillar.

The step of inhibiting the heating may include drilling at least one cooling well through the oil shale formation below the portion of the topography that is more environmentally sensitive to subsidence. It may also include injecting a cooling fluid into the cooling well in order to inhibit pyrolysis within the portion of the oil shale formation below that portion of the topography that is more environmentally sensitive to subsidence. The cooling fluid may be any fluid that is not artificially heated at the surface.

Yet an additional method for developing hydrocarbons from an oil shale formation is provided herein. The method comprises mechanically characterizing geological forces acting upon the oil shale formation, and also mechanically characterizing the oil shale formation after at least partial pyrolysis of the oil shale formation has taken place. The method also comprises selecting a first prototype pillar geometry, and selecting a dimension for the first prototype pillar geometry representing a first selected percentage area of the oil shale formation. Preferably, the first prototype pillar geometry is one quarter of a square. A subsidence model for the first prototype pillar geometry at the first selected percentage area is then run.

An evaluation takes place in connection with the method. In this respect, the method also includes evaluating whether failure of the oil shale formation may occur at the selected first prototype pillar geometry and the first selected percentage area.

The method may further comprise selecting a dimension for the first prototype pillar geometry representing a second selected percentage area of the oil shale formation, and then running a subsidence model for the first prototype pillar geometry at the second selected percentage area. An evaluation again takes place. In this respect, the method also includes evaluating whether failure of the oil shale formation may occur at the selected first prototype pillar geometry and the second selected percentage area.

The method may further include selecting a second prototype pillar geometry, and selecting a dimension for the second prototype pillar geometry representing a first selected percentage area of the oil shale formation. A subsidence model for the second prototype pillar geometry at the first selected percentage area may then be run, and an evaluation made as to whether failure of the oil shale formation may occur at the selected second prototype pillar geometry and the first selected percentage area.

In one aspect, the step of mechanically characterizing geological forces acting upon the oil shale formation comprises assigning overburden and underburden forces acting upon the oil shale formation. In another aspect, the step of mechanically characterizing the oil shale formation after at least partial pyrolysis of the oil shale formation comprises assigning a post-treatment modulus of elasticity that is lower than an initial modulus of elasticity for the oil shale formation prior to pyrolysis.

In one aspect, the step of evaluating whether failure of the oil shale formation may occur at the selected first prototype pillar geometry and the first selected percentage area comprises determining whether rock in the overburden immediately above the oil shale formation goes into a state of tension. In another aspect, the step of evaluating whether failure of the oil shale formation may occur at the selected first prototype pillar geometry and the first selected percentage area comprises determining whether unacceptable displacement of rock in the overburden occurs.

It is preferred that the first selected percentage area represents no more than 50 percent of the oil shale formation within a development area. More preferably, the first selected percentage area represents no more than 25 percent of the oil shale formation, or no more than 10 percent of the oil shale formation within a development area. Preferably, the first prototype pillar geometry defines at least two separate pillars within the oil shale formation.

In some embodiments, compositions and properties of the hydrocarbon fluids produced by an in situ conversion process may vary depending on, for example, conditions within an organic-rich rock formation. Controlling heat and/or heating rates of a selected section in an organic-rich rock formation may increase or decrease production of selected produced fluids.

In one embodiment, operating conditions may be determined by measuring at least one property of the organic-rich rock formation. The measured properties may be input into a computer-executable program. At least one property of the produced fluids selected to be produced from the formation may also be input into the computer-executable program. The program may be operable to determine a set of operating conditions from at least the one or more measured properties. The program may also be configured to determine the set of operating conditions from at least one property of the selected produced fluids. In this manner, the determined set of operating conditions may be configured to increase production of selected produced fluids from the formation.

In accordance with one aspect of the production processes of the present inventions, a temperature distribution within the organic-rich rock formation may be computed using a numerical simulation model. The numerical simulation model may calculate a subsurface temperature distribution through interpolation of known data points and assumptions of formation conductivity. In addition, the numerical simulation model may be used to determine other properties of the formation under the assessed temperature distribution. For example, the various properties of the formation may include, but are not limited to, permeability of the formation.

The numerical simulation model may also include assessing various properties of a fluid formed within an organic-rich rock formation under the assessed temperature distribution. For example, the various properties of a formed fluid may include, but are not limited to, a cumulative volume of a fluid formed in the formation, fluid viscosity, fluid density, and a composition of the fluid formed in the formation. Such a simulation may be used to assess the performance of a commercial-scale operation or small-scale field experiment. For example, a performance of a commercial-scale development may be assessed based on, but not limited to, a total volume of product that may be produced from a research-scale operation.

In certain areas with oil shale resources, additional oil shale resources or other hydrocarbon resources may exist at lower depths. Other hydrocarbon resources may include natural gas in low permeability formations (so-called "tight gas") or natural gas trapped in and adsorbed on coal (so called "coal-bed methane"). In some embodiments with multiple shale oil resources it may be advantageous to develop deeper zones first and then sequentially shallower zones. In this way, wells need not cross hot zones or zones of weakened rock. In other embodiments in may be advantageous to develop deeper zones by drilling wells through regions being utilized as pillars for shale oil development at a shallower depth.

Simultaneous development of shale oil resources and natural gas resources in the same area can synergistically utilize certain facility and logistic operations. For example, gas treating may be performed at a single plant. Likewise personnel may be shared among the developments.

It is believed that lithostatic stress can affect the composition of produced fluids generated within an organic-rich rock via heating and pyrolysis. This implies that the composition of a produced hydrocarbon fluid can also be influenced by altering the lithostatic stress of the organic-rich rock formation. For example, the lithostatic stress of the organic-rich rock formation may be altered by choice of pillar geometries and/or locations and/or by choice of heating and pyrolysis formation region thickness and/or heating sequencing.

The following discussion of FIGS. 18-27 concerns data obtained in Examples 1-5 which are discussed below in the section labeled "Experiments". The data was obtained through experimental procedures, gas and liquid sample collection procedures, hydrocarbon gas sample gas chromatography (GC) analysis methodology, gas sample GC peak integration methodology, gas sample GC peak identification methodology, whole oil gas chromatography (WOGC) analysis methodology, whole oil gas chromatography (WOGC) peak integration methodology, whole oil gas chromatography (WOGC) peak identification methodology, and pseudo component analysis methodology discussed in the Experiments section. For clarity, when referring to gas chromatography chromatograms of hydrocarbon gas samples, graphical data is provided for one unstressed experiment through Example 1, two 400 psi stressed experiments through Examples 2 and 3, and two 1,000 psi stressed experiments through Examples 4 and 5. When referring to whole oil gas chromatography (WOGC) chromatograms of liquid hydrocarbon samples, graphical data is provided for one unstressed experiment through Example 1, one 400 psi stressed experiments through Example 3, and one 1,000 psi stressed experiment through Example 4.

Figure 18:
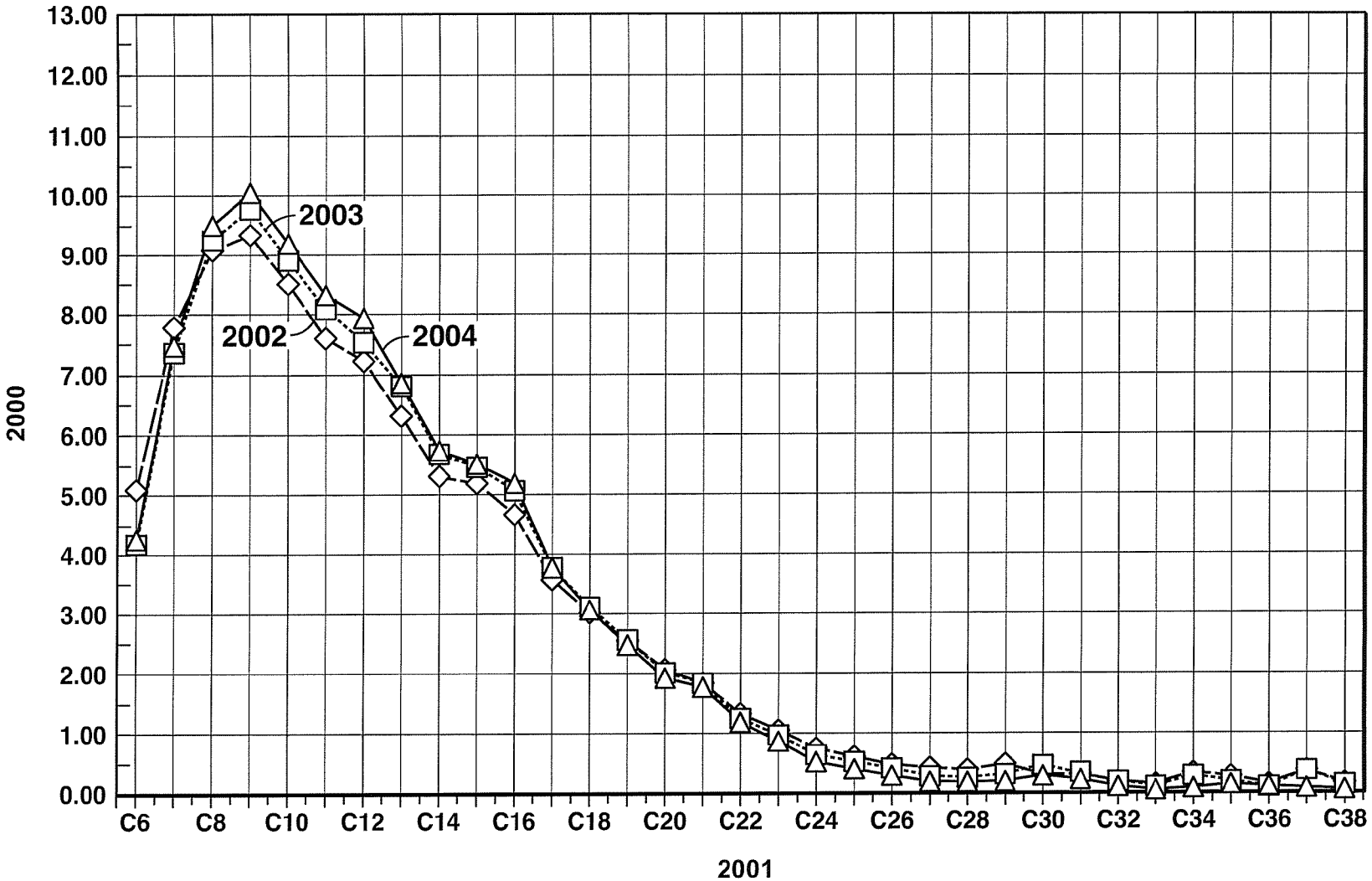
FIG. 18 is a graph of the weight percent of each carbon number pseudo component occurring from C6 to C38 for laboratory experiments conducted at three different stress levels.

FIG. 18 is a graph of the weight percent of each carbon number pseudo component occurring from C6 to C38 for each of the three stress levels tested and analyzed in the laboratory experiments discussed herein. The pseudo component weight percentages were obtained through the experimental procedures, liquid sample collection procedures, whole oil gas chromatography (WOGC) analysis methodology, whole oil gas chromatography (WOGC) peak identification and integration methodology, and pseudo component analysis methodology discussed in the Experiments section. For clarity, the pseudo component weight percentages are taken as a percentage of the entire C3 to pseudo C38 whole oil gas chromatography areas and calculated weights. Thus the graphed C6 to C38 weight percentages do not include the weight contribution of the associated gas phase product from any of the experiments which was separately treated. Further, the graphed weight percentages do not include the weight contribution of any liquid hydrocarbon compounds heavier than (i.e. having a longer retention time than) the C38 pseudo component. The y-axis 2000 represents the concentration in terms of weight percent of each C6 to C38 pseudo component in the liquid phase. The x-axis 2001 contains the identity of each hydrocarbon pseudo component from C6 to C38. The data points occurring on line 2002 represent the weight percent of each C6 to C38 pseudo component for the unstressed experiment of Example 1. The data points occurring on line 2003 represent the weight percent of each C6 to C38 pseudo component for the 400 psi stressed experiment of Example 3. While the data points occurring on line 2004 represent the weight percent of each C6 to C38 pseudo component for the 1,000 psi stressed experiment of Example 4. From FIG. 18 it can be seen that the hydrocarbon liquid produced in the unstressed experiment, represented by data points on line 2002, contains a lower weight percentage of lighter hydrocarbon components in the C8 to C17 pseudo component range and a greater weight percentage of heavier hydrocarbon components in the C20 to C29 pseudo component range, both as compared to the 400 psi stress experiment hydrocarbon liquid and the 1,000 psi stress experiment hydrocarbon liquid. Looking now at the data points occurring on line 2003, it is apparent that the intermediate level 400 psi stress experiment produced a hydrocarbon liquid having C8 to C17 pseudo component concentrations between the unstressed experiment represented by line 2002 and the 1,000 psi stressed experiment represented by line 2004. It is noted that the C17 pseudo component data for both the 400 psi and 1,000 psi stressed experiments are about equal. Further, it is apparent that the weight percentage of heavier hydrocarbon components in the C20 to C29 pseudo component range for the intermediate stress level experiment represented by line 2003 falls between the unstressed experiment (Line 2002) hydrocarbon liquid and the 1,000 psi stress experiment (Line 2004) hydrocarbon liquid. Lastly, it is apparent that the high level 1,000 psi stress experiment produced a hydrocarbon liquid having C8 to C17 pseudo component concentrations greater than both the unstressed experiment represented by line 2002 and the 400 psi stressed experiment represented by line 2003. Further, it is apparent that the weight percentage of heavier hydrocarbon components in the C20 to C29 pseudo component range for the high level stress experiment represented by line 2004 are less than both the unstressed experiment (Line 2002) hydrocarbon liquid and the 400 psi stress experiment (Line 2003) hydrocarbon liquid. Thus pyrolyzing oil shale under increasing levels of lithostatic stress appears to produce hydrocarbon liquids having increasingly lighter carbon number distributions.

Figure 19:
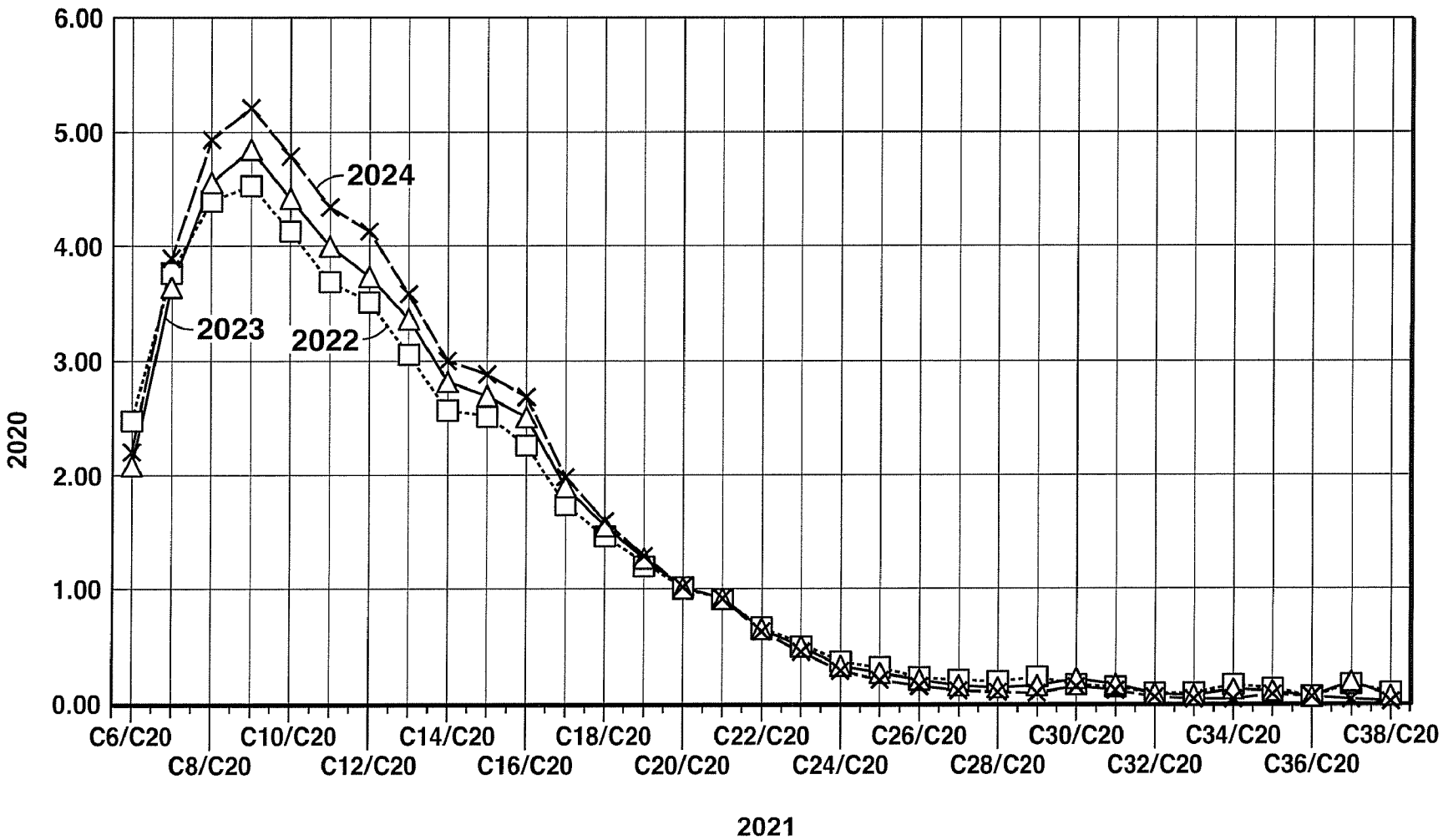
FIG. 19 is a graph of the weight percent ratios of each carbon number pseudo component occurring from C6 to C38 as compared to the C20 pseudo component for laboratory experiments conducted at three different stress levels.

FIG. 19 is a graph of the weight percent ratios of each carbon number pseudo component occurring from C6 to C38 as compared to the C20 pseudo component for each of the three stress levels tested and analyzed in the laboratory experiments discussed herein. The pseudo component weight percentages were obtained as described for FIG. 18. The y-axis 2020 represents the weight ratio of each C6 to C38 pseudo component compared to the C20 pseudo component in the liquid phase. The x-axis 2021 contains the identity of each hydrocarbon pseudo component ratio from C6/C20 to C38/C20. The data points occurring on line 2022 represent the weight ratio of each C6 to C38 pseudo component to C20 pseudo component for the unstressed experiment of Example 1. The data points occurring on line 2023 represent the weight ratio of each C6 to C38 pseudo component to C20 pseudo component for the 400 psi stressed experiment of Example 3. While the data points occurring on line 2024 represent the weight ratio of each C6 to C38 pseudo component to C20 pseudo component for the 1,000 psi stressed experiment of Example 4. From FIG. 19 it can be seen that the hydrocarbon liquid produced in the unstressed experiment, represented by data points on line 2022, contains a lower weight percentage of lighter hydrocarbon components in the C8 to C18 pseudo component range as compared to the C20 pseudo component and a greater weight percentage of heavier hydrocarbon components in the C22 to C29 pseudo component range as compared to the C20 pseudo component, both as compared to the 400 psi stress experiment hydrocarbon liquid and the 1,000 psi stress experiment hydrocarbon liquid. Looking now at the data points occurring on line 2023, it is apparent that the intermediate level 400 psi stress experiment produced a hydrocarbon liquid having C8 to C18 pseudo component concentrations as compared to the C20 pseudo component between the unstressed experiment represented by line 2022 and the 1,000 psi stressed experiment represented by line 2024. Further, it is apparent that the weight percentage of heavier hydrocarbon components in the C22 to C29 pseudo component range as compared to the C20 pseudo component for the intermediate stress level experiment represented by line 2023 falls between the unstressed experiment (Line 2022) hydrocarbon liquid and the 1,000 psi stress experiment (Line 2024) hydrocarbon liquid. Lastly, it is apparent that the high level 1,000 psi stress experiment produced a hydrocarbon liquid having C8 to C18 pseudo component concentrations as compared to the C20 pseudo component greater than both the unstressed experiment represented by line 2022 and the 400 psi stressed experiment represented by line 2023. Further, it is apparent that the weight percentage of heavier hydrocarbon components in the C22 to C29 pseudo component range as compared to the C20 pseudo component for the high level stress experiment represented by line 2024 are less than both the unstressed experiment (Line 2022) hydrocarbon liquid and the 400 psi stress experiment (Line 2023) hydrocarbon liquid. This analysis further supports the relationship that pyrolyzing oil shale under increasing levels of lithostatic stress produces hydrocarbon liquids having increasingly lighter carbon number distributions.

Figure 20:
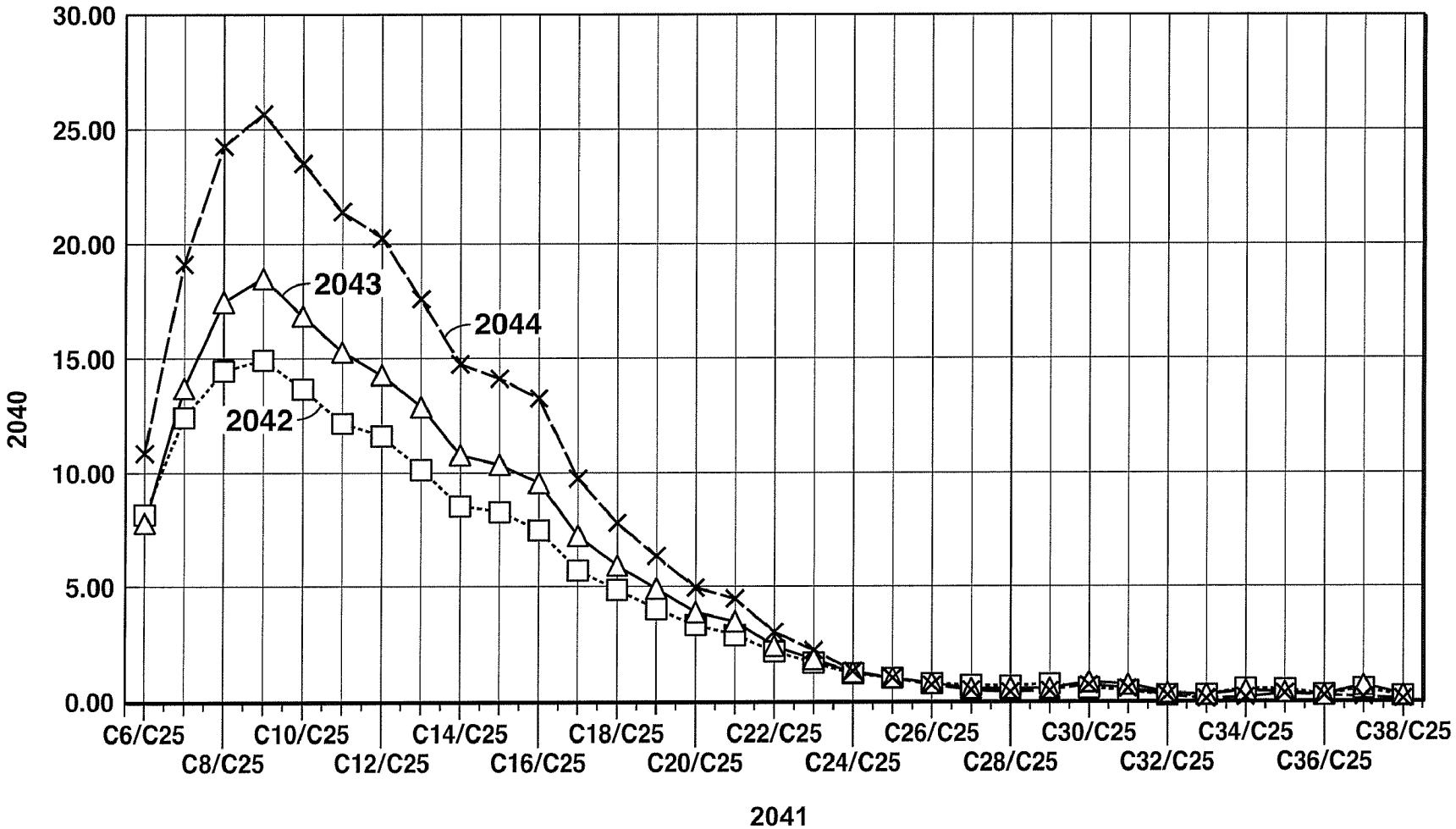
FIG. 20 is a graph of the weight percent ratios of each carbon number pseudo component occurring from C6 to C38 as compared to the C25 pseudo component for laboratory experiments conducted at three different stress levels.

FIG. 20 is a graph of the weight percent ratios of each carbon number pseudo component occurring from C6 to C38 as compared to the C25 pseudo component for each of the three stress levels tested and analyzed in the laboratory experiments discussed herein. The pseudo component weight percentages were obtained as described for FIG. 18. The y-axis 2040 represents the weight ratio of each C6 to C38 pseudo component compared to the C25 pseudo component in the liquid phase. The x-axis 2041 contains the identity of each hydrocarbon pseudo component ratio from C6/C25 to C38/C25. The data points occurring on line 2042 represent the weight ratio of each C6 to C38 pseudo component to C25 pseudo component for the unstressed experiment of Example 1. The data points occurring on line 2043 represent the weight ratio of each C6 to C38 pseudo component to C25 pseudo component for the 400 psi stressed experiment of Example 3. While the data points occurring on line 2044 represent the weight ratio of each C6 to C38 pseudo component to C25 pseudo component for the 1,000 psi stressed experiment of Example 4. From FIG. 20 it can be seen that the hydrocarbon liquid produced in the unstressed experiment, represented by data points on line 2042, contains a lower weight percentage of lighter hydrocarbon components in the C7 to C24 pseudo component range as compared to the C25 pseudo component and a greater weight percentage of heavier hydrocarbon components in the C26 to C29 pseudo component range as compared to the C25 pseudo component, both as compared to the 400 psi stress experiment hydrocarbon liquid and the 1,000 psi stress experiment hydrocarbon liquid. Looking now at the data points occurring on line 2043, it is apparent that the intermediate level 400 psi stress experiment produced a hydrocarbon liquid having C7 to C24 pseudo component concentrations as compared to the C25 pseudo component between the unstressed experiment represented by line 2042 and the 1,000 psi stressed experiment represented by line 2044. Further, it is apparent that the weight percentage of heavier hydrocarbon components in the C26 to C29 pseudo component range as compared to the C25 pseudo component for the intermediate stress level experiment represented by line 2043 falls between the unstressed experiment (Line 2042) hydrocarbon liquid and the 1,000 psi stress experiment (Line 2044) hydrocarbon liquid. Lastly, it is apparent that the high level 1,000 psi stress experiment produced a hydrocarbon liquid having C7 to C24 pseudo component concentrations as compared to the C25 pseudo component greater than both the unstressed experiment represented by line 2042 and the 400 psi stressed experiment represented by line 2043. Further, it is apparent that the weight percentage of heavier hydrocarbon components in the C26 to C29 pseudo component range as compared to the C25 pseudo component for the high level stress experiment represented by line 2044 are less than both the unstressed experiment (Line 2042) hydrocarbon liquid and the 400 psi stress experiment (Line 2043) hydrocarbon liquid. This analysis further supports the relationship that pyrolyzing oil shale under increasing levels of lithostatic stress produces hydrocarbon liquids having increasingly lighter carbon number distributions.

Figure 21:
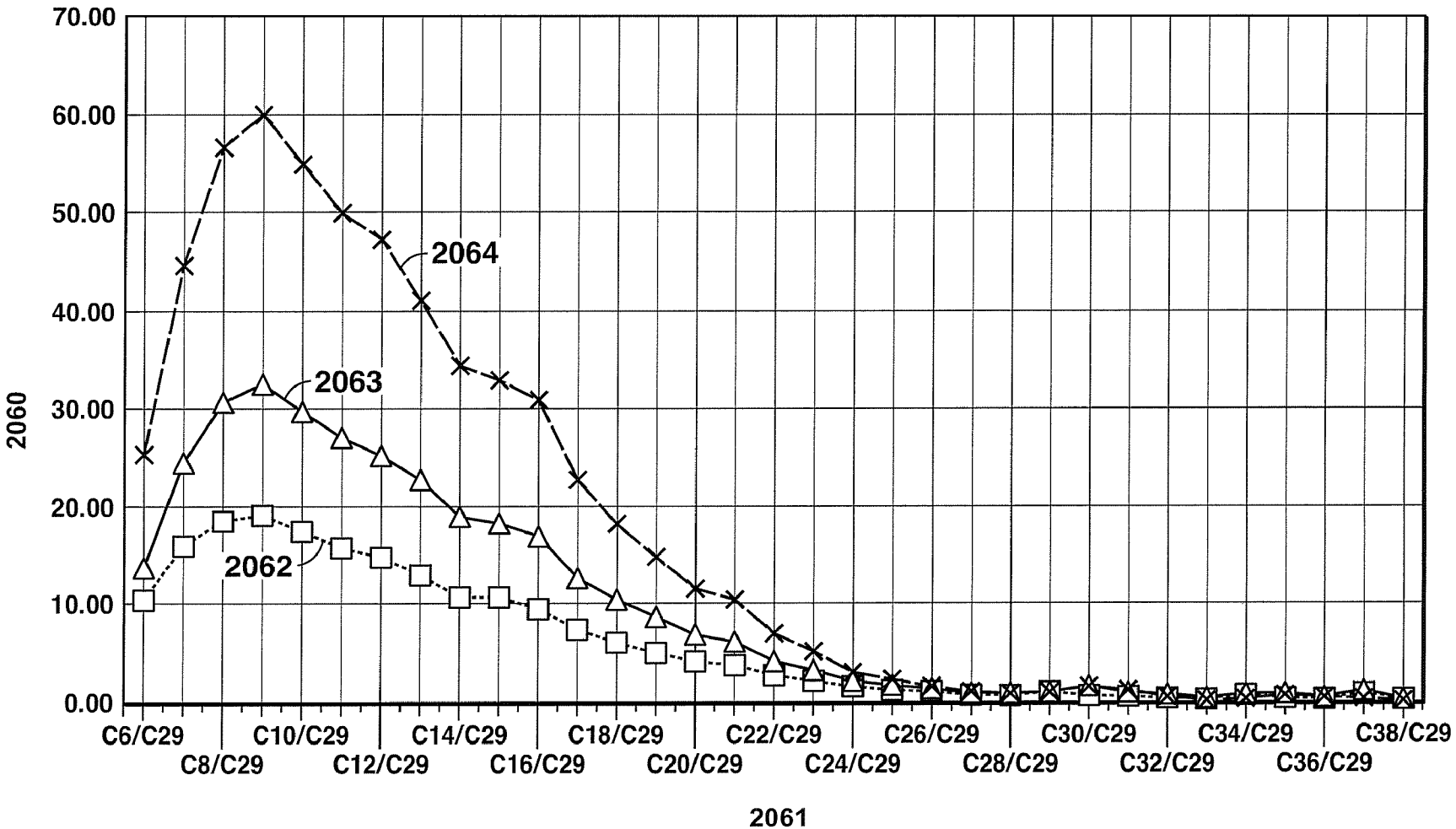
FIG. 21 is a graph of the weight percent ratios of each carbon number pseudo component occurring from C6 to C38 as compared to the C29 pseudo component for laboratory experiments conducted at three different stress levels.

FIG. 21 is a graph of the weight percent ratios of each carbon number pseudo component occurring from C6 to C38 as compared to the C29 pseudo component for each of the three stress levels tested and analyzed in the laboratory experiments discussed herein. The pseudo component weight percentages were obtained as described for FIG. 18. The y-axis 2060 represents the weight ratio of each C6 to C38 pseudo component compared to the C29 pseudo component in the liquid phase. The x-axis 2061 contains the identity of each hydrocarbon pseudo component ratio from C6/C29 to C38/C29. The data points occurring on line 2062 represent the weight ratio of each C6 to C38 pseudo component to C29 pseudo component for the unstressed experiment of Example 1. The data points occurring on line 2063 represent the weight ratio of each C6 to C38 pseudo component to C29 pseudo component for the 400 psi stressed experiment of Example 3. While the data points occurring on line 2064 represent the weight ratio of each C6 to C38 pseudo component to C29 pseudo component for the 1,000 psi stressed experiment of Example 4. From FIG. 21 it can be seen that the hydrocarbon liquid produced in the unstressed experiment, represented by data points on line 2062, contains a lower weight percentage of lighter hydrocarbon components in the C6 to C28 pseudo component range as compared to the C29 pseudo component, both as compared to the 400 psi stress experiment hydrocarbon liquid and the 1,000 psi stress experiment hydrocarbon liquid. Looking now at the data points occurring on line 2063, it is apparent that the intermediate level 400 psi stress experiment produced a hydrocarbon liquid having C6 to C28 pseudo component concentrations as compared to the C29 pseudo component between the unstressed experiment represented by line 2062 and the 1,000 psi stressed experiment represented by line 2064. Lastly, it is apparent that the high level 1,000 psi stress experiment produced a hydrocarbon liquid having C6 to C28 pseudo component concentrations as compared to the C29 pseudo component greater than both the unstressed experiment represented by line 2062 and the 400 psi stressed experiment represented by line 2063. This analysis further supports the relationship that pyrolyzing oil shale under increasing levels of lithostatic stress produces hydrocarbon liquids having increasingly lighter carbon number distributions.

Figure 22:
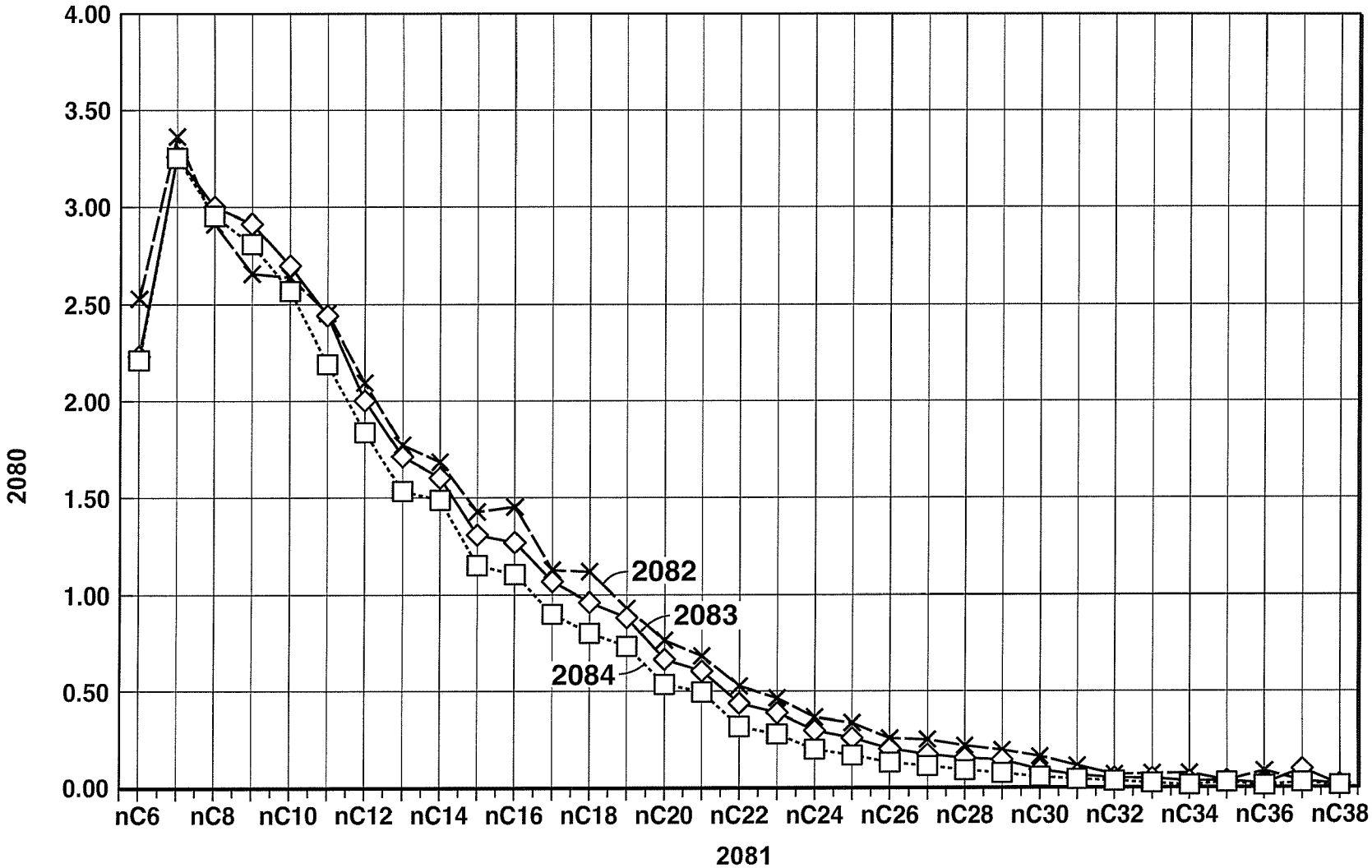
FIG. 22 is a graph of the weight percent of normal alkane hydrocarbon compounds occurring from normal-C6 to normal-C38 for laboratory experiments conducted at three different stress levels.

FIG. 22 is a graph of the weight percent of normal alkane hydrocarbon compounds occurring from the normal-C6 alkane to the normal-C38 alkane for each of the three stress levels tested and analyzed in the laboratory experiments discussed herein. The normal alkane compound weight percentages were obtained as described for FIG. 18, except that each individual normal alkane compound peak area integration was used to determine each respective normal alkane compound weight percentage. For clarity, the normal alkane hydrocarbon weight percentages are taken as a percentage of the entire C3 to pseudo C38 whole oil gas chromatography areas and calculated weights as used in the pseudo compound data presented in FIG. 18. The y-axis 2080 represents the concentration in terms of weight percent of each normal-C6 to normal-C38 compound found in the liquid phase. The x-axis 2081 contains the identity of each normal alkane hydrocarbon compound from normal-C6 to normal-C38. The data points occurring on line 2082 represent the weight percent of each normal-C6 to normal-C38 hydrocarbon compound for the unstressed experiment of Example 1. The data points occurring on line 2083 represent the weight percent of each normal-C6 to normal-C38 hydrocarbon compound for the 400 psi stressed experiment of Example 3. While the data points occurring on line 2084 represent the weight percent of each normal-C6 to normal-C38 hydrocarbon compound for the 1,000 psi stressed experiment of Example 4. From FIG. 22 it can be seen that the hydrocarbon liquid produced in the unstressed experiment, represented by data points on line 2082, contains a greater weight percentage of hydrocarbon compounds in the normal-C12 to normal-C30 compound range, both as compared to the 400 psi stress experiment hydrocarbon liquid and the 1,000 psi stress experiment hydrocarbon liquid. Looking now at the data points occurring on line 2083, it is apparent that the intermediate level 400 psi stress experiment produced a hydrocarbon liquid having normal-C12 to normal-C30 compound concentrations between the unstressed experiment represented by line 2082 and the 1,000 psi stressed experiment represented by line 2084. Lastly, it is apparent that the high level 1,000 psi stress experiment produced a hydrocarbon liquid having normal-C12 to normal-C30 compound concentrations less than both the unstressed experiment represented by line 2082 and the 400 psi stressed experiment represented by line 2083. Thus pyrolyzing oil shale under increasing levels of lithostatic stress appears to produce hydrocarbon liquids having lower concentrations of normal alkane hydrocarbons.

Figure 23:
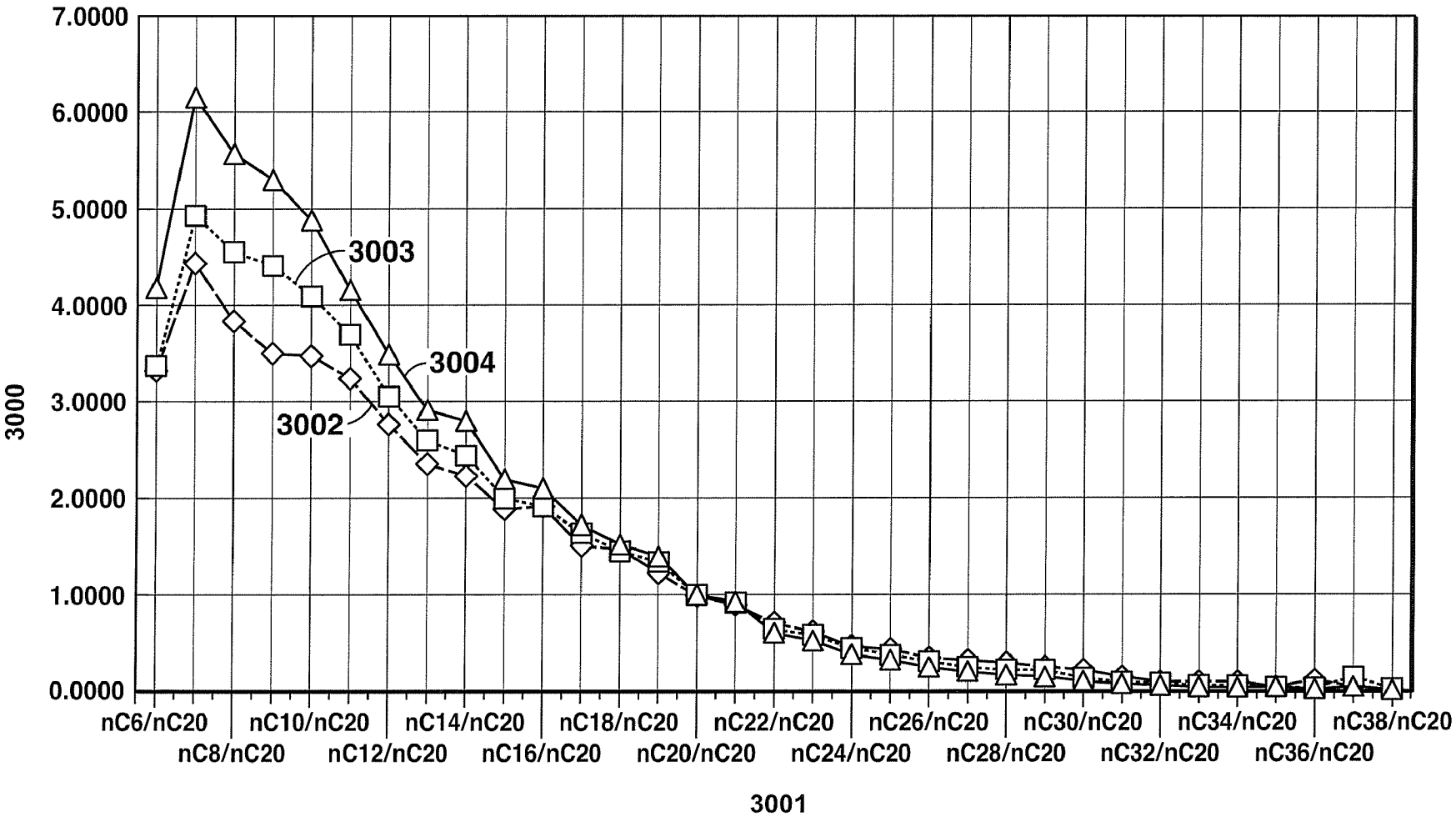
FIG. 23 is a graph of the weight percent of normal alkane hydrocarbon compounds occurring from normal-C6 to normal-C38 as compared to the normal-C20 hydrocarbon compound for laboratory experiments conducted at three different stress levels.

FIG. 23 is a graph of the weight percent of normal alkane hydrocarbon compounds occurring from normal-C6 to normal-C38 as compared to the normal-C20 hydrocarbon compound for each of the three stress levels tested and analyzed in the laboratory experiments discussed herein. The normal compound weight percentages were obtained as described for FIG. 22. The y-axis 3000 represents the concentration in terms of weight ratio of each normal-C6 to normal-C38 compound as compared to the normal-C20 compound found in the liquid phase. The x-axis 3001 contains the identity of each normal alkane hydrocarbon compound ratio from normal-C6/normal-C20 to normal-C38/normal-C20. The data points occurring on line 3002 represent the weight ratio of each normal-C6 to normal-C38 hydrocarbon compound as compared to the normal-C20 compound for the unstressed experiment of Example 1. The data points occurring on line 3003 represent the weight ratio of each normal-C6 to normal-C38 hydrocarbon compound as compared to the normal-C20 compound for the 400 psi stressed experiment of Example 3. While the data points occurring on line 3004 represent the weight ratio of each normal-C6 to normal-C38 hydrocarbon compound as compared to the normal-C20 compound for the 1,000 psi stressed experiment of Example 4. From FIG. 23 it can be seen that the hydrocarbon liquid produced in the unstressed experiment, represented by data points on line 3002, contains a lower weight percentage of lighter normal alkane hydrocarbon components in the normal-C6 to normal-C17 compound range as compared to the normal-C20 compound and a greater weight percentage of heavier hydrocarbon components in the normal-C22 to normal-C34 compound range as compared to the normal-C20 compound, both as compared to the 400 psi stress experiment hydrocarbon liquid and the 1,000 psi stress experiment hydrocarbon liquid. Looking now at the data points occurring on line 3003, it is apparent that the intermediate level 400 psi stress experiment produced a hydrocarbon liquid having normal-C6 to normal-C17 compound concentrations as compared to the normal-C20 compound between the unstressed experiment represented by line 3002 and the 1,000 psi stressed experiment represented by line 3004. Further, it is apparent that the weight percentage of heavier hydrocarbon components in the normal-C22 to normal-C34 compound range as compared to the normal-C20 compound for the intermediate stress level experiment represented by line 3003 falls between the unstressed experiment (Line 3002) hydrocarbon liquid and the 1,000 psi stress experiment (Line 3004) hydrocarbon liquid. Lastly, it is apparent that the high level 1,000 psi stress experiment produced a hydrocarbon liquid having normal-C6 to normal-C17 compound concentrations as compared to the normal-C20 compound greater than both the unstressed experiment represented by line 3002 and the 400 psi stressed experiment represented by line 3003. Further, it is apparent that the weight percentage of heavier hydrocarbon components in the normal-C22 to normal-C34 compound range as compared to the normal-C20 compound for the high level stress experiment represented by line 3004 are less than both the unstressed experiment (Line 3002) hydrocarbon liquid and the 400 psi stress experiment (Line 3003) hydrocarbon liquid. This analysis further supports the relationship that pyrolyzing oil shale under increasing levels of lithostatic stress produces hydrocarbon liquids having lower concentrations of normal alkane hydrocarbons.

Figure 24:
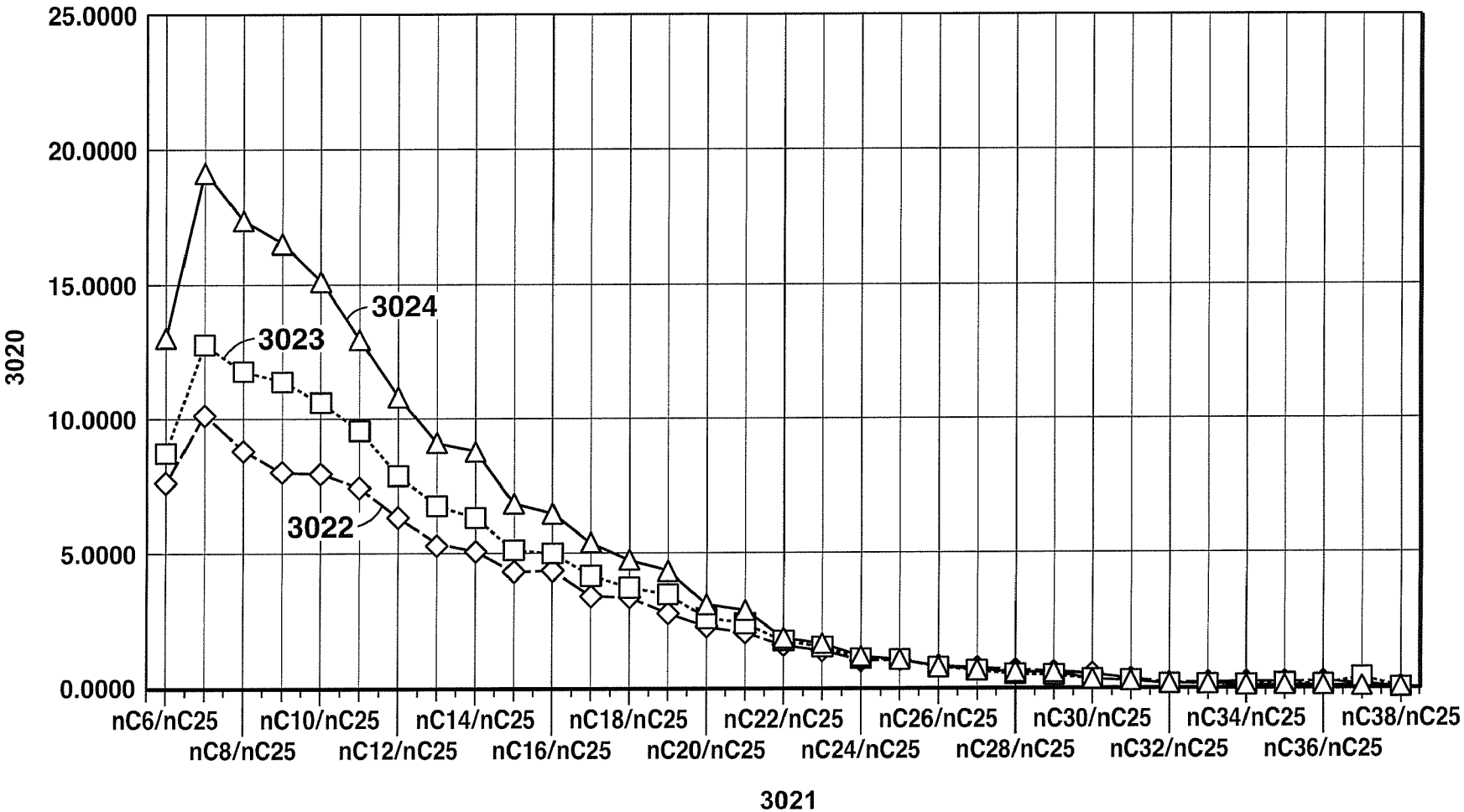
FIG. 24 is a graph of the weight percent of normal alkane hydrocarbon compounds occurring from normal-C6 to normal-C38 as compared to the normal-C25 hydrocarbon compound for laboratory experiments conducted at three different stress levels.

FIG. 24 is a graph of the weight percent of normal alkane hydrocarbon compounds occurring from normal-C6 to normal-C38 as compared to the normal-C25 hydrocarbon compound for each of the three stress levels tested and analyzed in the laboratory experiments discussed herein. The normal compound weight percentages were obtained as described for FIG. 22. The y-axis 3020 represents the concentration in terms of weight ratio of each normal-C6 to normal-C38 compound as compared to the normal-C25 compound found in the liquid phase. The x-axis 3021 contains the identity of each normal alkane hydrocarbon compound ratio from normal-C6/normal-C25 to normal-C38/normal-C25. The data points occurring on line 3022 represent the weight ratio of each normal-C6 to normal-C38 hydrocarbon compound as compared to the normal-C25 compound for the unstressed experiment of Example 1. The data points occurring on line 3023 represent the weight ratio of each normal-C6 to normal-C38 hydrocarbon compound as compared to the normal-C25 compound for the 400 psi stressed experiment of Example 3. While the data points occurring on line 3024 represent the weight ratio of each normal-C6 to normal-C38 hydrocarbon compound as compared to the normal-C25 compound for the 1,000 psi stressed experiment of Example 4. From FIG. 24 it can be seen that the hydrocarbon liquid produced in the unstressed experiment, represented by data points on line 3022, contains a lower weight percentage of lighter normal alkane hydrocarbon components in the normal-C6 to normal-C24 compound range as compared to the normal-C25 compound and a greater weight percentage of heavier hydrocarbon components in the normal-C26 to normal-C30 compound range as compared to the normal-C25 compound, both as compared to the 400 psi stress experiment hydrocarbon liquid and the 1,000 psi stress experiment hydrocarbon liquid. Looking now at the data points occurring on line 3023, it is apparent that the intermediate level 400 psi stress experiment produced a hydrocarbon liquid having normal-C6 to normal-C24 compound concentrations as compared to the normal-C25 compound between the unstressed experiment represented by line 3022 and the 1,000 psi stressed experiment represented by line 3024. Further, it is apparent that the weight percentage of heavier hydrocarbon components in the normal-C26 to normal-C30 compound range as compared to the normal-C25 compound for the intermediate stress level experiment represented by line 3023 falls between the unstressed experiment (Line 3022) hydrocarbon liquid and the 1,000 psi stress experiment (Line 3024) hydrocarbon liquid. Lastly, it is apparent that the high level 1,000 psi stress experiment produced a hydrocarbon liquid having normal-C6 to normal-C24 compound concentrations as compared to the normal-C25 compound greater than both the unstressed experiment represented by line 3022 and the 400 psi stressed experiment represented by line 3023. Further, it is apparent that the weight percentage of heavier hydrocarbon components in the normal-C26 to normal-C30 compound range as compared to the normal-C25 compound for the high level stress experiment represented by line 3024 are less than both the unstressed experiment (Line 3022) hydrocarbon liquid and the 400 psi stress experiment (Line 3023) hydrocarbon liquid. This analysis further supports the relationship that pyrolyzing oil shale under increasing levels of lithostatic stress produces hydrocarbon liquids having lower concentrations of normal alkane hydrocarbons.

Figure 25:
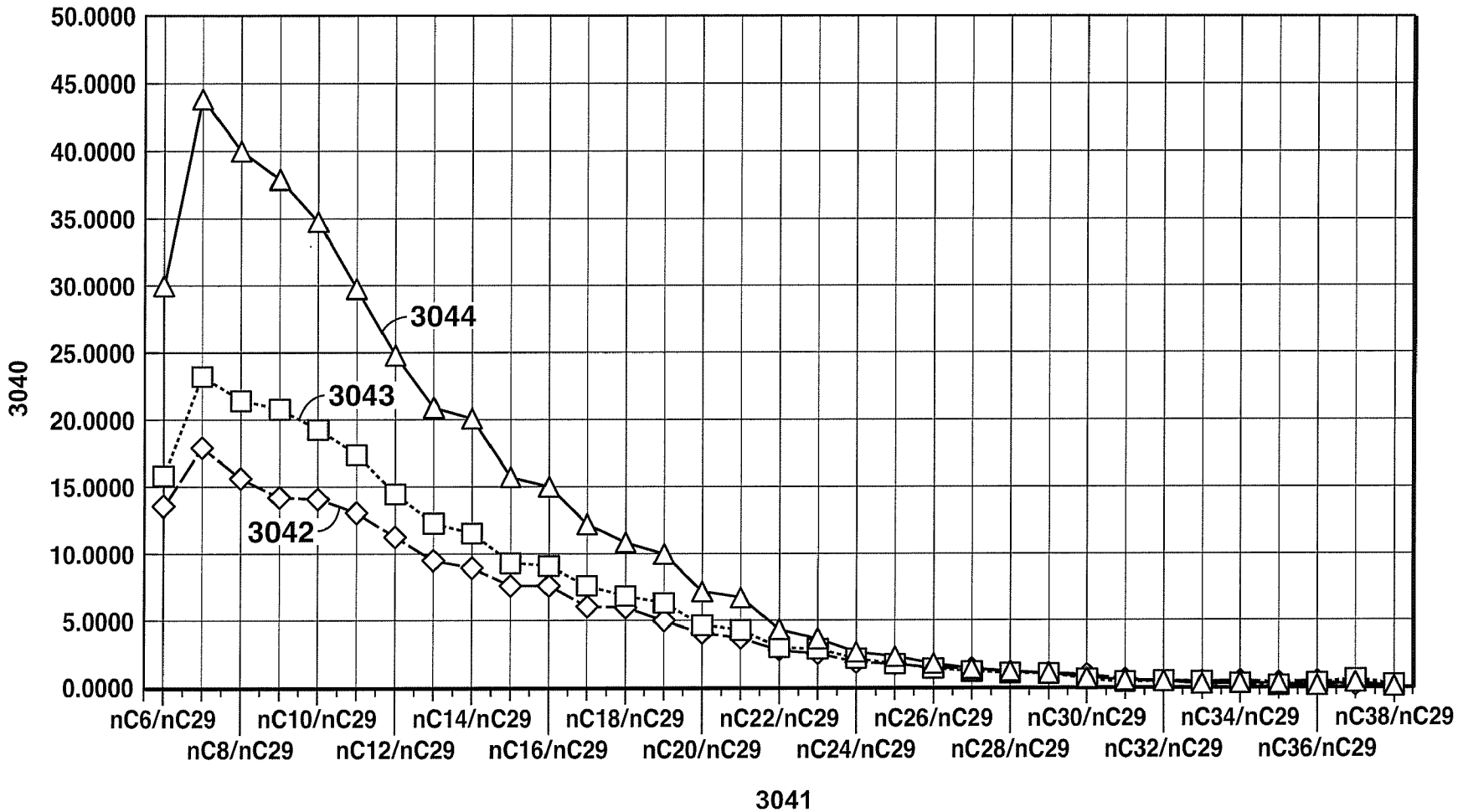
FIG. 25 is a graph of the weight percent of normal alkane hydrocarbon compounds occurring from normal-C6 to normal-C38 as compared to the normal-C29 hydrocarbon compound for laboratory experiments conducted at three different stress levels.

FIG. 25 is a graph of the weight percent of normal alkane hydrocarbon compounds occurring from normal-C6 to normal-C38 as compared to the normal-C29 hydrocarbon compound for each of the three stress levels tested and analyzed in the laboratory experiments discussed herein. The normal compound weight percentages were obtained as described for FIG. 22. The y-axis 3040 represents the concentration in terms of weight ratio of each normal-C6 to normal-C38 compound as compared to the normal-C29 compound found in the liquid phase. The x-axis 3041 contains the identity of each normal alkane hydrocarbon compound ratio from normal-C6/normal-C29 to normal-C38/normal-C29. The data points occurring on line 3042 represent the weight ratio of each normal-C6 to normal-C38 hydrocarbon compound as compared to the normal-C29 compound for the unstressed experiment of Example 1. The data points occurring on line 3043 represent the weight ratio of each normal-C6 to normal-C38 hydrocarbon compound as compared to the normal-C29 compound for the 400 psi stressed experiment of Example 3. While the data points occurring on line 3044 represent the weight ratio of each normal-C6 to normal-C38 hydrocarbon compound as compared to the normal-C29 compound for the 1,000 psi stressed experiment of Example 4. From FIG. 25 it can be seen that the hydrocarbon liquid produced in the unstressed experiment, represented by data points on line 3042, contains a lower weight percentage of lighter normal alkane hydrocarbon components in the normal-C6 to normal-C26 compound range as compared to the normal-C29 compound, both as compared to the 400 psi stress experiment hydrocarbon liquid and the 1,000 psi stress experiment hydrocarbon liquid. Looking now at the data points occurring on line 3043, it is apparent that the intermediate level 400 psi stress experiment produced a hydrocarbon liquid having normal-C6 to normal-C26 compound concentrations as compared to the normal-C29 compound between the unstressed experiment represented by line 3042 and the 1,000 psi stressed experiment represented by line 3044. Lastly, it is apparent that the high level 1,000 psi stress experiment produced a hydrocarbon liquid having normal-C6 to normal-C26 compound concentrations as compared to the normal-C29 compound greater than both the unstressed experiment represented by line 3042 and the 400 psi stressed experiment represented by line 3043. This analysis further supports the relationship that pyrolyzing oil shale under increasing levels of lithostatic stress produces hydrocarbon liquids having lower concentrations of normal alkane hydrocarbons.

Figure 26:
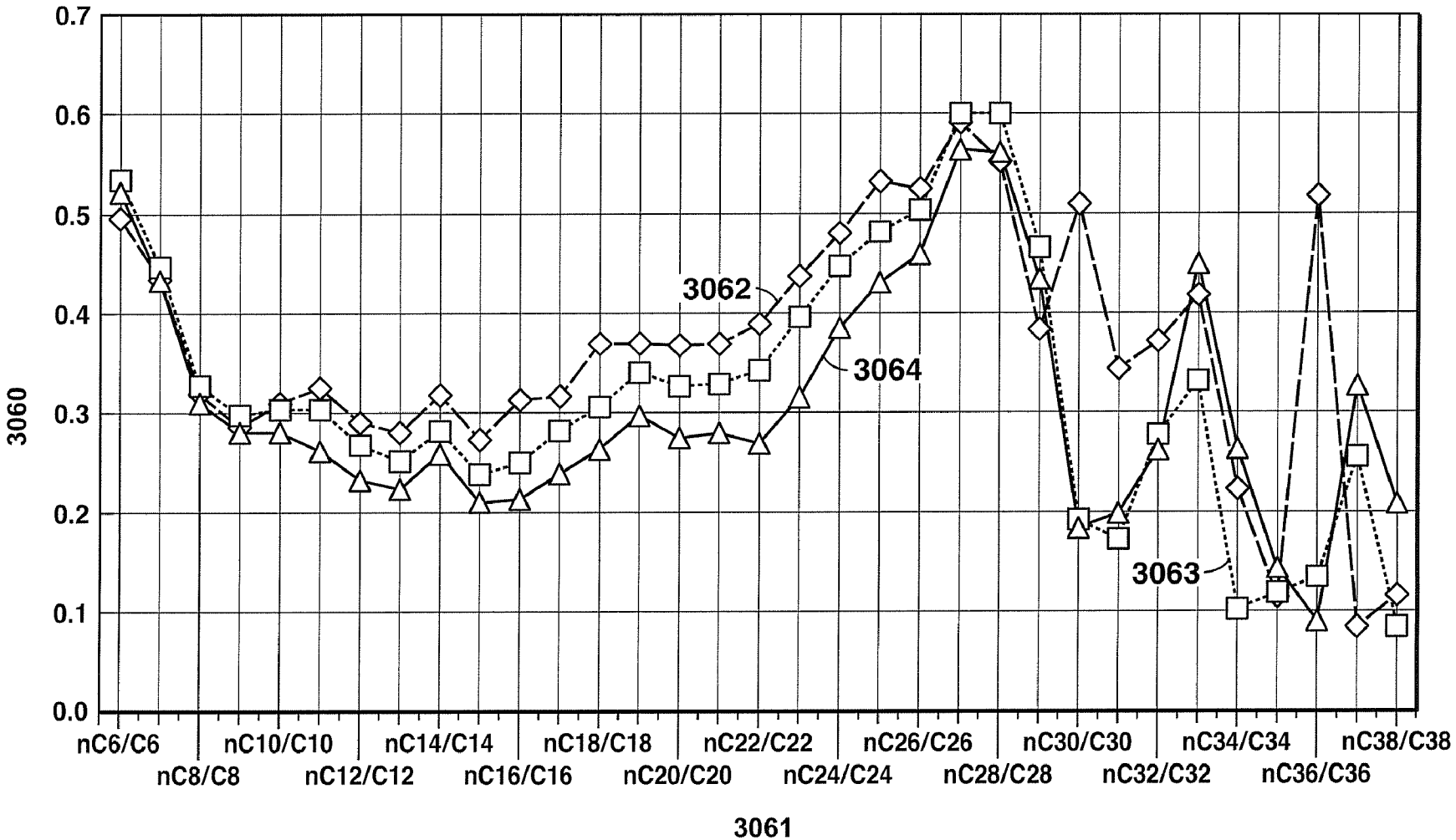
FIG. 26 is a graph of the weight ratio of normal alkane hydrocarbon compounds to pseudo components for each carbon number from C6 to C38 for laboratory experiments conducted at three different stress levels.

FIG. 26 is a graph of the weight ratio of normal alkane hydrocarbon compounds to pseudo components for each carbon number from C6 to C38 for each of the three stress levels tested and analyzed in the laboratory experiments discussed herein. The normal compound and pseudo component weight percentages were obtained as described for FIGS. 18 and 22. For clarity, the normal alkane hydrocarbon and pseudo component weight percentages are taken as a percentage of the entire C3 to pseudo C38 whole oil gas chromatography areas and calculated weights as used in the pseudo compound data presented in FIG. 18. The y-axis 3060 represents the concentration in terms of weight ratio of each normal-C6/pseudo C6 to normal-C38/pseudo C38 compound found in the liquid phase. The x-axis 3061 contains the identity of each normal alkane hydrocarbon compound to pseudo component ratio from normal-C6/pseudo C6 to normal-C38/pseudo C38. The data points occurring on line 3062 represent the weight ratio of each normal-C6/pseudo C6 to normal-C38/pseudo C38 ratio for the unstressed experiment of Example 1. The data points occurring on line 3063 represent the weight ratio of each normal-C6/pseudo C6 to normal-C38/pseudo C38 ratio for the 400 psi stressed experiment of Example 3. While the data points occurring on line 3064 represent the weight ratio of each normal-C6/pseudo C6 to normal-C38/pseudo C38 ratio for the 1,000 psi stressed experiment of Example 4. From FIG. 26 it can be seen that the hydrocarbon liquid produced in the unstressed experiment, represented by data points on line 3062, contains a greater weight percentage of normal alkane hydrocarbon compounds to pseudo components in the C10 to C26 range, both as compared to the 400 psi stress experiment hydrocarbon liquid and the 1,000 psi stress experiment hydrocarbon liquid. Looking now at the data points occurring on line 3063, it is apparent that the intermediate level 400 psi stress experiment produced a hydrocarbon liquid having normal alkane hydrocarbon compound to pseudo component ratios in the C10 to C26 range between the unstressed experiment represented by line 3062 and the 1,000 psi stressed experiment represented by line 3064. Lastly, it is apparent that the high level 1,000 psi stress experiment produced a hydrocarbon liquid having normal alkane hydrocarbon compound to pseudo component ratios in the C10 to C26 range less than both the unstressed experiment represented by line 3062 and the 400 psi stressed experiment represented by line 3063. Thus pyrolyzing oil shale under increasing levels of lithostatic stress appears to produce hydrocarbon liquids having lower concentrations of normal alkane hydrocarbons as compared to the total hydrocarbons for a given carbon number occurring between C10 and C26.

From the above-described data, it can be seen that heating and pyrolysis of oil shale under increasing levels of stress results in a condensable hydrocarbon fluid product that is lighter (i.e., greater proportion of lower carbon number compounds or components relative to higher carbon number compounds or components) and contains a lower concentration of normal alkane hydrocarbon compounds. Such a product may be suitable for refining into gasoline and distillate products. Further, such a product, either before or after further fractionation, may have utility as a feed stock for certain chemical processes.

In some embodiments, the produced hydrocarbon fluid includes a condensable hydrocarbon portion. In some embodiments the condensable hydrocarbon portion may have one or more of a total C7 to total C20 weight ratio greater than 0.8, a total C8 to total C20 weight ratio greater than 1.7, a total C9 to total C20 weight ratio greater than 2.5, a total C10 to total C20 weight ratio greater than 2.8, a total C11 to total C20 weight ratio greater than 2.3, a total C12 to total C20 weight ratio greater than 2.3, a total C13 to total C20 weight ratio greater than 2.9, a total C14 to total C20 weight ratio greater than 2.2, a total C15 to total C20 weight ratio greater than 2.2, and a total C16 to total C20 weight ratio greater than 1.6. In alternative embodiments the condensable hydrocarbon portion has one or more of a total C7 to total C20 weight ratio greater than 2.5, a total C8 to total C20 weight ratio greater than 3.0, a total C9 to total C20 weight ratio greater than 3.5, a total C10 to total C20 weight ratio greater than 3.5, a total C11 to total C20 weight ratio greater than 3.0, and a total C12 to total C20 weight ratio greater than 3.0. In alternative embodiments the condensable hydrocarbon portion has one or more of a total C7 to total C20 weight ratio greater than 3.5, a total C8 to total C20 weight ratio greater than 4.3, a total C9 to total C20 weight ratio greater than 4.5, a total C10 to total C20 weight ratio greater than 4.2, a total C11 to total C20 weight ratio greater than 3.7, and a total C12 to total C20 weight ratio greater than 3.5. As used in this paragraph and in the claims, the phrase "one or more" followed by a listing of different compound or component ratios with the last ratio introduced by the conjunction "and" is meant to include a condensable hydrocarbon portion that has at least one of the listed ratios or that has two or more, or three or more, or four or more, etc., or all of the listed ratios. Further, a particular condensable hydrocarbon portion may also have additional ratios of different compounds or components that are not included in a particular sentence or claim and still fall within the scope of such a sentence or claim. The embodiments described in this paragraph may be combined with any of the other aspects of the invention discussed herein.

In some embodiments the condensable hydrocarbon portion has a total C7 to total C20 weight ratio greater than 0.8. Alternatively, the condensable hydrocarbon portion may have a total C7 to total C20 weight ratio greater than 1.0, greater than 1.5, greater than 2.0, greater than 2.5, greater than 3.5 or greater than 3.7. In alternative embodiments, the condensable hydrocarbon portion may have a total C7 to total C20 weight ratio less than 10.0, less than 7.0, less than 5.0 or less than 4.0. In some embodiments the condensable hydrocarbon portion has a total C8 to total C20 weight ratio greater than 1.7. Alternatively, the condensable hydrocarbon portion may have a total C8 to total C20 weight ratio greater than 2.0, greater than 2.5, greater than 3.0, greater than 4.0, greater than 4.4, or greater than 4.6. In alternative embodiments, the condensable hydrocarbon portion may have a total C8 to total C20 weight ratio less than 7.0 or less than 6.0. In some embodiments the condensable hydrocarbon portion has a total C9 to total C20 weight ratio greater than 2.5. Alternatively, the condensable hydrocarbon portion may have a total C9 to total C20 weight ratio greater than 3.0, greater than 4.0, greater than 4.5, or greater than 4.7. In alternative embodiments, the condensable hydrocarbon portion may have a total C9 to total C20 weight ratio less than 7.0 or less than 6.0. In some embodiments the condensable hydrocarbon portion has a total C10 to total C20 weight ratio greater than 2.8. Alternatively, the condensable hydrocarbon portion may have a total C10 to total C20 weight ratio greater than 3.0, greater than 3.5, greater than 4.0, or greater than 4.3. In alternative embodiments, the condensable hydrocarbon portion may have a total C10 to total C20 weight ratio less than 7.0 or less than 6.0. In some embodiments the condensable hydrocarbon portion has a total C11 to total C20 weight ratio greater than 2.3. Alternatively, the condensable hydrocarbon portion may have a total C11 to total C20 weight ratio greater than 2.5, greater than 3.5, greater than 3.7, greater than 4.0. In alternative embodiments, the condensable hydrocarbon portion may have a total C11 to total C20 weight ratio less than 7.0 or less than 6.0. In some embodiments the condensable hydrocarbon portion has a total C12 to total C20 weight ratio greater than 2.3. Alternatively, the condensable hydrocarbon portion may have a total C12 to total C20 weight ratio greater than 2.5, greater than 3.0, greater than 3.5, or greater than 3.7. In alternative embodiments, the condensable hydrocarbon portion may have a total C12 to total C20 weight ratio less than 7.0 or less than 6.0. In some embodiments the condensable hydrocarbon portion has a total C13 to total C20 weight ratio greater than 2.9. Alternatively, the condensable hydrocarbon portion may have a total C13 to total C20 weight ratio greater than 3.0, greater than 3.1, or greater than 3.2. In alternative embodiments, the condensable hydrocarbon portion may have a total C13 to total C20 weight ratio less than 6.0 or less than 5.0. In some embodiments the condensable hydrocarbon portion has a total C14 to total C20 weight ratio greater than 2.2. Alternatively, the condensable hydrocarbon portion may have a total C14 to total C20 weight ratio greater than 2.5, greater than 2.6, or greater than 2.7. In alternative embodiments, the condensable hydrocarbon portion may have a total C14 to total C20 weight ratio less than 6.0 or less than 4.0. In some embodiments the condensable hydrocarbon portion has a total C15 to total C20 weight ratio greater than 2.2. Alternatively, the condensable hydrocarbon portion may have a total C15 to total C20 weight ratio greater than 2.3, greater than 2.4, or greater than 2.6. In alternative embodiments, the condensable hydrocarbon portion may have a total C15 to total C20 weight ratio less than 6.0 or less than 4.0. In some embodiments the condensable hydrocarbon portion has a total C16 to total C20 weight ratio greater than 1.6. Alternatively, the condensable hydrocarbon portion may have a total C16 to total C20 weight ratio greater than 1.8, greater than 2.3, or greater than 2.5. In alternative embodiments, the condensable hydrocarbon portion may have a total C16 to total C20 weight ratio less than 5.0 or less than 4.0. Certain features of the present invention are described in terms of a set of numerical upper limits (e.g. "less than") and a set of numerical lower limits (e.g. "greater than") in the preceding paragraph. It should be appreciated that ranges formed by any combination of these limits are within the scope of the invention unless otherwise indicated. The embodiments described in this paragraph may be combined with any of the other aspects of the invention discussed herein.

In some embodiments the condensable hydrocarbon portion may have the one or more of a total C7 to total C25 weight ratio greater than 2.0, a total C8 to total C25 weight ratio greater than 4.5, a total C9 to total C25 weight ratio greater than 6.5, a total C10 to total C25 weight ratio greater than 7.5, a total C11 to total C25 weight ratio greater than 6.5, a total C12 to total C25 weight ratio greater than 6.5, a total C13 to total C25 weight ratio greater than 8.0, a total C14 to total C25 weight ratio greater than 6.0, a total C15 to total C25 weight ratio greater than 6.0, a total C16 to total C25 weight ratio greater than 4.5, a total C17 to total C25 weight ratio greater than 4.8, and a total C18 to total C25 weight ratio greater than 4.5. In alternative embodiments the condensable hydrocarbon portion has one or more of a total C7 to total C25 weight ratio greater than 7.0, a total C8 to total C25 weight ratio greater than 10.0, a total C9 to total C25 weight ratio greater than 10.0, a total C10 to total C25 weight ratio greater than 10.0, a total C11 to total C25 weight ratio greater than 8.0, and a total C12 to total C25 weight ratio greater than 8.0. In alternative embodiments the condensable hydrocarbon portion has one or more of a total C7 to total C25 weight ratio greater than 13.0, a total C8 to total C25 weight ratio greater than 17.0, a total C9 to total C25 weight ratio greater than 17.0, a total C10 to total C25 weight ratio greater than 15.0, a total C11 to total C25 weight ratio greater than 14.0, and a total C12 to total C25 weight ratio greater than 13.0. As used in this paragraph and in the claims, the phrase "one or more" followed by a listing of different compound or component ratios with the last ratio introduced by the conjunction "and" is meant to include a condensable hydrocarbon portion that has at least one of the listed ratios or that has two or more, or three or more, or four or more, etc., or all of the listed ratios. Further, a particular condensable hydrocarbon portion may also have additional ratios of different compounds or components that are not included in a particular sentence or claim and still fall within the scope of such a sentence or claim. The embodiments described in this paragraph may be combined with any of the other aspects of the invention discussed herein.

In some embodiments the condensable hydrocarbon portion has a total C7 to total C25 weight ratio greater than 2.0. Alternatively, the condensable hydrocarbon portion may have a total C7 to total C25 weight ratio greater than 3.0, greater than 5.0, greater than 10.0, greater than 13.0, or greater than 15.0. In alternative embodiments, the condensable hydrocarbon portion may have a total C7 to total C25 weight ratio less than 30.0 or less than 25.0. In some embodiments the condensable hydrocarbon portion has a total C8 to total C25 weight ratio greater than 4.5. Alternatively, the condensable hydrocarbon portion may have a total C8 to total C25 weight ratio greater than 5.0, greater than 7.0, greater than 10.0, greater than 15.0, or greater than 17.0. In alternative embodiments, the condensable hydrocarbon portion may have a total C8 to total C25 weight ratio less than 35.0, or less than 30.0. In some embodiments the condensable hydrocarbon portion has a total C9 to total C25 weight ratio greater than 6.5. Alternatively, the condensable hydrocarbon portion may have a total C9 to total C25 weight ratio greater than 8.0, greater than 10.0, greater than 15.0, greater than 17.0, or greater than 19.0. In alternative embodiments, the condensable hydrocarbon portion may have a total C9 to total C25 weight ratio less than 40.0 or less than 35.0. In some embodiments the condensable hydrocarbon portion has a total C10 to total C25 weight ratio greater than 7.5. Alternatively, the condensable hydrocarbon portion may have a total C10 to total C25 weight ratio greater than 10.0, greater than 14.0, or greater than 17.0. In alternative embodiments, the condensable hydrocarbon portion may have a total C10 to total C25 weight ratio less than 35.0 or less than 30.0. In some embodiments the condensable hydrocarbon portion has a total C11 to total C25 weight ratio greater than 6.5. Alternatively, the condensable hydrocarbon portion may have a total C11 to total C25 weight ratio greater than 8.5, greater than 10.0, greater than 12.0, or greater than 14.0. In alternative embodiments, the condensable hydrocarbon portion may have a total C11 to total C25 weight ratio less than 35.0 or less than 30.0. In some embodiments the condensable hydrocarbon portion has a total C12 to total C25 weight ratio greater than 6.5. Alternatively, the condensable hydrocarbon portion may have a total C12 to total C25 weight ratio greater than 8.5, a total C12 to total C25 weight ratio greater than 10.0, greater than 12.0, or greater than 14.0. In alternative embodiments, the condensable hydrocarbon portion may have a total C12 to total C25 weight ratio less than 30.0 or less than 25.0. In some embodiments the condensable hydrocarbon portion has a total C13 to total C25 weight ratio greater than 8.0. Alternatively, the condensable hydrocarbon portion may have a total C13 to total C25 weight ratio greater than 10.0, greater than 12.0, or greater than 14.0. In alternative embodiments, the condensable hydrocarbon portion may have a total C13 to total C25 weight ratio less than 25.0 or less than 20.0. In some embodiments the condensable hydrocarbon portion has a total C14 to total C25 weight ratio greater than 6.0. Alternatively, the condensable hydrocarbon portion may have a total C14 to total C25 weight ratio greater than 8.0, greater than 10.0, or greater than 12.0. In alternative embodiments, the condensable hydrocarbon portion may have a total C14 to total C25 weight ratio less than 25.0 or less than 20.0. In some embodiments the condensable hydrocarbon portion has a total C15 to total C25 weight ratio greater than 6.0. Alternatively, the condensable hydrocarbon portion may have a total C15 to total C25 weight ratio greater than 8.0, or greater than 10.0. In alternative embodiments, the condensable hydrocarbon portion may have a total C15 to total C25 weight ratio less than 25.0 or less than 20.0. In some embodiments the condensable hydrocarbon portion has a total C16 to total C25 weight ratio greater than 4.5. Alternatively, the condensable hydrocarbon portion may have a total C16 to total C25 weight ratio greater than 6.0, greater than 8.0, or greater than 10.0. In alternative embodiments, the condensable hydrocarbon portion may have a total C16 to total C25 weight ratio less than 20.0 or less than 15.0. In some embodiments the condensable hydrocarbon portion has a total C17 to total C25 weight ratio greater than 4.8. Alternatively, the condensable hydrocarbon portion may have a total C17 to total C25 weight ratio greater than 5.5 or greater than 7.0. In alternative embodiments, the condensable hydrocarbon portion may have a total C17 to total C25 weight ratio less than 20.0. In some embodiments the condensable hydrocarbon portion has a total C18 to total C25 weight ratio greater than 4.5. Alternatively, the condensable hydrocarbon portion may have a total C18 to total C25 weight ratio greater than 5.0 or greater than 5.5. In alternative embodiments, the condensable hydrocarbon portion may have a total C18 to total C25 weight ratio less than 15.0. Certain features of the present invention are described in terms of a set of numerical upper limits (e.g. "less than") and a set of numerical lower limits (e.g. "greater than") in the preceding paragraph. It should be appreciated that ranges formed by any combination of these limits are within the scope of the invention unless otherwise indicated. The embodiments described in this paragraph may be combined with any of the other aspects of the invention discussed herein.

In some embodiments the condensable hydrocarbon portion may have the one or more of a total C7 to total C29 weight ratio greater than 3.5, a total C8 to total C29 weight ratio greater than 9.0, a total C9 to total C29 weight ratio greater than 12.0, a total C10 to total C29 weight ratio greater than 15.0, a total C11 to total C29 weight ratio greater than 13.0, a total C12 to total C29 weight ratio greater than 12.5, and a total C13 to total C29 weight ratio greater than 16.0, a total C14 to total C29 weight ratio greater than 12.0, a total C15 to total C29 weight ratio greater than 12.0, a total C16 to total C29 weight ratio greater than 9.0, a total C17 to total C29 weight ratio greater than 10.0, a total C18 to total C29 weight ratio greater than 8.8, a total C19 to total C29 weight ratio greater than 7.0, a total C20 to total C29 weight ratio greater than 6.0, a total C21 to total C29 weight ratio greater than 5.5, and a total C22 to total C29 weight ratio greater than 4.2. In alternative embodiments the condensable hydrocarbon portion has one or more of a total C7 to total C29 weight ratio greater than 16.0, a total C8 to total C29 weight ratio greater than 19.0, a total C9 to total C29 weight ratio greater than 20.0, a total C10 to total C29 weight ratio greater than 18.0, a total C11 to total C29 weight ratio greater than 16.0, a total C12 to total C29 weight ratio greater than 15.0, and a total C13 to total C29 weight ratio greater than 17.0, a total C14 to total C29 weight ratio greater than 13.0, a total C15 to total C29 weight ratio greater than 13.0, a total C16 to total C29 weight ratio greater than 10.0, a total C17 to total C29 weight ratio greater than 11.0, a total C18 to total C29 weight ratio greater than 9.0, a total C19 to total C29 weight ratio greater than 8.0, a total C20 to total C29 weight ratio greater than 6.5, and a total C21 to total C29 weight ratio greater than 6.0. In alternative embodiments the condensable hydrocarbon portion has one or more of a total C7 to total C29 weight ratio greater than 24.0, a total C8 to total C29 weight ratio greater than 30.0, a total C9 to total C29 weight ratio greater than 32.0, a total C10 to total C29 weight ratio greater than 30.0, a total C11 to total C29 weight ratio greater than 27.0, a total C12 to total C29 weight ratio greater than 25.0, and a total C13 to total C29 weight ratio greater than 22.0, a total C14 to total C29 weight ratio greater than 18.0, a total C15 to total C29 weight ratio greater than 18.0, a total C16 to total C29 weight ratio greater than 16.0, a total C17 to total C29 weight ratio greater than 13.0, a total C18 to total C29 weight ratio greater than 10.0, a total C19 to total C29 weight ratio greater than 9.0, and a total C20 to total C29 weight ratio greater than 7.0. As used in this paragraph and in the claims, the phrase "one or more" followed by a listing of different compound or component ratios with the last ratio introduced by the conjunction "and" is meant to include a condensable hydrocarbon portion that has at least one of the listed ratios or that has two or more, or three or more, or four or more, etc., or all of the listed ratios. Further, a particular condensable hydrocarbon portion may also have additional ratios of different compounds or components that are not included in a particular sentence or claim and still fall within the scope of such a sentence or claim. The embodiments described in this paragraph may be combined with any of the other aspects of the invention discussed herein.

In some embodiments the condensable hydrocarbon portion has a total C7 to total C29 weight ratio greater than 3.5. Alternatively, the condensable hydrocarbon portion may have a total C7 to total C29 weight ratio greater than 5.0, greater than 10.0, greater than 18.0, greater than 20.0, or greater than 24.0. In alternative embodiments, the condensable hydrocarbon portion may have a total C7 to total C29 weight ratio less than 60.0 or less than 50.0. In some embodiments the condensable hydrocarbon portion has a total C8 to total C29 weight ratio greater than 9.0. Alternatively, the condensable hydrocarbon portion may have a total C8 to total C29 weight ratio greater than 10.0, greater than 18.0, greater than 20.0, greater than 25.0, or greater than 30.0. In alternative embodiments, the condensable hydrocarbon portion may have a total C8 to total C29 weight ratio less than 85.0 or less than 75.0. In some embodiments the condensable hydrocarbon portion has a total C9 to total C29 weight ratio greater than 12.0. Alternatively, the condensable hydrocarbon portion may have a total C9 to total C29 weight ratio greater than 15.0, greater than 20.0, greater than 23.0, greater than 27.0, or greater than 32.0. In alternative embodiments, the condensable hydrocarbon portion may have a total C9 to total C29 weight ratio less than 85.0 or less than 75.0. In some embodiments the condensable hydrocarbon portion has a total C10 to total C29 weight ratio greater than 15.0. Alternatively, the condensable hydrocarbon portion may have a total C10 to total C29 weight ratio greater than 18.0, greater than 22.0, or greater than 28.0. In alternative embodiments, the condensable hydrocarbon portion may have a total C10 to total C29 weight ratio less than 80.0 or less than 70.0. In some embodiments the condensable hydrocarbon portion has a total C11 to total C29 weight ratio greater than 13.0. Alternatively, the condensable hydrocarbon portion may have a total C11 to total C29 weight ratio greater than 16.0, greater than 18.0, greater than 24.0, or greater than 27.0. In alternative embodiments, the condensable hydrocarbon portion may have a total C11 to total C29 weight ratio less than 75.0 or less than 65.0. In some embodiments the condensable hydrocarbon portion has a total C12 to total C29 weight ratio greater than 12.5. Alternatively, the condensable hydrocarbon portion may have a total C12 to total C29 weight ratio greater than 14.5, greater than 18.0, greater than 22.0, or greater than 25.0. In alternative embodiments, the condensable hydrocarbon portion may have a total C12 to total C29 weight ratio less than 75.0 or less than 65.0. In some embodiments the condensable hydrocarbon portion has a total C13 to total C29 weight ratio greater than 16.0. Alternatively, the condensable hydrocarbon portion may have a total C13 to total C29 weight ratio greater than 18.0, greater than 20.0, or greater than 22.0. In alternative embodiments, the condensable hydrocarbon portion may have a total C13 to total C29 weight ratio less than 70.0 or less than 60.0. In some embodiments the condensable hydrocarbon portion has a total C14 to total C29 weight ratio greater than 12.0. Alternatively, the condensable hydrocarbon portion may have a total C14 to total C29 weight ratio greater than 14.0, greater than 16.0, or greater than 18.0. In alternative embodiments, the condensable hydrocarbon portion may have a total C14 to total C29 weight ratio less than 60.0 or less than 50.0. In some embodiments the condensable hydrocarbon portion has a total C15 to total C29 weight ratio greater than 12.0. Alternatively, the condensable hydrocarbon portion may have a total C15 to total C29 weight ratio greater than 15.0 or greater than 18.0. In alternative embodiments, the condensable hydrocarbon portion may have a total C15 to total C29 weight ratio less than 60.0 or less than 50.0. In some embodiments the condensable hydrocarbon portion has a total C16 to total C29 weight ratio greater than 9.0. Alternatively, the condensable hydrocarbon portion may have a total C16 to total C29 weight ratio greater than 10.0, greater than 13.0, or greater than 16.0. In alternative embodiments, the condensable hydrocarbon portion may have a total C16 to total C29 weight ratio less than 55.0 or less than 45.0. In some embodiments the condensable hydrocarbon portion has a total C17 to total C29 weight ratio greater than 10.0. Alternatively, the condensable hydrocarbon portion may have a total C17 to total C29 weight ratio greater than 11.0 or greater than 12.0. In alternative embodiments, the condensable hydrocarbon portion may have a total C17 to total C29 weight ratio less than 45.0. In some embodiments the condensable hydrocarbon portion has a total C18 to total C29 weight ratio greater than 8.8. Alternatively, the condensable hydrocarbon portion may have a total C18 to total C29 weight ratio greater than 9.0 or greater than 10.0. In alternative embodiments, the condensable hydrocarbon portion may have a total C18 to total C29 weight ratio less than 35.0. In some embodiments the condensable hydrocarbon portion has a total C19 to total C29 weight ratio greater than 7.0. Alternatively, the condensable hydrocarbon portion may have a total C19 to total C29 weight ratio greater than 8.0 or greater than 9.0. In alternative embodiments, the condensable hydrocarbon portion may have a total C19 to total C29 weight ratio less than 30.0. Certain features of the present invention are described in terms of a set of numerical upper limits (e.g. "less than") and a set of numerical lower limits (e.g. "greater than") in the preceding paragraph. It should be appreciated that ranges formed by any combination of these limits are within the scope of the invention unless otherwise indicated. The embodiments described in this paragraph may be combined with any of the other aspects of the invention discussed herein.

In some embodiments the condensable hydrocarbon portion may have the one or more of a total C9 to total C20 weight ratio between 2.5 and 6.0, a total C10 to total C20 weight ratio between 2.8 and 7.3, a total C11 to total C20 weight ratio between 2.6 and 6.5, a total C12 to total C20 weight ratio between 2.6 and 6.4 and a total C13 to total C20 weight ratio between 3.2 and 8.0. In alternative embodiments the condensable hydrocarbon portion has one or more of a total C9 to total C20 weight ratio between 3.0 and 5.5, a total C10 to total C20 weight ratio between 3.2 and 7.0, a total C11 to total C20 weight ratio between 3.0 and 6.0, a total C12 to total C20 weight ratio between 3.0 and 6.0, and a total C13 to total C20 weight ratio between 3.3 and 7.0. In alternative embodiments the condensable hydrocarbon portion has one or more of a total C9 to total C20 weight ratio between 4.6 and 5.5, a total C10 to total C20 weight ratio between 4.2 and 7.0, a total C11 to total C20 weight ratio between 3.7 and 6.0, a total C12 to total C20 weight ratio between 3.6 and 6.0, and a total C13 to total C20 weight ratio between 3.4 and 7.0. As used in this paragraph and in the claims, the phrase "one or more" followed by a listing of different compound or component ratios with the last ratio introduced by the conjunction "and" is meant to include a condensable hydrocarbon portion that has at least one of the listed ratios or that has two or more, or three or more, or four or more, etc., or all of the listed ratios. Further, a particular condensable hydrocarbon portion may also have additional ratios of different compounds or components that are not included in a particular sentence or claim and still fall within the scope of such a sentence or claim. The embodiments described in this paragraph may be combined with any of the other aspects of the invention discussed herein.

In some embodiments the condensable hydrocarbon portion has a total C9 to total C20 weight ratio between 2.5 and 6.0. Alternatively, the condensable hydrocarbon portion may have a total C9 to total C20 weight ratio between 3.0 and 5.8, between 3.5 and 5.8, between 4.0 and 5.8, between 4.5 and 5.8, between 4.6 and 5.8, or between 4.7 and 5.8. In some embodiments the condensable hydrocarbon portion has a total C10 to total C20 weight ratio between 2.8 and 7.3. Alternatively, the condensable hydrocarbon portion may have a total C10 to total C20 weight ratio between 3.0 and 7.2, between 3.5 and 7.0, between 4.0 and 7.0, between 4.2 and 7.0, between 4.3 and 7.0, or between 4.4 and 7.0. In some embodiments the condensable hydrocarbon portion has a total C11 to total C20 weight ratio between 2.6 and 6.5. Alternatively, the condensable hydrocarbon portion may have a total C11 to total C20 weight ratio between 2.8 and 6.3, between 3.5 and 6.3, between 3.7 and 6.3, between 3.8 and 6.3, between 3.9 and 6.2, or between 4.0 and 6.2. In some embodiments the condensable hydrocarbon portion has a total C12 to total C20 weight ratio between 2.6 and 6.4. Alternatively, the condensable hydrocarbon portion may have a total C12 to total C20 weight ratio between 2.8 and 6.2, between 3.2 and 6.2, between 3.5 and 6.2, between 3.6 and 6.2, between 3.7 and 6.0, or between 3.8 and 6.0. In some embodiments the condensable hydrocarbon portion has a total C13 to total C20 weight ratio between 3.2 and 8.0. Alternatively, the condensable hydrocarbon portion may have a total C13 to total C20 weight ratio between 3.3 and 7.8, between 3.3 and 7.0, between 3.4 and 7.0, between 3.5 and 6.5, or between 3.6 and 6.0. The embodiments described in this paragraph may be combined with any of the other aspects of the invention discussed herein.

In some embodiments the condensable hydrocarbon portion may have one or more of a total C10 to total C25 weight ratio between 7.1 and 24.5, a total C11 to total C25 weight ratio between 6.5 and 22.0, a total C12 to total C25 weight ratio between 6.5 and 22.0, and a total C13 to total C25 weight ratio between 8.0 and 27.0. In alternative embodiments the condensable hydrocarbon portion has one or more of a total C10 to total C25 weight ratio between 10.0 and 24.0, a total C11 to total C25 weight ratio between 10.0 and 21.5, a total C12 to total C25 weight ratio between 10.0 and 21.5, and a total C13 to total C25 weight ratio between 9.0 and 25.0. In alternative embodiments the condensable hydrocarbon portion has one or more of a total C10 to total C25 weight ratio between 14.0 and 24.0, a total C11 to total C25 weight ratio between 12.5 and 21.5, a total C12 to total C25 weight ratio between 12.0 and 21.5, and a total C13 to total C25 weight ratio between 10.5 and 25.0. As used in this paragraph and in the claims, the phrase "one or more" followed by a listing of different compound or component ratios with the last ratio introduced by the conjunction "and" is meant to include a condensable hydrocarbon portion that has at least one of the listed ratios or that has two or more, or three or more, or four or more, etc., or all of the listed ratios. Further, a particular condensable hydrocarbon portion may also have additional ratios of different compounds or components that are not included in a particular sentence or claim and still fall within the scope of such a sentence or claim. The embodiments described in this paragraph may be combined with any of the other aspects of the invention discussed herein.

In some embodiments the condensable hydrocarbon portion has a total C10 to total C25 weight ratio between 7.1 and 24.5. Alternatively, the condensable hydrocarbon portion may have a total C10 to total C25 weight ratio between 7.5 and 24.5, between 12.0 and 24.5, between 13.8 and 24.5, between 14.0 and 24.5, or between 15.0 and 24.5. In some embodiments the condensable hydrocarbon portion has a total C11 to total C25 weight ratio between 6.5 and 22.0. Alternatively, the condensable hydrocarbon portion may have a total C11 to total C25 weight ratio between 7.0 and 21.5, between 10.0 and 21.5, between 12.5 and 21.5, between 13.0 and 21.5, between 13.7 and 21.5, or between 14.5 and 21.5. In some embodiments the condensable hydrocarbon portion has a total C12 to total C25 weight ratio between 10.0 and 21.5. Alternatively, the condensable hydrocarbon portion may have a total C12 to total C25 weight ratio between 10.5 and 21.0, between 11.0 and 21.0, between 12.0 and 21.0, between 12.5 and 21.0, between 13.0 and 21.0, or between 13.5 and 21.0. In some embodiments the condensable hydrocarbon portion has a total C13 to total C25 weight ratio between 8.0 and 27.0. Alternatively, the condensable hydrocarbon portion may have a total C13 to total C25 weight ratio between 9.0 and 26.0, between 10.0 and 25.0, between 10.5 and 25.0, between 11.0 and 25.0, or between 11.5 and 25.0. The embodiments described in this paragraph may be combined with any of the other aspects of the invention discussed herein.

In some embodiments the condensable hydrocarbon portion may have one or more of a total C10 to total C29 weight ratio between 15.0 and 60.0, a total C11 to total C29 weight ratio between 13.0 and 54.0, a total C12 to total C29 weight ratio between 12.5 and 53.0, and a total C13 to total C29 weight ratio between 16.0 and 65.0. In alternative embodiments the condensable hydrocarbon portion has one or more of a total C10 to total C29 weight ratio between 17.0 and 58.0, a total C11 to total C29 weight ratio between 15.0 and 52.0, a total C12 to total C29 weight ratio between 14.0 and 50.0, and a total C13 to total C29 weight ratio between 17.0 and 60.0. In alternative embodiments the condensable hydrocarbon portion has one or more of a total C10 to total C29 weight ratio between 20.0 and 58.0, a total C11 to total C29 weight ratio between 18.0 and 52.0, a total C12 to total C29 weight ratio between 18.0 and 50.0, and a total C13 to total C29 weight ratio between 18.0 and 50.0. As used in this paragraph and in the claims, the phrase "one or more" followed by a listing of different compound or component ratios with the last ratio introduced by the conjunction "and" is meant to include a condensable hydrocarbon portion that has at least one of the listed ratios or that has two or more, or three or more, or four or more, etc., or all of the listed ratios. Further, a particular condensable hydrocarbon portion may also have additional ratios of different compounds or components that are not included in a particular sentence or claim and still fall within the scope of such a sentence or claim. The embodiments described in this paragraph may be combined with any of the other aspects of the invention discussed herein.

In some embodiments the condensable hydrocarbon portion has a total C10 to total C29 weight ratio between 15.0 and 60.0. Alternatively, the condensable hydrocarbon portion may have a total C10 to total C29 weight ratio between 18.0 and 58.0, between 20.0 and 58.0, between 24.0 and 58.0, between 27.0 and 58.0, or between 30.0 and 58.0. In some embodiments the condensable hydrocarbon portion has a total C11 to total C29 weight ratio between 13.0 and 54.0. Alternatively, the condensable hydrocarbon portion may have a total C11 to total C29 weight ratio between 15.0 and 53.0, between 18.0 and 53.0, between 20.0 and 53.0, between 22.0 and 53.0, between 25.0 and 53.0, or between 27.0 and 53.0. In some embodiments the condensable hydrocarbon portion has a total C12 to total C29 weight ratio between 12.5 and 53.0. Alternatively, the condensable hydrocarbon portion may have a total C12 to total C29 weight ratio between 14.5 and 51.0, between 16.0 and 51.0, between 18.0 and 51.0, between 20.0 and 51.0, between 23.0 and 51.0, or between 25.0 and 51.0. In some embodiments the condensable hydrocarbon portion has a total C13 to total C29 weight ratio between 16.0 and 65.0. Alternatively, the condensable hydrocarbon portion may have a total C13 to total C29 weight ratio between 17.0 and 60.0, between 18.0 and 60.0, between 20.0 and 60.0, between 22.0 and 60.0, or between 25.0 and 60.0. The embodiments described in this paragraph may be combined with any of the other aspects of the invention discussed herein.

In some embodiments the condensable hydrocarbon portion may have one or more of a normal-C7 to normal-C20 weight ratio greater than 0.9, a normal-C8 to normal-C20 weight ratio greater than 2.0, a normal-C9 to normal-C20 weight ratio greater than 1.9, a normal-C10 to normal-C20 weight ratio greater than 2.2, a normal-C11 to normal-C20 weight ratio greater than 1.9, a normal-C12 to normal-C20 weight ratio greater than 1.9, a normal-C13 to normal-C20 weight ratio greater than 2.3, a normal-C14 to normal-C20 weight ratio greater than 1.8, a normal-C15 to normal-C20 weight ratio greater than 1.8, and normal-C16 to normal-C20 weight ratio greater than 1.3. In alternative embodiments the condensable hydrocarbon portion has one or more of a normal-C7 to normal-C20 weight ratio greater than 4.4, a normal-C8 to normal-C20 weight ratio greater than 3.7, a normal-C9 to normal-C20 weight ratio greater than 3.5, a normal-C10 to normal-C20 weight ratio greater than 3.4, a normal-C11 to normal-C20 weight ratio greater than 3.0, and a normal-C12 to normal-C20 weight ratio greater than 2.7. In alternative embodiments the condensable hydrocarbon portion has one or more of a normal-C7 to normal-C20 weight ratio greater than 4.9, a normal-C8 to normal-C20 weight ratio greater than 4.5, a normal-C9 to normal-C20 weight ratio greater than 4.4, a normal-C10 to normal-C20 weight ratio greater than 4.1, a normal-C11 to normal-C20 weight ratio greater than 3.7, and a normal-C12 to normal-C20 weight ratio greater than 3.0. As used in this paragraph and in the claims, the phrase "one or more" followed by a listing of different compound or component ratios with the last ratio introduced by the conjunction "and" is meant to include a condensable hydrocarbon portion that has at least one of the listed ratios or that has two or more, or three or more, or four or more, etc., or all of the listed ratios. Further, a particular condensable hydrocarbon portion may also have additional ratios of different compounds or components that are not included in a particular sentence or claim and still fall within the scope of such a sentence or claim. The embodiments described in this paragraph may be combined with any of the other aspects of the invention discussed herein.

In some embodiments the condensable hydrocarbon portion has a normal-C7 to normal-C20 weight ratio greater than 0.9. Alternatively, the condensable hydrocarbon portion may have a normal-C7 to normal-C20 weight ratio greater than 1.0, than 2.0, greater than 3.0, greater than 4.0, greater than 4.5, or greater than 5.0. In alternative embodiments, the condensable hydrocarbon portion may have a normal-C7 to normal-C20 weight ratio less than 8.0 or less than 7.0. In some embodiments the condensable hydrocarbon portion has a normal-C8 to normal-C20 weight ratio greater than 1.7. Alternatively, the condensable hydrocarbon portion may have a normal-C8 to normal-C20 weight ratio greater than 2.0, greater than 2.5, greater than 3.0, greater than 3.5, greater than 4.0, or greater than 4.4. In alternative embodiments, the condensable hydrocarbon portion may have a normal-C8 to normal-C20 weight ratio less than 8.0 or less than 7.0. In some embodiments the condensable hydrocarbon portion has a normal-C9 to normal-C20 weight ratio greater than 1.9. Alternatively, the condensable hydrocarbon portion may have a normal-C9 to normal-C20 weight ratio greater than 2.0, greater than 3.0, greater than 4.0, or greater than 4.5. In alternative embodiments, the condensable hydrocarbon portion may have a normal-C9 to normal-C20 weight ratio less than 7.0 or less than 6.0. In some embodiments the condensable hydrocarbon portion has a normal-C10 to normal-C20 weight ratio greater than 2.2. Alternatively, the condensable hydrocarbon portion may have a normal-C10 to normal-C20 weight ratio greater than 2.8, greater than 3.3, greater than 3.5, or greater than 4.0. In alternative embodiments, the condensable hydrocarbon portion may have a normal-C10 to normal-C20 weight ratio less than 7.0 or less than 6.0. In some embodiments the condensable hydrocarbon portion has a normal-C11 to normal-C20 weight ratio greater than 1.9. Alternatively, the condensable hydrocarbon portion may have a normal-C11 to normal-C20 weight ratio greater than 2.5, greater than 3.0, greater than 3.5, or greater than 3.7. In alternative embodiments, the condensable hydrocarbon portion may have a normal-C11 to normal-C20 weight ratio less than 7.0 or less than 6.0. In some embodiments the condensable hydrocarbon portion has a normal-C12 to normal-C20 weight ratio greater than 1.9. Alternatively, the condensable hydrocarbon portion may have a normal-C12 to normal-C20 weight ratio greater than 2.0, greater than 2.2, greater than 2.6, or greater than 3.0. In alternative embodiments, the condensable hydrocarbon portion may have a normal-C12 to normal-C20 weight ratio less than 7.0 or less than 6.0. In some embodiments the condensable hydrocarbon portion has a normal-C13 to normal-C20 weight ratio greater than 2.3. Alternatively, the condensable hydrocarbon portion may have a normal-C13 to normal-C20 weight ratio greater than 2.5, greater than 2.7, or greater than 3.0. In alternative embodiments, the condensable hydrocarbon portion may have a normal-C13 to normal-C20 weight ratio less than 6.0 or less than 5.0. In some embodiments the condensable hydrocarbon portion has a normal-C14 to normal-C20 weight ratio greater than 1.8. Alternatively, the condensable hydrocarbon portion may have a normal-C14 to normal-C20 weight ratio greater than 2.0, greater than 2.2, or greater than 2.5. In alternative embodiments, the condensable hydrocarbon portion may have a normal-C14 to normal-C20 weight ratio less than 6.0 or less than 4.0. In some embodiments the condensable hydrocarbon portion has a normal-C15 to normal-C20 weight ratio greater than 1.8. Alternatively, the condensable hydrocarbon portion may have a normal-C15 to normal-C20 weight ratio greater than 2.0, greater than 2.2, or greater than 2.4. In alternative embodiments, the condensable hydrocarbon portion may have a normal-C15 to normal-C20 weight ratio less than 6.0 or less than 4.0. In some embodiments the condensable hydrocarbon portion has a normal-C16 to normal-C20 weight ratio greater than 1.3. Alternatively, the condensable hydrocarbon portion may have a normal-C16 to normal-C20 weight ratio greater than 1.5, greater than 1.7, or greater than 2.0. In alternative embodiments, the condensable hydrocarbon portion may have a normal-C16 to normal-C20 weight ratio less than 5.0 or less than 4.0. Certain features of the present invention are described in terms of a set of numerical upper limits (e.g. "less than") and a set of numerical lower limits (e.g. "greater than") in the preceding paragraph. It should be appreciated that ranges formed by any combination of these limits are within the scope of the invention unless otherwise indicated. The embodiments described in this paragraph may be combined with any of the other aspects of the invention discussed herein.

In some embodiments the condensable hydrocarbon portion may have one or more of a normal-C7 to normal-C25 weight ratio greater than 1.9, a normal-C8 to normal-C25 weight ratio greater than 3.9, a normal-C9 to normal-C25 weight ratio greater than 3.7, a normal-C10 to normal-C25 weight ratio greater than 4.4, a normal-C11 to normal-C25 weight ratio greater than 3.8, a normal-C12 to normal-C25 weight ratio greater than 3.7, a normal-C13 to normal-C25 weight ratio greater than 4.7, a normal-C14 to normal-C25 weight ratio greater than 3.7, a normal-C15 to normal-C25 weight ratio greater than 3.7, a normal-C16 to normal-C25 weight ratio greater than 2.5, a normal-C17 to normal-C25 weight ratio greater than 3.0, and a normal-C18 to normal-C25 weight ratio greater than 3.4. In alternative embodiments the condensable hydrocarbon portion has one or more of a normal-C7 to normal-C25 weight ratio greater than 10, a normal-C8 to normal-C25 weight ratio greater than 8.0, a normal-C9 to normal-C25 weight ratio greater than 7.0, a normal-C10 to normal-C25 weight ratio greater than 7.0, a normal-C11 to normal-C25 weight ratio greater than 7.0, and a normal-C12 to normal-C25 weight ratio greater than 6.0. In alternative embodiments the condensable hydrocarbon portion has one or more of a normal-C7 to normal-C25 weight ratio greater than 10.0, a normal-C8 to normal-C25 weight ratio greater than 12.0, a normal-C9 to normal-C25 weight ratio greater than 11.0, a normal-C10 to normal-C25 weight ratio greater than 11.0, a normal-C11 to normal-C25 weight ratio greater than 9.0, and a normal-C12 to normal-C25 weight ratio greater than 8.0. As used in this paragraph and in the claims, the phrase "one or more" followed by a listing of different compound or component ratios with the last ratio introduced by the conjunction "and" is meant to include a condensable hydrocarbon portion that has at least one of the listed ratios or that has two or more, or three or more, or four or more, etc., or all of the listed ratios. Further, a particular condensable hydrocarbon portion may also have additional ratios of different compounds or components that are not included in a particular sentence or claim and still fall within the scope of such a sentence or claim. The embodiments described in this paragraph may be combined with any of the other aspects of the invention discussed herein.

In some embodiments the condensable hydrocarbon portion has a normal-C7 to normal-C25 weight ratio greater than 1.9. Alternatively, the condensable hydrocarbon portion may have a normal-C7 to normal-C25 weight ratio greater than 3.0, greater than 5.0, greater than 8.0, greater than 10.0, or greater than 13.0. In alternative embodiments, the condensable hydrocarbon portion may have a normal-C7 to normal-C25 weight ratio less than 35.0 or less than 25.0. In some embodiments the condensable hydrocarbon portion has a normal-C8 to normal-C25 weight ratio greater than 3.9. Alternatively, the condensable hydrocarbon portion may have a normal-C8 to normal-C25 weight ratio greater than 4.5, greater than 6.0, greater than 8.0, greater than 10.0, or greater than 13.0. In alternative embodiments, the condensable hydrocarbon portion may have a normal-C8 to normal-C25 weight ratio less than 35.0 or less than 25.0. In some embodiments the condensable hydrocarbon portion has a normal-C9 to normal-C25 weight ratio greater than 3.7. Alternatively, the condensable hydrocarbon portion may have a normal-C9 to normal-C25 weight ratio greater than 4.5, greater than 7.0, greater than 10.0, greater than 12.0, or greater than 13.0. In alternative embodiments, the condensable hydrocarbon portion may have a normal-C9 to normal-C25 weight ratio less than 35.0 or less than 25.0. In some embodiments the condensable hydrocarbon portion has a normal-C10 to normal-C25 weight ratio greater than 4.4. Alternatively, the condensable hydrocarbon portion may have a normal-C10 to normal-C25 weight ratio greater than 6.0, greater than 8.0, or greater than 11. In alternative embodiments, the condensable hydrocarbon portion may have a normal-C10 to normal-C25 weight ratio less than 35.0 or less than 25.0. In some embodiments the condensable hydrocarbon portion has a normal-C11 to normal-C25 weight ratio greater than 3.8. Alternatively, the condensable hydrocarbon portion may have a normal-C11 to normal-C25 weight ratio greater than 4.5, greater than 7.0, greater than 8.0, or greater than 10.0. In alternative embodiments, the condensable hydrocarbon portion may have a normal-C11 to normal-C25 weight ratio less than 35.0 or less than 25.0. In some embodiments the condensable hydrocarbon portion has a normal-C12 to normal-C25 weight ratio greater than 3.7. Alternatively, the condensable hydrocarbon portion may have a normal-C12 to normal-C25 weight ratio greater than 4.5, greater than 6.0, greater than 7.0, or greater than 8.0. In alternative embodiments, the condensable hydrocarbon portion may have a normal-C12 to normal-C25 weight ratio less than 30.0 or less than 20.0. In some embodiments the condensable hydrocarbon portion has a normal-C13 to normal-C25 weight ratio greater than 4.7. Alternatively, the condensable hydrocarbon portion may have a normal-C13 to normal-C25 weight ratio greater than 5.0, greater than 6.0, or greater than 7.5. In alternative embodiments, the condensable hydrocarbon portion may have a normal-C13 to normal-C25 weight ratio less than 25.0 or less than 20.0. In some embodiments the condensable hydrocarbon portion has a normal-C14 to normal-C25 weight ratio greater than 3.7. Alternatively, the condensable hydrocarbon portion may have a normal-C14 to normal-C25 weight ratio greater than 4.5, greater than 5.5, or greater than 7.0. In alternative embodiments, the condensable hydrocarbon portion may have a normal-C14 to normal-C25 weight ratio less than 25.0 or less than 20.0. In some embodiments the condensable hydrocarbon portion has a normal-C15 to normal-C25 weight ratio greater than 3.7. Alternatively, the condensable hydrocarbon portion may have a normal-C15 to normal-C25 weight ratio greater than 4.2 or greater than 5.0. In alternative embodiments, the condensable hydrocarbon portion may have a normal-C15 to normal-C25 weight ratio less than 25.0 or less than 20.0. In some embodiments the condensable hydrocarbon portion has a normal-C16 to normal-C25 weight ratio greater than 2.5. Alternatively, the condensable hydrocarbon portion may have a normal-C16 to normal-C25 weight ratio greater than 3.0, greater than 4.0, or greater than 5.0. In alternative embodiments, the condensable hydrocarbon portion may have a normal-C16 to normal-C25 weight ratio less than 20.0 or less than 15.0. In some embodiments the condensable hydrocarbon portion has a normal-C17 to normal-C25 weight ratio greater than 3.0. Alternatively, the condensable hydrocarbon portion may have a normal-C17 to normal-C25 weight ratio greater than 3.5 or greater than 4.0. In alternative embodiments, the condensable hydrocarbon portion may have a normal-C17 to normal-C25 weight ratio less than 20.0. In some embodiments the condensable hydrocarbon portion has a normal-C18 to normal-C25 weight ratio greater than 3.4. Alternatively, the condensable hydrocarbon portion may have a normal-C18 to normal-C25 weight ratio greater than 3.6 or greater than 4.0. In alternative embodiments, the condensable hydrocarbon portion may have a normal-C18 to normal-C25 weight ratio less than 15.0. Certain features of the present invention are described in terms of a set of numerical upper limits (e.g. "less than") and a set of numerical lower limits (e.g. "greater than") in the preceding paragraph. It should be appreciated that ranges formed by any combination of these limits are within the scope of the invention unless otherwise indicated. The embodiments described in this paragraph may be combined with any of the other aspects of the invention discussed herein.

In some embodiments the condensable hydrocarbon portion may have one or more of a normal-C7 to normal-C29 weight ratio greater than 18.0, a normal-C8 to normal-C29 weight ratio greater than 16.0, a normal-C9 to normal-C29 weight ratio greater than 14.0, a normal-C10 to normal-C29 weight ratio greater than 14.0, a normal-C11 to normal-C29 weight ratio greater than 13.0, a normal-C12 to normal-C29 weight ratio greater than 11.0, a normal-C13 to normal-C29 weight ratio greater than 10.0, a normal-C14 to normal-C29 weight ratio greater than 9.0, a normal-C15 to normal-C29 weight ratio greater than 8.0, a normal-C16 to normal-C29 weight ratio greater than 8.0, a normal-C17 to normal-C29 weight ratio greater than 6.0, a normal-C18 to normal-C29 weight ratio greater than 6.0, a normal-C19 to normal-C29 weight ratio greater than 5.0, a normal-C20 to normal-C29 weight ratio greater than 4.0, a normal-C21 to normal-C29 weight ratio greater than 3.6, and a normal-C22 to normal-C29 weight ratio greater than 2.8. In alternative embodiments the condensable hydrocarbon portion has one or more of a normal-C7 to normal-C29 weight ratio greater than 20.0, a normal-C8 to normal-C29 weight ratio greater than 18.0, a normal-C9 to normal-C29 weight ratio greater than 17.0, a normal-C10 to normal-C29 weight ratio greater than 16.0, a normal-C11 to normal-C29 weight ratio greater than 15.0, a normal-C12 to normal-C29 weight ratio greater than 12.5, a normal-C13 to normal-C29 weight ratio greater than 11.0, a normal-C14 to normal-C29 weight ratio greater than 10.0, a normal-C15 to normal-C29 weight ratio greater than 8.0, a normal-C16 to normal-C29 weight ratio greater than 8.0, a normal-C17 to normal-C29 weight ratio greater than 7.0, a normal-C18 to normal-C29 weight ratio greater than 6.5, a normal-C19 to normal-C29 weight ratio greater than 5.5, a normal-C20 to normal-C29 weight ratio greater than 4.5, and a normal-C21 to normal-C29 weight ratio greater than 4.0. In alternative embodiments the condensable hydrocarbon portion has one or more of a normal-C7 to normal-C29 weight ratio greater than 23.0, a normal-C8 to normal-C29 weight ratio greater than 21.0, a normal-C9 to normal-C29 weight ratio greater than 20.0, a normal-C10 to normal-C29 weight ratio greater than 19.0, a normal-C11 to normal-C29 weight ratio greater than 17.0, a normal-C12 to normal-C29 weight ratio greater than 14.0, a normal-C13 to normal-C29 weight ratio greater than 12.0, a normal-C14 to normal-C29 weight ratio greater than 11.0, a normal-C15 to normal-C29 weight ratio greater than 9.0, a normal-C16 to normal-C29 weight ratio greater than 9.0, a normal-C17 to normal-C29 weight ratio greater than 7.5, a normal-C18 to normal-C29 weight ratio greater than 7.0, a normal-C19 to normal-C29 weight ratio greater than 6.5, a normal-C20 to normal-C29 weight ratio greater than 4.8, and a normal-C21 to normal-C29 weight ratio greater than 4.5. As used in this paragraph and in the claims, the phrase "one or more" followed by a listing of different compound or component ratios with the last ratio introduced by the conjunction "and" is meant to include a condensable hydrocarbon portion that has at least one of the listed ratios or that has two or more, or three or more, or four or more, etc., or all of the listed ratios. Further, a particular condensable hydrocarbon portion may also have additional ratios of different compounds or components that are not included in a particular sentence or claim and still fall within the scope of such a sentence or claim. The embodiments described in this paragraph may be combined with any of the other aspects of the invention discussed herein.

In some embodiments the condensable hydrocarbon portion has a normal-C7 to normal-C29 weight ratio greater than 18.0. Alternatively, the condensable hydrocarbon portion may have a normal-C7 to normal-C29 weight ratio greater than 20.0, greater than 22.0, greater than 25.0, greater than 30.0, or greater than 35.0. In alternative embodiments, the condensable hydrocarbon portion may have a normal-C7 to normal-C29 weight ratio less than 70.0 or less than 60.0. In some embodiments the condensable hydrocarbon portion has a normal-C8 to normal-C29 weight ratio greater than 16.0. Alternatively, the condensable hydrocarbon portion may have a normal-C8 to normal-C29 weight ratio greater than 18.0, greater than 22.0, greater than 25.0, greater than 27.0, or greater than 30.0. In alternative embodiments, the condensable hydrocarbon portion may have a normal-C8 to normal-C29 weight ratio less than 85.0 or less than 75.0. In some embodiments the condensable hydrocarbon portion has a normal-C9 to normal-C29 weight ratio greater than 14.0. Alternatively, the condensable hydrocarbon portion may have a normal-C9 to normal-C29 weight ratio greater than 18.0, greater than 20.0, greater than 23.0, greater than 27.0, or greater than 30.0. In alternative embodiments, the condensable hydrocarbon portion may have a normal-C9 to normal-C29 weight ratio less than 85.0 or less than 75.0. In some embodiments the condensable hydrocarbon portion has a normal-C10 to normal-C29 weight ratio greater than 14.0. Alternatively, the condensable hydrocarbon portion may have a normal-C10 to normal-C29 weight ratio greater than 20.0, greater than 25.0, or greater than 30.0. In alternative embodiments, the condensable hydrocarbon portion may have a normal-C10 to normal-C29 weight ratio less than 80.0 or less than 70.0. In some embodiments the condensable hydrocarbon portion has a normal-C11 to normal-C29 weight ratio greater than 13.0. Alternatively, the condensable hydrocarbon portion may have a normal-C11 to normal-C29 weight ratio greater than 16.0, greater than 18.0, greater than 24.0, or greater than 27.0. In alternative embodiments, the condensable hydrocarbon portion may have a normal-C11 to normal-C29 weight ratio less than 75.0 or less than 65.0. In some embodiments the condensable hydrocarbon portion has a normal-C12 to normal-C29 weight ratio greater than 11.0. Alternatively, the condensable hydrocarbon portion may have a normal-C12 to normal-C29 weight ratio greater than 14.5, greater than 18.0, greater than 22.0, or greater than 25.0. In alternative embodiments, the condensable hydrocarbon portion may have a normal-C12 to normal-C29 weight ratio less than 75.0 or less than 65.0. In some embodiments the condensable hydrocarbon portion has a normal-C13 to normal-C29 weight ratio greater than 10.0. Alternatively, the condensable hydrocarbon portion may have a normal-C13 to normal-C29 weight ratio greater than 18.0, greater than 20.0, or greater than 22.0. In alternative embodiments, the condensable hydrocarbon portion may have a normal-C13 to normal-C29 weight ratio less than 70.0 or less than 60.0. In some embodiments the condensable hydrocarbon portion has a normal-C14 to normal-C29 weight ratio greater than 9.0. Alternatively, the condensable hydrocarbon portion may have a normal-C14 to normal-C29 weight ratio greater than 14.0, greater than 16.0, or greater than 18.0. In alternative embodiments, the condensable hydrocarbon portion may have a normal-C14 to normal-C29 weight ratio less than 60.0 or less than 50.0. In some embodiments the condensable hydrocarbon portion has a normal-C15 to normal-C29 weight ratio greater than 8.0. Alternatively, the condensable hydrocarbon portion may have a normal-C15 to normal-C29 weight ratio greater than 12.0 or greater than 16.0. In alternative embodiments, the condensable hydrocarbon portion may have a normal-C15 to normal-C29 weight ratio less than 60.0 or less than 50.0. In some embodiments the condensable hydrocarbon portion has a normal-C16 to normal-C29 weight ratio greater than 8.0. Alternatively, the condensable hydrocarbon portion may have a normal-C16 to normal-C29 weight ratio greater than 10.0, greater than 13.0, or greater than 15.0. In alternative embodiments, the condensable hydrocarbon portion may have a normal-C16 to normal-C29 weight ratio less than 55.0 or less than 45.0. In some embodiments the condensable hydrocarbon portion has a normal-C17 to normal-C29 weight ratio greater than 6.0. Alternatively, the condensable hydrocarbon portion may have a normal-C17 to normal-C29 weight ratio greater than 8.0 or greater than 12.0. In alternative embodiments, the condensable hydrocarbon portion may have a normal-C17 to normal-C29 weight ratio less than 45.0. In some embodiments the condensable hydrocarbon portion has a normal-C18 to normal-C29 weight ratio greater than 6.0. Alternatively, the condensable hydrocarbon portion may have a normal-C18 to normal-C29 weight ratio greater than 8.0 or greater than 10.0. In alternative embodiments, the condensable hydrocarbon portion may have a normal-C18 to normal-C29 weight ratio less than 35.0. In some embodiments the condensable hydrocarbon portion has a normal-C19 to normal-C29 weight ratio greater than 5.0. Alternatively, the condensable hydrocarbon portion may have a normal-C19 to normal-C29 weight ratio greater than 7.0 or greater than 9.0. In alternative embodiments, the condensable hydrocarbon portion may have a normal-C19 to normal-C29 weight ratio less than 30.0. In some embodiments the condensable hydrocarbon portion has a normal-C20 to normal-C29 weight ratio greater than 4.0. Alternatively, the condensable hydrocarbon portion may have a normal-C20 to normal-C29 weight ratio greater than 6.0 or greater than 8.0. In alternative embodiments, the condensable hydrocarbon portion may have a normal-C20 to normal-C29 weight ratio less than 30.0. In some embodiments the condensable hydrocarbon portion has a normal-C21 to normal-C29 weight ratio greater than 3.6. Alternatively, the condensable hydrocarbon portion may have a normal-C21 to normal-C29 weight ratio greater than 4.0 or greater than 6.0. In alternative embodiments, the condensable hydrocarbon portion may have a normal-C21 to normal-C29 weight ratio less than 30.0. In some embodiments the condensable hydrocarbon portion has a normal-C22 to normal-C29 weight ratio greater than 2.8. Alternatively, the condensable hydrocarbon portion may have a normal-C22 to normal-C29 weight ratio greater than 3.0. In alternative embodiments, the condensable hydrocarbon portion may have a normal-C22 to normal-C29 weight ratio less than 30.0. Certain features of the present invention are described in terms of a set of numerical upper limits (e.g. "less than") and a set of numerical lower limits (e.g. "greater than") in the preceding paragraph. It should be appreciated that ranges formed by any combination of these limits are within the scope of the invention unless otherwise indicated. The embodiments described in this paragraph may be combined with any of the other aspects of the invention discussed herein.

In some embodiments the condensable hydrocarbon portion may have one or more of a normal-C10 to total C10 weight ratio less than 0.31, a normal-C11 to total C11 weight ratio less than 0.32, a normal-C12 to total C12 weight ratio less than 0.29, a normal-C13 to total C13 weight ratio less than 0.28, a normal-C14 to total C14 weight ratio less than 0.31, a normal-C15 to total C15 weight ratio less than 0.27, a normal-C16 to total C16 weight ratio less than 0.31, a normal-C17 to total C17 weight ratio less than 0.31, a normal-C18 to total C18 weight ratio less than 0.37, normal-C19 to total C19 weight ratio less than 0.37, a normal-C20 to total C20 weight ratio less than 0.37, a normal-C21 to total C21 weight ratio less than 0.37, a normal-C22 to total C22 weight ratio less than 0.38, normal-C23 to total C23 weight ratio less than 0.43, a normal-C24 to total C24 weight ratio less than 0.48, and a normal-C25 to total C25 weight ratio less than 0.53. In alternative embodiments the condensable hydrocarbon portion has one or more of a normal-C11 to total C11 weight ratio less than 0.30, a normal-C12 to total C12 weight ratio less than 0.27, a normal-C13 to total C13 weight ratio less than 0.26, a normal-C14 to total C14 weight ratio less than 0.29, a normal-C15 to total C15 weight ratio less than 0.24, a normal-C16 to total C16 weight ratio less than 0.25, a normal-C17 to total C17 weight ratio less than 0.29, a normal-C18 to total C18 weight ratio less than 0.31, normal-C19 to total C19 weight ratio less than 0.35, a normal-C20 to total C20 weight ratio less than 0.33, a normal-C21 to total C21 weight ratio less than 0.33, a normal-C22 to total C22 weight ratio less than 0.35, normal-C23 to total C23 weight ratio less than 0.40, a normal-C24 to total C24 weight ratio less than 0.45, and a normal-C25 to total C25 weight ratio less than 0.49. In alternative embodiments the condensable hydrocarbon portion has one or more of a normal-C11 to total C11 weight ratio less than 0.28, a normal-C12 to total C12 weight ratio less than 0.25, a normal-C13 to total C13 weight ratio less than 0.24, a normal-C14 to total C14 weight ratio less than 0.27, a normal-C15 to total C15 weight ratio less than 0.22, a normal-C16 to total C16 weight ratio less than 0.23, a normal-C17 to total C17 weight ratio less than 0.25, a normal-C18 to total C18 weight ratio less than 0.28, normal-C19 to total C19 weight ratio less than 0.31, a normal-C20 to total C20 weight ratio less than 0.29, a normal-C21 to total C21 weight ratio less than 0.30, a normal-C22 to total C22 weight ratio less than 0.28, normal-C23 to total C23 weight ratio less than 0.33, a normal-C24 to total C24 weight ratio less than 0.40, and a normal-C25 to total C25 weight ratio less than 0.45. As used in this paragraph and in the claims, the phrase "one or more" followed by a listing of different compound or component ratios with the last ratio introduced by the conjunction "and" is meant to include a condensable hydrocarbon portion that has at least one of the listed ratios or that has two or more, or three or more, or four or more, etc., or all of the listed ratios. Further, a particular condensable hydrocarbon portion may also have additional ratios of different compounds or components that are not included in a particular sentence or claim and still fall within the scope of such a sentence or claim. The embodiments described in this paragraph may be combined with any of the other aspects of the invention discussed herein.

In some embodiments the condensable hydrocarbon portion has a normal-C10 to total C10 weight ratio less than 0.31. Alternatively, the condensable hydrocarbon portion may have a normal-C10 to total C10 weight ratio less than 0.30 or less than 0.29. In alternative embodiments, the condensable hydrocarbon portion may have a normal-C10 to total C10 weight ratio greater than 0.15 or greater than 0.20. In some embodiments the condensable hydrocarbon portion has a normal-C11 to total C11 weight ratio less than 0.32. Alternatively, the condensable hydrocarbon portion may have a normal-C11 to total C11 weight ratio less than 0.31, less than 0.30, or less than 0.29. In alternative embodiments, the condensable hydrocarbon portion may have a normal-C11 to total C11 weight ratio greater than 0.15 or greater than 0.20. In some embodiments the condensable hydrocarbon portion has a normal-C12 to total C12 weight ratio less than 0.29. Alternatively, the condensable hydrocarbon portion may have a normal-C12 to total C12 weight ratio less than 0.26, or less than 0.24. In alternative embodiments, the condensable hydrocarbon portion may have a normal-C12 to total C12 weight ratio greater than 0.10 or greater than 0.15. In some embodiments the condensable hydrocarbon portion has a normal-C13 to total C13 weight ratio less than 0.28. Alternatively, the condensable hydrocarbon portion may have a normal-C13 to total C13 weight ratio less than 0.27, less than 0.25, or less than 0.23. In alternative embodiments, the condensable hydrocarbon portion may have a normal-C13 to total C13 weight ratio greater than 0.10 or greater than 0.15. In some embodiments the condensable hydrocarbon portion has a normal-C14 to total C14 weight ratio less than 0.31. Alternatively, the condensable hydrocarbon portion may have a normal-C14 to total C14 weight ratio less than 0.30, less than 0.28, or less than 0.26. In alternative embodiments, the condensable hydrocarbon portion may have a normal-C14 to total C14 weight ratio greater than 0.10 or greater than 0.15. In some embodiments the condensable hydrocarbon portion has a normal-C15 to total C15 weight ratio less than 0.27. Alternatively, the condensable hydrocarbon portion may have a normal-C15 to total C15 weight ratio less than 0.26, less than 0.24, or less than 0.22. In alternative embodiments, the condensable hydrocarbon portion may have a normal-C15 to total C15 weight ratio greater than 0.10 or greater than 0.15. In some embodiments the condensable hydrocarbon portion has a normal-C16 to total C16 weight ratio less than 0.31. Alternatively, the condensable hydrocarbon portion may have a normal-C16 to total C16 weight ratio less than 0.29, less than 0.26, or less than 0.24. In alternative embodiments, the condensable hydrocarbon portion may have a normal-C16 to total C16 weight ratio greater than 0.10 or greater than 0.15. In some embodiments the condensable hydrocarbon portion has a normal-C17 to total C17 weight ratio less than 0.31. Alternatively, the condensable hydrocarbon portion may have a normal-C17 to total C17 weight ratio less than 0.29, less than 0.27, or less than 0.25. In alternative embodiments, the condensable hydrocarbon portion may have a normal-C17 to total C17 weight ratio greater than 0.10 or greater than 0.15. In some embodiments the condensable hydrocarbon portion has a normal-C18 to total C18 weight ratio less than 0.37. Alternatively, the condensable hydrocarbon portion may have a normal-C18 to total C18 weight ratio less than 0.35, less than 0.31, or less than 0.28. In alternative embodiments, the condensable hydrocarbon portion may have a normal-C18 to total C18 weight ratio greater than 0.10 or greater than 0.15. In some embodiments the condensable hydrocarbon portion has a normal-C19 to total C19 weight ratio less than 0.37. Alternatively, the condensable hydrocarbon portion may have a normal-C19 to total C19 weight ratio less than 0.36, less than 0.34, or less than 0.31. In alternative embodiments, the condensable hydrocarbon portion may have a normal-C19 to total C19 weight ratio greater than 0.10 or greater than 0.15. In some embodiments the condensable hydrocarbon portion has a normal-C20 to total C20 weight ratio less than 0.37. Alternatively, the condensable hydrocarbon portion may have a normal-C20 to total C20 weight ratio less than 0.35, less than 0.32, or less than 0.29. In alternative embodiments, the condensable hydrocarbon portion may have a normal-C20 to total C20 weight ratio greater than 0.10 or greater than 0.15. In some embodiments the condensable hydrocarbon portion has a normal-C21 to total C21 weight ratio less than 0.37. Alternatively, the condensable hydrocarbon portion may have a normal-C21 to total C21 weight ratio less than 0.35, less than 0.32, or less than 0.30. In alternative embodiments, the condensable hydrocarbon portion may have a normal-C21 to total C21 weight ratio greater than 0.10 or greater than 0.15. In some embodiments the condensable hydrocarbon portion has a normal-C22 to total C22 weight ratio less than 0.38. Alternatively, the condensable hydrocarbon portion may have a normal-C22 to total C22 weight ratio less than 0.36, less than 0.34, or less than 0.30. In alternative embodiments, the condensable hydrocarbon portion may have a normal-C22 to total C22 weight ratio greater than 0.10 or greater than 0.15. In some embodiments the condensable hydrocarbon portion has a normal-C23 to total C23 weight ratio less than 0.43. Alternatively, the condensable hydrocarbon portion may have a normal-C23 to total C23 weight ratio less than 0.40, less than 0.35, or less than 0.29. In alternative embodiments, the condensable hydrocarbon portion may have a normal-C23 to total C23 weight ratio greater than 0.15 or greater than 0.20. In some embodiments the condensable hydrocarbon portion has a normal-C24 to total C24 weight ratio less than 0.48. Alternatively, the condensable hydrocarbon portion may have a normal-C24 to total C24 weight ratio less than 0.46, less than 0.42, or less than 0.40. In alternative embodiments, the condensable hydrocarbon portion may have a normal-C24 to total C24 weight ratio greater than 0.15 or greater than 0.20. In some embodiments the condensable hydrocarbon portion has a normal-C25 to total C25 weight ratio less than 0.48. Alternatively, the condensable hydrocarbon portion may have a normal-C25 to total C25 weight ratio less than 0.46, less than 0.42, or less than 0.40. In alternative embodiments, the condensable hydrocarbon portion may have a normal-C25 to total C25 weight ratio greater than 0.20 or greater than 0.25. Certain features of the present invention are described in terms of a set of numerical upper limits (e.g. "less than") and a set of numerical lower limits (e.g. "greater than") in the preceding paragraph. It should be appreciated that ranges formed by any combination of these limits are within the scope of the invention unless otherwise indicated. The embodiments described in this paragraph may be combined with any of the other aspects of the invention discussed herein.

The use of "total C_" (e.g., total C10) herein and in the claims is meant to refer to the amount of a particular pseudo component found in a condensable hydrocarbon fluid determined as described herein, particularly as described in the section labeled "Experiments" herein. That is "total C_" is determined using the whole oil gas chromatography (WOGC) analysis methodology according to the procedure described in the Experiments section of this application. Further, "total C_" is determined from the whole oil gas chromatography (WOGC) peak integration methodology and peak identification methodology used for identifying and quantifying each pseudo-component as described in the Experiments section herein. Further, "total C_" weight percent and mole percent values for the pseudo components were obtained using the pseudo component analysis methodology involving correlations developed by Katz and Firoozabadi (Katz, D. L., and A. Firoozabadi, 1978. Predicting phase behavior of condensate/crude-oil systems using methane interaction coefficients, J. Petroleum Technology (November 1978), 1649-1655) as described in the Experiments section, including the exemplary molar and weight percentage determinations.

The use of "normal-C_" (e.g., normal-C10) herein and in the claims is meant to refer to the amount of a particular normal alkane hydrocarbon compound found in a condensable hydrocarbon fluid determined as described herein, particularly in the section labeled "Experiments" herein. That is "normal-C_" is determined from the GC peak areas determined using the whole oil gas chromatography (WOGC) analysis methodology according to the procedure described in the Experiments section of this application. Further, "total C_" is determined from the whole oil gas chromatography (WOGC) peak identification and integration methodology used for identifying and quantifying individual compound peaks as described in the Experiments section herein. Further, "normal-C_" weight percent and mole percent values for the normal alkane compounds were obtained using methodology analogous to the pseudo component exemplary molar and weight percentage determinations explained in the Experiments section, except that the densities and molecular weights for the particular normal alkane compound of interest were used and then compared to the totals obtained in the pseudo component methodology to obtain weight and molar percentages.

Figure 27:
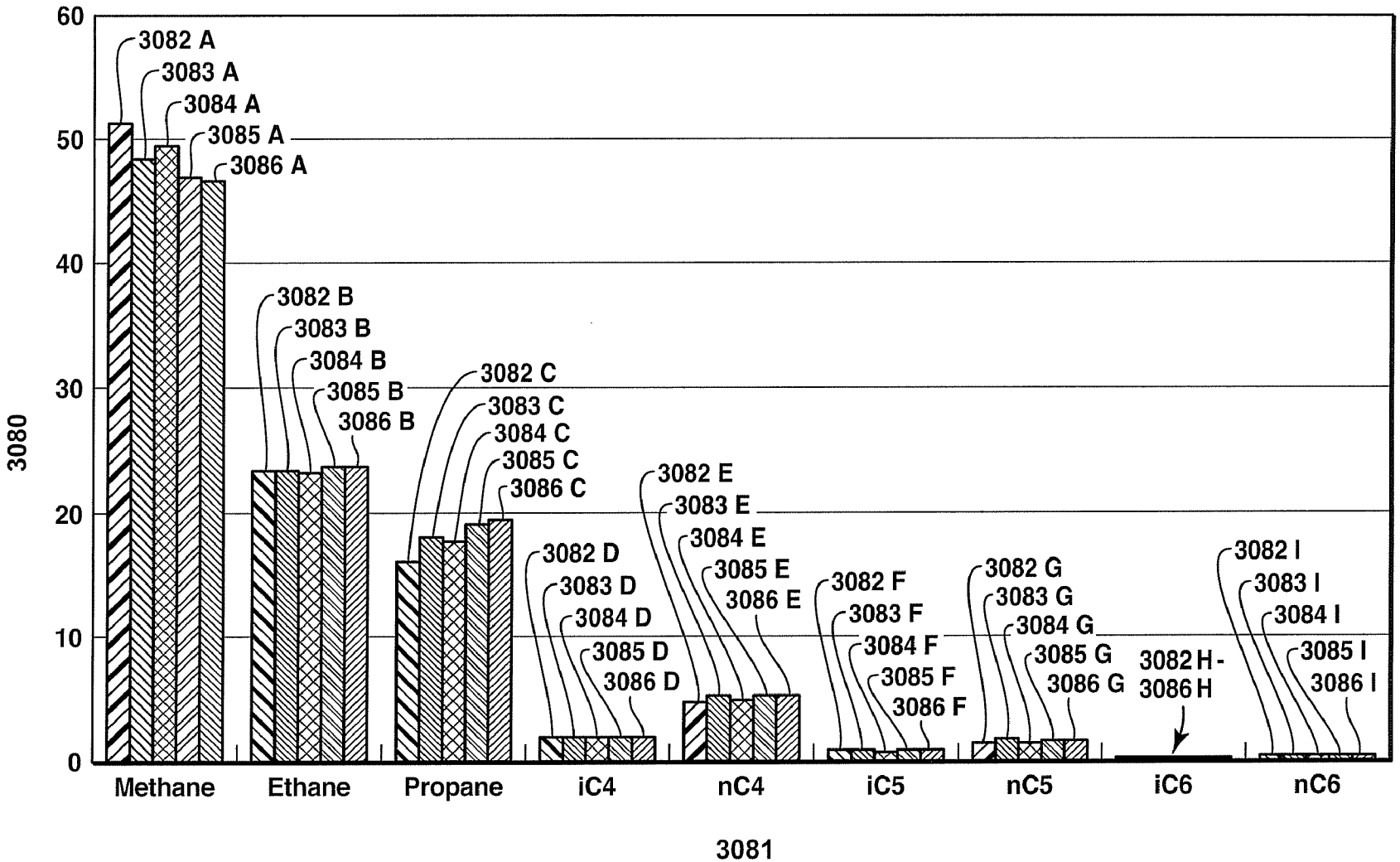
FIG. 27 is a bar graph showing the concentration, in molar percentage, of the hydrocarbon species present in the gas samples taken from duplicate laboratory experiments conducted at three different stress levels.

The following discussion of FIG. 27 concerns data obtained in Examples 1-5 which are discussed in the section labeled "Experiments". The data was obtained through the experimental procedures, gas sample collection procedures, hydrocarbon gas sample gas chromatography (GC) analysis methodology, and gas sample GC peak identification and integration methodology discussed in the Experiments section. For clarity, when referring to gas chromatograms of gaseous hydrocarbon samples, graphical data is provided for one unstressed experiment through Example 1, two 400 psi stressed experiments through Examples 2 and 3, and two 1,000 psi stressed experiments through Examples 4 and 5.

FIG. 27 is a bar graph showing the concentration, in molar percentage, of the hydrocarbon species present in the gas samples taken from each of the three stress levels tested and analyzed in the laboratory experiments discussed herein. The gas compound molar percentages were obtained through the experimental procedures, gas sample collection procedures, hydrocarbon gas sample gas chromatography (GC) analysis methodology, gas sample GC peak integration methodology and molar concentration determination procedures described herein. For clarity, the hydrocarbon molar percentages are taken as a percentage of the total of all identified hydrocarbon gas GC areas (i.e., methane, ethane, propane, iso-butane, n-butane, iso-pentane, n-pentane, 2-methyl pentane, and n-hexane) and calculated molar concentrations. Thus the graphed methane to normal C6 molar percentages for all of the experiments do not include the molar contribution of any associated non-hydrocarbon gas phase product (e.g., hydrogen, $CO_2$ or $H_2S$), any of the unidentified hydrocarbon gas species listed in Tables 2, 4, 5, 7, or 9 (e.g., peak numbers 2, 6, 8-11, 13, 15-22, 24-26, and 28-78 in Table 2) or any of the gas species dissolved in the liquid phase which were separately treated in the liquid GC's. The y-axis 3080 represents the concentration in terms of molar percent of each gaseous compound in the gas phase. The x-axis 3081 contains the identity of each hydrocarbon compound from methane to normal hexane. The bars 3082A-I represent the molar percentage of each gaseous compound for the unstressed experiment of Example 1. That is 3082A represents methane, 3082B represents ethane, 3082C represents propane, 3082D represents iso-butane, 3082E represents normal butane, 3082F represents iso-pentane, 3082G represents normal pentane, 3082H represents 2-methyl pentane, and 3082I represents normal hexane. The bars 3083A-I and 3084A-I represent the molar percent of each gaseous compound for samples from the duplicate 400 psi stressed experiments of Examples 2 and 3, with the letters assigned in the manner described for the unstressed experiment. While the bars 3085A-I and 3086A-I represent the molar percent of each gaseous compound for the duplicate 1,000 psi stressed experiments of Examples 4 and 5, with the letters assigned in the manner described for the unstressed experiment. From FIG. 27 it can be seen that the hydrocarbon gas produced in all the experiments is primarily methane, ethane and propane on a molar basis. It is further apparent that the unstressed experiment, represented by bars 3082A-I, contains the most methane 3082A and least propane 3082C, both as compared to the 400 psi stress experiments hydrocarbon gases and the 1,000 psi stress experiments hydrocarbon gases. Looking now at bars 3083A-I and 3084A-I, it is apparent that the intermediate level 400 psi stress experiments produced a hydrocarbon gas having methane 3083A and 3084A and propane 3083C and 3084C concentrations between the unstressed experiment represented by bars 3082A and 3082C and the 1,000 psi stressed experiment represented by bars 3085A and 3085C and 3086A and 3086C. Lastly, it is apparent that the high level 1,000 psi stress experiments produced hydrocarbon gases having the lowest methane 3085A and 3086A concentration and the highest propane concentrations 3085C and 3086C, as compared to both the unstressed experiments represented by bars 3082A and 3082C and the 400 psi stressed experiment represented by bars 3083A and 3084A and 3083C and 3084C. Thus pyrolyzing oil shale under increasing levels of lithostatic stress appears to produce hydrocarbon gases having decreasing concentrations of methane and increasing concentrations of propane.

The hydrocarbon fluid produced from the organic-rich rock formation may include both a condensable hydrocarbon portion (e.g. liquid) and a non-condensable hydrocarbon portion (e.g. gas). In some embodiments the non-condensable hydrocarbon portion includes methane and propane. In some embodiments the molar ratio of propane to methane in the non-condensable hydrocarbon portion is greater than 0.32. In alternative embodiments, the molar ratio of propane to methane in the non-condensable hydrocarbon portion is greater than 0.34, 0.36 or 0.38. As used herein "molar ratio of propane to methane" is the molar ratio that may be determined as described herein, particularly as described in the section labeled "Experiments" herein. That is "molar ratio of propane to methane" is determined using the hydrocarbon gas sample gas chromatography (GC) analysis methodology, gas sample GC peak identification and integration methodology and molar concentration determination procedures described in the Experiments section of this application.

In some embodiments the condensable hydrocarbon portion of the hydrocarbon fluid includes benzene. In some embodiments the condensable hydrocarbon portion has a benzene content between 0.1 and 0.8 weight percent. Alternatively, the condensable hydrocarbon portion may have a benzene content between 0.15 and 0.6 weight percent, a benzene content between 0.15 and 0.5, or a benzene content between 0.15 and 0.5.

In some embodiments the condensable hydrocarbon portion of the hydrocarbon fluid includes cyclohexane. In some embodiments the condensable hydrocarbon portion has a cyclohexane content less than 0.8 weight percent. Alternatively, the condensable hydrocarbon portion may have a cyclohexane content less than 0.6 weight percent or less than 0.43 weight percent. Alternatively, the condensable hydrocarbon portion may have a cyclohexane content greater than 0.1 weight percent or greater than 0.2 weight percent.

In some embodiments the condensable hydrocarbon portion of the hydrocarbon fluid includes methyl-cyclohexane. In some embodiments the condensable hydrocarbon portion has a methyl-cyclohexane content greater than 0.5 weight percent. Alternatively, the condensable hydrocarbon portion may have a methyl-cyclohexane content greater than 0.7 weight percent or greater than 0.75 weight percent. Alternatively, the condensable hydrocarbon portion may have a methyl-cyclohexane content less than 1.2 or 1.0 weight percent.

The use of weight percentage contents of benzene, cyclohexane, and methyl-cyclohexane herein and in the claims is meant to refer to the amount of benzene, cyclohexane, and methyl-cyclohexane found in a condensable hydrocarbon fluid determined as described herein, particularly as described in the section labeled "Experiments" herein. That is, respective compound weight percentages are determined from the whole oil gas chromatography (WOGC) analysis methodology and whole oil gas chromatography (WOGC) peak identification and integration methodology discussed in the Experiments section herein. Further, the respective compound weight percentages were obtained as described for FIG. 22, except that each individual respective compound peak area integration was used to determine each respective compound weight percentage. For clarity, the compound weight percentages are taken as a percentage of the entire C3 to pseudo C38 whole oil gas chromatography areas and calculated weights as used in the pseudo compound data presented in FIG. 18.

As noted, the discovery that lithostatic stress can affect the composition of produced fluids generated within an organic-rich rock via heating and pyrolysis implies that the composition of the produced hydrocarbon fluid can also be influenced by altering the lithostatic stress of the organic-rich rock formation. For example, the lithostatic stress of the organic-rich rock formation may be altered by choice of pillar geometries and/or locations and/or by choice of heating and pyrolysis formation region thickness and/or heating sequencing.

Embodiments of the method may include controlling the composition of produced hydrocarbon fluids generated by heating and pyrolysis from a first region within an organic-rich rock formation by increasing the lithostatic stresses within the first region by first heating and pyrolyzing formation hydrocarbons present in the organic-rich rock formation and producing fluids from a second neighboring region within the organic-rich rock formation such that the Young's modulus (i.e., stiffness) of the second region is reduced.

Embodiments of the method may include controlling the composition of produced hydrocarbon fluids generated by heating and pyrolysis from a first region within an organic-rich rock formation by increasing the lithostatic stresses within the first region by heating the first region prior to or to a greater degree than neighboring regions within the organic-rich rock formation such that the thermal expansion within the first region is greater than that within the neighboring regions of the organic-rich rock formation.

Embodiments of the method may include controlling the composition of produced hydrocarbon fluids generated by heating and pyrolysis from a first region within an organic-rich rock formation by decreasing the lithostatic stresses within the first region by heating one or more neighboring regions of the organic-rich rock formation prior to or to a greater degree than the first region such that the thermal expansion within the neighboring regions is greater than that within the first region.

Embodiments of the method may include locating, sizing, and/or timing the heating of heated regions within an organic-rich rock formation so as to alter the in situ lithostatic stresses of current or future heating and pyrolysis regions within the organic-rich rock formation so as to control the composition of produced hydrocarbon fluids.

EXPERIMENTS

Figure 29:
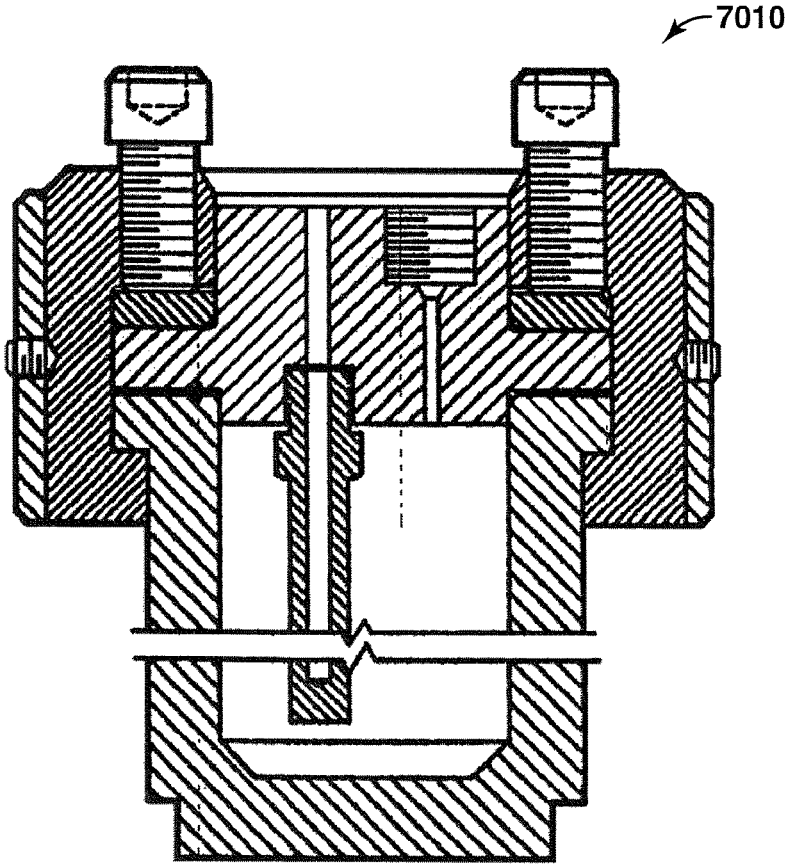
FIG. 29 is a cross-sectional view of the Parr vessel used in Examples 1-5, described below.

Heating experiments were conducted on several different oil shale specimens and the liquids and gases released from the heated oil shale examined in detail. An oil shale sample from the Mahogany formation in the Piceance Basin in Colorado was collected. A solid, continuous block of the oil shale formation, approximately 1 cubic foot in size, was collected from the pilot mine at the Colony mine site on the eastern side of Parachute Creek. The oil shale block was designated CM-1B. The core specimens taken from this block, as described in the following examples, were all taken from the same stratigraphic interval. The heating tests were conducted using a Parr vessel, model number 243HC5, which is shown in FIG. 29 and is available from Parr Instrument Company.

Example 1

Figure 28:
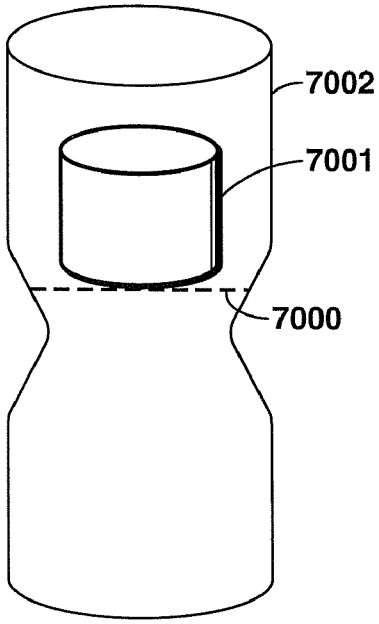
FIG. 28 is an exemplary view of the gold tube apparatus used in the unstressed Parr heating test described below in Example 1.

Oil shale block CM-1B was cored across the bedding planes to produce a cylinder 1.391 inches in diameter and approximately 2 inches long. A gold tube 7002 approximately 2 inches in diameter and 5 inches long was crimped and a screen 7000 inserted to serve as a support for the core specimen 7001 (FIG. 28). The oil shale core specimen 7001, 82.46 grams in weight, was placed on the screen 7000 in the gold tube 7002 and the entire assembly placed into a Parr heating vessel. The Parr vessel 7010, shown in FIG. 29, had an internal volume of 565 milliliters. Argon was used to flush the Parr vessel 7010 several times to remove air present in the chamber and the vessel pressurized to 500 psi with argon. The Parr vessel was then placed in a furnace which was designed to fit the Parr vessel. The furnace was initially at room temperature and was heated to 400° C. after the Parr vessel was placed in the furnace. The temperature of the Parr vessel achieved 400° C. after about 3 hours and remained in the 400° C. furnace for 24 hours. The Parr vessel was then removed from the furnace and allowed to cool to room temperature over a period of approximately 16 hours.

Figure 30:
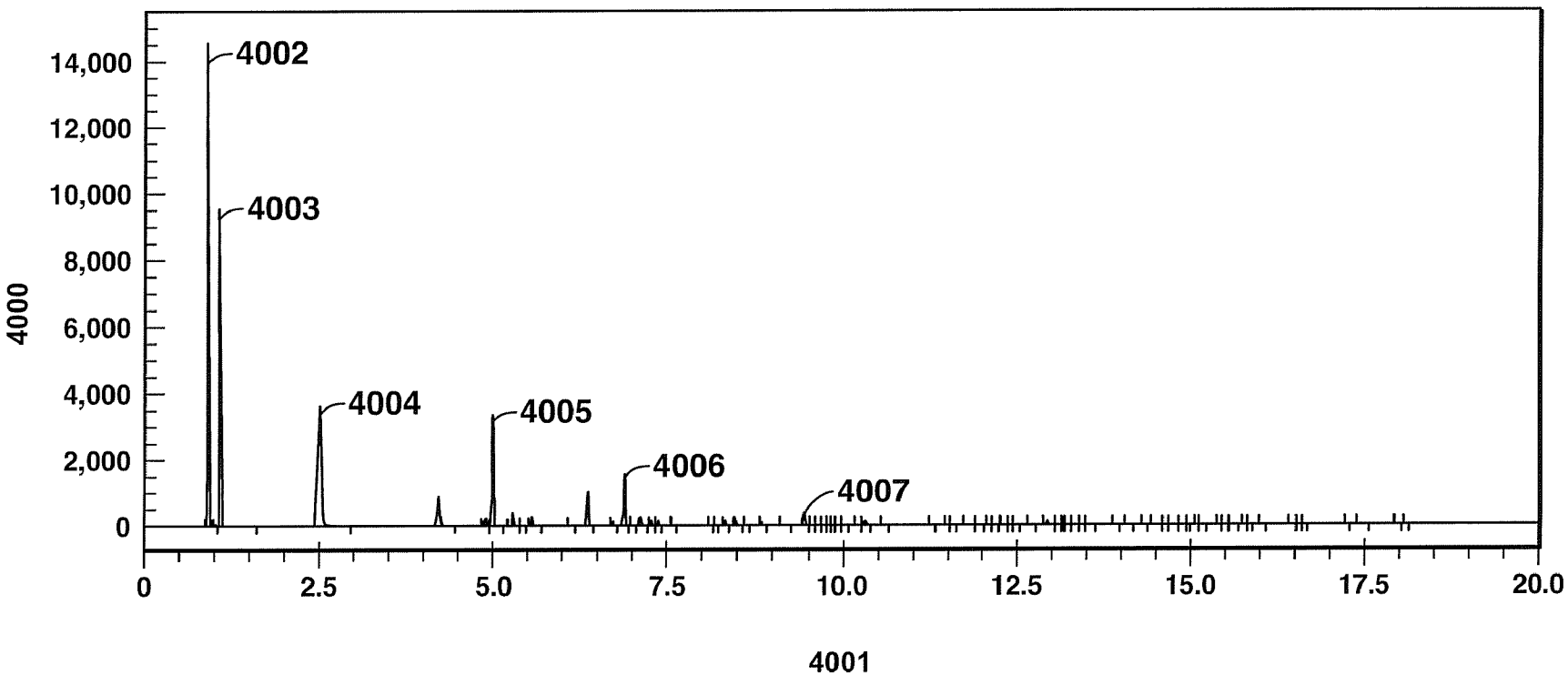
FIG. 30 is gas chromatogram of gas sampled from Example 1.

The room temperature Parr vessel was sampled to obtain a representative portion of the gas remaining in the vessel following the heating experiment. A small gas sampling cylinder 150 milliliters in volume was evacuated, attached to the Parr vessel and the pressure allowed to equilibrate. Gas chromatography (GC) analysis testing and non-hydrocarbon gas sample gas chromatography (GC) (GC not shown) of this gas sample yielded the results shown in FIG. 30, Table 1 and Table 2. In FIG. 30 the y-axis 4000 represents the detector response in pico-amperes (pA) while the x-axis 4001 represents the retention time in minutes. In FIG. 30 peak 4002 represents the response for methane, peak 4003 represents the response for ethane, peak 4004 represents the response for propane, peak 4005 represents the response for butane, peak 4006 represents the response for pentane and peak 4007 represents the response for hexane. From the GC results and the known volumes and pressures involved the total hydrocarbon content of the gas (2.09 grams), $CO_2$ content of the gas (3.35 grams), and H2S content of the gas (0.06 gram) were obtained.

TABLE 2

Peak and Area Details for FIG. 30 - Example 1 - 0 stress - Gas GC

| Peak Number | Ret Time [min] | Area [pA * s] | Compound Name |
|---|---|---|---|
| 1 | 0.910 | 1.46868e4 | Methane |
| 2 | 0.999 | 148.12119 | |
| 3 | 1.077 | 1.26473e4 | Ethane |
| 4 | 2.528 | 1.29459e4 | Propane |
| 5 | 4.243 | 2162.93066 | *i*C4 |
| 6 | 4.922 | 563.11804 | |
| 7 | 5.022 | 5090.54150 | n-Butane |
| 8 | 5.301 | 437.92255 | |
| 9 | 5.446 | 4.67394 | |
| 10 | 5.582 | 283.92194 | |
| 11 | 6.135 | 15.47334 | |
| 12 | 6.375 | 1159.83130 | *i*C5 |
| 13 | 6.742 | 114.83960 | |
| 14 | 6.899 | 1922.98450 | n-Pentane |
| 15 | 7.023 | 2.44915 | |
| 16 | 7.136 | 264.34424 | |
| 17 | 7.296 | 127.60601 | |
| 18 | 7.383 | 118.79453 | |
| 19 | 7.603 | 3.99227 | |
| 20 | 8.138 | 13.15432 | |
| 21 | 8.223 | 13.01887 | |
| 22 | 8.345 | 103.15615 | |
| 23 | 8.495 | 291.26767 | 2-methyl |
| 24 | 8.651 | 15.64066 | pentane |
| 25 | 8.884 | 91.85989 | |
| 26 | 9.165 | 40.09448 | |

TABLE 2-continued

Peak and Area Details for FIG. 30 - Example 1 - 0 stress - Gas GC

| Peak Number | Ret Time [min] | Area [pA * s] | Compound Name |
|---|---|---|---|
| 27 | 9.444 | 534.44507 | |
| 28 | 9.557 | 2.64731 | n-Hexane |
| 29 | 9.650 | 32.28295 | |
| 30 | 9.714 | 52.42796 | |
| 31 | 9.793 | 42.05001 | |
| 32 | 9.852 | 8.93775 | |
| 33 | 9.914 | 4.43648 | |
| 34 | 10.013 | 24.74299 | |
| 35 | 10.229 | 13.34387 | |
| 36 | 10.302 | 133.95892 | |
| 37 | 10.577 | 2.67224 | |
| 38 | 11.252 | 27.57400 | |
| 39 | 11.490 | 23.41665 | |
| 40 | 11.567 | 8.13992 | |
| 41 | 11.820 | 32.80781 | |
| 42 | 11.945 | 4.61821 | |
| 43 | 12.107 | 30.67044 | |
| 44 | 12.178 | 2.58269 | |
| 45 | 12.308 | 13.57769 | |
| 46 | 12.403 | 12.43018 | |
| 47 | 12.492 | 34.29918 | |
| 48 | 12.685 | 4.71311 | |
| 49 | 12.937 | 183.31729 | |
| 50 | 13.071 | 7.18510 | |
| 51 | 13.155 | 2.01699 | |
| 52 | 13.204 | 7.77467 | |
| 53 | 13.317 | 7.21400 | |
| 54 | 13.443 | 4.22721 | |
| 55 | 13.525 | 35.08374 | |
| 56 | 13.903 | 18.48654 | |
| 57 | 14.095 | 6.39745 | |
| 58 | 14.322 | 3.19935 | |
| 59 | 14.553 | 8.48772 | |
| 60 | 14.613 | 3.34738 | |
| 61 | 14.730 | 5.44062 | |
| 62 | 14.874 | 40.17010 | |
| 63 | 14.955 | 3.41596 | |
| 64 | 15.082 | 3.04766 | |
| 65 | 15.138 | 7.33028 | |
| 66 | 15.428 | 2.71734 | |
| 67 | 15.518 | 11.00256 | |
| 68 | 15.644 | 5.16752 | |
| 69 | 15.778 | 45.12025 | |
| 70 | 15.855 | 3.26920 | |
| 71 | 16.018 | 3.77424 | |
| 72 | 16.484 | 4.66657 | |
| 73 | 16.559 | 5.54783 | |
| 74 | 16.643 | 10.57255 | |
| 75 | 17.261 | 2.19534 | |
| 76 | 17.439 | 10.26123 | |
| 77 | 17.971 | 1.85618 | |
| 78 | 18.097 | 11.42077 | |

Figure 31:
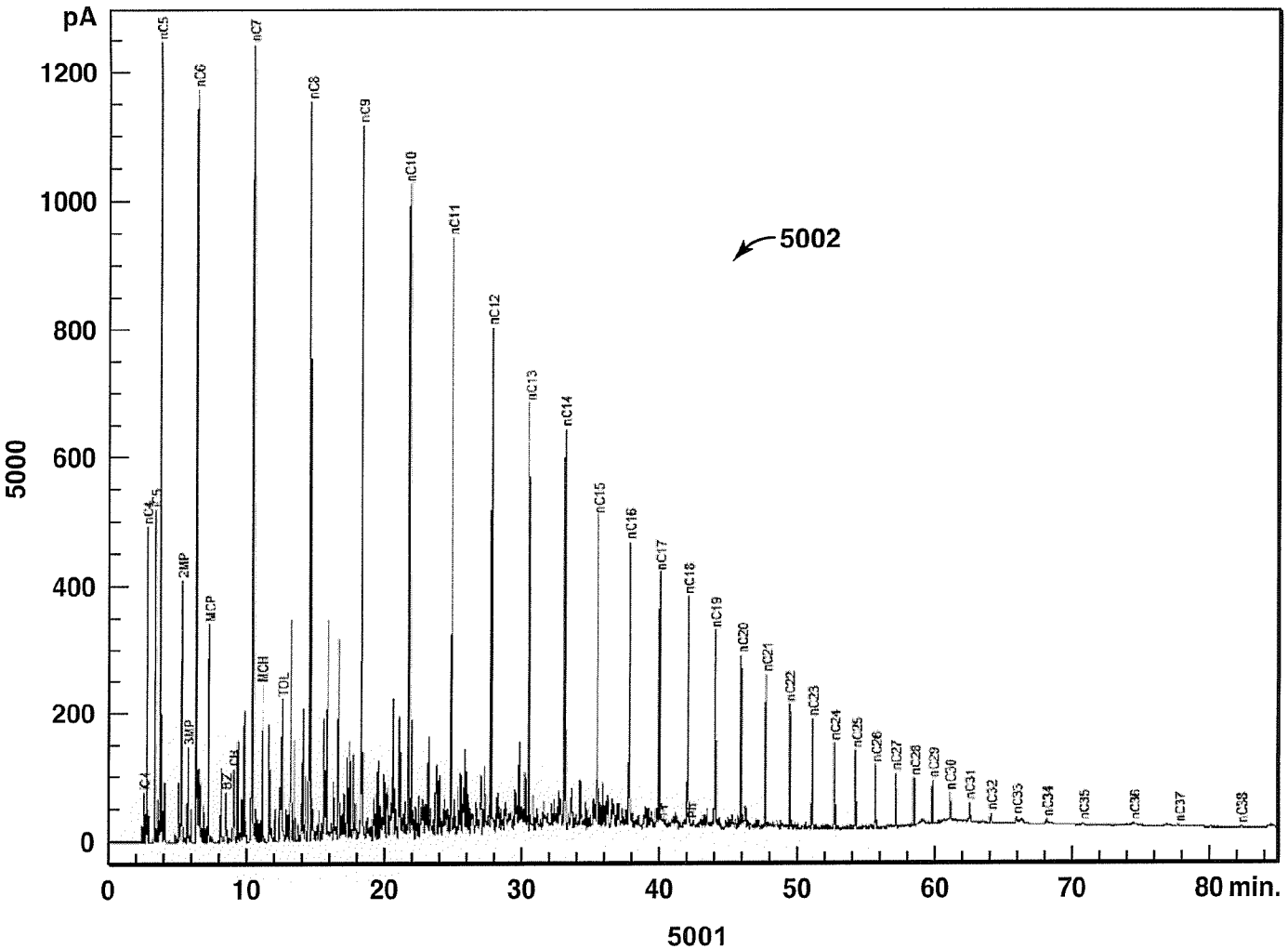
FIG. 31 is a whole oil gas chromatogram of liquid sampled from Example 1.

The Parr vessel was then vented to achieve atmospheric pressure, the vessel opened, and liquids collected from both inside the gold tube and in the bottom of the Parr vessel. Water was separated from the hydrocarbon layer and weighed. The amount collected is noted in Table 1. The collected hydrocarbon liquids were placed in a small vial, sealed and stored in the absence of light. No solids were observed on the walls of the gold tube or the walls of the Parr vessel. The solid core specimen was weighed and determined to have lost 19.21 grams as a result of heating. Whole oil gas chromatography (WOGC) testing of the liquid yielded the results shown in FIG. 31, Table 3, and Table 1. In FIG. 31 the y-axis 5000 represents the detector response in pico-amperes (pA) while the x-axis 5001 represents the retention time in minutes. The GC chromatogram is shown generally by label 5002 with individual identified peaks labeled with abbreviations.

TABLE 3

Peak and Area Details for FIG. 31 - Example 1 - 0 stress - Liquid GC

| Peak Number | Ret. Time [min] | Peak Area [pA * s] | Compound Name |
|---|---|---|---|
| 1 | 2.660 | 119.95327 | *i*C4 |
| 2 | 2.819 | 803.25989 | *n*C4 |
| 3 | 3.433 | 1091.80298 | *i*C5 |
| 4 | 3.788 | 2799.32520 | *n*C5 |
| 5 | 5.363 | 1332.67871 | 2-methyl pentane (2MP) |
| 6 | 5.798 | 466.35703 | 3-methyl pentane (3MP) |
| 7 | 6.413 | 3666.46240 | *n*C6 |
| 8 | 7.314 | 1161.70435 | Methyl cyclopentane (MCP) |
| 9 | 8.577 | 287.05969 | Benzene (BZ) |
| 10 | 9.072 | 530.19781 | Cyclohexane (CH) |
| 11 | 10.488 | 4700.48291 | *n*C7 |
| 12 | 11.174 | 937.38757 | Methyl cyclohexane (MCH) |
| 13 | 12.616 | 882.17358 | Toluene (TOL) |
| 14 | 14.621 | 3954.29687 | *n*C8 |
| 15 | 18.379 | 3544.52905 | *n*C9 |
| 16 | 21.793 | 3452.04199 | *n*C10 |
| 17 | 24.929 | 3179.11841 | *n*C11 |
| 18 | 27.843 | 2680.95459 | *n*C12 |
| 19 | 30.571 | 2238.89600 | *n*C13 |
| 20 | 33.138 | 2122.53540 | *n*C14 |
| 21 | 35.561 | 1773.59973 | *n*C15 |
| 22 | 37.852 | 1792.89526 | *n*C16 |
| 23 | 40.027 | 1394.61707 | *n*C17 |
| 24 | 40.252 | 116.81663 | Pristane (Pr) |
| 25 | 42.099 | 1368.02734 | *n*C18 |
| 26 | 42.322 | 146.96437 | Phytane (Ph) |
| 27 | 44.071 | 1130.63342 | *n*C19 |
| 28 | 45.956 | 920.52136 | *n*C20 |
| 29 | 47.759 | 819.92810 | *n*C21 |
| 30 | 49.483 | 635.42065 | *n*C22 |
| 31 | 51.141 | 563.24316 | *n*C23 |
| 32 | 52.731 | 432.74606 | *n*C24 |
| 33 | 54.261 | 397.36270 | *n*C25 |
| 34 | 55.738 | 307.56073 | *n*C26 |
| 35 | 57.161 | 298.70926 | *n*C27 |
| 36 | 58.536 | 252.60083 | *n*C28 |
| 37 | 59.867 | 221.84540 | *n*C29 |
| 38 | 61.154 | 190.29596 | *n*C30 |
| 39 | 62.539 | 123.65781 | *n*C31 |
| 40 | 64.133 | 72.47668 | *n*C32 |
| 41 | 66.003 | 76.84142 | *n*C33 |
| 42 | 68.208 | 84.35004 | *n*C34 |
| 43 | 70.847 | 36.68131 | *n*C35 |
| 44 | 74.567 | 87.62341 | *n*C36 |
| 45 | 77.798 | 33.30892 | *n*C37 |
| 46 | 82.361 | 21.99784 | *n*C38 |
| Totals: | | 5.32519e4 | |

Example 2

Figure 32:
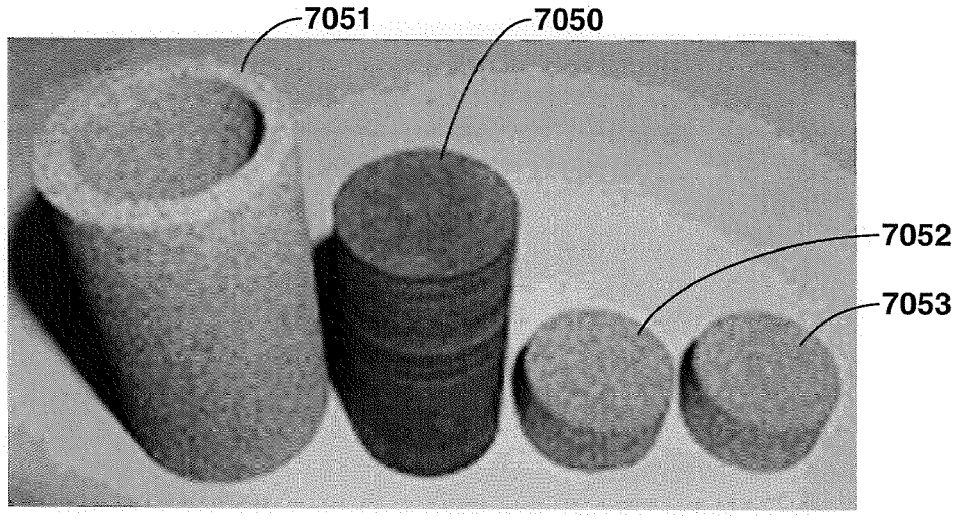
FIG. 32 is an exemplary view of a Berea cylinder, Berea plugs, and an oil shale core specimen as used in Examples 2-5.
Figure 33:
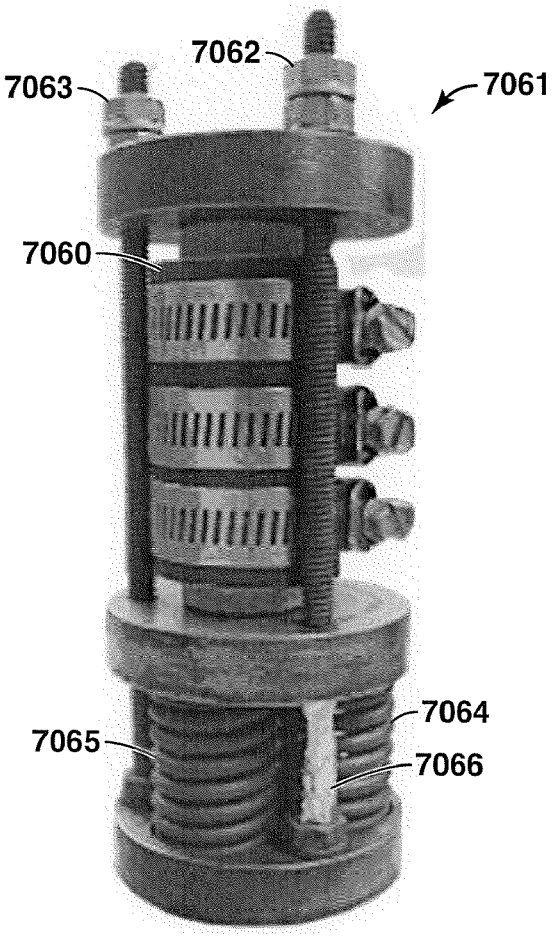
FIG. 33 is an exemplary view of the mini load frame and sample assembly used in Examples 2-5.

Oil shale block CM-1B was cored in a manner similar to that of Example 1 except that a 1 inch diameter core was created. With reference to FIG. 32, the core specimen 7050 was approximately 2 inches in length and weighed 42.47 grams. This core specimen 7050 was placed in a Berea sandstone cylinder 7051 with a 1-inch inner diameter and a 1.39 inch outer diameter. Berea plugs 7052 and 7053 were placed at each end of this assembly, so that the core specimen was completely surrounded by Berea. The Berea cylinder 7051 along with the core specimen 7050 and the Berea end plugs 7052 and 7053 were placed in a slotted stainless steel sleeve and clamped into place. The sample assembly 7060 was placed in a spring-loaded mini-load-frame 7061 as shown in FIG. 33. Load was applied by tightening the nuts 7062 and 7063 at the top of the load frame 7061 to compress the springs 7064 and 7065. The springs 7064 and 7065 were high temperature, INCONEL springs, which delivered 400 psi effective stress to the oil shale specimen 7060 when compressed. Sufficient travel of the springs 7064 and 7065 remained in order to accommodate any expansion of the core specimen 7060 during the course of heating. In order to ensure that this was the case, gold foil 7066 was placed on one of the legs of the apparatus to gauge the extent of travel. The entire spring loaded apparatus 7061 was placed in the Parr vessel (FIG. 29) and the heating experiment conducted as described in Example 1.

Figure 34:
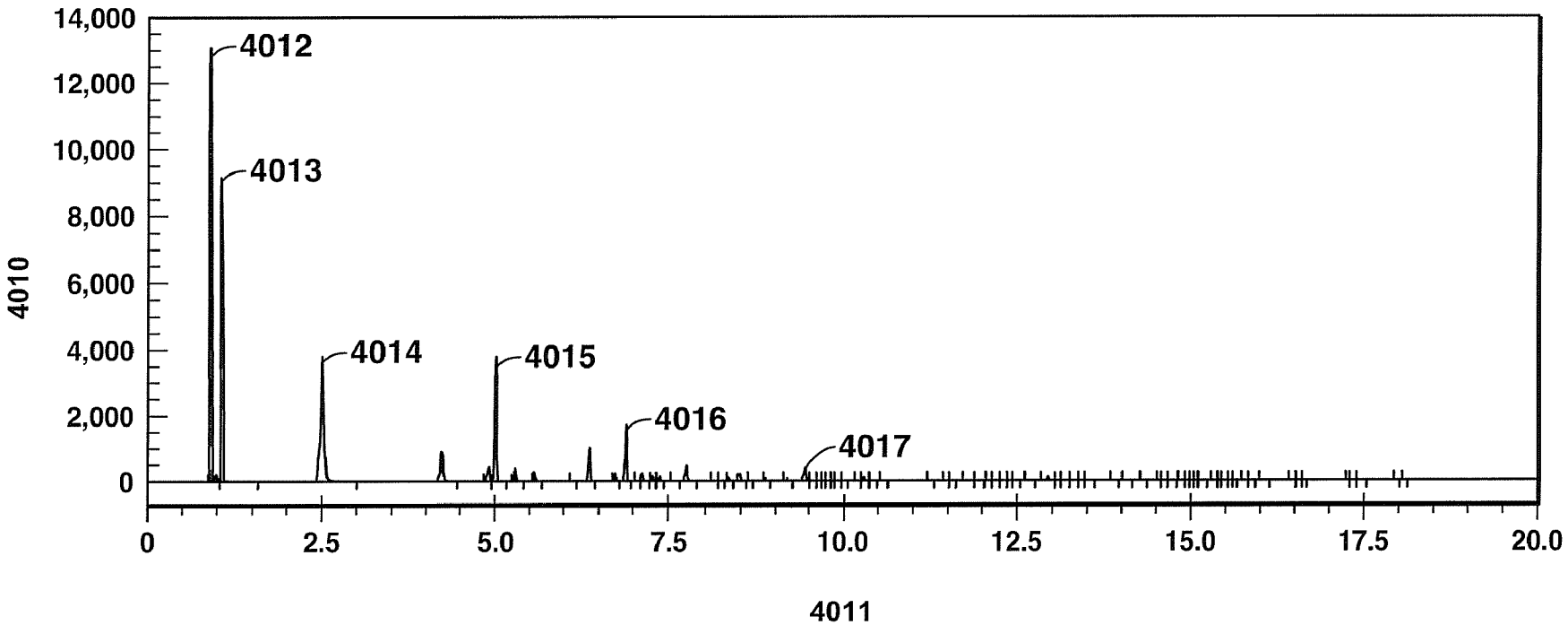
FIG. 34 is gas chromatogram of gas sampled from Example 2.

As described in Example 1, the room temperature Parr vessel was then sampled to obtain a representative portion of the gas remaining in the vessel following the heating experiment. Gas sampling, hydrocarbon gas sample gas chromatography (GC) testing, and non-hydrocarbon gas sample gas chromatography (GC) was conducted as in Example 1. Results are shown in FIG. 34, Table 4 and Table 1. In FIG. 34 the y-axis 4010 represents the detector response in picoamperes (pA) while the x-axis 4011 represents the retention time in minutes. In FIG. 34 peak 4012 represents the response for methane, peak 4013 represents the response for ethane, peak 4014 represents the response for propane, peak 4015 represents the response for butane, peak 4016 represents the response for pentane and peak 4017 represents the response for hexane. From the gas chromatographic results and the known volumes and pressures involved the total hydrocarbon content of the gas was determined to be 1.33 grams and $CO_2$ content of the gas was 1.70 grams.

TABLE 4

Peak and Area Details for FIG. 34 - Example 2 - 400 stress - Gas GC

| Peak Number | Ret. Time [min] | Peak Area [pA * s] | Compound Name |
|---|---|---|---|
| 1 | 0.910 | 1.36178e4 | Methane |
| 2 | 0.999 | 309.65613 | |
| 3 | 1.077 | 1.24143e4 | Ethane |
| 4 | 2.528 | 1.41685e4 | Propane |
| 5 | 4.240 | 2103.01929 | *i*C4 |
| 6 | 4.917 | 1035.25513 | |
| 7 | 5.022 | 5689.08887 | n-Butane |
| 8 | 5.298 | 450.26572 | |
| 9 | 5.578 | 302.56229 | |
| 10 | 6.125 | 33.82201 | |
| 11 | 6.372 | 1136.37097 | *i*C5 |
| 12 | 6.736 | 263.35754 | |
| 13 | 6.898 | 2254.86621 | n-Pentane |
| 14 | 7.066 | 7.12101 | |
| 15 | 7.133 | 258.31876 | |
| 16 | 7.293 | 126.54671 | |
| 17 | 7.378 | 155.60977 | |
| 18 | 7.598 | 6.73467 | |
| 19 | 7.758 | 679.95312 | |
| 20 | 8.133 | 27.13466 | |
| 21 | 8.216 | 24.77329 | |
| 22 | 8.339 | 124.70064 | |
| 23 | 8.489 | 289.12952 | 2-methyl |
| 24 | 8.644 | 19.83309 | pentane |
| 25 | 8.878 | 92.18938 | |
| 26 | 9.184 | 102.25701 | |
| 27 | 9.438 | 664.42584 | |
| 28 | 9.549 | 2.91525 | n-Hexane |
| 29 | 9.642 | 26.86672 | |
| 30 | 9.705 | 49.83235 | |
| 31 | 9.784 | 52.11239 | |
| 32 | 9.843 | 9.03158 | |
| 33 | 9.904 | 6.18217 | |
| 34 | 10.004 | 24.84150 | |
| 35 | 10.219 | 13.21182 | |
| 36 | 10.292 | 158.67511 | |
| 37 | 10.411 | 2.49094 | |
| 38 | 10.566 | 3.25252 | |
| 39 | 11.240 | 46.79988 | |
| 40 | 11.478 | 29.59438 | |

TABLE 4-continued

Peak and Area Details for FIG. 34 - Example 2 - 400 stress - Gas GC

| Peak Number | Ret. Time [min] | Peak Area [pA * s] | Compound Name |
|---|---|---|---|
| 41 | 11.555 | 12.84377 | |
| 42 | 11.809 | 38.67433 | |
| 43 | 11.935 | 5.68525 | |
| 44 | 12.096 | 31.29068 | |
| 45 | 12.167 | 5.84513 | |
| 46 | 12.297 | 15.52042 | |
| 47 | 12.393 | 13.54158 | |
| 48 | 12.483 | 30.95983 | |
| 49 | 12.669 | 20.21915 | |
| 50 | 12.929 | 229.00655 | |
| 51 | 13.063 | 6.38678 | |
| 52 | 13.196 | 10.89876 | |
| 53 | 13.306 | 7.91553 | |
| 54 | 13.435 | 5.05444 | |
| 55 | 13.516 | 44.42806 | |
| 56 | 13.894 | 20.61910 | |
| 57 | 14.086 | 8.32365 | |
| 58 | 14.313 | 2.80677 | |
| 59 | 14.545 | 9.18198 | |
| 60 | 14.605 | 4.93703 | |
| 61 | 14.722 | 5.06628 | |
| 62 | 14.865 | 46.53282 | |
| 63 | 14.946 | 6.55945 | |
| 64 | 15.010 | 2.85594 | |
| 65 | 15.075 | 4.05371 | |
| 66 | 15.131 | 9.15954 | |
| 67 | 15.331 | 2.16523 | |
| 68 | 15.421 | 3.03294 | |
| 69 | 15.511 | 9.73797 | |
| 70 | 15.562 | 5.22962 | |
| 71 | 15.636 | 3.73105 | |
| 72 | 15.771 | 54.64651 | |
| 73 | 15.848 | 3.95764 | |
| 74 | 16.010 | 3.39639 | |
| 75 | 16.477 | 5.49586 | |
| 76 | 16.552 | 6.21470 | |
| 77 | 16.635 | 11.08140 | |
| 78 | 17.257 | 2.28673 | |
| 79 | 17.318 | 2.82284 | |
| 80 | 17.433 | 11.11376 | |
| 81 | 17.966 | 2.54065 | |
| 82 | 18.090 | 14.28333 | |

At this point, the Parr vessel was vented to achieve atmospheric pressure, the vessel opened, and liquids collected from inside the Parr vessel. Water was separated from the hydrocarbon layer and weighed. The amount collected is noted in Table 1. The collected hydrocarbon liquids were placed in a small vial, sealed and stored in the absence of light. Any additional liquid coating the surface of the apparatus or sides of the Parr vessel was collected with a paper towel and the weight of this collected liquid added to the total liquid collected. Any liquid remaining in the Berea sandstone was extracted with methylene chloride and the weight accounted for in the liquid total reported in Table 1. The Berea sandstone cylinder and end caps were clearly blackened with organic material as a result of the heating. The organic material in the Berea was not extractable with either toluene or methylene chloride, and was therefore determined to be coke formed from the cracking of hydrocarbon liquids. After the heating experiment, the Berea was crushed and its total organic carbon (TOC) was measured. This measurement was used to estimate the amount of coke in the Berea and subsequently how much liquid must have cracked in the Berea. A constant factor of 2.283 was used to convert the TOC measured to an estimate of the amount of liquid, which must have been present to produce the carbon found in the Berea. This liquid estimated is the "inferred oil" value shown in Table 1. The solid core specimen was weighed and determined to have lost 10.29 grams as a result of heating.

Example 3

Figure 35:
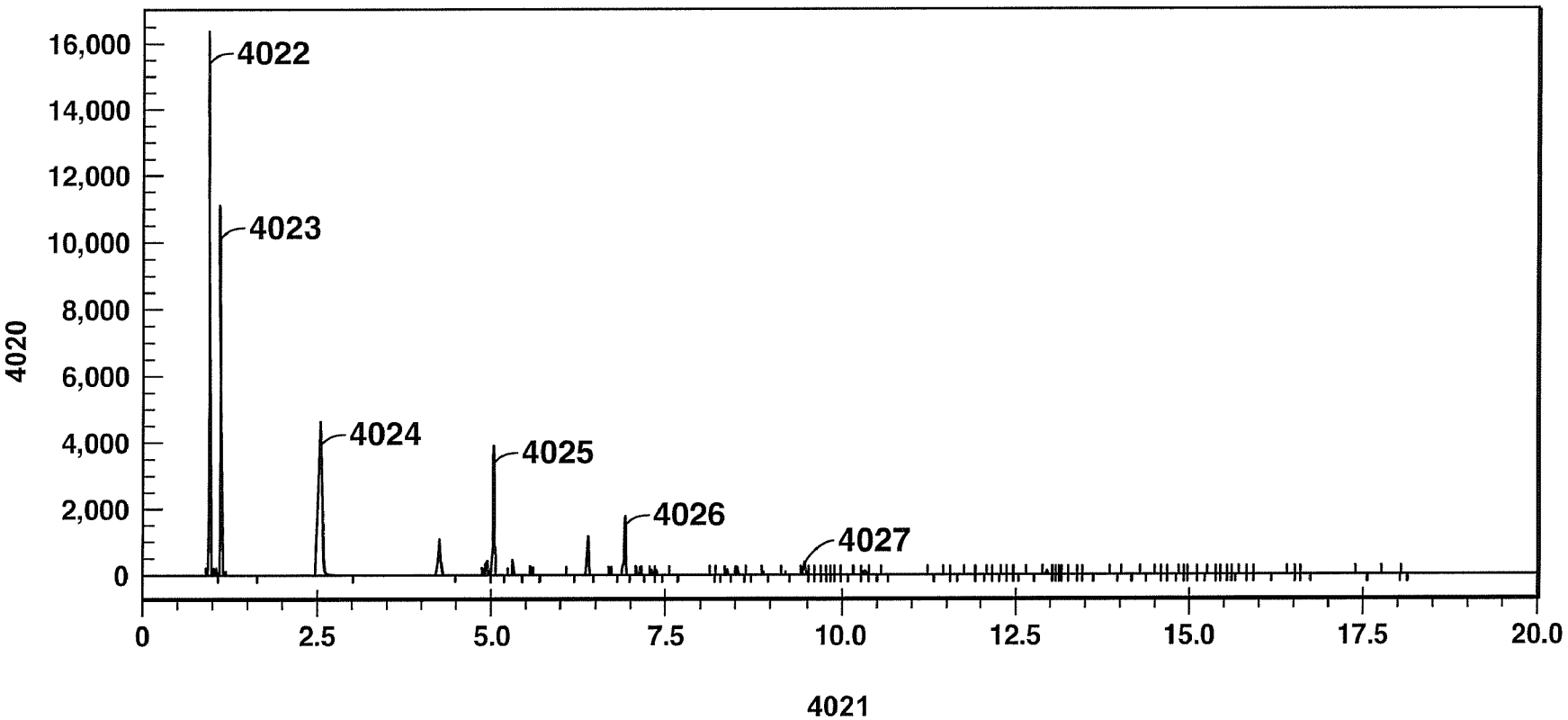
FIG. 35 is gas chromatogram of gas sampled from Example 3.

Conducted in a manner similar to that of Example 2 on a core specimen from oil shale block CM-1B, where the effective stress applied was 400 psi. Results for the gas sample collected and analyzed by hydrocarbon gas sample gas chromatography (GC) and non-hydrocarbon gas sample gas chromatography (GC) (GC not shown) are shown in FIG. 35, Table 5 and Table 1. In FIG. 35 the y-axis 4020 represents the detector response in pico-amperes (pA) while the x-axis 4021 represents the retention time in minutes. In FIG. 35 peak 4022 represents the response for methane, peak 4023 represents the response for ethane, peak 4024 represents the response for propane, peak 4025 represents the response for butane, peak 4026 represents the response for pentane and peak 4027 represents the response for hexane.

TABLE 5

Peak and Area Details for FIG. 35 - Example 3 - 400 psi stress - Gas GC

| Peak Number | Ret Time [min] | Area [pA * s] | Compound Name |
|---|---|---|---|
| 1 | 0.910 | 1.71356e4 | Methane |
| 2 | 0.998 | 341.71646 | |
| 3 | 1.076 | 1.52621e4 | Ethane |
| 4 | 2.534 | 1.72319e4 | Propane |
| 5 | 4.242 | 2564.04077 | *i*C4 |
| 6 | 4.919 | 1066.90942 | |
| 7 | 5.026 | 6553.25244 | n-Butane |
| 8 | 5.299 | 467.88803 | |
| 9 | 5.579 | 311.65158 | |
| 10 | 6.126 | 33.61063 | |
| 11 | 6.374 | 1280.77869 | *i*C5 |
| 12 | 6.737 | 250.05510 | |
| 13 | 6.900 | 2412.40918 | n-Pentane |
| 14 | 7.134 | 249.80679 | |
| 15 | 7.294 | 122.60424 | |
| 16 | 7.379 | 154.40988 | |
| 17 | 7.599 | 6.87471 | |
| 18 | 8.132 | 25.50270 | |
| 19 | 8.216 | 22.33015 | |
| 20 | 8.339 | 129.17023 | |
| 21 | 8.490 | 304.97903 | 2-methyl pentane |
| 22 | 8.645 | 18.48411 | |
| 23 | 8.879 | 98.23043 | |
| 24 | 9.187 | 89.71329 | |
| 25 | 9.440 | 656.02161 | n-Hexane |
| 26 | 9.551 | 3.05892 | |
| 27 | 9.645 | 25.34058 | |
| 28 | 9.708 | 45.14915 | |
| 29 | 9.786 | 48.62077 | |
| 30 | 9.845 | 10.03335 | |
| 31 | 9.906 | 5.43165 | |
| 32 | 10.007 | 22.33582 | |
| 33 | 10.219 | 16.02756 | |
| 34 | 10.295 | 196.43715 | |
| 35 | 10.413 | 2.98115 | |
| 36 | 10.569 | 3.88067 | |
| 37 | 11.243 | 41.63386 | |
| 38 | 11.482 | 28.44063 | |
| 39 | 11.558 | 12.05196 | |
| 40 | 11.812 | 37.83630 | |
| 41 | 11.938 | 5.45990 | |
| 42 | 12.100 | 31.03111 | |
| 43 | 12.170 | 4.91053 | |
| 44 | 12.301 | 15.75041 | |
| 45 | 12.397 | 13.75454 | |
| 46 | 12.486 | 30.26099 | |
| 47 | 12.672 | 15.14775 | |
| 48 | 12.931 | 207.50433 | |
| 49 | 13.064 | 3.35393 | |
| 50 | 13.103 | 3.04880 | |

TABLE 5-continued

| Peak and Area Details for FIG. 35 - Example 3 - 400 psi stress - Gas GC | | | |
|---|---|---|---|
| Peak Number | Ret Time [min] | Area [pA * s] | Compound Name |
| 51 | 13.149 | 1.62203 | |
| 52 | 13.198 | 7.97665 | |
| 53 | 13.310 | 7.49605 | |
| 54 | 13.437 | 4.64921 | |
| 55 | 13.519 | 41.82572 | |
| 56 | 13.898 | 19.01739 | |
| 57 | 14.089 | 7.34498 | |
| 58 | 14.316 | 2.68912 | |
| 59 | 14.548 | 8.29593 | |
| 60 | 14.608 | 3.93147 | |
| 61 | 14.725 | 4.75483 | |
| 62 | 14.869 | 40.93447 | |
| 63 | 14.949 | 5.30140 | |
| 64 | 15.078 | 5.79979 | |
| 65 | 15.134 | 7.95179 | |
| 66 | 15.335 | 1.91589 | |
| 67 | 15.423 | 2.75893 | |
| 68 | 15.515 | 8.64343 | |
| 69 | 15.565 | 3.76481 | |
| 70 | 15.639 | 3.41854 | |
| 71 | 15.774 | 45.59035 | |
| 72 | 15.850 | 3.73501 | |
| 73 | 16.014 | 5.84199 | |
| 74 | 16.480 | 4.87036 | |
| 75 | 16.555 | 5.12607 | |
| 76 | 16.639 | 9.97469 | |
| 77 | 17.436 | 8.00434 | |
| 78 | 17.969 | 3.86749 | |
| 79 | 18.093 | 9.71661 | |

Figure 36:
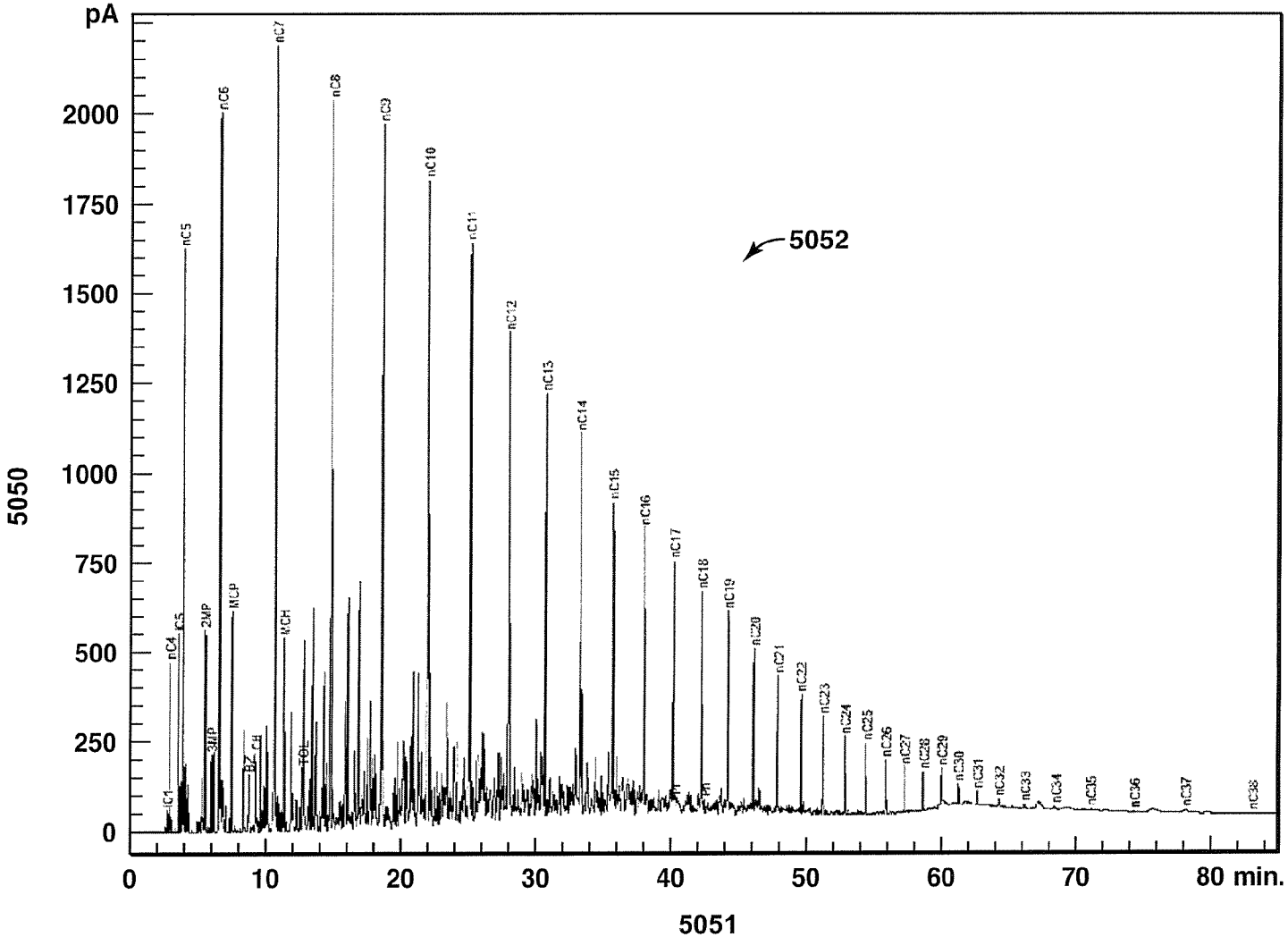
FIG. 36 is a whole oil gas chromatogram of liquid sampled from Example 3.

Results for the liquid collected and analyzed by whole oil gas chromatography (WOGC) analysis are shown in FIG. 36, Table 6 and Table 1. In FIG. 36 the y-axis 5050 represents the detector response in pico-amperes (pA) while the x-axis 5051 represents the retention time in minutes. The GC chromatogram is shown generally by label 5052 with individual identified peaks labeled with abbreviations.

TABLE 6

| Peak and Area Details from FIG. 36 - Example 3 - 400 psi stress - Liquid GC. | | | |
|---|---|---|---|
| Peak Number | Ret Time [min] | Peak Area [pA * s] | Compound Name |
| 1 | 2.744 | 102.90978 | *i*C4 |
| 2 | 2.907 | 817.57861 | *n*C4 |
| 3 | 3.538 | 1187.01831 | *i*C5 |
| 4 | 3.903 | 3752.84326 | *n*C5 |
| 5 | 5.512 | 1866.25342 | 2MP |
| 6 | 5.950 | 692.18964 | 3MP |
| 7 | 6.580 | 6646.48242 | *n*C6 |
| 8 | 7.475 | 2117.66919 | MCP |
| 9 | 8.739 | 603.21204 | BZ |
| 10 | 9.230 | 1049.96240 | CH |
| 11 | 10.668 | 9354.29590 | *n*C7 |
| 12 | 11.340 | 2059.10303 | MCH |
| 13 | 12.669 | 689.82861 | TOL |
| 14 | 14.788 | 8378.59375 | *n*C8 |
| 15 | 18.534 | 7974.54883 | *n*C9 |
| 16 | 21.938 | 7276.47705 | *n*C10 |
| 17 | 25.063 | 6486.47998 | *n*C11 |
| 18 | 27.970 | 5279.17187 | *n*C12 |
| 19 | 30.690 | 4451.49902 | *n*C13 |
| 20 | 33.254 | 4156.73389 | *n*C14 |
| 21 | 35.672 | 3345.80273 | *n*C15 |
| 22 | 37.959 | 3219.63745 | *n*C16 |
| 23 | 40.137 | 2708.28003 | *n*C17 |
| 24 | 40.227 | 219.38252 | Pr |
| 25 | 42.203 | 2413.01929 | *n*C18 |
| 26 | 42.455 | 317.17825 | Ph |

TABLE 6-continued

| Peak and Area Details from FIG. 36 - Example 3 - 400 psi stress - Liquid GC. | | | |
|---|---|---|---|
| Peak Number | Ret Time [min] | Peak Area [pA * s] | Compound Name |
| 27 | 44.173 | 2206.65405 | *n*C19 |
| 28 | 46.056 | 1646.56616 | *n*C20 |
| 29 | 47.858 | 1504.49097 | *n*C21 |
| 30 | 49.579 | 1069.23608 | *n*C22 |
| 31 | 51.234 | 949.49316 | *n*C23 |
| 32 | 52.823 | 719.34735 | *n*C24 |
| 33 | 54.355 | 627.46436 | *n*C25 |
| 34 | 55.829 | 483.81885 | *n*C26 |
| 35 | 57.253 | 407.86371 | *n*C27 |
| 36 | 58.628 | 358.52216 | *n*C28 |
| 37 | 59.956 | 341.01791 | *n*C29 |
| 38 | 61.245 | 214.87863 | *n*C30 |
| 39 | 62.647 | 146.06461 | *n*C31 |
| 40 | 64.259 | 127.66831 | *n*C32 |
| 41 | 66.155 | 85.17574 | *n*C33 |
| 42 | 68.403 | 64.29253 | *n*C34 |
| 43 | 71.066 | 56.55088 | *n*C35 |
| 44 | 74.282 | 28.61854 | *n*C36 |
| 45 | 78.140 | 220.95929 | *n*C37 |
| 46 | 83.075 | 26.95426 | *n*C38 |
| Totals: | | 9.84518e4 | |

Example 4

Figure 37:
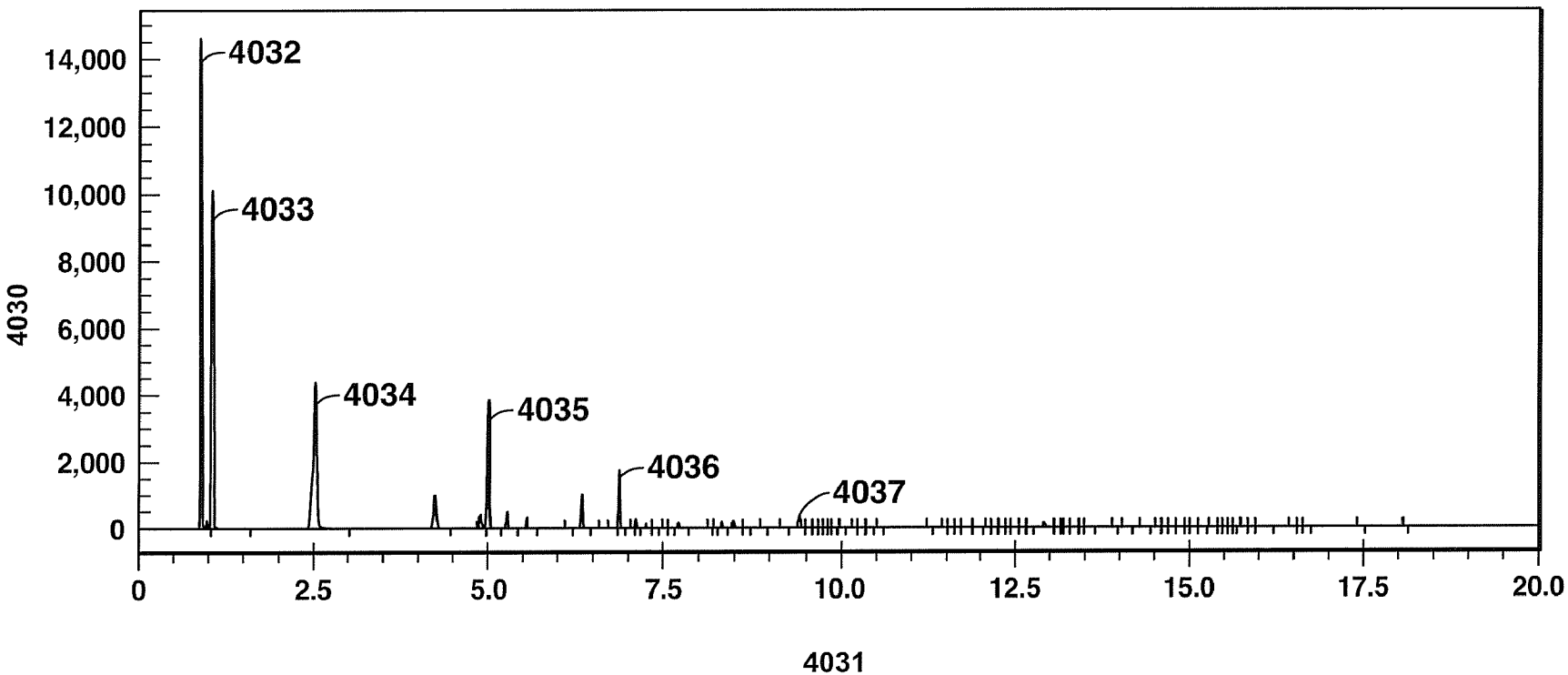
FIG. 37 is gas chromatogram of gas sampled from Example 4.

Conducted in a manner similar to that of Example 2 on a core specimen from oil shale block CM-1B; however, in this example the applied effective stress was 1,000 psi. Results for the gas collected and analyzed by hydrocarbon gas sample gas chromatography (GC) and non-hydrocarbon gas sample gas chromatography (GC) (GC not shown) are shown in FIG. 37, Table 7 and Table 1. In FIG. 37 the y-axis 4030 represents the detector response in pico-amperes (pA) while the x-axis 4031 represents the retention time in minutes. In FIG. 37 peak 4032 represents the response for methane, peak 4033 represents the response for ethane, peak 4034 represents the response for propane, peak 4035 represents the response for butane, peak 4036 represents the response for pentane and peak 4037 represents the response for hexane.

TABLE 7

| Peak and Area Details for FIG. 37 - Example 4 - 1000 psi stress - Gas GC | | | |
|---|---|---|---|
| Peak Number | Ret Time [min] | Area [pA * s] | Compound Name |
| 1 | 0.910 | 1.43817e4 | Methane |
| 2 | 1.000 | 301.69287 | |
| 3 | 1.078 | 1.37821e4 | Ethane |
| 4 | 2.541 | 1.64047e4 | Propane |
| 5 | 4.249 | 2286.08032 | *i*C4 |
| 6 | 4.924 | 992.04395 | |
| 7 | 5.030 | 6167.50000 | n-Butane |
| 8 | 5.303 | 534.37000 | |
| 9 | 5.583 | 358.96567 | |
| 10 | 6.131 | 27.44937 | |
| 11 | 6.376 | 1174.68872 | *i*C5 |
| 12 | 6.740 | 223.61662 | |
| 13 | 6.902 | 2340.79248 | n-Pentane |
| 14 | 7.071 | 5.29245 | |
| 15 | 7.136 | 309.94775 | |
| 16 | 7.295 | 154.59171 | |
| 17 | 7.381 | 169.53279 | |
| 18 | 7.555 | 2.80458 | |
| 19 | 7.601 | 5.22327 | |
| 20 | 7.751 | 117.69164 | |

TABLE 7-continued

Peak and Area Details for FIG. 37 - Example 4 - 1000 psi stress - Gas GC

| Peak Number | Ret Time [min] | Area [pA * s] | Compound Name |
|---|---|---|---|
| 21 | 8.134 | 29.41086 | |
| 22 | 8.219 | 19.39338 | |
| 23 | 8.342 | 133.52739 | |
| 24 | 8.492 | 281.61343 | 2-methyl pentane |
| 25 | 8.647 | 22.19704 | |
| 26 | 8.882 | 99.56919 | |
| 27 | 9.190 | 86.65676 | |
| 28 | 9.443 | 657.28754 | n-Hexane |
| 29 | 9.552 | 4.12572 | |
| 30 | 9.646 | 34.33701 | |
| 31 | 9.710 | 59.12064 | |
| 32 | 9.788 | 62.97972 | |
| 33 | 9.847 | 15.13559 | |
| 34 | 9.909 | 6.88310 | |
| 35 | 10.009 | 29.11555 | |
| 36 | 10.223 | 23.65434 | |
| 37 | 10.298 | 173.95422 | |
| 38 | 10.416 | 3.37255 | |
| 39 | 10.569 | 7.64592 | |
| 40 | 11.246 | 47.30062 | |
| 41 | 11.485 | 32.04262 | |
| 42 | 11.560 | 13.74583 | |
| 43 | 11.702 | 2.68917 | |
| 44 | 11.815 | 36.51670 | |
| 45 | 11.941 | 6.45255 | |
| 46 | 12.103 | 28.44484 | |
| 47 | 12.172 | 5.96475 | |
| 48 | 12.304 | 17.59856 | |
| 49 | 12.399 | 15.17446 | |
| 50 | 12.490 | 31.96492 | |
| 51 | 12.584 | 3.27834 | |
| 52 | 12.675 | 14.08259 | |
| 53 | 12.934 | 207.21574 | |
| 54 | 13.105 | 8.29743 | |
| 55 | 13.151 | 2.25476 | |
| 56 | 13.201 | 8.36965 | |
| 57 | 13.312 | 9.49917 | |
| 58 | 13.436 | 6.09893 | |
| 59 | 13.521 | 46.34579 | |
| 60 | 13.900 | 20.53506 | |
| 61 | 14.090 | 8.41120 | |
| 62 | 14.318 | 4.36870 | |
| 63 | 14.550 | 8.68951 | |
| 64 | 14.610 | 4.39150 | |
| 65 | 14.727 | 4.35713 | |
| 66 | 14.870 | 37.17881 | |
| 67 | 14.951 | 5.78219 | |
| 68 | 15.080 | 5.54470 | |
| 69 | 15.136 | 8.07308 | |
| 70 | 15.336 | 2.07075 | |
| 71 | 15.425 | 2.67118 | |
| 72 | 15.516 | 8.47004 | |
| 73 | 15.569 | 3.89987 | |
| 74 | 15.641 | 3.96979 | |
| 75 | 15.776 | 40.75155 | |
| 76 | 16.558 | 5.06379 | |
| 77 | 16.641 | 8.43767 | |
| 78 | 17.437 | 6.00180 | |
| 79 | 18.095 | 7.66881 | |
| 80 | 15.853 | 3.97375 | |
| 81 | 16.016 | 5.68997 | |
| 82 | 16.482 | 3.27234 | |

Figure 38:
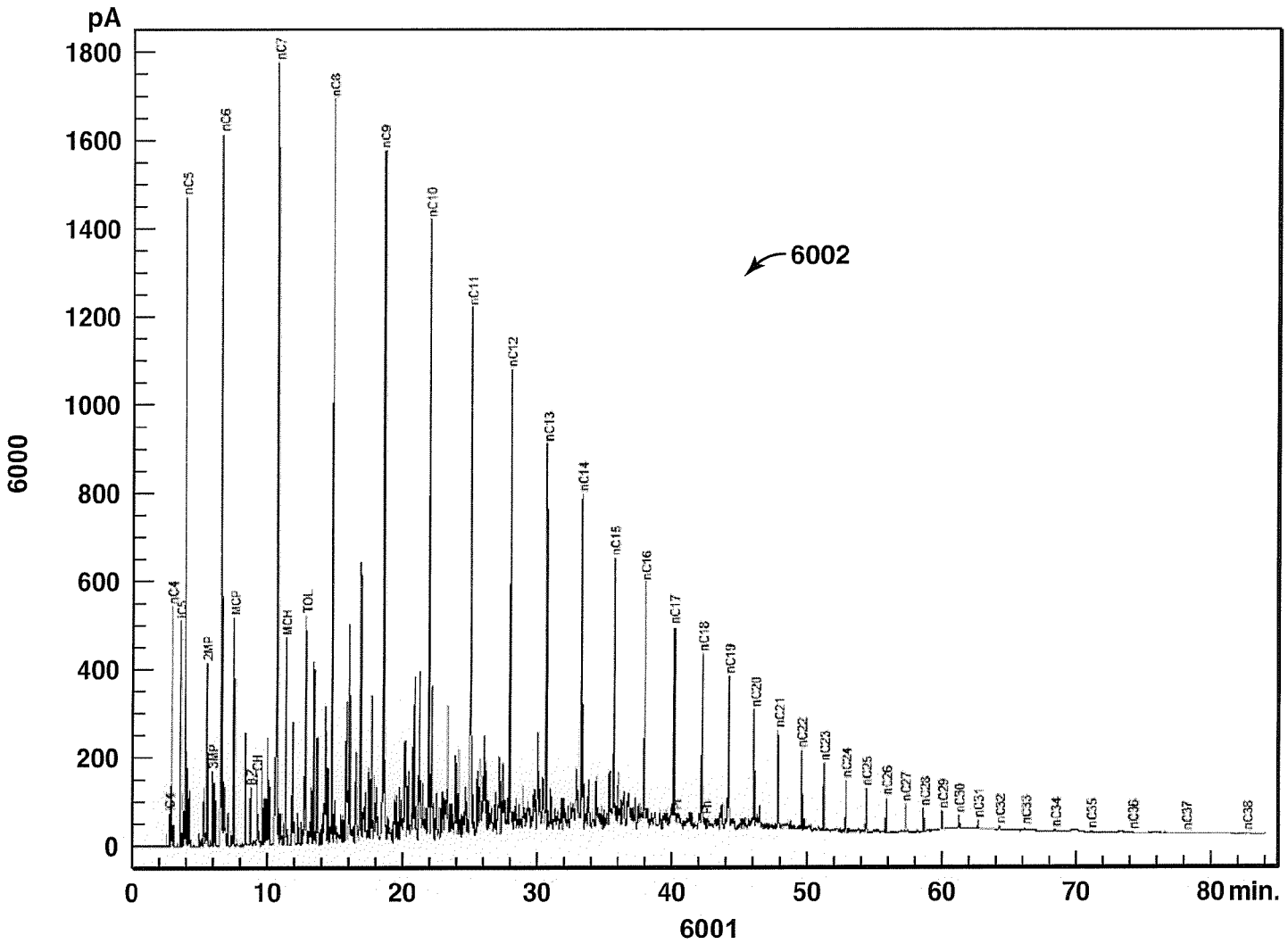
FIG. 38 is a whole oil gas chromatogram of liquid sampled from Example 4.

Results for the liquid collected and analyzed by whole oil gas chromatography (WOGC) are shown in FIG. 38, Table 8 and Table 1. In FIG. 38 the y-axis 6000 represents the detector response in pico-amperes (pA) while the x-axis 6001 represents the retention time in minutes. The GC chromatogram is shown generally by label 6002 with individual identified peaks labeled with abbreviations.

TABLE 8

Peak and Area Details from FIG. 38 - Example 4 - 1000 psi stress - Liquid GC.

| Peak Number | Ret Time [min] | Peak Area [pA * s] | Compound Name |
|---|---|---|---|
| 1 | 2.737 | 117.78948 | *i*C4 |
| 2 | 2.901 | 923.40125 | *n*C4 |
| 3 | 3.528 | 1079.83325 | *i*C5 |
| 4 | 3.891 | 3341.44604 | *n*C5 |
| 5 | 5.493 | 1364.53186 | 2MP |
| 6 | 5.930 | 533.68530 | 3MP |
| 7 | 6.552 | 5160.12207 | *n*C6 |
| 8 | 7.452 | 1770.29932 | MCP |
| 9 | 8.717 | 487.04718 | BZ |
| 10 | 9.206 | 712.61566 | CH |
| 11 | 10.634 | 7302.51123 | *n*C7 |
| 12 | 11. | 1755.92236 | MCH |
| 13 | 12.760 | 2145.57666 | TOL |
| 14 | 14.755 | 6434.40430 | *n*C8 |
| 15 | 18.503 | 6007.12891 | *n*C9 |
| 16 | 21.906 | 5417.67480 | *n*C10 |
| 17 | 25.030 | 4565.11084 | *n*C11 |
| 18 | 27.936 | 3773.91943 | *n*C12 |
| 19 | 30.656 | 3112.23950 | *n*C13 |
| 20 | 33.220 | 2998.37720 | *n*C14 |
| 21 | 35.639 | 2304.97632 | *n*C15 |
| 22 | 37.927 | 2197.88892 | *n*C16 |
| 23 | 40.102 | 1791.11877 | *n*C17 |
| 24 | 40.257 | 278.39423 | Pr |
| 25 | 42.171 | 1589.64233 | *n*C18 |
| 26 | 42.428 | 241.65131 | Ph |
| 27 | 44.141 | 1442.51843 | *n*C19 |
| 28 | 46.025 | 1031.68481 | *n*C20 |
| 29 | 47.825 | 957.65479 | *n*C21 |
| 30 | 49.551 | 609.59943 | *n*C22 |
| 31 | 51.208 | 526.53339 | *n*C23 |
| 32 | 52.798 | 383.01022 | *n*C24 |
| 33 | 54.329 | 325.93640 | *n*C25 |
| 34 | 55.806 | 248.12935 | *n*C26 |
| 35 | 57.230 | 203.21725 | *n*C27 |
| 36 | 58.603 | 168.78055 | *n*C28 |
| 37 | 59.934 | 140.40034 | *n*C29 |
| 38 | 61.222 | 95.47594 | *n*C30 |
| 39 | 62.622 | 77.49546 | *n*C31 |
| 40 | 64.234 | 49.08135 | *n*C32 |
| 41 | 66.114 | 33.61663 | *n*C33 |
| 42 | 68.350 | 27.46170 | *n*C34 |
| 43 | 71.030 | 35.89277 | *n*C35 |
| 44 | 74.162 | 16.87499 | *n*C36 |
| 45 | 78.055 | 29.21477 | *n*C37 |
| 46 | 82.653 | 9.88631 | *n*C38 |
| Totals: | | 7.38198e4 | |

Example 5

Figure 39:
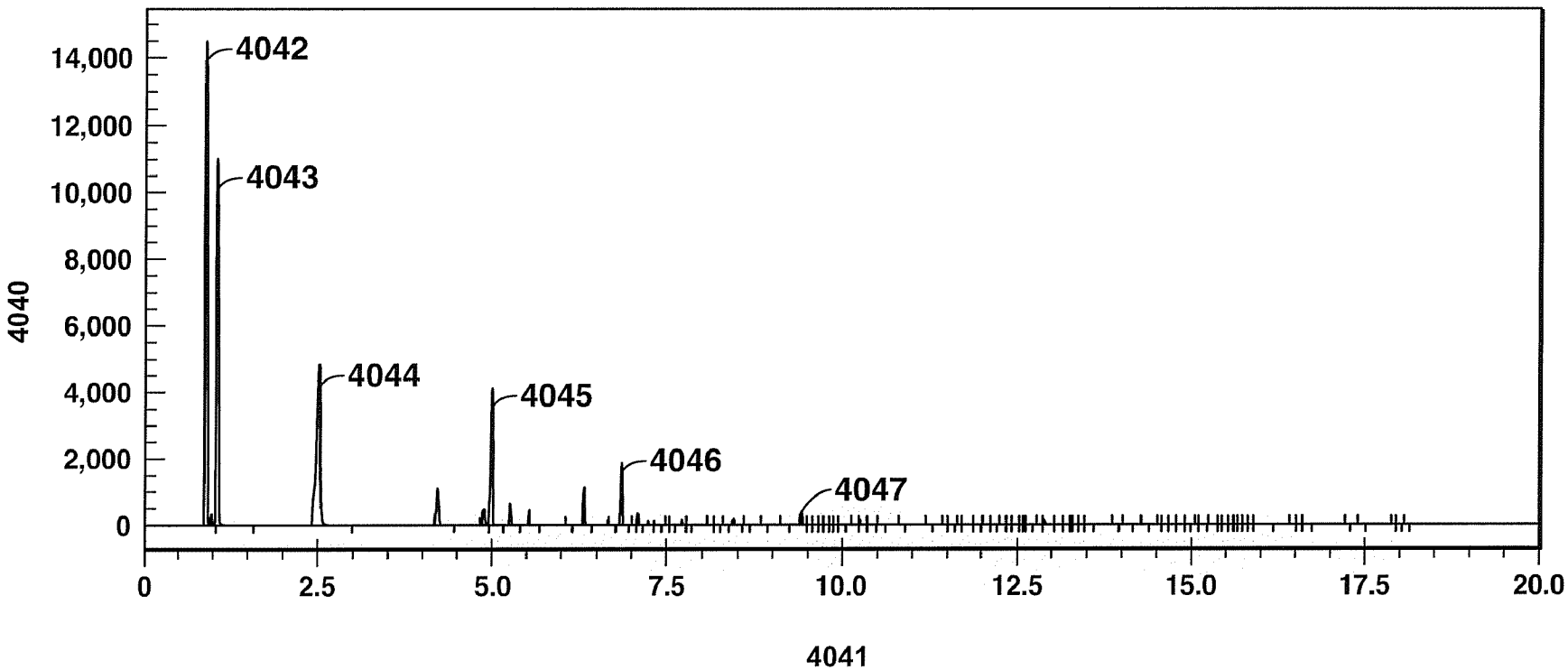
FIG. 39 is gas chromatogram of gas sampled from Example 5.

Conducted in a manner similar to that of Example 2 on a core specimen from oil shale block CM-1B; however, in this example the applied effective stress was 1,000 psi. Results for the gas collected and analyzed by hydrocarbon gas sample gas chromatography (GC) and non-hydrocarbon gas sample gas chromatography (GC) (GC not shown) are shown in FIG. 39, Table 9 and Table 1. In FIG. 39 the y-axis 4040 represents the detector response in pico-amperes (pA) while the x-axis 4041 represents the retention time in minutes. In FIG. 39 peak 4042 represents the response for methane, peak 4043 represents the response for ethane, peak 4044 represents the response for propane, peak 4045 represents the response for butane, peak 4046 represents the response for pentane and peak 4047 represents the response for hexane.

TABLE 9

Peak and Area Details for FIG. 39 - Example 5 - 1000 psi stress - Gas GC

| Peak Number | Ret Time [min] | Area [pA * s] | Compound Name |
|---|---|---|---|
| 1 | 0.910 | 1.59035e4 | Methane |
| 2 | 0.999 | 434.21375 | |
| 3 | 1.077 | 1.53391e4 | Ethane |
| 4 | 2.537 | 1.86530e4 | Propane |
| 5 | 4.235 | 2545.45850 | *i*C4 |
| 6 | 4.907 | 1192.68970 | |
| 7 | 5.015 | 6814.44678 | n-Butane |
| 8 | 5.285 | 687.83679 | |
| 9 | 5.564 | 463.25885 | |
| 10 | 6.106 | 30.02624 | |
| 11 | 6.351 | 1295.13477 | *i*C5 |
| 12 | 6.712 | 245.26985 | |
| 13 | 6.876 | 2561.11792 | n-Pentane |
| 14 | 7.039 | 4.50998 | |
| 15 | 7.109 | 408.32999 | |
| 16 | 7.268 | 204.45311 | |
| 17 | 7.354 | 207.92183 | |
| 18 | 7.527 | 4.02397 | |
| 19 | 7.574 | 5.65699 | |
| 20 | 7.755 | 2.35952 | |
| 21 | 7.818 | 2.00382 | |
| 22 | 8.107 | 38.23093 | |
| 23 | 8.193 | 20.54333 | |
| 24 | 8.317 | 148.54445 | |
| 25 | 8.468 | 300.31586 | 2-methyl pentane |
| 26 | 8.622 | 26.06131 | |
| 27 | 8.858 | 113.70123 | |
| 28 | 9.168 | 90.37163 | |
| 29 | 9.422 | 694.74438 | n-Hexane |
| 30 | 9.531 | 4.88323 | |
| 31 | 9.625 | 45.91505 | |
| 32 | 9.689 | 76.32931 | |
| 33 | 9.767 | 77.63214 | |
| 34 | 9.826 | 19.23768 | |
| 35 | 9.889 | 8.54605 | |
| 36 | 9.989 | 37.74959 | |
| 37 | 10.204 | 30.83943 | |
| 38 | 10.280 | 184.58420 | |
| 39 | 10.397 | 4.43609 | |
| 40 | 10.551 | 10.59880 | |
| 41 | 10.843 | 2.30370 | |
| 42 | 11.231 | 55.64666 | |
| 43 | 11.472 | 35.46931 | |
| 44 | 11.547 | 17.16440 | |
| 45 | 11.691 | 3.30460 | |
| 46 | 11.804 | 39.46368 | |
| 47 | 11.931 | 7.32969 | |
| 48 | 12.094 | 30.59748 | |
| 49 | 12.163 | 6.93754 | |
| 50 | 12.295 | 18.69523 | |
| 51 | 12.391 | 15.96837 | |
| 52 | 12.482 | 33.66422 | |
| 53 | 12.577 | 2.02121 | |
| 54 | 12.618 | 2.32440 | |
| 55 | 12.670 | 12.83803 | |
| 56 | 12.851 | 2.22731 | |
| 57 | 12.929 | 218.23195 | |
| 58 | 13.100 | 14.33166 | |
| 59 | 13.198 | 10.20244 | |
| 60 | 13.310 | 12.02551 | |
| 61 | 13.432 | 8.23884 | |
| 62 | 13.519 | 47.64641 | |
| 63 | 13.898 | 22.63760 | |
| 64 | 14.090 | 9.29738 | |
| 65 | 14.319 | 3.88012 | |
| 66 | 14.551 | 9.26884 | |
| 67 | 14.612 | 4.34914 | |
| 68 | 14.729 | 4.07543 | |
| 69 | 14.872 | 46.24465 | |
| 70 | 14.954 | 6.62461 | |
| 71 | 15.084 | 3.92423 | |
| 72 | 15.139 | 8.60328 | |
| 73 | 15.340 | 2.17899 | |
| 74 | 15.430 | 2.96646 | |

TABLE 9-continued

Peak and Area Details for FIG. 39 - Example 5 - 1000 psi stress - Gas GC

| Peak Number | Ret Time [min] | Area [pA * s] | Compound Name |
|---|---|---|---|
| 75 | 15.521 | 9.66407 | |
| 76 | 15.578 | 4.27190 | |
| 77 | 15.645 | 4.37904 | |
| 78 | 15.703 | 2.68909 | |
| 79 | 15.782 | 46.97895 | |
| 80 | 15.859 | 4.69475 | |
| 81 | 16.022 | 7.36509 | |
| 82 | 16.489 | 3.91073 | |
| 83 | 16.564 | 6.22445 | |
| 84 | 16.648 | 10.24660 | |
| 85 | 17.269 | 2.69753 | |
| 86 | 17.445 | 10.16989 | |
| 87 | 17.925 | 2.28341 | |
| 88 | 17.979 | 2.71101 | |
| 89 | 18.104 | 11.19730 | |

TABLE 1

Summary data for Examples 1-5.

| | Example 1 | Example 2 | Example 3 | Example 4 | Example 5 |
|---|---|---|---|---|---|
| Effective Stress (psi) | 0 | 400 | 400 | 1000 | 1000 |
| Sample weight (g) | 82.46 | 42.57 | 48.34 | 43.61 | 43.73 |
| Sample weight loss (g) | 19.21 | 10.29 | 11.41 | 10.20 | 9.17 |
| Fluids Recovered: | | | | | |
| Oil (g) | 10.91 | 3.63 | 3.77 | 3.02 | 2.10 |
| | 36.2 gal/ton | 23.4 gal/ton | 21.0 gal/ton | 19.3 gal/ton | 13/1 gal/ton |
| Water (g) | 0.90 | 0.30 | 0.34 | 0.39 | 0.28 |
| | 2.6 gal/ton | 1.7 gal/ton | 1.7 gal/ton | 2.1 gal/ton | 1.5 gal/ton |
| HC gas (g) | 2.09 | 1.33 | 1.58 | 1.53 | 1.66 |
| | 683 scf/ton | 811 scf/ton | 862 scf/ton | 905 scf/ton | 974 scf/ton |
| $CO_2$ (g) | 3.35 | 1.70 | 1.64 | 1.74 | 1.71 |
| | 700 scf/ton | 690 scf/ton | 586 scf/ton | 690 scf/ton | 673 scf/ton |
| $H_2S$ (g) | 0.06 | 0.0 | 0.0 | 0.0 | 0.0 |
| Coke Recovered: | 0.0 | 0.73 | 0.79 | .47 | 0.53 |
| Inferred Oil (g) | 0.0 | 1.67 | 1.81 | 1.07 | 1.21 |
| | 0 gal/ton | 10.8 gal/ton | 10.0 gal/ton | 6.8 gal/ton | 7.6 gal/ton |
| Total Oil (g) | 10.91 | 5.31 | 5.58 | 4.09 | 3.30 |
| | 36.2 gal/ton | 34.1 gal/ton | 31.0 gal/ton | 26.1 gal/ton | 20.7 gal/ton |
| Balance (g) | 1.91 | 2.59 | 3.29 | 3.05 | 2.91 |

Analysis

The gas and liquid samples obtained through the experimental procedures and gas and liquid sample collection procedures described for Examples 1-5, were analyzed by the following hydrocarbon gas sample gas chromatography (GC) analysis methodology, non-hydrocarbon gas sample gas chromatography (GC) analysis methodology, gas sample GC peak identification and integration methodology, whole oil gas chromatography (WOGC) analysis methodology, and whole oil gas chromatography (WOGC) peak identification and integration methodology.

Gas samples collected during the heating tests as described in Examples 1-5 were analyzed for both hydrocarbon and non-hydrocarbon gases, using an Agilent Model 6890 Gas Chromatograph coupled to an Agilent Model 5973 quadrapole mass selective detector. The 6890 GC was configured with two inlets (front and back) and two detectors (front and back) with two fixed volume sample loops for sample introduction. Peak identifications and integrations were performed using the CHEMSTATION software (Revision A.03.01) supplied with the GC instrument. For hydrocarbon gases, the GC configuration consisted of the following:

- split/splitless inlet (back position of the GC)
- FID (Flame ionization detector) back position of the GC
- HP Ultra-2 (5% Phenyl Methyl Siloxane) capillary columns (two) (25 meters×200 μm ID) one directed to the FID detector, the other to an Agilent 5973 Mass Selective Detector
- 500 μl fixed volume sample loop
- six-port gas sampling valve
- cryogenic (liquid nitrogen) oven cooling capability
- Oven program −80° C. for 2 mins., 20° C./min. to 0° C., then 4° C./min to 20° C., then 10° C./min. to 100° C., hold for 1 min.
- Helium carrier gas flow rate of 2.2 ml/min
- Inlet temperature 100° C.
- Inlet pressure 19.35 psi
- Split ratio 25:1
- FID temperature 310° C.
- For non-hydrocarbon gases (e.g., argon, carbon dioxide and hydrogen sulfide) the GC configuration consisted of the following:
- PTV (programmable temperature vaporization) inlet (front position of the GC)
- TCD (Thermal conductivity detector) front position of the GC
- GS-GasPro capillary column (30 meters×0.32 mm ID)
- 100 μl fixed volume sample loop
- six port gas sampling valve
- Oven program: 25° C. hold for 2 min., then 10° C./min to 200° C., hold 1 min.
- Helium carrier gas flow rate of 4.1 ml/min.
- Inlet temperature 200° C.
- Inlet pressure 14.9 psi
- Splitless mode
- TCD temperature 250° C.

For Examples 1-5, a stainless steel sample cylinder containing gas collected from the Parr vessel (FIG. 29) was fitted with a two stage gas regulator (designed for lecture bottle use) to reduce gas pressure to approximately twenty pounds per square inch. A septum fitting was positioned at the outlet port of the regulator to allow withdrawal of gas by means of a HAMILTON model 1005 gas-tight syringe. Both the septum fitting and the syringe were purged with gas from the stainless steel sample cylinder to ensure that a representative gas sample was collected. The gas sample was then transferred to a stainless steel cell (septum cell) equipped with a pressure transducer and a septum fitting. The septum cell was connected to the fixed volume sample loop mounted on the GC by stainless steel capillary tubing. The septum cell and sample loop were evacuated for approximately 5 minutes. The evacuated septum cell was then isolated from the evacuated sample loop by closure of a needle valve positioned at the outlet of the septum cell. The gas sample was introduced into the septum cell from the gas-tight syringe through the septum fitting and a pressure recorded. The evacuated sample loop was then opened to the pressurized septum cell and the gas sample allowed to equilibrate between the sample loop and the septum cell for one minute. The equilibrium pressure was then recorded, to allow calculation of the total moles of gas present in the sample loop before injection into the GC inlet. The sample loop contents were then swept into the inlet by Helium carrier gas and components separated by retention time in the capillary column, based upon the GC oven temperature program and carrier gas flow rates.

Calibration curves, correlating integrated peak areas with concentration, were generated for quantification of gas compositions using certified gas standards. For hydrocarbon gases, standards containing a mixture of methane, ethane, propane, butane, pentane and hexane in a helium matrix in varying concentrations (parts per million, mole basis) were injected into the GC through the fixed volume sample loop at atmospheric pressure. For non-hydrocarbon gases, standards containing individual components, i.e., carbon dioxide in helium and hydrogen sulfide in natural gas, were injected into the GC at varying pressures in the sample loop to generate calibration curves.

The hydrocarbon gas sample molar percentages reported in FIG. 27 were obtained using the following procedure. Gas standards for methane, ethane, propane, butane, pentane and hexane of at least three varying concentrations were run on the gas chromatograph to obtain peak area responses for such standard concentrations. The known concentrations were then correlated to the respective peak area responses within the CHEMSTATION software to generate calibration curves for methane, ethane, propane, butane, pentane and hexane. The calibration curves were plotted in CHEMSTATION to ensure good linearity (R2>0.98) between concentration and peak intensity. A linear fit was used for each calibrated compound, so that the response factor between peak area and molar concentration was a function of the slope of the line as determined by the CHEMSTATION software. The CHEMSTATION software program then determined a response factor relating GC peak area intensity to the amount of moles for each calibrated compound. The software then determined the number of moles of each calibrated compound from the response factor and the peak area. The peak areas used in Examples 1-5 are reported in Tables 2, 4, 5, 7, and 9. The number of moles of each identified compound for which a calibration curve was not determined (i.e., iso-butane, iso-pentane, and 2-methyl pentane) was then estimated using the response factor for the closest calibrated compound (i.e., butane for iso-butane; pentane for iso-pentane; and hexane for 2-methyl pentane) multiplied by the ratio of the peak area for the identified compound for which a calibration curve was not determined to the peak area of the calibrated compound. The values reported in FIG. 27 were then taken as a percentage of the total of all identified hydrocarbon gas GC areas (i.e., methane, ethane, propane, iso-butane, n-butane, iso-pentane, n-pentane, 2-methyl pentane, and n-hexane) and calculated molar concentrations. Thus the graphed methane to normal C6 molar percentages for all of the experiments do not include the molar contribution of the unidentified hydrocarbon gas species listed in Tables 2, 4, 5, 7, or 9 (e.g., peak numbers 2, 6, 8-11, 13, 15-22, 24-26, and 28-78 in Table 2).

Liquid samples collected during the heating tests as described in Examples 1, 3 and 4 were analyzed by whole oil gas chromatography (WOGC) according to the following procedure. Samples, QA/QC standards and blanks (carbon disulfide) were analyzed using an Ultra 1 Methyl Siloxane column (25 m length, 0.32 μm diameter, 0.52 μm film thickness) in an Agilent 6890 GC equipped with a split/splitless injector, autosampler and flame ionization detector (FID). Samples were injected onto the capillary column in split mode with a split ratio of 80:1. The GC oven temperature was kept constant at 20° C. for 5 min, programmed from 20° C. to 300° C. at a rate of 5° C.min$^{-1}$, and then maintained at 300° C.

for 30 min (total run time=90 min.). The injector temperature was maintained at 300° C. and the FID temperature set at 310° C. Helium was used as carrier gas at a flow of 2.1 mL $min^{-1}$. Peak identifications and integrations were performed using CHEMSTATION software Rev.A.10.02 [1757] (Agilent Tech. 1990-2003) supplied with the Agilent instrument.

Standard mixtures of hydrocarbons were analyzed in parallel by the WOGC method described above and by an Agilent 6890 GC equipped with a split/splitless injector, auto sampler and mass selective detector (MS) under the same conditions. Identification of the hydrocarbon compounds was conducted by analysis of the mass spectrum of each peak from the GC-MS. Since conditions were identical for both instruments, peak identification conducted on the GC-MS could be transferred to the peaks obtained on the GC-FID. Using these data, a compound table relating retention time and peak identification was set up in the GC-FID CHEMSTATION. This table was used for peak identification.

The gas chromatograms obtained on the liquid samples (FIGS. 4, 9 and 11) were analyzed using a pseudo-component technique. The convention used for identifying each pseudo-component was to integrate all contributions from normal alkane to next occurring normal alkane with the pseudo-component being named by the late eluting n-alkane. For example, the C-10 pseudo-component would be obtained from integration beginning just past normal-C9 and continue just through normal-C10. The carbon number weight % and mole % values for the pseudo-components obtained in this manner were assigned using correlations developed by Katz and Firoozabadi (Katz, D. L., and A. Firoozabadi, 1978. Predicting phase behavior of condensate/crude-oil systems using methane interaction coefficients, J. Petroleum Technology (November 1978), 1649-1655). Results of the pseudo-component analyses for Examples 1, 3 and 4 are shown in Tables 10, 11 and 12.

An exemplary pseudo component weight percent calculation is presented below with reference to Table 10 for the C10 pseudo component for Example 1 in order to illustrate the technique. First, the C-10 pseudo-component total area is obtained from integration of the area beginning just past normal-C9 and continued just through normal-C10 as described above. The total integration area for the C10 pseudo component is 10551.700 pico-ampere-seconds (pAs). The total C10 pseudo component integration area (10551.700 pAs) is then multiplied by the C10 pseudo component density (0.7780 g/ml) to yield an "area X density" of 8209.22 pAs g/ml. Similarly, the peak integration areas for each pseudo component and all lighter listed compounds (i.e., nC3, iC4, nC4, iC5 & nC5) are determined and multiplied by their respective densities to yield "area X density" numbers for each respective pseudo component and listed compound. The respective determined "area X density" numbers for each pseudo component and listed compound is then summed to determine a "total area X density" number. The "total area X density" number for Example 1 is 96266.96 pAs g/ml. The C10 pseudo component weight percentage is then obtained by dividing the C10 pseudo component "area X density" number (8209.22 pAs g/ml) by the "total area X density" number (96266.96 pAs g/ml) to obtain the C10 pseudo component weight percentage of 8.53 weight percent.

An exemplary pseudo component molar percent calculation is presented below with reference to Table 10 for the C10 pseudo component for Example 1 in order to further illustrate the pseudo component technique. First, the C-10 pseudo-component total area is obtained from integration of the area beginning just past normal-C9 and continued just through normal-C10 as described above. The total integration area for the C10 pseudo component is 10551.700 pico-ampere-seconds (pAs). The total C10 pseudo component integration area (10551.700 pAs) is then multiplied by the C10 pseudo component density (0.7780 g/ml) to yield an "area X density" of 8209.22 pAs g/ml. Similarly, the integration areas for each pseudo component and all lighter listed compounds (i.e., nC3, iC4, nC4, iC5 & nC5) are determined and multiplied by their respective densities to yield "area X density" numbers for each respective pseudo component and listed compound. The C10 pseudo component "area X density" number (8209.22 pAs g/ml) is then divided by the C10 pseudo component molecular weight (134.00 g/mol) to yield a C10 pseudo component "area X density/molecular weight" number of 61.26 pAs mol/ml. Similarly, the "area X density" number for each pseudo component and listed compound is then divided by such components or compounds respective molecular weight to yield an "area X density/molecular weight" number for each respective pseudo component and listed compound. The respective determined "area X density/molecular weight" numbers for each pseudo component and listed compound is then summed to determine a "total area X density/molecular weight" number. The total "total area X density/molecular weight" number for Example 1 is 665.28 pAs mol/ml. The C10 pseudo component molar percentage is then obtained by dividing the C10 pseudo component "area X density/molecular weight" number (61.26 pAs mol/ml) by the "total area X density/molecular weight" number (665.28 pAs mol/ml) to obtain the C10 pseudo component molar percentage of 9.21 molar percent.

TABLE 10

Pseudo-components for Example 1 - GC of liquid - 0 stress

| Component | Area (cts.) | Area % | Avg. Boiling Pt. (° F.) | Density (g/ml) | Molecular Wt. (g/mol) | Wt. % | Mol % |
|---|---|---|---|---|---|---|---|
| $nC_3$ | 41.881 | 0.03 | −43.73 | 0.5069 | 44.10 | 0.02 | 0.07 |
| $iC_4$ | 120.873 | 0.10 | 10.94 | 0.5628 | 58.12 | 0.07 | 0.18 |
| $nC_4$ | 805.690 | 0.66 | 31.10 | 0.5840 | 58.12 | 0.49 | 1.22 |
| $iC_5$ | 1092.699 | 0.89 | 82.13 | 0.6244 | 72.15 | 0.71 | 1.42 |
| $nC_5$ | 2801.815 | 2.29 | 96.93 | 0.6311 | 72.15 | 1.84 | 3.68 |
| Pseudo $C_6$ | 7150.533 | 5.84 | 147.00 | 0.6850 | 84.00 | 5.09 | 8.76 |
| Pseudo $C_7$ | 10372.800 | 8.47 | 197.50 | 0.7220 | 96.00 | 7.78 | 11.73 |
| Pseudo $C_8$ | 11703.500 | 9.56 | 242.00 | 0.7450 | 107.00 | 9.06 | 12.25 |
| Pseudo $C_9$ | 11776.200 | 9.61 | 288.00 | 0.7640 | 121.00 | 9.35 | 11.18 |
| Pseudo $C_{10}$ | 10551.700 | 8.61 | 330.50 | 0.7780 | 134.00 | 8.53 | 9.21 |
| Pseudo $C_{11}$ | 9274.333 | 7.57 | 369.00 | 0.7890 | 147.00 | 7.60 | 7.48 |
| Pseudo $C_{12}$ | 8709.231 | 7.11 | 407.00 | 0.8000 | 161.00 | 7.24 | 6.50 |
| Pseudo $C_{13}$ | 7494.549 | 6.12 | 441.00 | 0.8110 | 175.00 | 6.31 | 5.22 |

TABLE 10-continued

Pseudo-components for Example 1 - GC of liquid - 0 stress

| Component | Area (cts.) | Area % | Avg. Boiling Pt. (° F.) | Density (g/ml) | Molecular Wt. (g/mol) | Wt. % | Mol % |
|---|---|---|---|---|---|---|---|
| Pseudo $C_{14}$ | 6223.394 | 5.08 | 475.50 | 0.8220 | 190.00 | 5.31 | 4.05 |
| Pseudo $C_{15}$ | 6000.179 | 4.90 | 511.00 | 0.8320 | 206.00 | 5.19 | 3.64 |
| Pseudo $C_{16}$ | 5345.791 | 4.36 | 542.00 | 0.8390 | 222.00 | 4.66 | 3.04 |
| Pseudo $C_{17}$ | 4051.886 | 3.31 | 572.00 | 0.8470 | 237.00 | 3.57 | 2.18 |
| Pseudo $C_{18}$ | 3398.586 | 2.77 | 595.00 | 0.8520 | 251.00 | 3.01 | 1.73 |
| Pseudo $C_{19}$ | 2812.101 | 2.30 | 617.00 | 0.8570 | 263.00 | 2.50 | 1.38 |
| Pseudo $C_{20}$ | 2304.651 | 1.88 | 640.50 | 0.8620 | 275.00 | 2.06 | 1.09 |
| Pseudo $C_{21}$ | 2038.925 | 1.66 | 664.00 | 0.8670 | 291.00 | 1.84 | 0.91 |
| Pseudo $C_{22}$ | 1497.726 | 1.22 | 686.00 | 0.8720 | 305.00 | 1.36 | 0.64 |
| Pseudo $C_{23}$ | 1173.834 | 0.96 | 707.00 | 0.8770 | 318.00 | 1.07 | 0.49 |
| Pseudo $C_{24}$ | 822.762 | 0.67 | 727.00 | 0.8810 | 331.00 | 0.75 | 0.33 |
| Pseudo $C_{25}$ | 677.938 | 0.55 | 747.00 | 0.8850 | 345.00 | 0.62 | 0.26 |
| Pseudo $C_{26}$ | 532.788 | 0.43 | 766.00 | 0.8890 | 359.00 | 0.49 | 0.20 |
| Pseudo $C_{27}$ | 459.465 | 0.38 | 784.00 | 0.8930 | 374.00 | 0.43 | 0.16 |
| Pseudo $C_{28}$ | 413.397 | 0.34 | 802.00 | 0.8960 | 388.00 | 0.38 | 0.14 |
| Pseudo $C_{29}$ | 522.898 | 0.43 | 817.00 | 0.8990 | 402.00 | 0.49 | 0.18 |
| Pseudo $C_{30}$ | 336.968 | 0.28 | 834.00 | 0.9020 | 416.00 | 0.32 | 0.11 |
| Pseudo $C_{31}$ | 322.495 | 0.26 | 850.00 | 0.9060 | 430.00 | 0.30 | 0.10 |
| Pseudo $C_{32}$ | 175.615 | 0.14 | 866.00 | 0.9090 | 444.00 | 0.17 | 0.05 |
| Pseudo $C_{33}$ | 165.912 | 0.14 | 881.00 | 0.9120 | 458.00 | 0.16 | 0.05 |
| Pseudo $C_{34}$ | 341.051 | 0.28 | 895.00 | 0.9140 | 472.00 | 0.32 | 0.10 |
| Pseudo $C_{35}$ | 286.861 | 0.23 | 908.00 | 0.9170 | 486.00 | 0.27 | 0.08 |
| Pseudo $C_{36}$ | 152.814 | 0.12 | 922.00 | 0.9190 | 500.00 | 0.15 | 0.04 |
| Pseudo $C_{37}$ | 356.947 | 0.29 | 934.00 | 0.9220 | 514.00 | 0.34 | 0.10 |
| Pseudo $C_{38}$ | 173.428 | 0.14 | 947.00 | 0.9240 | 528.00 | 0.17 | 0.05 |
| Totals | 122484.217 | 100.00 | | | | 100.00 | 100.00 |

TABLE 11

Pseudo-Components for Example 3 - GC of Liquid - 400 psi Stress

| Component | Area | Area % | Avg. Boiling Pt. (° F.) | Density (g/ml) | Molecular Wt. (g/mol) | Wt. % | Mol % |
|---|---|---|---|---|---|---|---|
| $nC_3$ | 35.845 | 0.014 | −43.730 | 0.5069 | 44.10 | 0.01 | 0.03 |
| $iC_4$ | 103.065 | 0.041 | 10.940 | 0.5628 | 58.12 | 0.03 | 0.07 |
| $nC_4$ | 821.863 | 0.328 | 31.100 | 0.5840 | 58.12 | 0.24 | 0.62 |
| $iC_5$ | 1187.912 | 0.474 | 82.130 | 0.6244 | 72.15 | 0.37 | 0.77 |
| $nC_5$ | 3752.655 | 1.498 | 96.930 | 0.6311 | 72.15 | 1.20 | 2.45 |
| Pseudo $C_6$ | 12040.900 | 4.805 | 147.000 | 0.6850 | 84.00 | 4.17 | 7.34 |
| Pseudo $C_7$ | 20038.600 | 7.997 | 197.500 | 0.7220 | 96.00 | 7.31 | 11.26 |
| Pseudo $C_8$ | 24531.500 | 9.790 | 242.000 | 0.7450 | 107.00 | 9.23 | 12.76 |
| Pseudo $C_9$ | 25315.000 | 10.103 | 288.000 | 0.7640 | 121.00 | 9.77 | 11.94 |
| Pseudo $C_{10}$ | 22640.400 | 9.035 | 330.500 | 0.7780 | 134.00 | 8.90 | 9.82 |
| Pseudo $C_{11}$ | 20268.100 | 8.089 | 369.000 | 0.7890 | 147.00 | 8.08 | 8.13 |
| Pseudo $C_{12}$ | 18675.600 | 7.453 | 407.000 | 0.8000 | 161.00 | 7.55 | 6.93 |
| Pseudo $C_{13}$ | 16591.100 | 6.621 | 441.000 | 0.8110 | 175.00 | 6.80 | 5.74 |
| Pseudo $C_{14}$ | 13654.000 | 5.449 | 475.500 | 0.8220 | 190.00 | 5.67 | 4.41 |
| Pseudo $C_{15}$ | 13006.300 | 5.191 | 511.000 | 0.8320 | 206.00 | 5.47 | 3.92 |
| Pseudo $C_{16}$ | 11962.200 | 4.774 | 542.000 | 0.8390 | 222.00 | 5.07 | 3.38 |
| Pseudo $C_{17}$ | 8851.622 | 3.533 | 572.000 | 0.8470 | 237.00 | 3.79 | 2.36 |
| Pseudo $C_{18}$ | 7251.438 | 2.894 | 595.000 | 0.8520 | 251.00 | 3.12 | 1.84 |
| Pseudo $C_{19}$ | 5946.166 | 2.373 | 617.000 | 0.8570 | 263.00 | 2.57 | 1.45 |
| Pseudo $C_{20}$ | 4645.178 | 1.854 | 640.500 | 0.8620 | 275.00 | 2.02 | 1.09 |
| Pseudo $C_{21}$ | 4188.168 | 1.671 | 664.000 | 0.8670 | 291.00 | 1.83 | 0.93 |
| Pseudo $C_{22}$ | 2868.636 | 1.145 | 686.000 | 0.8720 | 305.00 | 1.26 | 0.61 |
| Pseudo $C_{23}$ | 2188.895 | 0.874 | 707.000 | 0.8770 | 318.00 | 0.97 | 0.45 |
| Pseudo $C_{24}$ | 1466.162 | 0.585 | 727.000 | 0.8810 | 331.00 | 0.65 | 0.29 |
| Pseudo $C_{25}$ | 1181.133 | 0.471 | 747.000 | 0.8850 | 345.00 | 0.53 | 0.23 |
| Pseudo $C_{26}$ | 875.812 | 0.350 | 766.000 | 0.8890 | 359.00 | 0.39 | 0.16 |
| Pseudo $C_{27}$ | 617.103 | 0.246 | 784.000 | 0.8930 | 374.00 | 0.28 | 0.11 |
| Pseudo $C_{28}$ | 538.147 | 0.215 | 802.000 | 0.8960 | 388.00 | 0.24 | 0.09 |
| Pseudo $C_{29}$ | 659.027 | 0.263 | 817.000 | 0.8990 | 402.00 | 0.30 | 0.11 |
| Pseudo $C_{30}$ | 1013.942 | 0.405 | 834.000 | 0.9020 | 416.00 | 0.46 | 0.16 |
| Pseudo $C_{31}$ | 761.259 | 0.304 | 850.000 | 0.9060 | 430.00 | 0.35 | 0.12 |
| Pseudo $C_{32}$ | 416.031 | 0.166 | 866.000 | 0.9090 | 444.00 | 0.19 | 0.06 |
| Pseudo $C_{33}$ | 231.207 | 0.092 | 881.000 | 0.9120 | 458.00 | 0.11 | 0.03 |
| Pseudo $C_{34}$ | 566.926 | 0.226 | 895.000 | 0.9140 | 472.00 | 0.26 | 0.08 |
| Pseudo $C_{35}$ | 426.697 | 0.170 | 908.000 | 0.9170 | 486.00 | 0.20 | 0.06 |

TABLE 11-continued

Pseudo-Components for Example 3 - GC of Liquid - 400 psi Stress

| Component | Area | Area % | Avg. Boiling Pt. (° F.) | Density (g/ml) | Molecular Wt. (g/mol) | Wt. % | Mol % |
|---|---|---|---|---|---|---|---|
| Pseudo $C_{36}$ | 191.626 | 0.076 | 922.000 | 0.9190 | 500.00 | 0.09 | 0.03 |
| Pseudo $C_{37}$ | 778.713 | 0.311 | 934.000 | 0.9220 | 514.00 | 0.36 | 0.10 |
| Pseudo $C_{38}$ | 285.217 | 0.114 | 947.000 | 0.9240 | 528.00 | 0.13 | 0.04 |
| Totals | 250574.144 | 100.000 | | | | 100.00 | 100.00 |

TABLE 12

Pseudo-Components for Example 4 - GC of Liquid - 1000 psi Stress

| Component | Area | Area % | Avg. Boiling Pt. (° F.) | Density (g/ml) | Molecular Wt. (g/mol) | Wt. % | Mol % |
|---|---|---|---|---|---|---|---|
| $nC_3$ | 44.761 | 0.023 | −43.730 | 0.5069 | 44.10 | 0.01 | 0.05 |
| $iC_4$ | 117.876 | 0.060 | 10.940 | 0.5628 | 58.12 | 0.04 | 0.11 |
| $nC_4$ | 927.866 | 0.472 | 31.100 | 0.5840 | 58.12 | 0.35 | 0.87 |
| $iC_5$ | 1082.570 | 0.550 | 82.130 | 0.6244 | 72.15 | 0.44 | 0.88 |
| $nC_5$ | 3346.533 | 1.701 | 96.930 | 0.6311 | 72.15 | 1.37 | 2.74 |
| Pseudo $C_6$ | 9579.443 | 4.870 | 147.000 | 0.6850 | 84.00 | 4.24 | 7.31 |
| Pseudo $C_7$ | 16046.200 | 8.158 | 197.500 | 0.7220 | 96.00 | 7.49 | 11.29 |
| Pseudo $C_8$ | 19693.300 | 10.012 | 242.000 | 0.7450 | 107.00 | 9.48 | 12.83 |
| Pseudo $C_9$ | 20326.300 | 10.334 | 288.000 | 0.7640 | 121.00 | 10.04 | 12.01 |
| Pseudo $C_{10}$ | 18297.600 | 9.302 | 330.500 | 0.7780 | 134.00 | 9.20 | 9.94 |
| Pseudo $C_{11}$ | 16385.600 | 8.330 | 369.000 | 0.7890 | 147.00 | 8.36 | 8.23 |
| Pseudo $C_{12}$ | 15349.000 | 7.803 | 407.000 | 0.8000 | 161.00 | 7.94 | 7.14 |
| Pseudo $C_{13}$ | 13116.500 | 6.668 | 441.000 | 0.8110 | 175.00 | 6.88 | 5.69 |
| Pseudo $C_{14}$ | 10816.100 | 5.499 | 475.500 | 0.8220 | 190.00 | 5.75 | 4.38 |
| Pseudo $C_{15}$ | 10276.900 | 5.225 | 511.000 | 0.8320 | 206.00 | 5.53 | 3.88 |
| Pseudo $C_{16}$ | 9537.818 | 4.849 | 542.000 | 0.8390 | 222.00 | 5.17 | 3.37 |
| Pseudo $C_{17}$ | 6930.611 | 3.523 | 572.000 | 0.8470 | 237.00 | 3.79 | 2.32 |
| Pseudo $C_{18}$ | 5549.802 | 2.821 | 595.000 | 0.8520 | 251.00 | 3.06 | 1.76 |
| Pseudo $C_{19}$ | 4440.457 | 2.257 | 617.000 | 0.8570 | 263.00 | 2.46 | 1.35 |
| Pseudo $C_{20}$ | 3451.250 | 1.755 | 640.500 | 0.8620 | 275.00 | 1.92 | 1.01 |
| Pseudo $C_{21}$ | 3133.251 | 1.593 | 664.000 | 0.8670 | 291.00 | 1.76 | 0.87 |
| Pseudo $C_{22}$ | 2088.036 | 1.062 | 686.000 | 0.8720 | 305.00 | 1.18 | 0.56 |
| Pseudo $C_{23}$ | 1519.460 | 0.772 | 707.000 | 0.8770 | 318.00 | 0.86 | 0.39 |
| Pseudo $C_{24}$ | 907.473 | 0.461 | 727.000 | 0.8810 | 331.00 | 0.52 | 0.23 |
| Pseudo $C_{25}$ | 683.205 | 0.347 | 747.000 | 0.8850 | 345.00 | 0.39 | 0.16 |
| Pseudo $C_{26}$ | 493.413 | 0.251 | 766.000 | 0.8890 | 359.00 | 0.28 | 0.11 |
| Pseudo $C_{27}$ | 326.831 | 0.166 | 784.000 | 0.8930 | 374.00 | 0.19 | 0.07 |
| Pseudo $C_{28}$ | 272.527 | 0.139 | 802.000 | 0.8960 | 388.00 | 0.16 | 0.06 |
| Pseudo $C_{29}$ | 291.862 | 0.148 | 817.000 | 0.8990 | 402.00 | 0.17 | 0.06 |
| Pseudo $C_{30}$ | 462.840 | 0.235 | 834.000 | 0.9020 | 416.00 | 0.27 | 0.09 |
| Pseudo $C_{31}$ | 352.886 | 0.179 | 850.000 | 0.9060 | 430.00 | 0.21 | 0.07 |
| Pseudo $C_{32}$ | 168.635 | 0.086 | 866.000 | 0.9090 | 444.00 | 0.10 | 0.03 |
| Pseudo $C_{33}$ | 67.575 | 0.034 | 881.000 | 0.9120 | 458.00 | 0.04 | 0.01 |
| Pseudo $C_{34}$ | 95.207 | 0.048 | 895.000 | 0.9140 | 472.00 | 0.06 | 0.02 |
| Pseudo $C_{35}$ | 226.660 | 0.115 | 908.000 | 0.9170 | 486.00 | 0.13 | 0.04 |
| Pseudo $C_{36}$ | 169.729 | 0.086 | 922.000 | 0.9190 | 500.00 | 0.10 | 0.03 |
| Pseudo $C_{37}$ | 80.976 | 0.041 | 934.000 | 0.9220 | 514.00 | 0.05 | 0.01 |
| Pseudo $C_{38}$ | 42.940 | 0.022 | 947.000 | 0.9240 | 528.00 | 0.03 | 0.01 |
| Totals | 196699.994 | 100.000 | | | | 100.00 | 100.00 |

TOC and Rock-eval tests were performed on specimens from oil shale block CM-1B taken at the same stratigraphic interval as the specimens tested by the Parr heating method described in Examples 1-5. These tests resulted in a TOC of 21% and a Rock-eval Hydrogen Index of 872 mg/g-toc.

The TOC and rock-eval procedures described below were performed on the oil shale specimens remaining after the Parr heating tests described in Examples 1-5. Results are shown in Table 13.

The Rock-Eval pyrolysis analyses described above were performed using the following procedures. Rock-Eval pyrolysis analyses were performed on calibration rock standards (IFP standard #55000), blanks, and samples using a Delsi Rock-Eval II instrument. Rock samples were crushed, micronized, and air-dried before loading into Rock-Eval crucibles. Between 25 and 100 mg of powdered-rock samples were loaded into the crucibles depending on the total organic carbon (TOC) content of the sample. Two or three blanks were run at the beginning of each day to purge the system and stabilize the temperature. Two or three samples of IFP calibration standard #55000 with weight of 100+/−1 mg were run to calibrate the system. If the Rock-Eval $T_{max}$ parameter was 419° C.+/−2° C. on these standards, analyses proceeded with samples. The standard was also run before and after every 10 samples to monitor the instrument's performance.

The Rock-Eval pyrolysis technique involves the rate-programmed heating of a powdered rock sample to a high temperature in an inert (helium) atmosphere and the characterization of products generated from the thermal breakdown of chemical bonds. After introduction of the sample the pyrolysis oven was held isothermally at 300° C. for three minutes. Hydrocarbons generated during this stage are detected by a flame-ionization detector (FID) yielding the $S_1$ peak. The pyrolysis-oven temperature was then increased at a gradient of 25° C./minute up to 550° C., where the oven was held isothermally for one minute. Hydrocarbons generated during this step were detected by the FID and yielded the $S_2$ peak.

Hydrogen Index (HI) is calculated by normalizing the $S_2$ peak (expressed as $mg_{hydrocarbons}/g_{rock}$) to weight % TOC (Total Organic Carbon determined independently) as follows:

$$HI=(S_2/TOC)*100$$

where HI is expressed as $mg_{hydrocarbons}/g_{TOC}$

Total Organic Carbon (TOC) was determined by well known methods suitable for geological samples—i.e., any carbonate rock present was removed by acid treatment followed by combustion of the remaining material to produce and measure organic based carbon in the form of CO2.

TABLE 13

TOC and Rock Eval Results on Oil Shale Specimens after the Parr Heating Tests.

| | Example 1 | Example 2 | Example 3 | Example 4 | Example 5 |
|---|---|---|---|---|---|
| TOC (%) | 12.07 | 10.83 | 10.62 | 11.22 | 11.63 |
| HI (mg/g-toc) | 77 | 83 | 81 | 62 | 77 |

The API gravity of Examples 1-5 was estimated by estimating the room temperature specific gravity (SG) of the liquids collected and the results are reported in Table 14. The API gravity was estimated from the determined specific gravity by applying the following formula:

$$\text{API gravity}=(141.5/SG)-131.5$$

The specific gravity of each liquid sample was estimated using the following procedure. An empty 50 μl HAMILTON Model 1705 gastight syringe was weighed on a Mettler AE 163 digital balance to determine the empty syringe weight. The syringe was then loaded by filling the syringe with a volume of liquid. The volume of liquid in the syringe was noted. The loaded syringe was then weighed. The liquid sample weight was then estimated by subtracting the loaded syringe measured weight from the measured empty syringe weight. The specific gravity was then estimated by dividing the liquid sample weight by the syringe volume occupied by the liquid sample.

TABLE 14

Estimated API Gravity of liquid samples from Examples 1-5

| | Example | | | | |
|---|---|---|---|---|---|
| | Example 1 | Example 2 | Example 3 | Example 4 | Example 5 |
| API Gravity | 29.92 | 30.00 | 27.13 | 32.70 | 30.00 |

The above-described processes may be of merit in connection with the recovery of hydrocarbons in the Piceance Basin of Colorado. Some have estimated that in some oil shale deposits of the Western United States, up to 1 million barrels of oil may be recoverable per surface acre. One study has estimated the oil shale resource within the nahcolite-bearing portions of the oil shale formations of the Piceance Basin to be 400 billion barrels of shale oil in place. Overall, up to 1 trillion barrels of shale oil may exist in the Piceance Basin alone.

Certain features of the present invention are described in terms of a set of numerical upper limits and a set of numerical lower limits. It should be appreciated that ranges formed by any combination of these limits are within the scope of the invention unless otherwise indicated. Although some of the dependent claims have single dependencies in accordance with U.S. practice, each of the features in any of such dependent claims can be combined with each of the features of one or more of the other dependent claims dependent upon the same independent claim or claims.

While it will be apparent that the invention herein described is well calculated to achieve the benefits and advantages set forth above, it will be appreciated that the invention is susceptible to modification, variation and change without departing from the spirit thereof.

What is claimed is:

1. A method for developing hydrocarbons from an organic-rich rock formation located in a hydrocarbon development area while controlling subsidence, comprising:

heating portions of the organic-rich rock formation through conductive heat generation, the heating pyrolyzing a portion of formation hydrocarbons located in a heated zone in the organic-rich rock formation into hydrocarbon fluids;

preserving at least two unheated zones within the organic-rich rock formation that are not subjected to pyrolyzing temperatures, thereby leaving formation hydrocarbons located in the at least two unheated zones unpyrolyzed, the at least two unheated zones also being located within the development area;

sizing an area of the at least two unheated zones in order to optimize the heated zone while controlling subsidence above the organic-rich rock formation;

drilling at least one cooling well through each of the at least two unheated zones; and injecting a cooling fluid into each cooling well in order to inhibit pyrolysis within the at least two unheated zones; wherein the organic-rich rock formation comprises oil shale;

each cooling well is completed at or below a depth of the organic-rich rock formation, and each cooling well comprises:

a wellbore;

an elongated tubular member within the wellbore; and an expansion valve in fluid communication with the tubular member through which the cooling fluid travels to inhibit heating within the organic-rich rock formation.

2. The method of claim 1, wherein conductive heat generation comprises non-oxidative heat generation including one or more of radiative heating by using an electrically resistive heating element in one or more heater wells, or by using one or more downhole combustion burners within one or more heater wells.

3. The method of claim 1, wherein the at least two unheated zones represents no more than 50 percent of the development area.

4. The method of claim 1, wherein the at least two unheated zones represents no more than 25 percent of the development area.

5. The method of claim 1, wherein optimizing the heated zone comprises identifying a maximum area of heating while still controlling subsidence above the organic-rich rock formation, and then reducing the size of the heated zone by about 1 to 10 percent of the maximum area of heating.

6. The method of claim 1, wherein optimizing the heated zone comprises defining a geometry for the heated zone.

7. The method of claim 6, wherein the defined geometry refers to a selected size, a selected shape, or a selected location within the development area.

8. The method of claim 6, wherein the defined geometry comprises a plurality of star-shaped areas, between heated zones.

9. The method of claim 6, wherein the defined geometry comprises a plurality of four-sided polygons that are unheated.

10. The method of claim 1, wherein controlling subsidence above the organic-rich rock formation comprises not exceeding a maximum subsidence criterion.

11. The method of claim 10, wherein the maximum subsidence criterion is a measure of the difference in elevation of a selected portion of the development area before and after heating the organic-rich rock formation.

12. The method of claim 11, wherein the difference in elevation is less than one foot.

13. The method of claim 11, wherein the difference in elevation provides for control of subsidence.

14. The method of claim 10, wherein the maximum subsidence criterion is an absence of faulting above the organic-rich rock formation.

15. The method of claim 10, wherein the maximum subsidence criterion is an absence of faulting between the organic-rich rock formation and a ground water formation thereabove.

16. The method of claim 1, further comprising:

selecting a geometry for the at least two unheated zones within the development area; and wherein the at least two unheated zones defines a cumulative area that is at least 10 percent greater than an area considered to be a subsidence failure point for the selected geometry.

17. The method of claim 1, wherein the at least two unheated zones are non-contiguous.

18. The method of claim 17, wherein the at least two unheated zones define at least five non-contiguous unheated zones that serve as pillars to minimize subsidence.

19. The method of claim 1, wherein each cooling well comprises a downhole piping assembly for circulating a cooling fluid, the cooling fluid being an unheated fluid or a fluid that has been chilled at the earth's surface.

20. The method of claim 19, wherein the cooling fluid is a gas.

21. The method of claim 1 wherein:

the expansion valve is positioned in the tubular member at or above the depth of the organic-rich rock formation;

the cooling well further comprises an annular region formed between the elongated tubular member and a diameter of the wellbore; and the cooling fluid is circulated through the tubular member, to a completion depth of the well, and back up the wellbore through the annular region.

22. The method of claim 1, wherein the step of sizing the area of the at least two unheated zones comprises considering at least one of richness of the formation hydrocarbons, thickness of the organic-rich rock formation, and permeability of the organic-rich rock formation.

23. The method of claim 22, wherein the step of sizing the area of the at least two unheated zones comprises considering geomechanical properties of the organic-rich rock formation.

24. The method of claim 23, wherein the geomechanical properties are selected from the group consisting of the Poisson ratio, the modulus of elasticity, shear modulus, Lame' constant, $V_p/V_s$, and combinations thereof.

25. A method for developing hydrocarbons from an organic-rich rock formation located in a hydrocarbon development area while controlling subsidence, comprising:

heating portions of the organic-rich rock formation through conductive heat generation, the heating pyrolyzing a portion of formation hydrocarbons located in a heated zone in the organic-rich rock formation into hydrocarbon fluids, wherein the organic-rich rock formation comprises oil shale;

preserving at least one unheated zone within the organic-rich rock formation that is not subjected to pyrolyzing temperatures, thereby leaving formation hydrocarbons located in the at least one unheated zone unpyrolyzed, the at least one unheated zone also being located within the development area; and sizing an area of the at least one unheated zone in order to optimize the heated zone while controlling subsidence above the organic-rich rock formation by selecting a first size ratio between the heated zone and the at least one unheated zone;

wherein the step of sizing the area of the at least one unheated zone is performed through input into a computer model and includes the steps of:

(a) assigning for the computer model an initial post-treatment modulus of elasticity for the heated zone, wherein the initial post-treatment modulus of elasticity is lower than a modulus of elasticity for the organic-rich rock formation in an untreated state;

(b) assigning a first fluid pressure in the heated zone;

(c) confirming that a subsidence failure point has not been reached at the first fluid pressure;

(d) assigning a second lower fluid pressure in the heated zone;

(e) determining whether a subsidence failure point has been reached at the second lower fluid pressure;

(f) in response to step (e), when minimal likelihood of subsidence above the heated zone is predicted, assigning for the computer model a second lower post-treatment modulus of elasticity for the heated zone;

(g) assigning a new first fluid pressure in the heated zone;

(h) confirming that a subsidence failure point has not been reached at the first fluid pressure;

(i) assigning at least one subsequent lower fluid pressure in the heated zone; and (j) determining whether a subsidence failure point has been reached at one of the at least one subsequent lower fluid pressures, thus simulating the reduction of fluid pressure within the organic-rich rock formation towards a hydrostatic pressure level.

26. The method of claim 25, further comprising:

(k) increasing the size of the selected size ratio by increasing the size of the heated zone relative to the unheated zone, thereby providing a second size ratio; and (l) repeating steps (b) through (j) at the second size ratio.

27. The method of claim 25, wherein the computer model is a finite element model.

28. The method of claim 25, wherein the modulus of elasticity for the formation in an untreated state is empirically determined through field tests, is empirically determined through laboratory tests on one or more core samples, or both.

29. The method of claim 25, wherein the first post-treatment modulus of elasticity is at least 5 times lower than the modulus of elasticity of rock in the organic-rich rock formation in its unheated state.

30. The method of claim 25, wherein the step of confirming that a subsidence failure point has not been reached comprises confirming that a maximum principal stress in rock above the organic rich-rock formation does not present a likelihood of faulting within the at least one unheated zone.

31. The method of claim 25, wherein the step of confirming that a subsidence failure point has not been reached comprises confirming that a Mohr-Coulomb failure criterion does not present a likelihood of faulting within the at least one unheated zone.

32. A method for developing hydrocarbons from an organic-rich rock formation located in a hydrocarbon development area while controlling subsidence, comprising:

heating portions of the organic-rich rock formation through conductive heat generation, the heating pyrolyzing a portion of formation hydrocarbons located in a heated zone in the organic-rich rock formation into hydrocarbon fluids, wherein the organic-rich rock formation comprises oil shale;

preserving at least one unheated zone within the organic-rich rock formation that is not subjected to pyrolyzing temperatures, thereby leaving formation hydrocarbons located in the at least one unheated zone unpyrolyzed, the at least one unheated zone also being located within the development area; and sizing an area of the at least one unheated zone in order to optimize the heated zone while controlling subsidence above the organic-rich rock formation; wherein the step of sizing the area of the at least one unheated zone is performed through input into a computer model and includes the steps of:

(a) assigning for the computer model an initial post-treatment modulus of elasticity for the heated zone, wherein the initial post-treatment modulus of elasticity is lower than a modulus of elasticity for the organic-rich rock formation in an untreated state;

(b) selecting a size ratio between a heated zone and an unheated zone;

(c) assigning a first fluid pressure in the heated zone;

(d) determining rock displacement above the heated zone at the first fluid pressure to confirm that a subsidence failure point has not been reached at the first fluid pressure;

(e) assigning a second lower fluid pressure in the heated zone; and (f) determining rock displacement above the heated zone at the second lower fluid pressure, thus simulating the production of hydrocarbon fluids resulting from the conversion of the formation hydrocarbons through pyrolysis at the initial post-treatment modulus of elasticity for the selected size ratio.

33. The method of claim 32, further comprising:

(g) confirming that the rock displacement determined from step (f) does not present a likelihood of subsidence above the heated zone at the selected size ratio.

34. The method of claim 33, further comprising:

(h) in response to step (g), when minimal likelihood of subsidence above the heated zone is predicted, increasing the size of the selected size ratio by increasing the size of the heated zone relative to the unheated zone, thereby providing a second size ratio;

(j) repeating steps (c) through (f) at the second size ratio; and (k) determining whether the rock displacement determined from step (h) at the second size ratio presents a likelihood of subsidence above the heated zone.

35. The method of claim 33, further comprising:

(h) in response to step (g), when minimal likelihood of subsidence above the heated zone is predicted, changing a configuration of the at least one unheated zone;

(j) repeating steps (c) through (f) at the second size ratio; and (k) determining that the rock displacement determined from step (h) at the new configuration does not present a likelihood of subsidence above the heated zone.

* * * * *